US007191473B2

(12) United States Patent
Matsumoto et al.

(10) Patent No.: US 7,191,473 B2
(45) Date of Patent: Mar. 20, 2007

(54) SANITARY WASHING APPARATUS

(75) Inventors: Tomohide Matsumoto, Yamatotakada (JP); Hideki Ohno, Yamatokoriyama (JP); Kazushige Nakamura, Yamatokoriyama (JP); Shigeru Shirai, Nara (JP); Hiroaki Fujii, Nara (JP); Shinichi Maruyama, Nara (JP); Muneo Tao, Yamatokoriyama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/341,445

(22) Filed: Jan. 14, 2003

(65) Prior Publication Data

US 2003/0140407 A1 Jul. 31, 2003

(30) Foreign Application Priority Data

| | | |
|---|---|---|
| Jan. 15, 2002 | (JP) | 2002-005678 |
| Feb. 13, 2002 | (JP) | 2002-035142 |
| Mar. 13, 2002 | (JP) | 2002-068329 |
| Apr. 26, 2002 | (JP) | 2002-126792 |
| Apr. 26, 2002 | (JP) | 2002-126793 |
| Jul. 24, 2002 | (JP) | 2002-215579 |
| Aug. 2, 2002 | (JP) | 2002-225750 |

(51) Int. Cl.
*A47K 3/022* (2006.01)

(52) U.S. Cl. ..... 4/420.2; 4/420.4

(58) Field of Classification Search ..... 4/420.1, 4/420.2, 420.3, 420.4, 420.5, 447; 417/534, 417/535, 536

See application file for complete search history.

(56) References Cited

U.S. PATENT DOCUMENTS 4,026 A * 5/1845 Walther ..... 417/535
5,826,282 A * 10/1998 Matsumoto et al. ..... 4/420.4

(Continued)

FOREIGN PATENT DOCUMENTS

CN 1304473 7/2001

(Continued)

OTHER PUBLICATIONS

English Language Abstract of JP 7-119195.

(Continued)

*Primary Examiner*—Robert M. Fetsuga
(74) *Attorney, Agent, or Firm*—Greenblum & Bernstein, P.L.C.

(57) ABSTRACT

When a user sets water power using a water power adjustment switch in a remote control device, a controller controls the period of pressure fluctuations, the width of pressure fluctuations, and the central pressure of the discharge pressure of a pump on the basis of a signal transmitted by radio from the remote control device. When the user sets the divergent angle of washing water using a washing area adjustment switch in the remote control device, the controller controls the divergent angle of the washing water sprayed from a posterior nozzle on the basis of the signal transmitted by radio from the remote control device. Consequently, the washing water supplied to a side surface of a cylindrical swirl chamber from a first flow path in the posterior nozzle is sprayed from a spray hole as dispersed spiral flow, and the washing water supplied to a lower part of the cylindrical swirl chamber from a second flow path in the posterior nozzle is sprayed from the spray hole as linear flow.

37 Claims, 79 Drawing Sheets

U.S. PATENT DOCUMENTS

| | | | | |
|---|---|---|---|---|
| 5,884,345 | A * | 3/1999 | Sugiyama et al. | 4/420.4 X |
| 5,898,956 | A * | 5/1999 | Kurisaki et al. | 4/420.4 |
| 6,327,718 | B1 * | 12/2001 | Ono et al. | 4/420.2 |
| 6,754,912 | B1 | 6/2004 | Hayashi et al. | |

FOREIGN PATENT DOCUMENTS

| | | |
|---|---|---|
| JP | 58-26140 | 2/1983 |
| JP | 59-012185 | 1/1984 |
| JP | 59-106637 | 6/1984 |
| JP | 4-060177 | 2/1992 |
| JP | 5-302350 | 11/1993 |
| JP | 7-119195 | 5/1995 |
| JP | 7-189317 | 7/1995 |
| JP | 7-259163 | 10/1995 |
| JP | 2769234 | 4/1996 |
| JP | 2820056 | 8/1998 |
| JP | 11-293745 | 10/1999 |
| JP | 11-350571 | 12/1999 |
| JP | 2000-008450 | 1/2000 |
| JP | 2000-008453 | 1/2000 |
| JP | 2000-038758 | 2/2000 |
| JP | 2000-96672 | 4/2000 |
| JP | 2000-096683 | 4/2000 |
| JP | 2000-144858 | 5/2000 |
| JP | 2000-154577 | 6/2000 |
| JP | 2000-220194 | 8/2000 |
| JP | 2000-248601 | 9/2000 |
| JP | 2000-282545 | 10/2000 |
| JP | 2001-059253 | 3/2001 |
| JP | 2001-090148 | 4/2001 |
| JP | 2001-90151 | 4/2001 |
| JP | 2001-90154 | 4/2001 |
| JP | 2001-090155 | 4/2001 |
| JP | 2001-140323 | 5/2001 |
| JP | 2001-224531 | 8/2001 |
| JP | 2001-295348 | 10/2001 |
| JP | 2002-070120 | 3/2002 |
| JP | 3292185 | 3/2002 |
| JP | 2002-155565 | 5/2002 |
| WO | 99/53150 | 10/1999 |
| WO | 00/43602 | 7/2000 |

OTHER PUBLICATIONS

English Language Abstract of JP 7-189317.
English Language Abstract of JP 7-259163.
English Language Abstract of JP 2000-96672.
English Language Abstract of JP 2001-90151.
English Language Abstract of JP 2001-90154.
English Language Abstract of JP 2001-295348.
English Language Abstract of JP 08246536.
English Language Abstract of JP 2001090155.
English Language Abstract of JP 11-350571.
English Language Abstract of JP 2000-282545.
English Language Abstract of JP 2001-059253.
English Language Abstract of JP 2001-140323.
English Language Abstract of JP 11-293745.
English Language Abstract of JP 2000-008450.
English Language Abstract of JP 2000-008453.
English Language Abstract of JP 2000-220194.
English Language Abstract of JP 2000-038758.
English Language Abstract of JP 2000-096683.
English Language Abstract of JP 2000-144858.
English Language Abstract of JP 2001-090148.
English Language Abstract of JP 2002-155565.
English Language Abstract of JP 4-082552.
English Language Abstract of JP 2001-224531.
English Language Abstract of JP 4-060177.
English Language Abstract of JP 05-302350.
English Language Abstract of JP 2002-070120.
English Language Abstract of JP 2000-154577.
English Language Abstract of JP 2000-248601.
English Language Abstract of JP 59-012185.

* cited by examiner

| ROTATION ANGLE OF SWITCHING VALVE | 0° | ~ | 90° | ~ | 180° | ~ | 270° |
|---|---|---|---|---|---|---|---|
| DRIVING STATE OF PUMP | ON | OFF | ON | OFF | ON | ON | ON |
| NOZZLE FOR SPRAYING WASHING WATER | BIDET NOZZLE | | NOZZLE CLEANING NOZZLE | | POSTERIOR NOZZLE (DISPERSED SPIRAL FLOW) | WASHING AREA ADJUSTMENT RANGE | POSTERIOR NOZZLE (LINEAR FLOW) |

SANITARY WASHING APPARATUS

BACKGROUND OF THE INVENTION

1. Field of the Invention

The present invention relates to a sanitary washing apparatus that washes the private parts of the human body.

2. Description of the Background Art

Generally in sanitary washing apparatuses that wash the private parts of the human bodies, there are provided heating devices for adjusting washing water used for washing to suitable temperatures in order not to give uncomfortable feelings to the human bodies. Examples of the heating devices mainly include hot water storage type heating systems or instantaneous heating devices.

The sanitary washing apparatuses using the hot water storage type heating systems comprise hot water tanks previously storing predetermined amounts of washing water as well as heating the washing water to predetermined temperatures by heaters contained therein, and employ methods of feeding by pressure the washing water previously heated to the predetermined temperatures in the hot water tanks utilizing tap water pressure or by pumps or the like and spraying the washing water from nozzles.

On the other hand, the sanitary washing apparatuses using the instantaneous heating devices employ methods of heating washing water to predetermined temperatures by heaters such as ceramic heaters superior in temperature rise speeds in washing the private parts of the human bodies, feeding by pressure the washing water utilizing tap water pressures or by pumps or the like, and spraying the washing water from nozzles.

In the sanitary washing apparatuses using the instantaneous heating devices, therefore, the washing water need not continue to be maintained at predetermined temperatures, and power may be supplied to the heaters only at the time of employment, thereby making it possible to restrain power consumption. Even when large amounts of washing water are used for washing the private parts of the human bodies by washing for a long time or continuous employment of toilets, for example, the temperatures of the washing water can be prevented from dropping to not more than the predetermined temperatures to give uncomfortable feelings to the human bodies.

The sanitary washing apparatuses of this type are employed by a plurality of users. Accordingly, desired washing forms are diverse depending on the sexes, the physical conditions, and the tastes of the users. In recent years, in the sanitary washing apparatuses, various functions have been devised in order to realize washing conforming to the tastes of users. For example, there are provided functions for adjusting the water power of the washing water sprayed from the nozzles in order to realize the washing conforming to the tastes of the users. The users can adjust the water power of the washing water sprayed from the nozzles in conformity with their tastes.

In the sanitary washing apparatuses using the hot water storage type heating systems, however, the flow rates of the washing water can be increased. However, washing feelings conforming to the tastes of the plurality of users cannot be obtained merely by making the flow rates of the washing water high. On the other hand, in the sanitary washing apparatuses using the instantaneous heating devices, the instantaneous temperature rises of the washing water are required. Accordingly, it is difficult to increase the flow rates of the washing water sprayed to the private parts of the users because of limitations of quantities of power. That is, in the sanitary washing apparatuses using the instantaneous heating devices, the flow rates of the washing water sprayed from the nozzles are restricted. Therefore, stimulation is weak, so that washing feelings conforming to the tastes of the users cannot be obtained.

SUMMARY OF THE INVENTION

An object of the present invention is to provide a sanitary washing apparatus having a high washing stimulatory effect even at a low flow rate and capable of obtaining a washing feeling and washing power conforming to the taste or physical conditions of a user.

Another object of the present invention is to provide a sanitary washing apparatus having a high washing stimulatory effect even at a low flow rate and capable of adjusting the washing area in conformity with the taste or physical conditions of a user.

Still another object of the present invention is to provide a sanitary washing apparatus having a high washing stimulatory effect even at a low flow rate and capable of more reliably preventing water hammer and vibration from being produced and capable of reducing the amount of washing water without the discharge flow rate thereof being dependent on water supply pressure.

A sanitary washing apparatus according to an aspect of the present invention is a sanitary washing apparatus that sprays washing water supplied from a water supply source onto the human body, comprising a spray device that sprays the washing water and is capable of changing the divergent angle of the sprayed washing water; a pressure device that pressurizes the washing water supplied from the water supply source to spray the pressurized washing water from the spray device while subjecting the washing water to periodical pressure fluctuations; and a control device that controls the divergent angle of the washing water sprayed from the spray device and the pressure device.

In the sanitary washing apparatus according to the present invention, the washing water supplied from the water supply source is pressurized while being subjected to the periodical pressure fluctuations by the pressure device. Consequently, the washing stimulatory effect is increased even at a low flow rate.

The washing water sprayed from the spray device is sprayed onto the human body after the divergent angle thereof is controlled by a divergent angle control device. Consequently, the user can obtain various types of washing feelings and washing power conforming to his or her taste or physical conditions.

The sanitary washing apparatus may further comprise a divergent angle setting device for setting the divergent angle of the washing water sprayed from the spray device. The control device may control the divergent angle of the washing water sprayed from the spray device on the basis of the setting by the divergent angle setting device.

In this case, the divergent angle of the washing water by the spray device can be controlled on the basis of the setting by the divergent angle setting device. Consequently, the user can adjust the divergent angle of the washing water sprayed from the spray device and change the washing area.

The divergent angle setting device may comprise a switch capable of gradually changing the divergent angle of the washing water.

In this case, the divergent angle of the washing water sprayed from the spray device can be gradually controlled on the basis of the setting by the divergent angle setting device. Consequently, the user can easily select the divergent angle of the washing water and the washing area by his or her taste.

The divergent angle setting device may comprise a switch capable of continuously changing the divergent angle of the washing water.

In this case, the divergent angle of the washing water sprayed from the spray device can be gradually controlled on the basis of the setting by the divergent angle setting device. Consequently, the user can easily select the divergent angle of the washing water and the washing area by his or her taste.

The control device may continuously enlarge or reduce the divergent angle of the washing water sprayed from the spray device on the basis of the setting by the divergent angle setting device.

In this case, the divergent angle of the washing water sprayed from the spray device can be enlarged or reduced continuously on the basis of the setting by the divergent angle setting device. Consequently, the user can continuously adjust the divergent angle of the washing water and the washing area by his or her taste.

The sanitary washing apparatus may further comprise a command device that issues a command to perform an operation for repeating the continuous enlargement or reduction of the divergent angle of the washing water sprayed from the spray device. The control device may change the divergent angle of the washing water sprayed from the spray device in response to the command issued by the command device.

In this case, the divergent angle of the washing water sprayed from the spray device can be repeatedly enlarged or reduced continuously by the command issued from the command device. Consequently, the user can repeatedly do washing over a wide range.

The control device may make the speed of the reduction of the divergent angle of the washing water smaller than the speed of the enlargement thereof.

In this case, the reduction speed of the divergent angle of the washing water sprayed from the spray device is lower than the enlargement speed of the divergent angle of the washing water sprayed from the spray device. Consequently, the washing water functions to remove dirt inward from the outside, thereby making it possible to prevent the dirt from being scattered toward the outer periphery of a surface to be washed.

The sanitary washing apparatus may further comprise a heating device that heats the washing water supplied from the water supply source and supplies the heated washing water to the pressure device.

In this case, the washing water supplied from the water supply source can be heated by the heating device and supplied to the pressure device, thereby making it possible to spray from the spray device the washing water suitably heated. Consequently, it is possible to wash the private parts of the human body without making the user have an uncomfortable feeling by the washing water suitably heated.

The heating device may be an instantaneous heating device for heating the washing water supplied from the water supply source while causing the washing water to flow.

In this case, the washing water supplied from the water supply source is heated while being caused to flow, whereby the washing water is instantaneously heated. Since the washing water is heated only when the human body is washed, therefore, power consumption can be kept to a minimum. Further, the necessity of a water storage tank storing the washing water, for example, is eliminated, thereby making it possible to realize space saving. Even when a time period required to wash the human body is lengthened, the temperature of the washing water is not lowered.

The sanitary washing apparatus may further comprise a display device that displays the divergent angle of the washing water sprayed from the spray device.

In this case, the divergent angle of the washing water is displayed on the display device so as to appeal to the eye. Consequently, the user can easily confirm the divergent angle of the washing water sprayed from the spray device.

The display device may display the divergent angle of the washing water on the basis of the setting by the divergent angle setting device.

In this case, the divergent angle of the washing water is displayed on the display device in synchronization with the operations of the divergent angle setting device. Consequently, the configuration of an electrical circuit can be simplified.

The divergent angle setting device may include of a remote control type divergent angle setting device.

In this case, the user can operate the divergent angle setting device at hand. Consequently, the user can easily adjust the divergent angle of the washing water sprayed from the spray device, and can easily confirm the divergent angle of the washing water displayed on the display device.

The spray device may spray the washing water in a circular cross-sectional shape.

In this case, the washing water sprayed from the spray device is circular in cross section. Consequently, the user can wash the surface to be washed in a circular shape. As a result, the user can obtain various types of washing feelings conforming to his or her taste or physical conditions.

The sanitary washing apparatus may further comprise a normal washing instruction device for issuing an instruction to do normal washing for washing the private parts of the human body by the washing water, a water power setting device for setting the water power of the washing water, and a strongest washing instruction device that issues an instruction to do the strongest washing for making the water power of the washing water strongest. The control device may control the pressure device so as to pressurize the washing water at a pressure corresponding to the water power set by the water power setting device in response to the instruction issued by the normal washing instruction device, and control the pressure device so as to pressurize the washing water at a high pressure which is not less than a pressure at the time of the maximum water power settable by the water power setting device in response to the instruction issued by the strongest washing instruction device.

In this case, the washing water supplied from the water supply source is pressurized by the pressure device at the pressure corresponding to the water power set by the water power setting device in response to the instruction issued by the normal washing instruction device and is sprayed from the spray device. Further, the washing water supplied from the water supply source is pressurized by the pressure device at the high pressure which is not less than the pressure at the time of the maximum water power settable by the water power setting device in response to the instruction issued by the strongest washing instruction device and is sprayed from the spray device. Consequently, it is possible to instantaneously wash the private parts of the human body and their surroundings by the washing water high in discharge pressure at the time of the strongest washing operation. Further, according to the strongest washing, the private parts of the human body and their surroundings can be stimulated by the washing water high in discharge pressure, thereby making it possible to hasten the bowels efficiently and reliably.

The pressure device may subject the washing water supplied from the water supply source to periodical pressure fluctuations taking a pressure higher than the pressure of the washing water as a central value.

In this case, the washing water supplied from the water supply source is subjected to the periodical pressure fluctuations taking the pressure higher than the pressure of the washing water as a central value. Consequently, the private parts of the human body can be washed by the washing water high in discharge pressure, and an excessive intermittent feeling can be prevented, thereby making it possible to realize washing in which comfortable stimulation is obtained. Further, pain or discomfort caused by the intermittent feeling can be alleviated, and the amount of the washing water can be also reduced.

The period of pressure fluctuations by the pressure device may be the period of pressure fluctuations perceivable by the human body.

In this case, the period of pressure fluctuations perceivable by the human body is given to the washing water, thereby making it possible to give comfortable stimulation to the user.

The sanitary washing apparatus may further comprise a pressure fluctuation setting device for setting the mode of the pressure fluctuations of the washing water. The control device may control the mode of the pressure fluctuations by the pressure device on the basis of the setting by the pressure fluctuation setting device.

In this case, the mode of the pressure fluctuations of the washing water sprayed from the spray device can be adjusted on the basis of the setting by the pressure fluctuation setting device. Consequently, the user can obtain the various types of washing feelings and washing power conforming to his or her physical conditions or taste.

The spray device may comprise a cylinder and a piston having a spray hole and inserted into the cylinder so as to be projectable. The piston may project from the cylinder by the pressure of the washing water supplied from the pressure device and spray the washing water from the spray hole.

In this case, the piston projects from the cylinder by the pressure of the washing water at the time of washing. Accordingly, any other driving devices such as a motor are not required. Further, it is feasible to miniaturize the sanitary washing apparatus.

A sanitary washing apparatus according to another aspect of the present invention is a sanitary washing apparatus that sprays washing water supplied from a water supply source onto the human body, comprising a pressure device that pressurizes the washing water supplied from the water supply source to a predetermined pressure; and a spray device that sprays the washing water pressurized by the pressure device onto the human body, the spray device comprising a spray hole, a first flow path that introduces the washing water supplied from the pressure device into the spray hole, a second flow path that introduces the washing water supplied from the pressure device into the spray hole, a rotating flow generator that generates rotating flow in the washing water in the first flow path, and a flow rate that adjusts device that adjusts the flow rate of the washing water supplied to the first flow path and the second flow path.

In the sanitary washing apparatus according to the present invention, the washing water supplied from the water supply source is pressurized to a predetermined pressure by the pressure device. The washing water pressurized by the pressure device is introduced into the spray hole by the first flow path and the second flow path. Further, the flow rate of the washing water supplied to the first flow path and the second flow path is adjusted by the flow rate adjustment device, and the rotating flow is generated in the washing water supplied to the first flow path by the rotating flow generator.

In this case, the pressurized washing water can be sprayed from the spray hole through the first flow path and the second flow path in the spray device. Further, the first flow path and the second flow path are separately formed, thereby making it possible to independently change the respective flow rates of the washing water flowing through the first flow path and the washing water flowing through the second flow path. Further, the rotating flow in the washing water can be generated in the first flow path, thereby making it possible to spray the dispersed spiral flow from the spray hole. Consequently, either one of the linear flow and the dispersed spiral flow or a mixture of the linear flow and the dispersed spiral flow can be sprayed in conformity with the physical conditions or taste of the user by adjusting the respective flow rates of the washing water flowing through the first flow path and the washing water flowing through the second flow path. Consequently, the divergent angle of the washing water and the washing area can be changed.

The rotating flow generator may have as a cylindrical chamber, and the washing water introduced from the first flow path may be supplied along an inner peripheral surface of the cylindrical chamber.

In this case, the washing water introduced from the first flow path is supplied along the inner peripheral surface of the cylindrical chamber. Accordingly, the flow in the swirling state caused by a centrifugal force can be efficiently generated inside the cylindrical chamber. The washing water in which the flow in the swirling state is maintained is sprayed from the spray hole, whereby the dispersed spiral flow from the spray hole is sprayed onto the surface to be washed in a wide range.

The sanitary washing apparatus may further comprise a heating device that heats the washing water supplied from the water supply source and supplies the heated washing water to the pressure device.

In this case, the washing water supplied from the water supply source can be heated by the heating device and supplied to the pressure device, and the washing water suitably heated can be sprayed from the spray device. Consequently, at the time of the normal washing operation, it is possible to wash the private parts of the human body without making the user have an uncomfortable feeling by the washing water suitably heated. Further, the private parts of the human body can be stimulated without making the user have an uncomfortable feeling by the washing water suitably heated, thereby making it possible to hasten the bowels efficiently and reliably.

The heating device may be an instantaneous heating device that heats the washing water supplied from the water supply source while causing the washing water to flow.

In this case, the washing water supplied from the water supply source is heated by the heating device while being caused to flow, whereby the washing water is instantaneously heated. Since the washing water is heated only when the human body is washed, therefore, power consumption can be kept to a minimum. Further, the necessity of a water storage tank storing the washing water, for example, is eliminated, thereby making it possible to realize space saving. Even when a time period required to wash the human body is lengthened, the temperature of the washing water is not lowered.

The spray device may comprise a cylinder and a piston inserted into the cylinder so as to be projectable. The piston may have the spray hole, the first flow path, and the second flow path, and project from the cylinder by the pressure of the washing water supplied from the pressure device and spray from the spray hole the washing water supplied from the pressure device.

In this case, the piston inserted into the cylinder in the spray device can project by the pressure of the washing water. Accordingly, any other driving devices such as a motor are not required. As a result, it is feasible to miniaturize the sanitary washing apparatus.

The spray device may comprise a cylinder and a piston. The cylinder may comprise a first water supply port receiving the washing water supplied from the first flow path, and a second water supply port receiving the washing water supplied from the second flow path, the spray hole, the first flow path, and the second flow path may be provided in the piston, and the piston accommodated in the cylinder by the pressure of the washing water supplied from the pressure device may project from the cylinder so that an accommodating portion is formed in the cylinder, and the washing water supplied to the accommodating portion in the cylinder is sprayed from the spray hole in the spray device.

In this case, the piston projects from the cylinder by the pressure of the washing water at the time of washing so that the accommodating portion is formed in the cylinder, thereby making it possible to realize, when the sanitary washing apparatus has not been employed yet, the miniaturization thereof. Further, the piston projects from the cylinder by the pressure of the washing water. Accordingly, any other driving devices such as a motor are not required. As a result, it is feasible to miniaturize the sanitary washing apparatus.

In the sanitary washing apparatus, an annular space may be formed between an inner peripheral surface of the cylinder and an outer peripheral surface of the piston, the washing water from the first flow path may be supplied to the accommodating portion through the first water supply port, the washing water from the second flow path may be supplied to the annular space through the second water supply port, the first flow path may be provided so as to communicate with the accommodating portion, the second flow path may be provided so as to communicate with the annular space, and the annular space may be brought into a sealed state in a state where the piston projects from the cylinder and separated from the accommodating portion.

In this case, the annular space is brought into the sealed state in the state where the piston projects from the cylinder, and is separated from the accommodating portion. Consequently, the washing water supplied from the second water supply port flows in the second flow path after passing through the sealed annular space. As a result, the first flow path and the second flow path are separately formed, thereby making it possible to independently change the respective flow rates of the washing water flowing in the first flow path and the washing water flowing in the second flow path. Consequently, it is possible to easily and arbitrarily control the ratio of the respective flow rates of the washing water in the first flow path and the washing water in the second flow path.

The cylinder may comprise a front end having a first inner diameter, an intermediate portion having a second inner diameter larger than the first inner diameter, and a rear end having an inner diameter larger than the second inner diameter in this order, and a first annular inner wall in the boundary between the front end and the intermediate portion, and a second annular inner wall in the boundary between the intermediate portion and the rear end. The piston may have first and second annular abutting portions which respectively watertightly abut against the first and second annular inner walls in a state where it projects from the cylinder. A first clearance may be formed between an inner peripheral surface of the intermediate portion of the cylinder and an outer peripheral surface of the first annular abutting portion of the piston, a second clearance may be formed between an inner peripheral surface at the rear end of the cylinder and an outer peripheral surface of the second annular abutting portion of the piston, the washing water from the first flow path may be supplied to the rear end through the first water supply port, the washing water from the second flow path may be supplied to the intermediate portion through the second water supply port, the first flow path may be provided so as to communicate with the rear end of the cylinder, and the second flow path may be provided so as to communicate with the intermediate portion of the cylinder.

In this case, the first clearance and the second clearance are formed until the piston projects from the cylinder. Accordingly, the washing water staying when the sanitary washing apparatus has not been employed yet can be discharged through the first and second clearances before the washing water is sprayed from the spray hole. Consequently, the washing can be done using the fresh washing water. Further, the first and second annular inner walls and the first and second annular abutting portions respectively watertightly abut against each other in a state where the piston projects from the cylinder so that the annular space in the intermediate portion is brought into the sealed state and is separated from the accommodating portion at the rear end. Consequently, the washing water from the second flow path flows in the second flow path through the annular space in the intermediate portion, and the washing water from the first flow path flows in the first flow path through the accommodating portion at the rear end. Consequently, the first flow path and the second flow path are separately formed, thereby making it possible to independently change the respective flow rates of the washing water flowing in the first flow path and the washing water flowing in the second flow path. Consequently, the ratio of the respective flow rates of the washing water in the first flow path and the washing water in the second flow path can be controlled easily and arbitrarily.

The spray device may further comprise a backflow preventer that prevents the washing water from flowing from the second flow path to the first flow path.

In this case, when the flow rate of the washing water flowing in the second flow path is higher than the flow rate of the washing water flowing in the first flow path, the backflow preventer functions in the direction in which the washing water is prevented from flowing from the second flow path to the first flow path. Even when bubbles exist in the accommodating portion, therefore, the pressure of the washing water sprayed from the second flow path through the spray hole can be prevented from being lowered. Consequently, the pressure of the washing water sprayed from the spray hole through the second flow path can be maintained. As a result, it is possible to prevent the washing feeling from being decreased.

The backflow preventer may comprise a check valve.

In this case, the function of the check valve allows the washing water to flow from the first flow path to the spray hole, and reliably prevent the washing water from flowing from the second flow path to the first flow path.

The check valve may include a spherical valve.

In this case, the spherical valve can prevent the washing water flowing from the second flow path to the first flow path. Further, the washing water can be prevented from flowing in a simple configuration, thereby making it feasible to miniaturize the sanitary washing apparatus.

The check valve may include a sheet valve.

In this case, the sheet valve can prevent the washing water flowing from the second flow path to the first flow path. Further, the washing water can be prevented from flowing in a simple configuration, thereby making it feasible to miniaturize the sanitary washing apparatus.

The sanitary washing apparatus may further comprise a normal washing instruction device that issues an instruction to do normal washing for washing the private parts of the human body by washing water, a water power setting device for setting the water power of the washing water, a stimulatory washing instruction device that issues an instruction to do stimulatory washing for stimulating the private parts of the human body by the washing water, and a control device that controls the pressure device so as to pressurize the washing water by the pressure corresponding to the water power set by the water power setting device in response to the instruction issued by the normal washing instruction device, and that controls the pressure device so as to pressurize the washing water at a pressure higher than a pressure at the time of the maximum water power settable by the water power setting device in response to the instruction issued by the stimulatory washing instruction device.

When a stimulatory washing operation is performed, therefore, the private parts of the human body and their surroundings can be stimulated by the washing water high in discharge pressure, thereby making it possible to hasten the bowels efficiently and reliably.

The sanitary washing apparatus may further comprise a heating device, a power supply device that supplies power to the heating device, and a power control device that controls the power supply device such that power higher than that at the time of the normal washing is supplied to the heating device at the time of the stimulatory washing.

In this case, at the time of the stimulatory washing, the power higher than that at the time of washing the human body is supplied to the heating device by the power supply device. Even when a large amount of washing water is sprayed from the spray device at the time of the stimulatory washing, therefore, the temperature of the washing water can be suitably kept.

The sanitary washing apparatus may further comprise a heating system. The power control device may control the power supply device so as to stop the supply of power to the heating system at the time of the stimulatory washing.

In this case, at the time of the stimulatory washing, the supply of the power to the heating system is stopped. Accordingly, the power is concentrically supplied to the heating device. Consequently, the washing water supplied from the water supply source can be heated by the heating device by sufficient power. Even when a large amount of washing water is sprayed from the spray device at the time of the stimulatory washing, therefore, the temperature of the washing water can be suitably maintained.

Even if the supply of the power to the heating system is stopped at the time of the stimulatory washing, the user does not feel cool on a toilet seat which has been warmed immediately before the stop by a complementary function between the temperature of the toilet seat and the body temperature of the user.

The flow rate adjustment device may comprise an inner cylinder having a cylindrical outer peripheral surface and an outer cylinder having a cylindrical inner peripheral surface. The inner cylinder may be inserted so as to be rotatable into the outer cylinder, and a fluid inlet may be provided at one end of the inner cylinder, a peripheral wall of the inner cylinder may be provided with a hole, a recess may be provided around the hole in the inner cylinder, and a peripheral wall of the outer cylinder may be provided with a plurality of fluid outlets which are opposable to the hole by the rotation of the inner cylinder.

In this case, when the washing water is supplied to the fluid inlet in the flow rate adjustment device by the pressure device, the hole in the inner cylinder can be opposed to the plurality of fluid outlets in the outer cylinder, thereby making it possible to cause the washing water to flow out of the plurality of fluid outlets in the outer cylinder.

The recess may be formed such that at least a part of the recess is opposed to any one of the plurality of fluid outlets in the outer cylinder in a state where the hole in the inner cylinder is not opposed to the plurality of fluid outlets in the outer cylinder. The washing water from the pressure device may flow into the fluid inlet, and the washing water flowing out of the plurality of fluid outlets may be supplied to the plurality of fluid paths in the spray device.

In this case, even when the hole in the inner cylinder is not opposed to the plurality of fluid outlets in the outer cylinder, at least a part of the recess in the inner cylinder is opposed to any one of the plurality of fluid outlets in the outer cylinder. Consequently, the flow path in the flow rate adjustment device is not closed. Even when the pressurized fluid is supplied due to any failure, therefore, the fluid flows out of any one of the plurality of fluid outlets through the recess provided around the hole. Consequently, the pressure in the pipe can be prevented from rising to prevent damage to the pipe and leakage of water, thereby making it possible to improve safety and reliability.

The recess may include a concave groove extending in the direction of rotation of the inner cylinder from the hole.

In this case, whatever angle is the rotation angle of the inner cylinder, the concave groove extending in the direction of rotation of the inner cylinder is opposed to any one of the plurality of fluid outlets in the outer cylinder. Consequently, the flow path from the fluid inlet to the plurality of fluid outlets is not closed.

The flow rate adjustment device may comprise a driving device that rotates the inner cylinder relative to the outer cylinder.

In this case, the inner cylinder is rotated relative to the outer cylinder by the driving device. Consequently, the hole provided in the inner cylinder or the recess provided around the hole can be opposed to the plurality of fluid outlets. Further, the washing water flowing out of the plurality of fluid outlets can be controlled by controlling the rotation of the driving device, thereby making it feasible to miniaturize the sanitary washing apparatus and reduce the cost thereof.

The pressure device may subject the washing water supplied from the water supply source to periodical pressure fluctuations taking a pressure higher than the pressure of the washing water as a central value.

In this case, the washing water having the periodical pressure fluctuations taking the pressure higher than the pressure of the washing water supplied from the water supply source as the central value is discharged. Although sprayed flow from the discharge unit is continuous flow, therefore, the pressure thereof fluctuates. Accordingly, the excessive intermittent feeling of the discharged washing water can be prevented, thereby making it feasible to do washing in which comfortable stimulation is obtained. Consequently, pain or discomfort caused by the intermittent feeling can be alleviated, and the amount of the washing water can be made smaller, as compared with that in the continuous flow.

The pressure device may comprise a reciprocating pump having a pressure member that reciprocates.

In this case, the washing water intermittently pressurized by the reciprocating pump can be sprayed from the spray hole. Consequently, a high washing feeling and washing power can be given to the human body even by the washing water with a low flow rate.

The period of pressure fluctuations by the pressure device may be the period of pressure fluctuations perceivable by the human body.

In this case, the period of pressure fluctuations by the pressure device can be perceived by the human body. Accordingly, the washing feeling is increased.

The sanitary washing apparatus may further comprise a pressure fluctuation setting device for setting the mode of the pressure fluctuations of the washing water, and a control device that controls the mode of the pressure fluctuations by the pressure device on the basis of the setting by the pressure fluctuation setting device. Here, the mode of the pressure fluctuations is the period (frequency) of pressure fluctuations, the width of pressure fluctuations, and the central pressure.

In this case, the mode of the pressure fluctuations of the washing water sprayed from the spray device can be adjusted on the basis of the setting by the pressure setting device. Consequently, it is possible to obtain various types of washing feelings and washing power conforming to his or her physical conditions or taste.

A sanitary washing apparatus according to still another aspect of the present invention is a sanitary washing apparatus that sprays washing water supplied from a water supply source onto the human body, comprising a spray device that sprays the washing water; a pressure device that pressurizes the washing water supplied from the water supply source to spray the pressurized washing water from the spray device while subjecting the washing water to periodical pressure fluctuations; and a control device that controls the pressure device, the pressure device being a multiple acting type reciprocating pump comprising a piston which reciprocates, and a plurality of pump chambers formed on both sides of the piston.

In the sanitary washing apparatus according to the present invention, the washing water supplied from the water supply source is pressurized while being subjected to the periodical pressure fluctuations by the pressure device. Consequently, the stimulatory washing effect is increased even at a low flow rate. Further, the sanitary washing apparatus has the plurality of pump chambers on both sides of the piston. Accordingly, the configuration of the reciprocating pump is simplified, thereby making it possible to miniaturize the sanitary washing apparatus and making the assembly thereof easy.

The plurality of pump chambers may respectively perform a suction operation and a discharge operation in different phases as the piston reciprocates.

In this case, the washing water in one of the pump chambers and the washing water in the other pump chamber are respectively pressurized in different phases, and are synthesized and discharged at an outlet in the reciprocating pump. Consequently, the width of pressure fluctuations of the washing water discharged from the outlet in the reciprocating pump is not excessively large, whereby the user does not feel pain.

The water supply source may have a pressure adjuster.

In this case, the pressure of the washing water does not depend on the pressure fluctuations of the tap water pressure. Consequently, the washing water having the accurate pressure fluctuations can be sprayed.

The spray device may have a configuration in which the divergent angle of the sprayed washing water is changeable.

In this case, the washing water sprayed from the spray device is sprayed onto the human body after the divergent angle thereof is controlled. Consequently, the user can obtain various types of washing feelings and washing power conforming to his or her taste or physical conditions.

The sanitary washing apparatus may further comprise a heating device that heats the washing water supplied from the water supply source and supplies the heated washing water to the pressure device.

In this case, the washing water supplied from the water supply source can be heated by the heating device and supplied to the pressure device, and the washing water suitably heated can be sprayed from the spray device. Consequently, it is possible to wash the private parts of the human body without making the user have an uncomfortable feeling by the washing water suitably heated.

The heating device may be an instantaneous heating device for heating the washing water supplied from the water supply source while causing the washing water to flow.

In this case, the washing water supplied from the water supply source is heated by the heating device while being caused to flow, whereby the washing water is instantaneously heated. Since the washing water is heated only when the human body is washed, therefore, power consumption can be kept to a minimum. Further, the necessity of a water storage tank storing the washing water, for example, is eliminated, thereby making it possible to realize space saving. Even when a time period required to wash the human body is lengthened, the temperature of the washing water is not lowered.

The pressure device may subject the washing water to periodical pressure fluctuations, and the period of pressure fluctuations may be the period of pressure fluctuations perceivable by the human body.

In this case, the period of pressure fluctuations perceivable by the human body is given to the washing water, thereby making it possible to give comfortable stimulation to the user.

The sanitary washing apparatus may further comprise a temperature sensing device that senses the temperature of the washing water. The pressure device may be operated after the temperature sensing device senses a predetermined temperature.

In this case, the temperature sensing device is not operated until a lubricant used in a sliding portion of the pressure device is softened. Consequently, a burden at the time of starting the pump is eased, the motor can be made compact, and power consumption can be reduced. Further, cold water can be prevented from being sprayed from the spray device, and an uncomfortable feeding is prevented from being given to the human body.

The sanitary washing apparatus may further comprise a pressure fluctuation setting device for setting the mode of the pressure fluctuations of the washing water. The control device may control the mode of the pressure fluctuations by the pressure device on the basis of the setting by the pressure fluctuation setting device.

In this case, the mode of the pressure fluctuations of the washing water sprayed from the spray device can be adjusted on the basis of the setting by the pressure fluctuation setting device. Consequently, the user can obtain various types of washing feelings and washing power conforming to his or her physical conditions or taste.

The pressure fluctuation setting device may comprise a switch for gradually changing the mode of the pressure fluctuations.

In this case, the mode of the pressure fluctuations of the washing water can be gradually controlled on the basis of the setting by the pressure fluctuation setting device. Consequently, the user can easily select the various types of washing feelings and washing power conforming to his or her physical conditions or taste.

The pressure fluctuation setting device may comprise a switch for continuously changing the mode of the pressure fluctuations.

In this case, the mode of the pressure fluctuations of the washing water can be continuously controlled on the basis of the setting by the pressure fluctuation setting device. Consequently, the user can easily adjust the various types of washing feelings and washing power conforming to his or her physical conditions or taste.

The control device may continuously increase or decrease at least one of the period of pressure fluctuations, the width of pressure fluctuations, and the central pressure of the washing water sprayed from the spray device on the basis of the setting by the pressure fluctuation setting device.

In this case, at least one of the period of pressure fluctuations, the width of pressure fluctuations, and the central pressure of the washing water sprayed from the spray device can be continuously increased or decreased on the basis of the setting by the pressure fluctuation setting device. Consequently, the user can obtain the various types of washing feelings and washing power conforming to his or her physical conditions or taste.

The spray device may comprise a cylinder, and a piston having a spray hole and inserted into the cylinder so as to be projectable. The piston may project from the cylinder by the pressure of the washing water supplied from the pressure device and spray the washing water from the spray hole.

In this case, the piston projects from the cylinder by the pressure of the washing water at the time of washing, thereby eliminating the necessity of other driving devices such as a motor. Further, it is feasible to miniaturize the sanitary washing apparatus.

The sanitary washing apparatus may further comprise a normal washing instruction device that issues an instruction to do normal washing for washing the private parts of the human body by the washing water, a water power setting device for setting the water power of the washing water, and a strongest washing instruction device that issues an instruction to do the strongest washing for making the water power of the washing water strongest. The control device may control the pressure device so as to pressurize the washing water at a pressure corresponding to the water power set by the water power setting device in response to the instruction issued by the normal washing instruction device and control the pressure device so as to pressurize the washing water at a high pressure which is not less than a pressure at the time of the maximum water power settable by the water power setting device in response to the instruction issued by the strongest washing instruction device.

In this case, the washing water supplied from the water supply source is pressurized by the pressure device at the pressure corresponding to the water power set by the water power setting device in response to the instruction issued by the normal washing instruction device and is sprayed from the spray device. Further, the washing water supplied from the water supply source is pressurized by the pressure device at the high pressure which is not less than the pressure at the time of the maximum water power settable by the water power setting device in response to the instruction issued by the strongest washing instruction device and is sprayed from the spray device. Consequently, the private parts of the human body and their surroundings can be instantaneously washed by the washing water high in discharge pressure in a case where the strongest washing operation is performed. Further, according to the strongest washing, the private parts of the human body and their surroundings can be stimulated by the washing water high in discharge pressure, thereby making it possible to hasten the bowels efficiently and reliably.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS (1) First Embodiment

Figure 1:
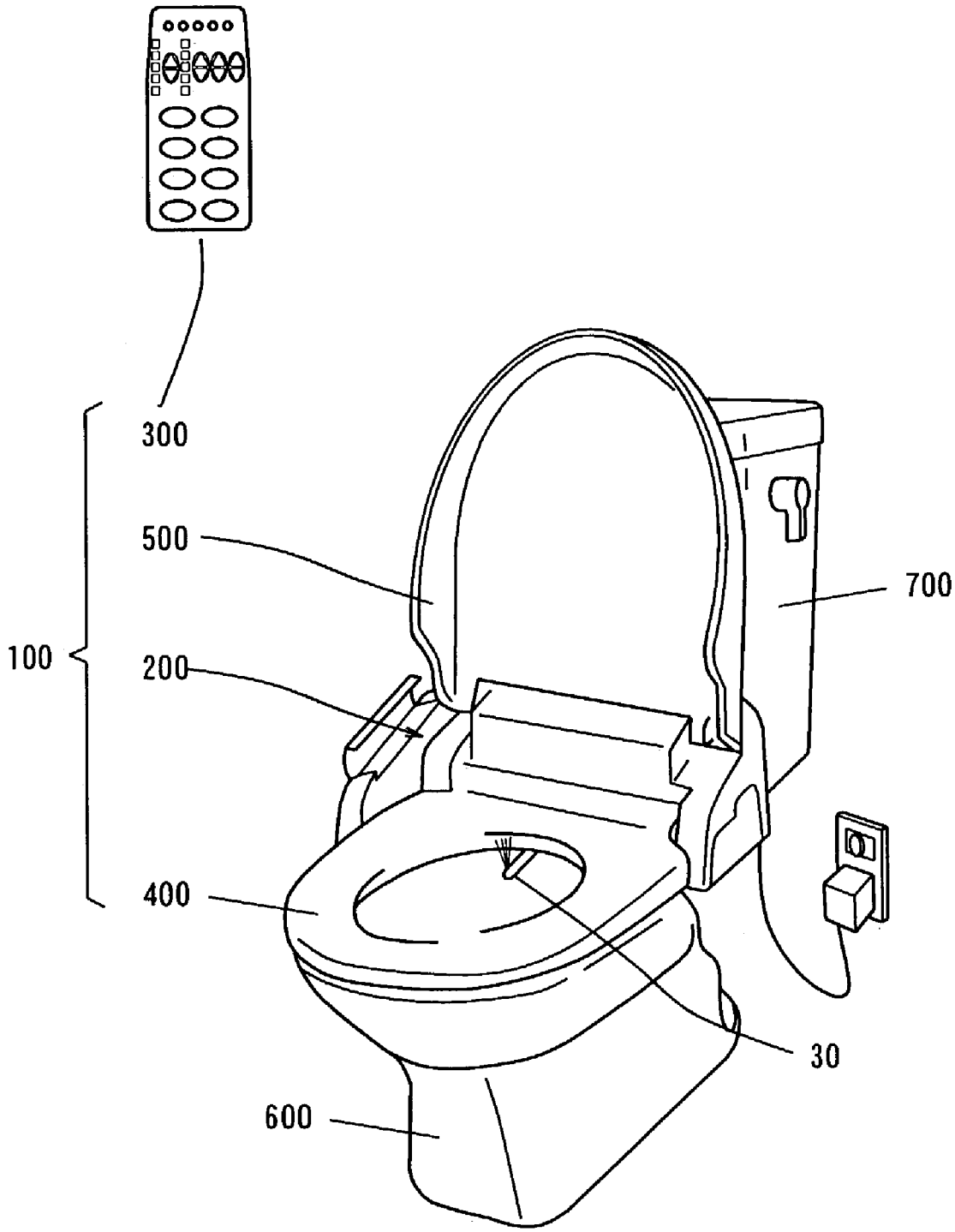
FIG. 1 is a perspective view showing a state where a sanitary washing apparatus according to a first embodiment is mounted on a toilet bowl.

FIG. 1 is a perspective view showing a state where a sanitary washing apparatus according to a first embodiment is mounted on a toilet bowl.

As shown in FIG. 1, a sanitary washing apparatus 100 is mounted on a toilet bowl 600. A tank 700 is connected to a tap water pipe, and supplies washing water to the toilet bowl 600.

The sanitary washing apparatus 100 comprises a main body 200, a remote control device 300, a toilet seat 400, and a cover 500.

The toilet seat 400 and the cover 500 are attached to the main body 200 so as to be capable of being opened or closed. Further, the main body 200 is provided with a washing water supply mechanism including a nozzle unit 30, and contains a controller. The controller in the main body 200 controls the washing water supply mechanism on the basis of a signal transmitted by the remote control device 300, as described later. The controller in the main body 200 also controls a heater contained in the toilet seat 400 and a deodorizing device (not shown) and a hot air supply device (not shown), for example, provided in the main body 200.

Figure 2:
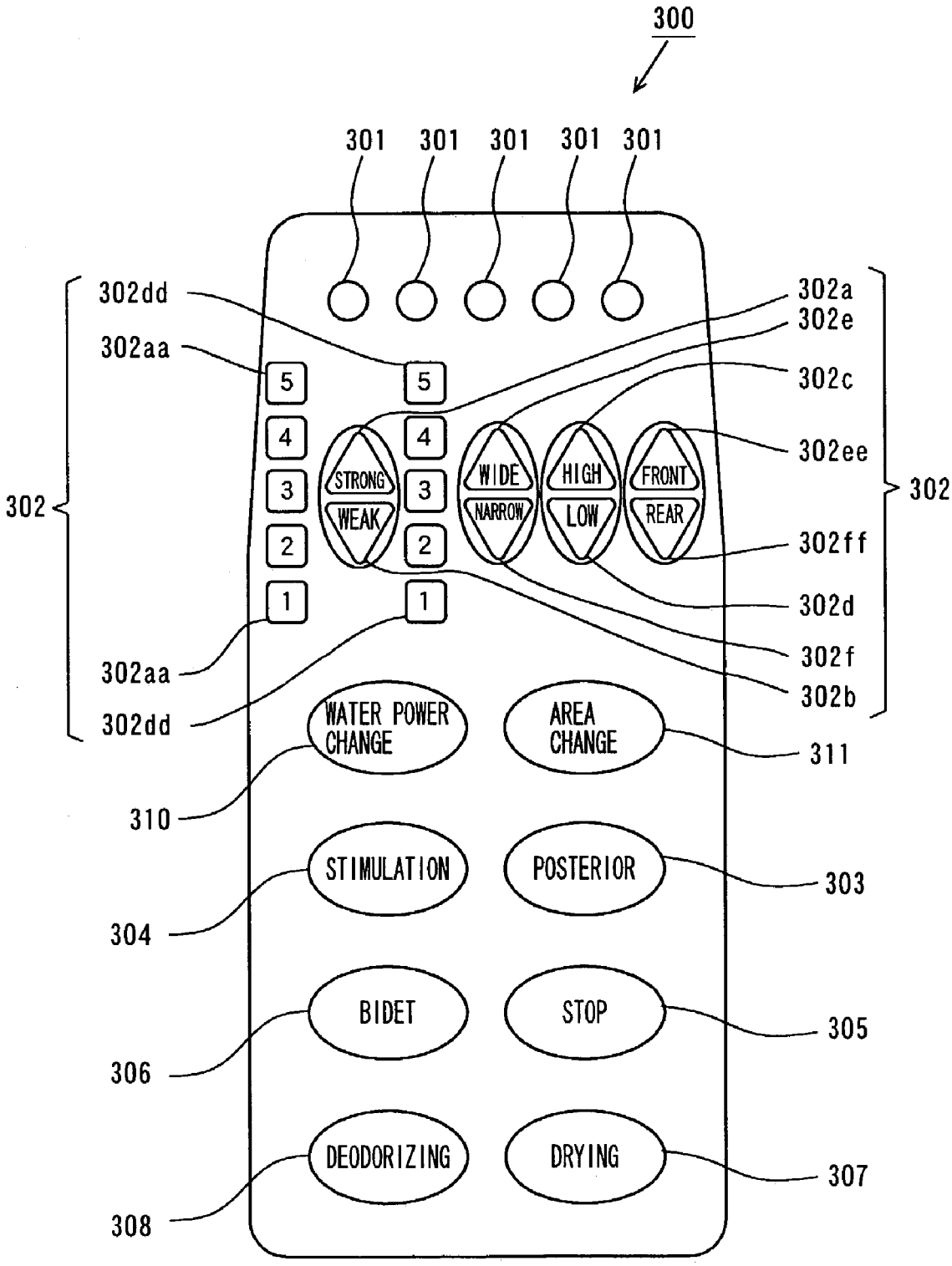
FIG. 2 is a schematic view showing an example of a remote control device shown in FIG. 1.

FIG. 2 is a schematic view showing an example of the remote control device 300 shown in FIG. 1.

As shown in FIG. 2, the remote control device 300 comprises a plurality of LEDs (Light Emitting Diodes) 301, a plurality of adjustment switches 302, a posterior switch 303, a stimulation switch 304, a stop switch 305, a bidet switch 306, a drying switch 307, a deodorizing switch 308, a water power change switch 310, and an area change switch 311.

The adjustment switch 302, the posterior switch 303, the stimulation switch 304, the stop switch 305, the bidet switch 306, the drying switch 307, the deodorizing switch 308, the water power change switch 310, and the area change switch 311 are pressed by a user. Consequently, the remote control device 300 transmits by radio a predetermined signal to the controller provided in the main body 200 in the sanitary washing apparatus 100, described later. The controller in the main body 200 receives the predetermined signal transmitted by radio from the remote control device 300, and controls the washing water supply mechanism or the like.

When the posterior switch 303 or the bidet switch 306 are pressed, for example, the nozzle unit 30 in the main body 200 shown in FIG. 1 moves so that the washing water is sprayed. When the stimulation switch 304 is pressed, the washing water for stimulating the private parts of the human body is sprayed from the nozzle unit 30 in the main body 200 shown in FIG. 1. When the stop switch 305 is pressed, the spray of the washing water from the nozzle unit 30 is stopped.

When the drying switch 307 is pressed, warm air is blown by a warm air supply device (not shown) in the sanitary washing apparatus 100 on the private parts of the human body. When the deodorizing switch 308 is pressed, a deodorizing device (not shown) in the sanitary washing apparatus 100 removes an odor from its surroundings.

The adjustment switch 302 comprises water power adjustment switches 302*a*, 302*b*, and 302*aa*, washing area adjustment switches 302*e*, 302*f*, and 302*dd*, temperature adjustment switches 302*c* and 302*d*, and nozzle position adjustment switches 302*ee* and 302*ff*.

When the nozzle position adjustment switches 302*ee* or 302*ff* are pressed, the position of the nozzle unit 30 in the main body 200 in the sanitary washing apparatus 100 shown in FIG. 1 is changed. When the temperature adjustment switch 302*c* or 302*d* is pressed, the temperature of the washing water sprayed from the nozzle unit 30 is changed. Further, when the water power adjustment switch 302*aa* is pressed, the water power (the mode of pressure fluctuations) of the washing water sprayed from the nozzle unit 30 is gradually changed. When the water power adjustment switch 302*a* or 302*b* is pressed, the water power (the mode of pressure fluctuations) of the washing water sprayed from the nozzle unit 30 is continuously changed. Here, the mode of pressure fluctuations means the period of pressure fluctuations, the width of pressure fluctuations, and the central pressure. Further, when the washing area adjustment switch 302*dd* is pressed, the spray form of the washing water sprayed from the nozzle unit 30 is gradually changed. When the washing area adjustment switch 302*e* or 302*f* is pressed, the spray form of the washing water sprayed from the nozzle unit 30 is continuously changed. Consequently, the divergent angle of the washing water is changed, so that the washing area of a surface to be washed is changed. The plurality of LEDs (Light Emitting Diodes) 301 light up as the adjustment switch 302 is pressed.

When the water power change switch 310 is pressed, the water power (the mode of pressure fluctuations) of the washing water sprayed from the nozzle unit 30 is repeatedly increased and decreased continuously. The details will be described later.

Furthermore, when the area change switch 311 is pressed, the divergent angle of the washing water sprayed from the nozzle unit 30 is changed, so that the washing area of the surface to be washed is repeatedly enlarged and reduced continuously. The details will be described later.

Figure 3:
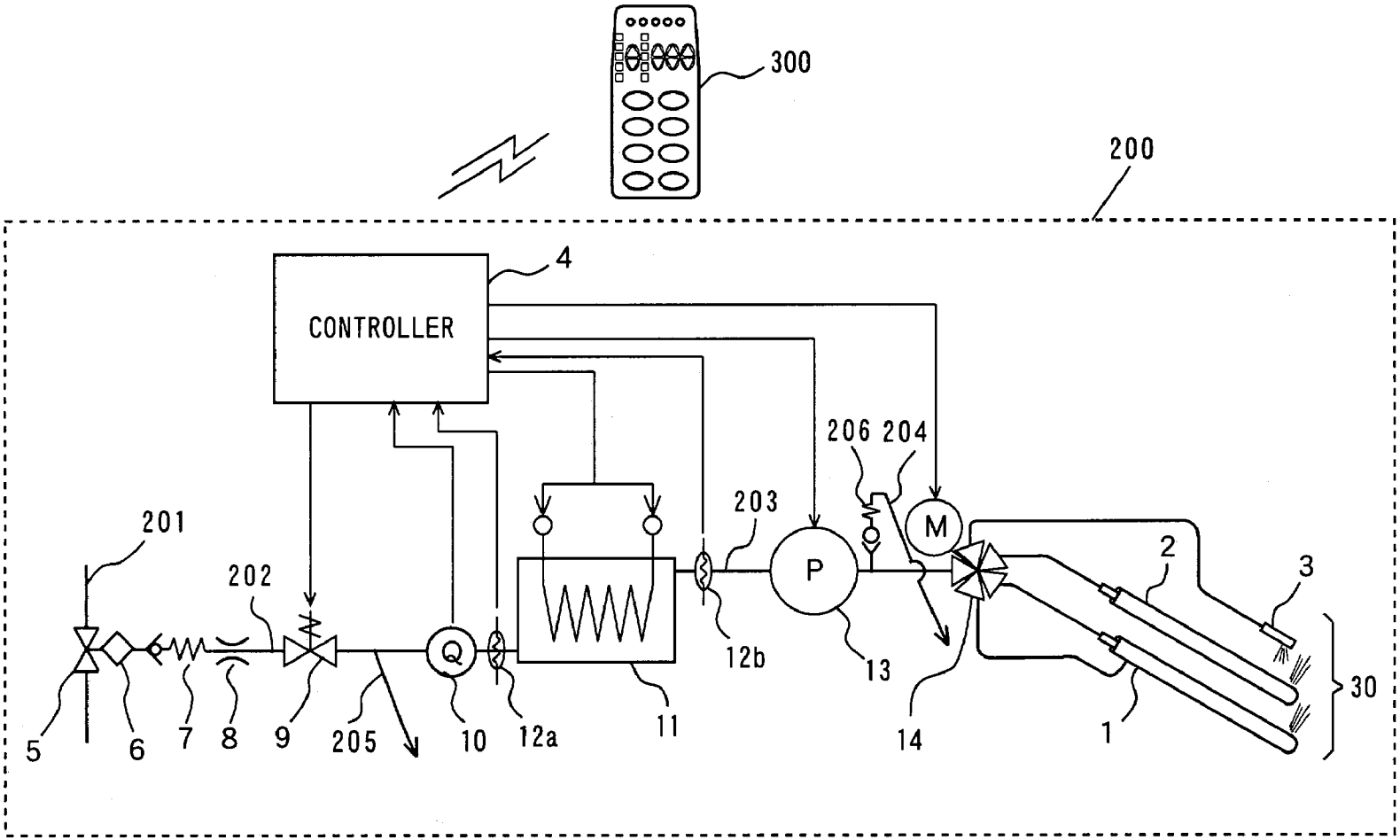
FIG. 3 is a schematic view showing the configuration of a main body in the sanitary washing apparatus according to the first embodiment.

The main body 200 in the sanitary washing apparatus 100 according to the present embodiment will be described. FIG. 3 is a schematic view showing the configuration of the main body 200 in the sanitary washing apparatus 100 according to the first embodiment.

The main body 200 shown in FIG. 3 comprises a controller 4, a branched water faucet 5, a strainer 6, a check valve 7, a constant flow valve 8, a stop solenoid valve 9, a flow sensor 10, a heat exchanger 11, temperature sensors 12*a* and 12*b*, a pump 13, a switching valve 14, and a nozzle unit 30. Further, the nozzle unit 30 comprises a posterior nozzle 1, a bidet nozzle 2, and a nozzle cleaning nozzle 3.

As shown in FIG. 3, the branched water faucet 5 is inserted into a tap water pipe 201. The strainer 6, the check valve 7, the constant flow valve 8, the stop solenoid valve 9, the flow sensor 10, and the temperature sensor 12*a* are inserted in this order into a pipe 202 connected between the branched water faucet 5 and the heat exchanger 11. Further, the temperature sensor 12*b* and the pump 13 are inserted into a pipe 203 connected between the heat exchanger 11 and the switching valve 14.

Clear water flowing through the tap water pipe 201 is first supplied as washing water to the strainer 6 by the branched water faucet 5. The strainer 6 removes dirt, impurities, etc. included in the washing water. The check valve 7 prevents the washing water in the pipe 202 from flowing backward. The constant flow valve 8 keeps the flow rate of the washing water flowing in the pipe 202 constant.

A relief pipe 204 is branched from the pipe connected between the pump 13 and the switching valve 14, and a relief water pipe 205 is branched from the pipe connected between the stop solenoid valve 9 and the flow sensor 10. A relief valve 206 is inserted into the relief pipe 204. The relief valve 206 is opened when the pressure, particularly on the downstream side of the pump 13, in the pipe 203 exceeds a predetermined value, thereby preventing problems such as damage to equipment at the abnormal time and the disconnection of a hose. On the other hand, the washing water which is not sucked by the pump 13 in the washing water which is supplied after the flow rate thereof is adjusted by the constant flow valve 8 is discharged from the relief water pipe 205. Consequently, a predetermined back pressure is exerted on the pump 13 without being dependent on the water supply pressure.

The flow sensor 10 then measures the flow rate of the washing water flowing in the pipe 202, to give a measured flow rate value to the controller 4. The temperature sensor 12*a* measures the temperature of the washing water flowing in the pipe 202, to give a measured temperature value to the controller 4.

The heat exchanger 11 then heats the washing water supplied through the pipe 202 to a predetermined temperature on the basis of a control signal fed by the controller 4. The temperature sensor 12*b* measures the temperature of the washing water heated to the predetermined temperature by the heat exchanger 11, to give a measured temperature value to the controller 4.

The pump 13 feeds by pressure the washing water heated by the heat exchanger 11 to the switching valve 14 on the basis of the control signal fed by the controller 4. The switching valve 14 supplies the washing water to any one of the posterior nozzle 1, the bidet nozzle 2, and the nozzle cleaning nozzle 3 in the nozzle unit 30 on the basis of the control signal fed by the controller 4. Consequently, the washing water is sprayed from any one of the posterior nozzle 1, the bidet nozzle 2, and the nozzle cleaning nozzle 3. Further, the switching valve 14 adjusts the flow rate of the washing water sprayed from the nozzle unit 30 on the basis of the control signal fed by the controller 4. Consequently, the flow rate of the washing water sprayed from the nozzle unit 30 is changed.

The controller 4 feeds the control signal to the stop solenoid valve 9, the heat exchanger 11, the pump 13, and the switching valve 14 on the basis of a signal transmitted by radio from the remote control device 300 shown in FIG. 1, the measured flow rate value given from the flow sensor 10, and the measured temperature value given from the temperature sensors 12*a* and 12*b*.

Figure 4:
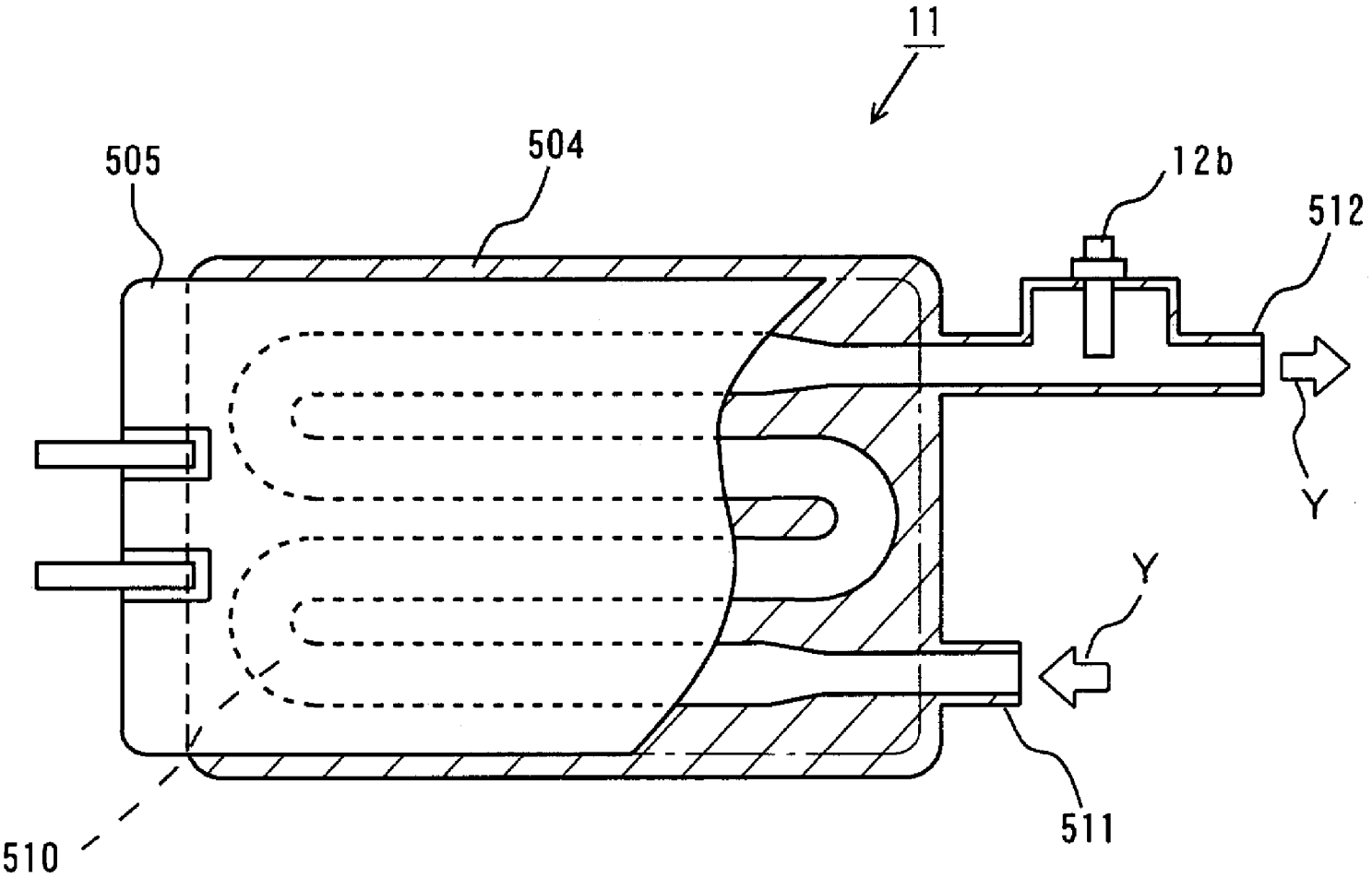
FIG. 4 is a partially cutaway sectional view showing an example of the configuration of a heat exchanger.

FIG. 4 is a partially cutaway sectional view showing an example of the configuration of the heat exchanger 11.

As shown in FIG. 4, a bent snaked pipe 510 is embedded in a resin case 504. A flat plate-shaped ceramic heater 505 is provided so as to be brought into contact with the snaked pipe 510. The washing water is supplied to the snaked pipe 510 from a water supply port 511, is heated more efficiently by the ceramic heater 505 while flowing in the snaked pipe 510, and is discharged from a discharge port 512, as indicated by an arrow Y.

The controller 4 shown in FIG. 3 controls the temperature of the ceramic heater 505 in the heat exchanger 11 by feedback control on the basis of the measured temperature value given from the temperature sensor 12*b*.

Although in the present embodiment, the controller 4 controls the temperature of the ceramic heater 505 in the heat exchanger 11 by feedback control, the present invention is not limited to the same. For example, the temperature of the ceramic heater 505 may be controlled by feed forward control. Alternatively, controlling the ceramic heater 505 by feed forward control when the temperature rises may be combined with controlling the ceramic heater 505 by feedback control at the steady time.

Figure 5:
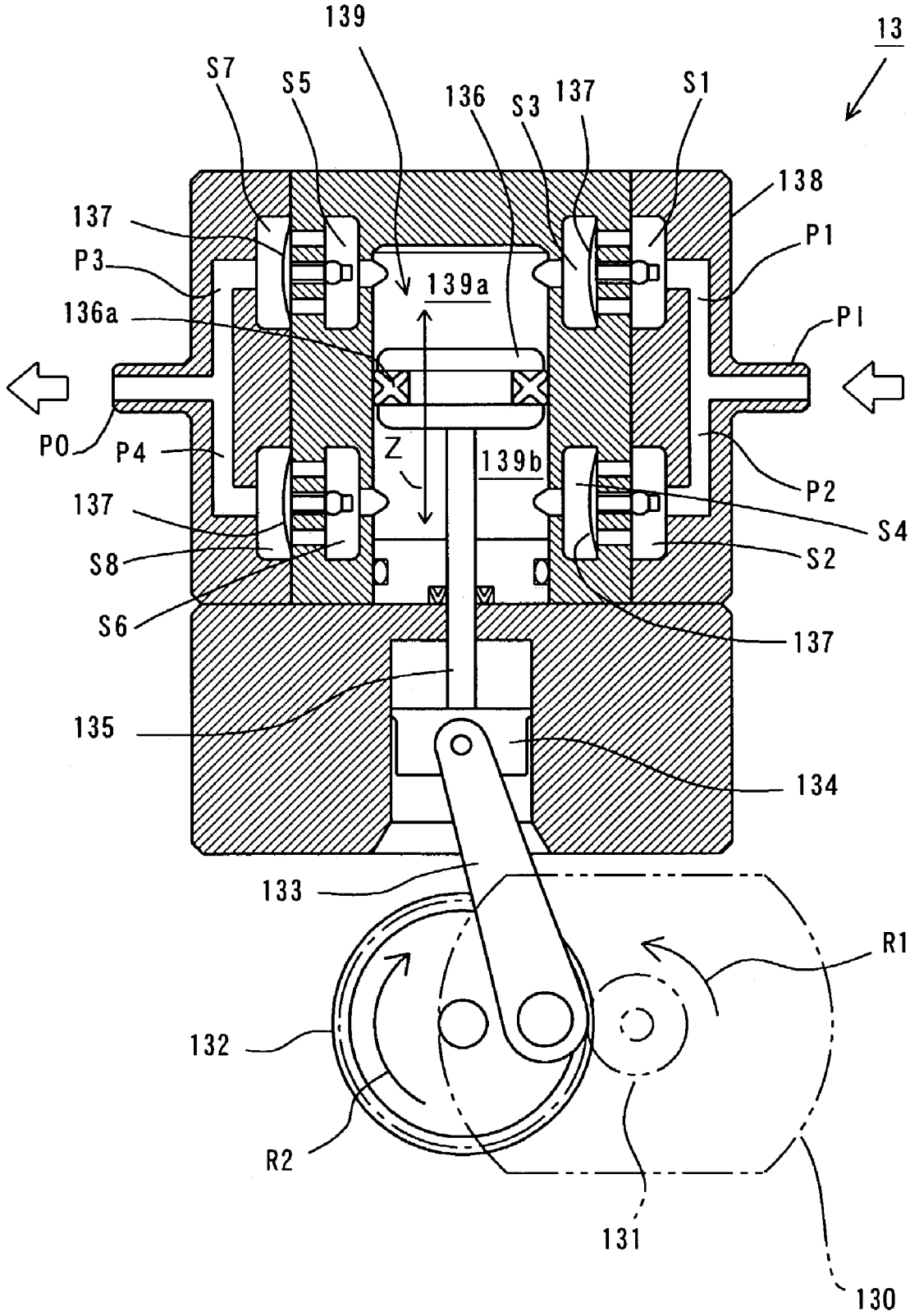
FIG. 5 is a schematic sectional view showing the configuration of a pump according to the present embodiment.

FIG. 5 is a cross-sectional view showing an example of the configuration of the pump 13. The pump shown in FIG. 5 is a multiple acting type reciprocating pump.

In FIG. 5, a columnar space 139 is formed in a main body 138. A pressure feeding piston 136 is provided in the columnar space 139. An X-shaped packing 136*a* is mounted on the outer periphery of the pressure feeding piston 136. The columnar space 139 is divided into a pump chamber 139*a* and a pump chamber 139*b* by the pressure feeding piston 136.

A washing water inlet PI is provided on one side of the main body 138, and a washing water outlet PO is provided on the other side thereof. The heat exchanger 11 is connected to the washing water inlet PI through the pipe 203 shown in FIG. 3, and the switching valve 14 is connected to the washing water outlet PO through the pipe 203.

The washing water inlet PI communicates with the pump chamber 139*a* through an internal flow path P1, a small chamber S1, and a small chamber S3, and communicates with the pump chamber 139*b* through an internal flow path P2, a small chamber S2, and a small chamber S4.

The pump chamber 139*a* communicates with the washing water outlet PO through a small chamber S5, a small chamber S7, and an internal flow path P3. The columnar space 139*b* communicates with the washing water outlet PO through a small chamber S6, a small chamber S8, and an internal flow path P4.

The small chamber S3, the small chamber S4, the small chamber S7, and the small chamber S8 are respectively provided with umbrella packings 137.

A gear 131 is attached to the axis of rotation of the motor 130, and a gear 132 is engaged with the gear 131. Further, one end of a crank shaft 133 is attached to the gear 132 so as to be rotatable with its one point supported thereon, and the pressure feeding piston 136 is attached to the other end of the crank shaft 133 through a piston holder 134 and a piston holding bar 135.

When the axis of rotation of the motor 130 is rotated on the basis of the control signal fed by the controller 4 shown in FIG. 3, the gear 131 attached to the axis of rotation of the motor 130 is rotated in a direction indicated by an arrow R1, and the gear 132 is rotated in a direction indicated by an arrow R2. Consequently, the pressure feeding piston 136 moves up and down in a direction indicated by an arrow Z.

Figure 6:
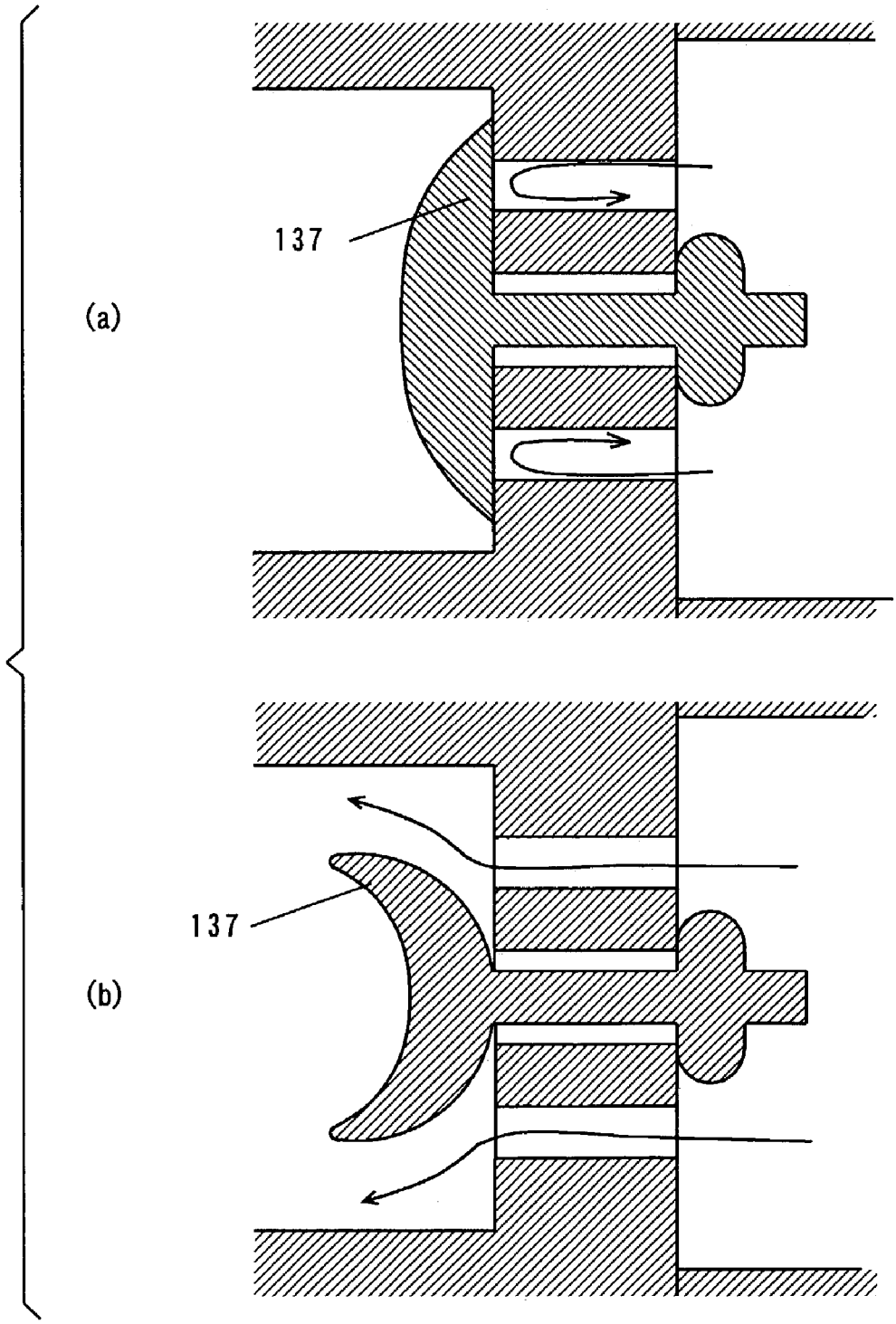
FIG. 6 is a schematic view for explaining the operations of an umbrella packing.

FIG. 6 is a schematic view for explaining the operations of the umbrella packing 137. When the pressure feeding piston 136 shown in FIG. 5 moves downward, to increase the volume of the pump chamber 139*a*, for example, the pressure in the pump chamber 139*a* is lower than the pressure in the small chamber S1. Accordingly, the umbrella packing 137 provided in the small chamber S3 is deformed, as shown in FIG. 6(*b*). As a result, the washing water supplied from the washing water inlet PI flows into the pump chamber 139*a* through the internal flow path P1, the small chamber S1, and the small chamber S3. In this case, the pressure in the pump chamber 139*a* is lower than the pressure in the small chamber S7, whereby the umbrella packing 137 provided in the small chamber S7 is not deformed from the state shown in FIG. 6(*a*). As a result, the washing water does not flow into the pump chamber 139*a*. Conversely, the washing water is not discharged from the washing water outlet PO.

On the other hand, when the pressure feeding piston 136 shown in FIG. 5 moves upward, to decrease the volume of the pump chamber 139*a*, the pressure in the pump chamber 139*a* is higher than the pressure in the small chamber S1. Accordingly, the umbrella packing 137 provided in the small chamber S3 is not deformed from the state shown in FIG. 6(*a*). As a result, the washing water inside the small chamber S1 does not flow into the pump chamber 139*a*. In this case, the umbrella packing 137 provided in the small chamber S7 is deformed, as shown in FIG. 6(*b*). As a result, the washing water inside the pump chamber 139*a* is discharged from the washing water outlet PO through the small chamber S5, the small chamber S7, and the internal flow path P3.

The umbrella packing 137 provided in the small chamber S4 is deformed, as shown in FIG. 6(*b*), when the pressure feeding piston 136 moves upward, while not being deformed from the state shown in FIG. 6(*a*) when the pressure feeding piston 136 moves downward. On the other hand, the umbrella packing 137 provided in the small chamber S8 is not deformed from the state shown in FIG. 6(*a*) when the pressure feeding piston 136 moves upward, while being deformed, as shown in FIG. 6(*b*), when the pressure feeding piston 136 moves downward. Therefore, the washing water from the washing water inlet PI flows into the pump chamber 139*b* when the washing water inside the pump chamber 139*a* is discharged from the washing water outlet PO, while the washing water inside the pump chamber 139*b* is discharged from the washing water outlet PO when the washing water from the washing water inlet PI flows into the pump chamber 139*a*.

Figure 7:
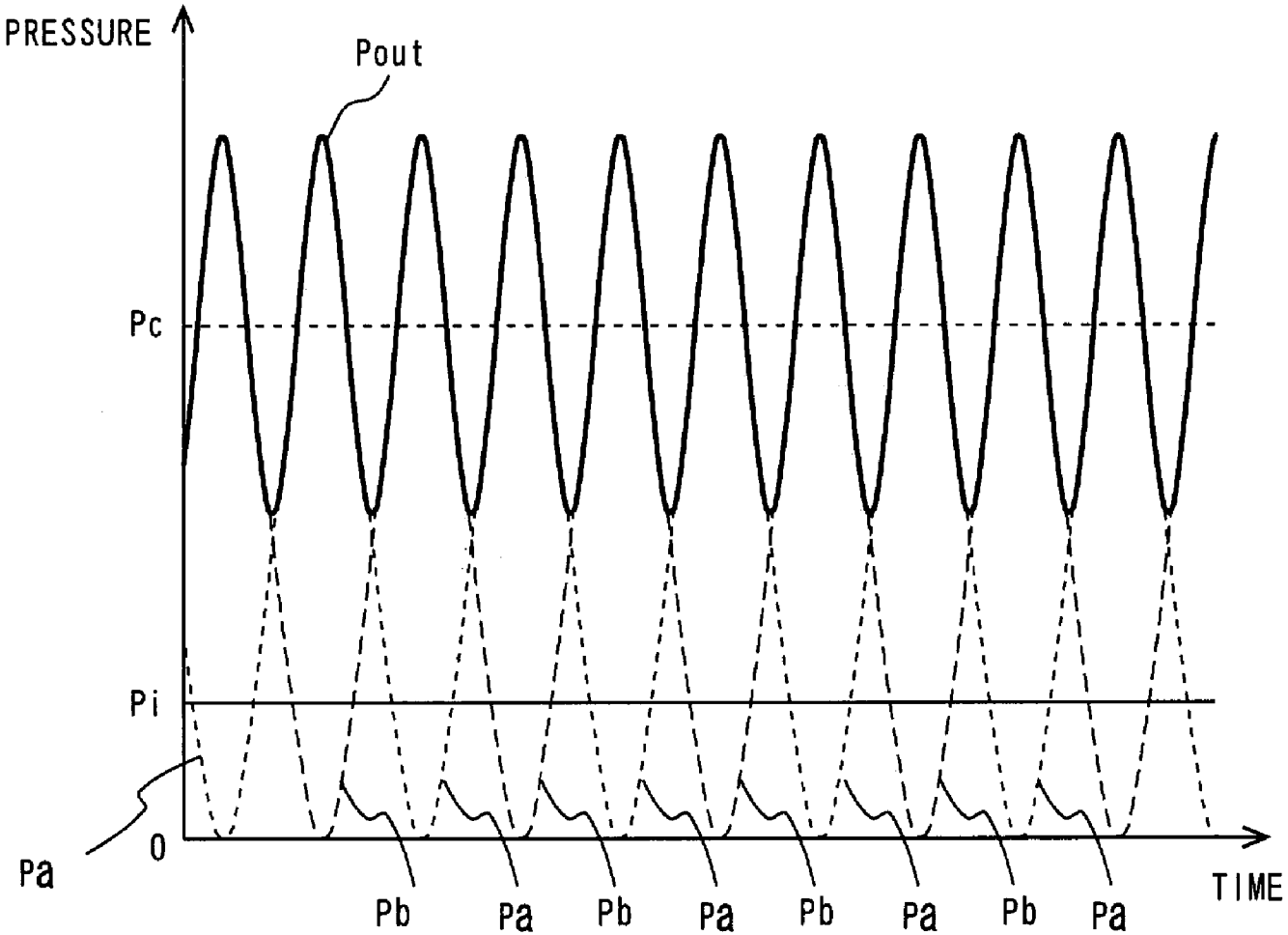
FIG. 7 is a diagram showing the change in pressure in the pump shown in FIG. 5.

FIG. 7 is a diagram showing the change in pressure in the pump 13 shown in FIG. 5. In FIG. 7, the vertical axis indicates pressure, and the horizontal axis indicates time.

As shown in FIG. 7, washing water at a pressure of Pi is supplied to the washing water inlet PI in the pump 13. In this case, the pressure feeding piston 136 shown in FIG. 6 moves up and down so that the pressure Pa of the washing water inside the pump chamber 139*a* is changed, as indicated by a dotted line. On the other hand, the pressure Pb of the washing water inside the pump chamber 139*b* is changed, as indicated by a broken line. The pressure Pout of the washing water discharged from the washing water outlet PO in the pump 13 is periodically changed upward and downward, centered at the pressure Pc, as indicated by a thick solid line.

The pressure feeding piston 136 thus moves up and down in the pump 13 so that pressure is alternately applied to the washing water in the pump chamber 139*a* and the washing water in the pump chamber 139*b*. Accordingly, the washing water at the washing water inlet PI is discharged from the washing water outlet PO after the pressure thereof is raised.

Description is now made of the change in discharge pressure based on the operations of the pump 13. In the sanitary washing apparatus 100 according to the present embodiment, the flow rate of the washing water passing through the switching valve 14 is fixed. However, the washing water sprayed from the posterior nozzle 1 or the bidet nozzle 2 can be subjected to pressure fluctuations, as shown below, by switching the switching valve 14.

Figure 8:
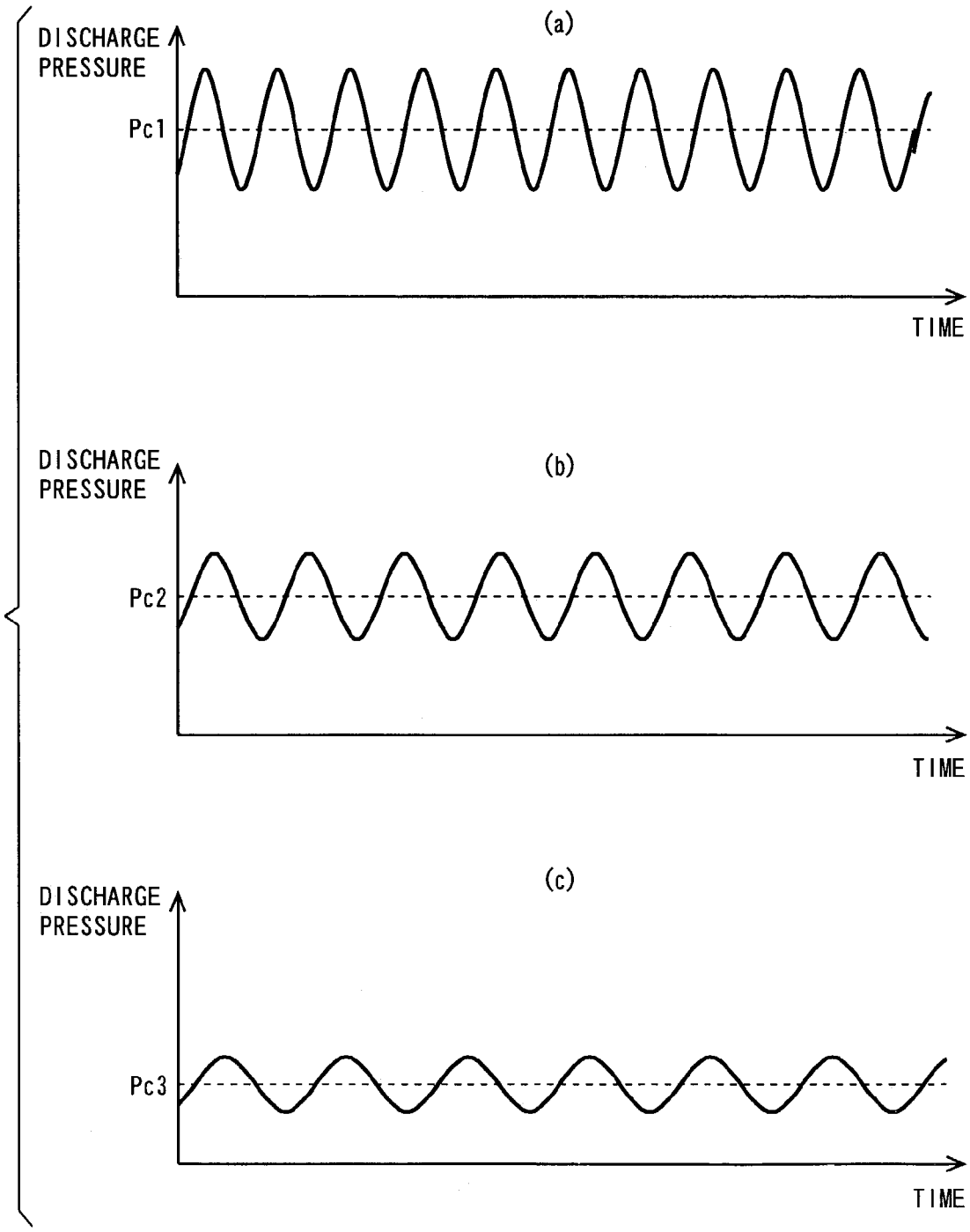
FIG. 8 is a diagram showing the change in pressure in the pump due to the difference in water power set in the first embodiment.

FIGS. 8(*a*) to 8(*c*) are diagrams showing the change in pressure in the pump 13 depending on the difference in the water power set in the first embodiment. The vertical axis indicates the discharge pressure of the pump 13, and the horizontal axis indicates time.

FIG. 8(*a*) is a diagram showing the discharge pressure of the pump 13 in a case where the user presses the water power adjustment switch 302*a* or 302*aa* shown in FIG. 2 to set the water power to "strong". In this case, the controller 4 increases the number of revolutions of the motor 130 in the pump 13. Consequently, the period of the up-and-down motion of the pressure feeding piston 136 shown in FIG. 5 is shortened. As a result, the frequency of fluctuations of the discharge pressure of the pump 13 becomes high, and the period of fluctuations of the discharge pressure becomes small. Further, the center of fluctuations Pc1 of the discharge pressure of the pump 13 becomes high, and the width of fluctuations of the discharge pressure becomes large.

FIG. 8(*b*) is a diagram showing the discharge pressure of the pump 13 in a case where the user presses the water power adjustment switch 302*a*, 302*b*, or 302*aa* shown in FIG. 2 to set the water power to "medium". In this case, the controller 4 makes the number of revolutions of the motor 130 medium. Consequently, the period of the up-and-down motion of the pressure feeding piston 136 shown in FIG. 5 becomes medium. As a result, the frequency of fluctuations of the discharge pressure of the pump 13 becomes medium, and the period of fluctuations of the discharge pressure becomes medium. Further, the center of fluctuations Pc2 of the discharge pressure of the pump 13 becomes medium, and the width of fluctuations of the discharge pressure becomes medium.

FIG. 8(*c*) is a diagram showing the discharge pressure of the pump 13 in a case where the user presses the water power adjustment switch 302*b* or 302*aa* shown in FIG. 2 to set the water power to "weak". In this case, the controller 4 decreases the number of revolutions of the motor 130. Consequently, the period of the up-and-down motion of the pressure feeding piston 136 shown in FIG. 5 is lengthened. As a result, the frequency of fluctuations of the discharge pressure of the pump 13 becomes low, and the period of fluctuations of the discharge pressure becomes large. Further, the center of fluctuations Pc3 of the discharge pressure of the pump 13 becomes low, and the width of fluctuations of the discharge pressure becomes small.

FIG. 8(*c*) is a diagram showing the discharge pressure of the pump 13 in a case where the user presses the water power adjustment switch 320*b* or 302*aa* shown in FIG. 2 to set the water power to "weak". In this case, the controller 4 decreases the number of revolutions of the motor 130. Consequently, the period of the up-and-down motion of the pressure feeding piston 136 shown in FIG. 5 is lengthened. As a result, the frequency of fluctuations of the discharge pressure of the pump 13 becomes low, and the period of fluctuations of the discharge pressure becomes large. Further, the center of fluctuations Po of the discharge pressure of the pump 13 becomes low, and the width of fluctuations of the discharge pressure becomes small.

When the user presses the water power change switch 310 shown in FIG. 2, the controller 4 repeatedly increase and decrease the number of revolutions of the motor 130 periodically. Consequently, the period of the up-and-down motion of the pressure feeding piston 136 shown in FIG. 5 is periodically increased and decreased. As a result, the period of fluctuations of the discharge pressure of the pump 13, the fluctuation center Po of the discharge pressure, and the width of fluctuations of the discharge pressure are repeatedly increased and decreased periodically. That is, the periodical change in the mode of the pressure fluctuations is repeated, as shown in FIGS. 8(*a*) to 8(*c*).

In the sanitary washing apparatus 100 according to the present embodiment, the water power is adjusted by changing the number of revolutions of the pump 13. Consequently, the user can adjust the flow rate (the average pressure) of the washing water sprayed from the nozzle unit 30, the width of pressure fluctuations, and the period of pressure fluctuations by the water power adjustment switches 302*a*, 302*b*, and 302*aa*.

Not only the flow rate of the washing water but also the width of pressure fluctuations and the period of pressure fluctuations are thus changed, thereby obtaining a washing feeling different from that in adjusting only the flow rate. Consequently, it is possible to obtain various types of washing feelings conforming to the taste of the user.

In the sanitary washing apparatus 100 according to the present embodiment, it is preferable that the width of pressure fluctuations and the period of pressure fluctuations are respectively controlled most suitably depending on the posterior nozzle 1 and the bidet nozzle 2. Consequently, comfort and usability are improved.

Figure 9:
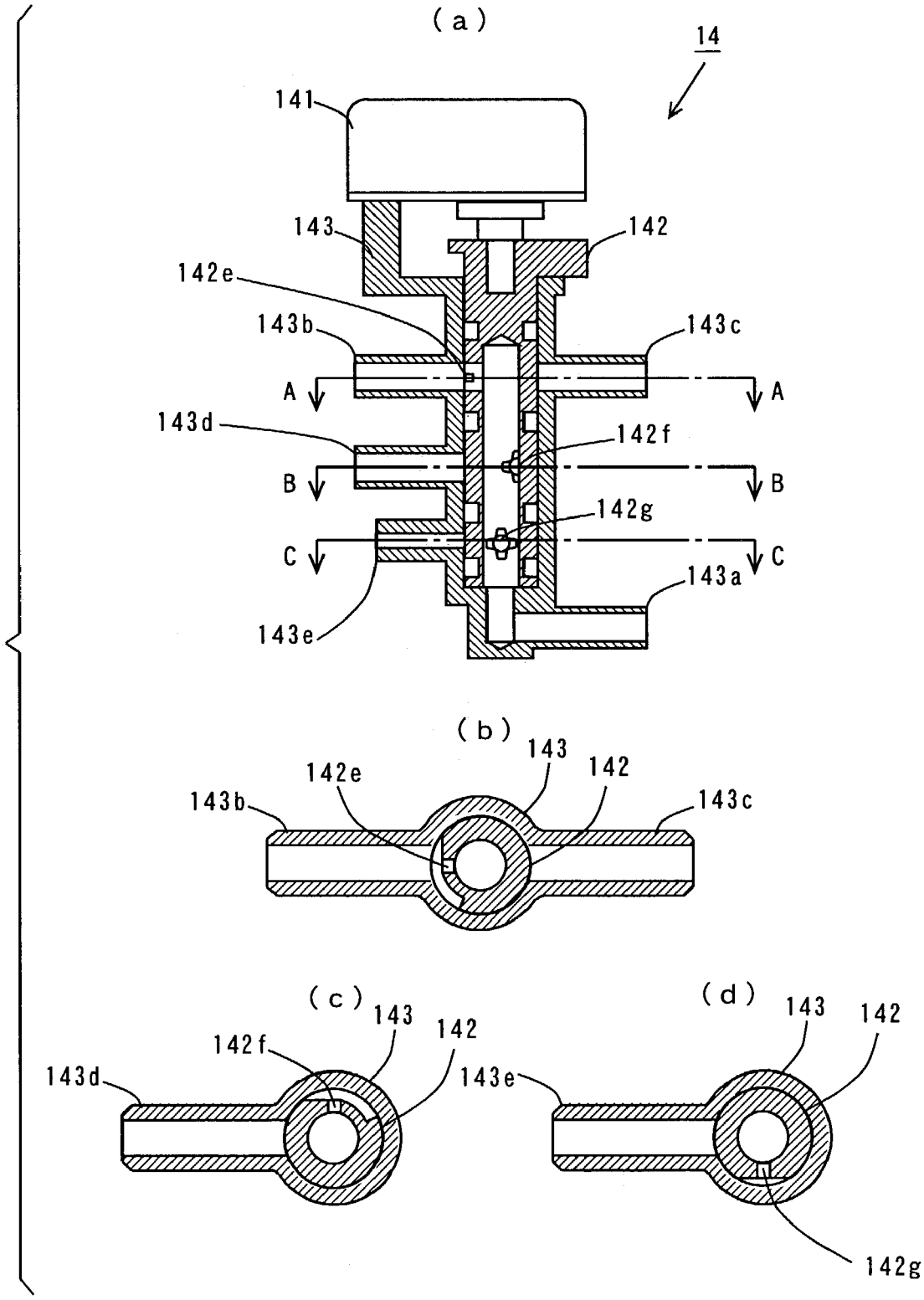
FIG. 9 is a diagram showing the configuration of a switching valve.

FIG. 9(*a*) is a vertical sectional view of the switching valve 14, FIG. 9(*b*) is a cross-sectional view taken along a line A—A of the switching valve 14 shown in FIG. 9(*a*), FIG. 9(*c*) is a cross-sectional view taken along a line B—B of the switching valve 14 shown in FIG. 9(*a*), and FIG. 9(*d*) is a cross-sectional view taken along a line C—C of the switching valve 14 shown in FIG. 9(*a*).

The switching valve 14 shown in FIG. 9 comprises a motor 141, an inner cylinder 142, and an outer cylinder 143.

The inner cylinder 142 is inserted into the outer cylinder 143, and the axis of rotation of the motor 141 is mounted on the inner cylinder 142. The motor 141 performs a rotating operation on the basis of the control signal fed by the controller 4. The motor 141 is rotated so that the inner cylinder 142 is rotated.

As shown in FIGS. 9(*a*), 9(*b*), 9(*c*), and 9(*d*), a washing water inlet 143*a* is provided at one end of the outer cylinder 143, washing water outlets 143*b* and 143*c* are provided at opposite positions on sides thereof, a washing water outlet 143*d* is provided at a position, different from the washing water outlets 143*b* and 143*c*, on the side thereof, and a washing water outlet 143*e* is provided at a position, different from the washing water outlets 143*b*, 143*c*, and 143*d*, on the side thereof. Holes 142*e*, 142*f*, and 142*g* are provided at different positions of the inner cylinder 142. Chamfers (recesses) composed of a curved line and a straight line are respectively formed, as shown in FIGS. 9(*b*) and 9(*c*), around the holes 142*e* and 142*f*, and a chamfer (recess) composed of a straight line is formed, as shown in FIG. 9(*d*), around the hole 142*g*.

By the rotation of the inner cylinder 142, the hole 142*e* is opposable to the washing water outlet 143*b* or 143*c* in the outer cylinder 143, the hole 142*f* is opposable to the washing water outlet 143*d* in the outer cylinder 143, and the hole 142*g* is opposable to the washing water outlet 143*e* in the outer cylinder 143.

The pipe 203 shown in FIG. 3 is connected to the washing water inlet 143*a*, the bidet nozzle 2 is connected to the washing water outlet 143*b*, the first flow path in the posterior nozzle 1 is connected to the washing water outlet 143*c*, the second flow path in the posterior nozzle 1 is connected to the washing water outlet 143*d*, and the nozzle cleaning nozzle 3 is connected to the washing water outlet 143*e*.

Figure 10:
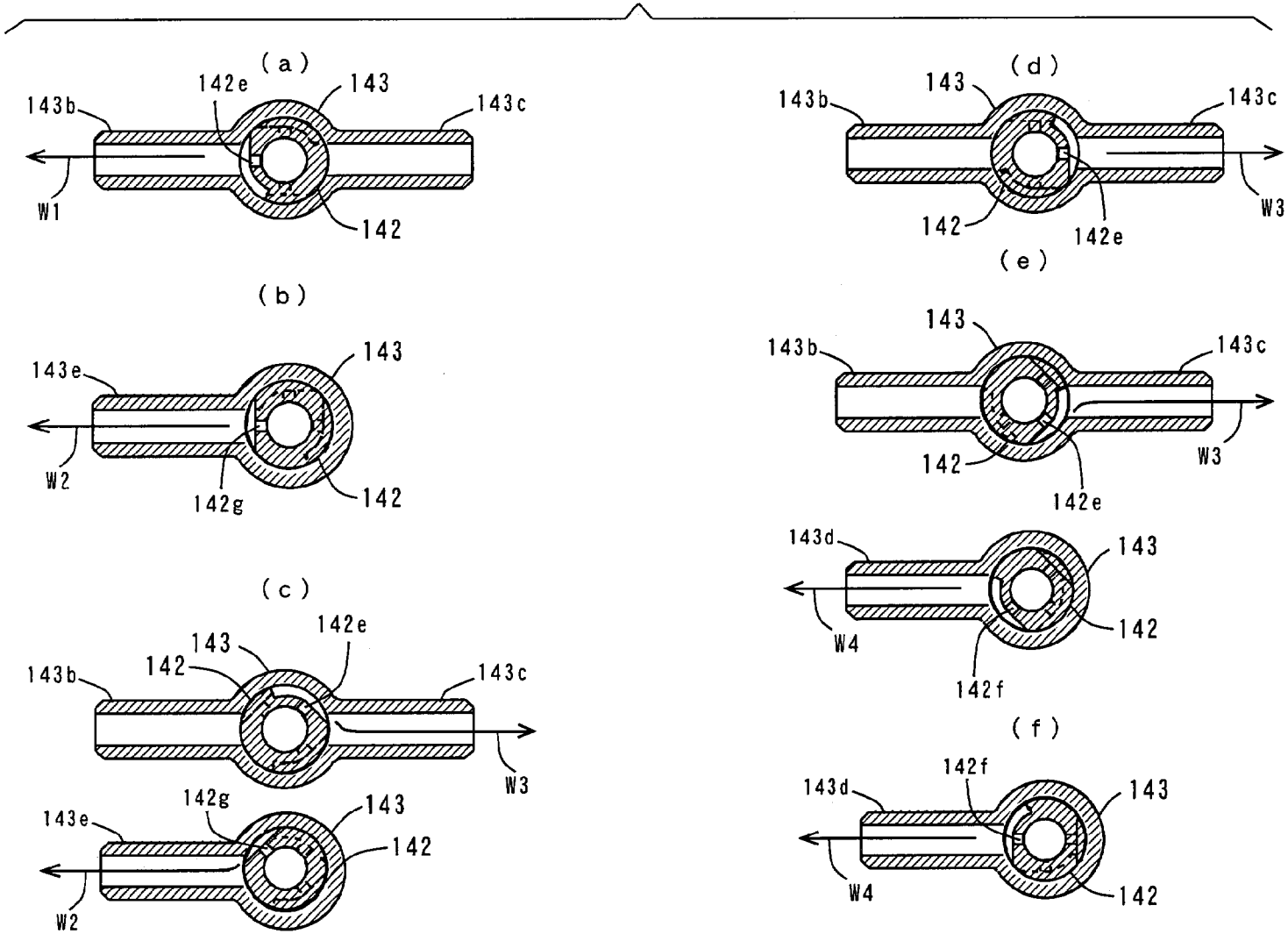
FIG. 10 is a cross-sectional view showing the operations of the switching valve shown in FIG. 9.

FIG. 10 is a cross-sectional view showing the operations of the switching valve 14 shown in FIG. 9.

FIGS. 10(*a*) to 10(*f*) illustrate states where the motor 141 in the switching valve 14 are respectively rotated through angles of zero, 90 degrees, 135 degrees, 180 degrees, 225 degrees and 270 degrees.

First, when the motor 141 is not rotated (rotated through an angle of zero), as shown in FIG. 10(*a*), the chamfer (recess) around the hole 142*e* in the inner cylinder 142 is opposed to the washing water outlet 143*b* in the outer cylinder 143. Consequently, the washing water passes in the inner cylinder 142 from the washing water inlet 143*a*, to flow out of the washing water outlet 143*b*, as indicated by an arrow W1.

When the motor 141 then rotates the inner cylinder 142 through 90 degrees, as shown in FIG. 10(*b*), the chamfer (recess) around the hole 142*g* in the inner cylinder 142 is opposed to the washing water outlet 143*e* in the outer cylinder 143. Consequently, the washing water passes in the inner cylinder 142 from the washing water inlet 143*a*, to flow out of the washing water outlet 143*e*, as indicated by an arrow W2.

When the motor 141 then rotates the inner cylinder 142 through 135 degrees, as shown in FIG. 10(*c*), a part of the chamfer (recess) around the hole 142*g* in the inner cylinder 142 is opposed to the washing water outlet 143*e* in the outer cylinder 143, and a part of the chamfer (recess) around the hole 142*e* in the inner cylinder 142 is opposed to the washing water outlet 143*c* in the outer cylinder 143. Consequently, a small amount of washing water passes in the inner cylinder 142 from the washing water inlet 143*a*, to flow out of the washing water outlets 143*c* and 143*e*, respectively, as indicated by an arrow W2 and an arrow W3.

When the motor 141 then rotates the inner cylinder 142 through 180 degrees, as shown in FIG. 10(*d*), the chamfer (recess) around the hole 142*a* in the inner cylinder 142 is opposed to the washing water outlet 143*c* in the outer cylinder 143. Consequently, the washing water passes in the inner cylinder 142 from the washing water inlet 143*a*, to flow out of the washing water outlet 143*c*, as indicated by an arrow W3.

When the motor 141 then rotates the inner cylinder 142 through 225 degrees, as shown in FIG. 10(*e*), a part of the chamfer (recess) around the hole 142*e* in the inner cylinder 142 is opposed to the washing water outlet 143*c* in the outer cylinder 143, and a part of the chamfer (recess) around the hole 142*f* in the inner cylinder 142 is opposed to the washing water outlet 143*d* in the outer cylinder 143. Consequently, a small amount of washing water passes in the inner cylinder 142 from the washing water inlet 143*a*, to flow out of the washing water outlets 143*c* and 143*d*, respectively, as indicated by an arrow W3 and an arrow W4.

When the motor 141 then rotates the inner cylinder 142 through 270 degrees, as shown in FIG. 10(*f*), the chamfer (recess) around the hole 142*f* in the inner cylinder 142 is opposed to the washing water outlet 143*d* in the outer cylinder 143. Consequently, the washing water passes in the inner cylinder 142 from the washing water inlet 143*a*, to flow out of the washing water outlet 143*d*, as indicated by an arrow W4.

As described in the foregoing, the motor 141 is rotated on the basis of the control signal from the controller 4 so that any one of the holes 142*e*, 142*f*, and 142*g* in the inner cylinder 142 is opposed to the washing water outlets 143*b* to 143*e* in the outer cylinder 143, and the washing water flowing into the inner cylinder 142 from the washing water inlet 143*a* flows out of any one of the washing water outlets 143*b* to 143*e*.

Figure 11:
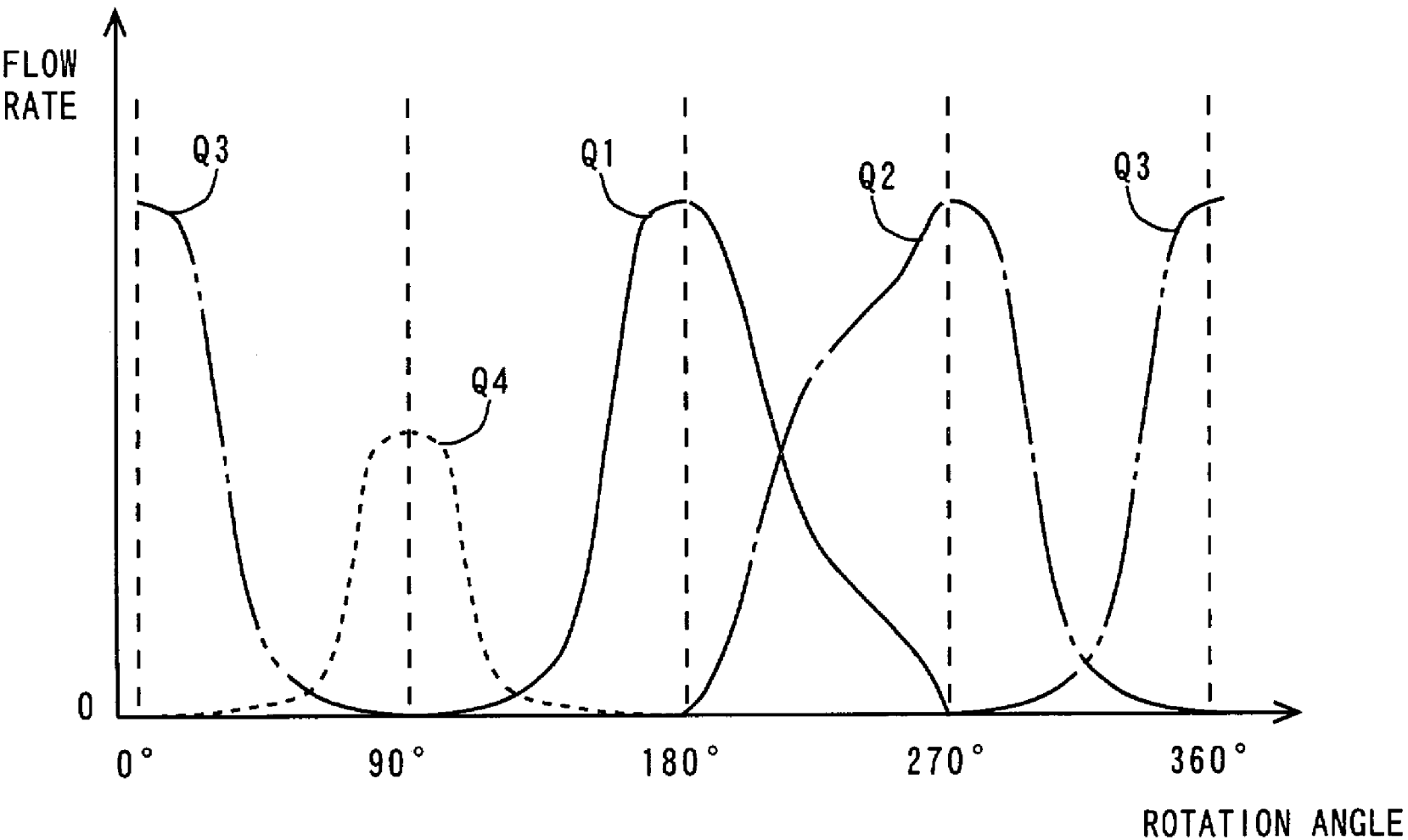
FIG. 11 is a diagram showing the flow rate of washing water flowing into a posterior nozzle from a washing water outlet in the switching valve shown in FIG. 10, the flow rate of washing water flowing into a bidet nozzle from the washing water outlet, and the flow rate of washing water flowing into a nozzle cleaning nozzle from the washing water outlet.

FIG. 11 is a diagram showing the flow rate of washing water flowing into the posterior nozzle 1 from the washing water outlets 143*c* and 143*d* in the switching valve 14 shown in FIG. 10, the flow rate of washing water flowing into the bidet nozzle 2 from the washing water outlet 143*b*, and the flow rate of washing water flowing into the nozzle cleaning nozzle 3 from the washing water outlet 143*e*. In FIG. 11, the horizontal axis indicates the rotation angle of the motor 141, and the vertical axis indicates the respective flow rates of the washing water flowing out of the washing water outlets 143*b* to 143*e*. A solid line Q1 indicates the change in the flow rate of the washing water flowing into the posterior nozzle 1 from the washing water outlet 143*c*, a one-dot and dash line Q2 indicates the change in the flow rate of the washing water flowing into the posterior nozzle 1 from the washing water outlet 143*d*, a two-dot and dash line Q3 indicates the change in the flow rate of the washing water flowing into the bidet nozzle 2 from the washing water outlet 143*b*, and a broken line Q4 indicates the change in the flow rate of the washing water flowing into the nozzle cleaning nozzle 3 from the washing water outlet 143*e*.

When the motor 141 is not rotated (rotated through an angle of zero), as shown in FIG. 11, for example, the flow rate Q3 of the washing water flowing into the bidet nozzle 2 from the washing water outlet 143*b* takes the maximum value. As the rotation angle of the motor 141 increases, the flow rate Q3 of the washing water flowing into the bidet nozzle 2 from the washing water outlet 143*b* decreases, and the flow rate Q4 of the washing water flowing into the nozzle cleaning nozzle 3 from the washing water outlet 143*e* increases.

When the motor 141 is then rotated through 90 degrees, the flow rate Q4 of the washing water flowing into the nozzle cleaning nozzle 3 from the washing water outlet 143*e* takes the maximum value. As the rotation angle of the motor 141 further increases, the flow rate Q4 of the washing water flowing into the nozzle cleaning nozzle 3 from the washing water outlet 143*c* decreases, and the flow rate Q1 of the washing water flowing into the posterior nozzle 1 from the washing water outlet 143*c* increases.

When the motor 141 is then rotated through 180 degrees, the flow rate Q1 of the washing water flowing into the posterior nozzle 1 from the washing water outlet 143*c* takes the maximum value. As the rotation angle of the motor 141 further increases, the flow rate Q1 of the washing water flowing into the posterior nozzle 1 from the washing water outlet 143*c* decreases, and the flow rate Q2 of the washing water flowing into the posterior nozzle 1 from the washing water outlet 143*d* increases.

When the motor 141 is then rotated through 270 degrees, the flow rate Q2 of the washing water flowing into the posterior nozzle 1 from the washing water outlet 143*d* takes the maximum value. As the rotation angle of the motor 141 further increases, the flow rate Q2 of the washing water flowing into the posterior nozzle 1 from the washing water outlet 143*d* decreases, and the flow rate Q3 of the washing water flowing into the bidet nozzle 2 from the washing water outlet 143*b* increases.

As described in the foregoing, the controller 4 controls the rotation angle of the motor 141 in the switching valve 14, thereby making it possible to control the flow rate of the washing water flowing out of the washing water outlets 143*b* to 143*e*. Further, whatever angle is the rotation angle of the motor 141 in the switching valve 14, any one of the washing water outlets 142*e*, 142*f*, and 142*g* or the chamfer (recess) around the washing water outlet is opposed to any one of the washing water outlets 143*b* to 143*e*. Accordingly, the flow path of the washing water is not closed, so that the washing water supplied from the washing water inlet 143*a* flows out of any one of the washing water outlets 143*b* to 143*e*.

Figure 12:
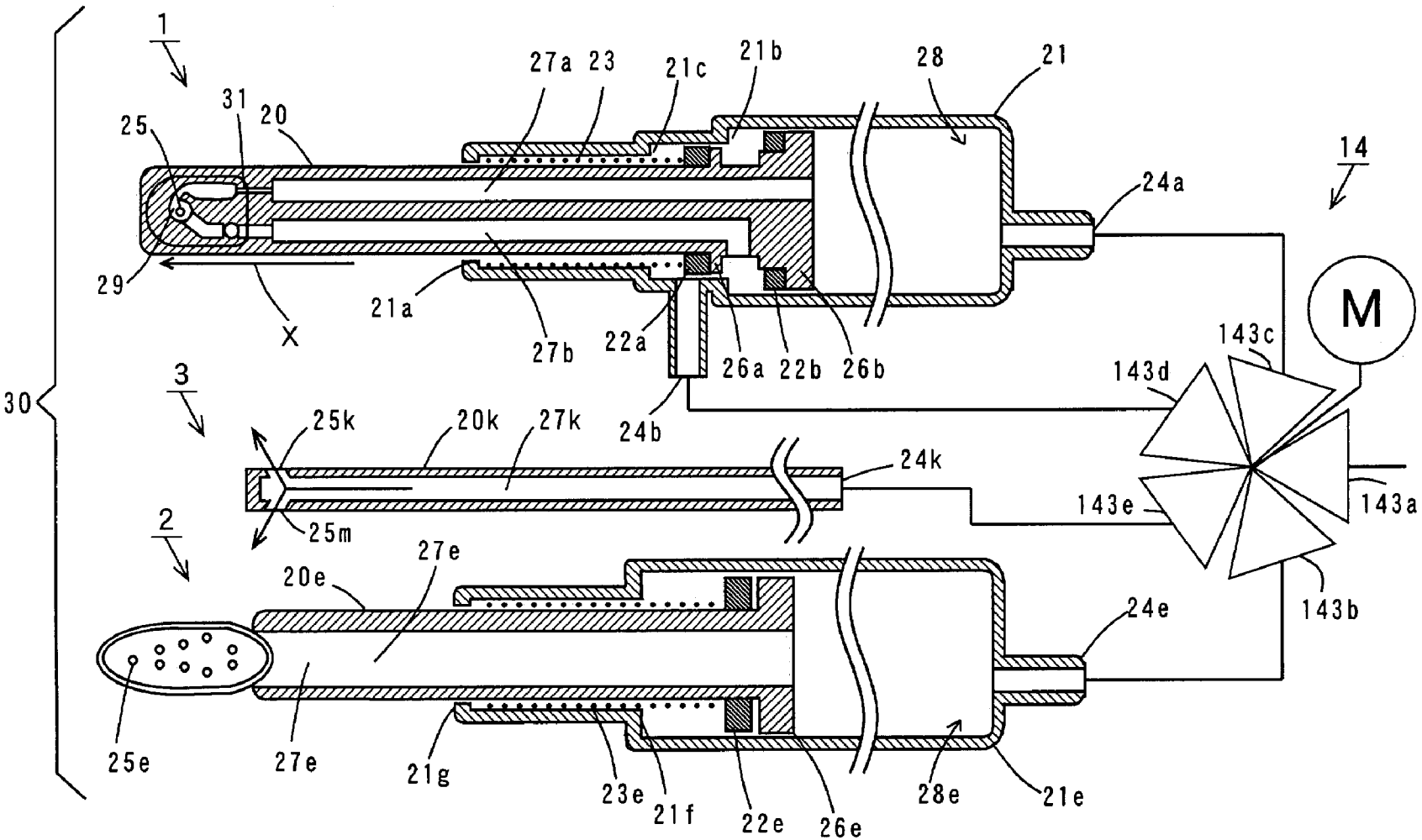
FIG. 12 is a schematic sectional view of a nozzle and a switching valve shown in FIG. 3.

The nozzle unit 30 shown in FIG. 3 will be then described. FIG. 12 is a schematic sectional view of the nozzle unit 30 and the switching valve 14 shown in FIG. 3.

As shown in FIG. 12, the washing water outlets 143*c* and 143*d* in the switching valve 14 are connected to the posterior nozzle 1, the washing water outlet 143*b* in the switching valve 14 is connected to the bidet nozzle 2, and the washing water outlet 143*e* in the switching valve 14 is connected to the nozzle cleaning nozzle 3.

The configuration of the posterior nozzle 1 will be first described, the configuration of the bidet nozzle 2 will be then described, and the configuration of the nozzle cleaning nozzle 3 will be finally described.

The posterior nozzle 1 comprises a cylindrical piston 20, a cylinder 21, seal packings 22*a* and 22*b*, and a spring 23.

A spray hole 25 for spraying washing water is formed in the vicinity of a front end of the piston 20. Flange-shaped stoppers 26*a* and 26*b* are provided at a rear end of the piston 20. Further, the seal packings 22*a* and 22*b* are respectively mounted on the stoppers 26*a* and 26*b*. Inside the piston 20, a first flow path 27*a* communicating with the spray hole 25 from a rear end surface of the piston 20 is formed, and a second flow path 27*b* communicating with the spray hole 25 from a peripheral surface of the piston 20 between the stopper 26*a* and the stopper 26*b* is formed. Further, a cylindrical swirl chamber 29 is formed around the spray hole 25, and a flow-contracting portion 31 is inserted between the first flow path 27*a* and the cylindrical swirl chamber 29.

On the other hand, the cylinder 21 comprises a small diameter portion at its front end, an intermediate portion having an intermediate diameter, and a large diameter portion at its rear end. Consequently, a stopper surface 21*c* against which the stopper 26*a* in the piston 20 can abut through the seal packing 22*a* is formed between the small diameter portion and the intermediate portion, and a stopper surface 21*b* against which the stopper 26*b* in the piston 20 can abut through the seal packing 22*b* is formed between the intermediate portion and the large diameter portion. A washing water inlet 24*a* is provided on a rear end surface of the cylinder 21, a washing water inlet 24*b* is provided on a peripheral surface of the intermediate portion of the cylinder 21, and an opening 21*a* is provided on a front end surface of the cylinder 21. An inner space of the cylinder 21 is a temperature fluctuation buffering space 28. The washing water inlet 24*a* is provided eccentrically at a position different from the central axis of the cylinder 21. The washing water inlet 24*a* is connected to the washing water outlet 143*c* in the switching valve 14, and the washing water inlet 24*b* is connected to the washing water outlet 143*d* in the switching valve 14. When the piston 20 projects most greatly from the cylinder 21, the washing water inlet 24*b* communicates with the second flow path 27*b*. The details of the connection of the washing water inlet 24*b* with the second flow path 27*b* will be described later.

The piston 20 is inserted into the cylinder 21 so as to be movable such that the stopper 26*b* is positioned in the temperature fluctuation buffering space 28, and the front end projects from the opening 21*a*.

Furthermore, the spring 23 is disposed between the stopper 26*a* in the piston 20 and a peripheral edge of the opening 21*a* in the cylinder 21, to urge the piston 20 toward the rear end of the cylinder 21.

A micro-clearance is formed between an outer peripheral surface of the stopper 26*a* or 26*b* in the piston 20 and an inner peripheral surface of the cylinder 21, and a micro-clearance is formed between an outer peripheral surface of the piston 20 and an inner peripheral surface of the opening 21*a* in the cylinder 21.

Then, the bidet nozzle 2 comprises a cylindrical piston 20*e*, a cylinder 21*e*, a seal packing 22*e*, and a spring 23*e*.

A spray hole 25*e* for spraying washing water is formed in the vicinity of the front end of the piston 20*e*. A flange-shaped stopper 26*e* is provided at a rear end of the piston 20*e*. Further, the seal packing 22*e* is mounted on the stopper 26*e*. A flow path 27*e* communicating with the spray hole 25*e* from a rear end surface of the piston 20*e* is formed in the piston 20*e*.

On the other hand, the cylinder 21*e* comprises a small diameter portion at its front end and a large diameter portion at its rear end. Consequently, a stopper surface 21*f* against which the stopper 26*e* in the piston 20*e* can abut through the seal packing 22*e* is formed between the small diameter portion and the large diameter portion. A washing water inlet 24*e* is provided on a rear end surface of the cylinder 21*e*, and an opening 21*g* is provided on the front end surface of the cylinder 21*e*. An inner space of the cylinder 21*e* is a temperature fluctuation buffering space 28*e*. The washing water inlet 24*e* is provided eccentrically at a position different from the central axis of the cylinder 21*e*. The washing water inlet 24*e* is connected to the washing water outlet 143*b* in the switching valve 14.

The piston 20*e* is inserted into the cylinder 21*e* so as to be movable such that the stopper 26*e* is positioned in the temperature fluctuation buffering space 28*e*, and the front end projects from the opening 21*g*.

Furthermore, the spring 23*e* is disposed between the stopper 26*e* in the piston 20*e* and a peripheral edge of the opening 21*g* in the cylinder 21*e*, to urge the piston 20*e* toward the rear end of the cylinder 21*e*.

A micro-clearance is formed between an outer peripheral surface of the stopper 26*e* in the piston 20*e* and an inner peripheral surface of the cylinder 21*e*, and a micro-clearance is formed between an outer peripheral surface of the piston 20*e* and an inner peripheral surface of the opening 21*g* in the cylinder 21*e*.

Then, the nozzle cleaning nozzle 3 is composed of a cylindrical sprayer 20*k*. A spray hole 25*k* for spraying washing water toward the posterior nozzle 1 and a spray hole 25*m* for spraying washing water toward the bidet nozzle 2 are respectively formed in the vicinity of a front end of the piston 20*k*. A washing water inlet 24*k* is provided at a rear end of the sprayer 20*k*. A flow path 27*k* communicating with the spray hole 25*k* and the spray hole 25*m* from the washing water inlet 24*k* provided at the rear end of the sprayer 20*k* is formed. The washing water inlet 24*k* is connected to the washing water outlet 143*e* in the switching valve 14.

Consequently, the washing water supplied from the washing water outlet 143*e* in the switching valve 14 is sprayed from the spray hole 25*k* and the spray hole 25*m* after passing through the washing water inlet 24*k* in the sprayer 20*k* and the flow path 27*k* in the nozzle cleaning nozzle 3. The posterior nozzle 1 and the bidet nozzle 2 are respectively cleaned by the washing water sprayed from the spray hole 25*k* and the washing water sprayed from the spray hole 25*m*.

Figure 13:
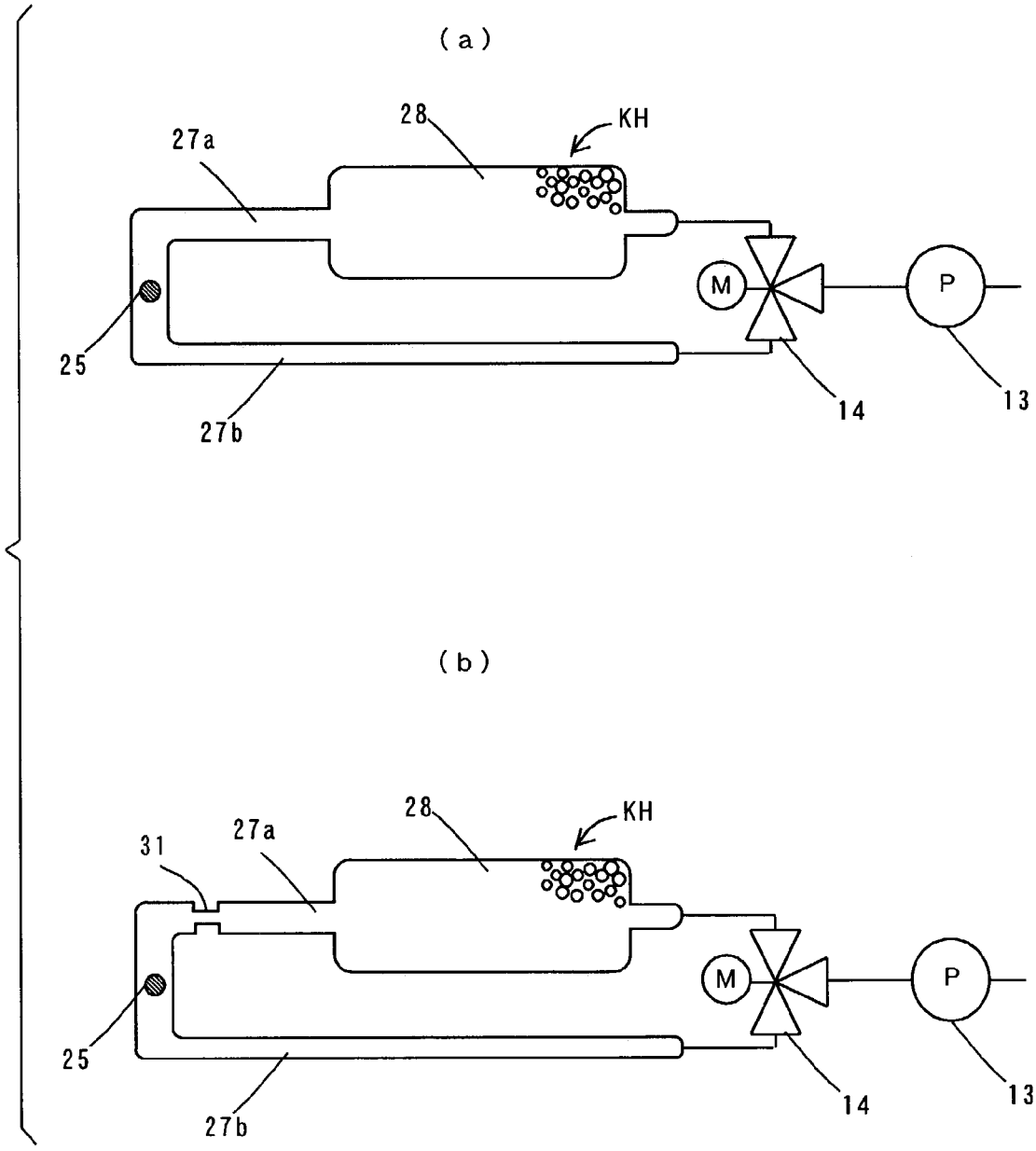
FIG. 13 is a diagram for explaining the function of a flow-contracting portion in the posterior nozzle shown in FIG. 12.

FIG. 13(*a*) is a schematic view showing the posterior nozzle 1, shown in FIG. 12, having no flow-contracting portion 31. FIG. 13(*b*) is a schematic view showing the posterior nozzle 1 shown in FIG. 12.

As shown in FIGS. 13(*a*) and 13(*b*), washing water heated by the heat exchanger 11 is supplied to the first flow path 27*a* and the second flow path 27*b* through the pump 13 and the switching valve 14. In this case, the washing water is instantaneously heated by the heat exchanger 11, and dissolved air included in the washing water is stored as bubbles KH in the temperature fluctuation buffering space 28. Alternatively, air in the pipe is stored as bubbles KH in the temperature fluctuation buffering space 28. The bubbles KH are a compressed fluid, and contract if pressure is applied thereto.

In the case of the posterior nozzle 1 having no flow-contracting portion 31 shown in FIG. 13(*a*), therefore, the pressure of the washing water supplied from the second flow path 27*b* is transmitted to the first flow path 27*a* through the cylindrical swirl chamber 29. As a result, the pressure transmitted to the first flow path 27*a* is transmitted to the temperature fluctuation buffering space 28, and the bubbles KH stored in the temperature fluctuation buffering space 28 contract so that the pressure is buffered.

On the other hand, in the case of the posterior nozzle 1 having a flow-contracting portion 31 shown in FIG. 13(*a*), the pressure of the washing water supplied from the second flow path 27*b* is not transmitted to the first flow path 27*a* through the cylindrical swirl chamber 29 by the function of the flow-contracting portion 31. That is, even when the internal pressure of the second flow path 27*b* rises, the pressure on the side of the first flow path 27*a* is kept higher than the internal pressure of the second flow path 27*b* by the function of the flow-contracting portion 31 provided in the first flow path 27*a*. Therefore, the washing water inside the second flow path 27*b* is unaffected by the bubble KH stored in the temperature fluctuation buffering space 28. Further, the flow-contracting portion 31 is a resistance component to fluid movement caused by buffering of the pressure in the first flow path 27*a* and the second flow path 27*b*. Therefore, the flow-contracting portion 31 can reduce the transmission speed of the pressure of the washing water and reduce the buffering of the pressure of the washing water in the first flow path 27*a* and the second flow path 27*b*.

Figure 14:
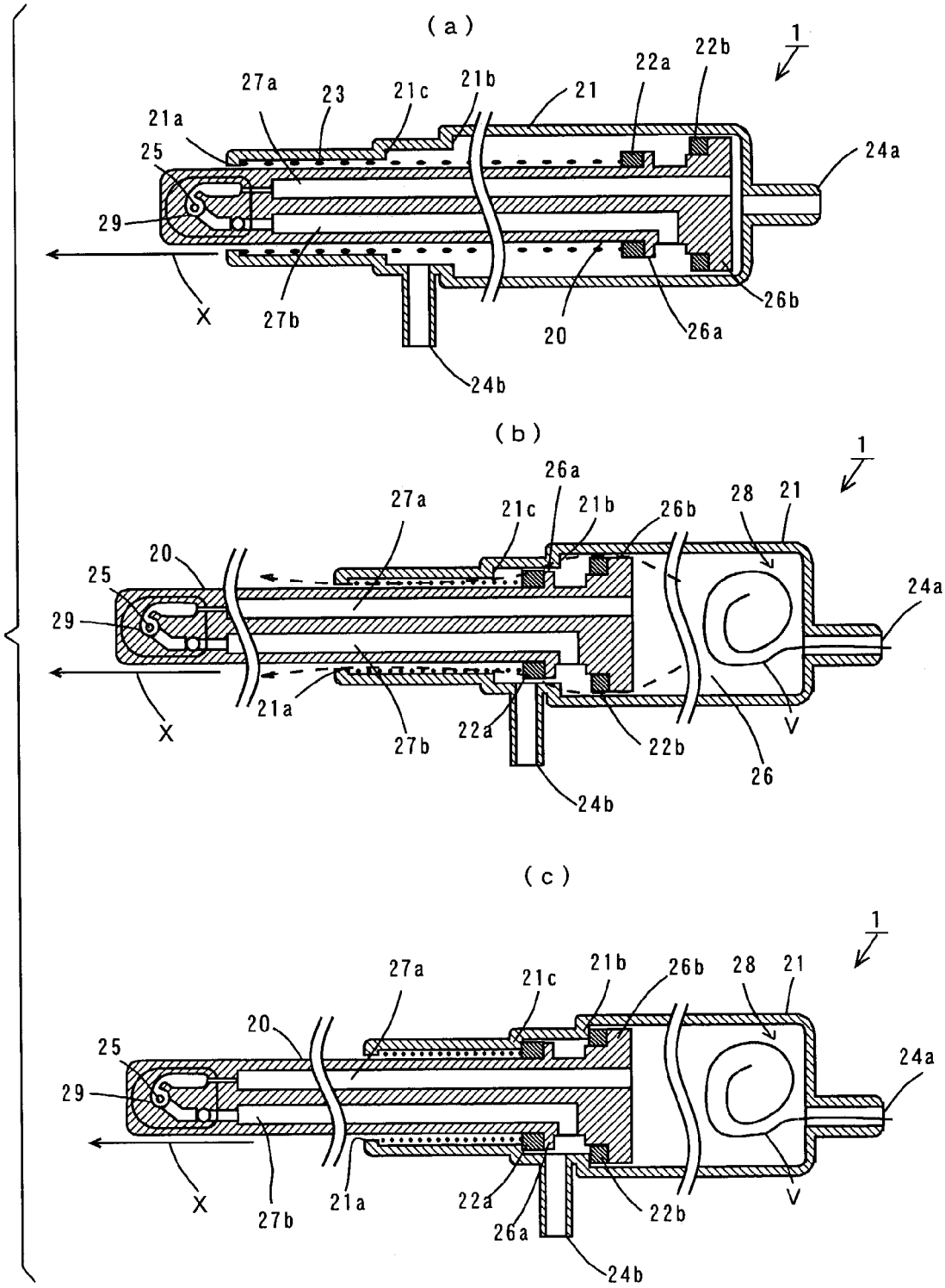
FIG. 14 is a cross-sectional view for explaining the operations of the posterior nozzle shown in FIG. 12.

Description is now made of the operations of the posterior nozzle 1 and the bidet nozzle 2 shown in FIG. 12. The operations of the posterior nozzle 1 will be first described, and the operations of the bidet nozzle 2 will be then described. FIG. 14 is a cross-sectional view for explaining the operations of the posterior nozzle 1 shown in FIG. 12.

When no washing water is supplied from the washing water inlets 24*a* and 24*b* in the cylinder 21, as shown in FIG. 14(*a*), the piston 20 retreats in the opposite direction to a direction indicated by an arrow X by the elastic force of the spring 23, and is accommodated in the cylinder 21. As a result, the piston 20 enters a state where it does not project most greatly from the opening 21*a* in the cylinder 21. At this time, the temperature fluctuation buffering space 28 is not formed in the cylinder 21.

When the supply of washing water from the washing water inlet 24*a* in the cylinder 21 is then started, as shown in FIG. 14(*b*), the piston 20 gradually advances in the direction indicated by the arrow X against the elastic force of the spring 23 by the pressure of the washing water. Consequently, the temperature fluctuation buffering space 28 is formed in the cylinder 21, and the washing water flows into the temperature fluctuation buffering space 28.

Since the washing water inlet 24*a* is provided at a position eccentric from the central axis of the cylinder 21, the washing water flowing into the temperature fluctuation buffering space 28 flows in a swirling state, as indicated by an arrow V. A part of the washing water in the temperature fluctuation buffering space 28 flows out of the micro-clearance between the outer peripheral surface of the piston 20 and the inner peripheral surface of the opening 21*a* in the cylinder 21 through the micro-clearance between the outer peripheral surface of the stopper 26*a* or 26*b* in the piston 20 and the inner peripheral surface of the cylinder 21, and is supplied to the cylindrical swirl chamber 29 through the first flow path 27*a* in the piston 20, to be slightly sprayed from the spray hole 25. The details of the cylindrical swirl chamber 29 will be described later.

When the piston 20 further advances, the stoppers 26*a* and 26*b* are respectively brought into watertight contact with the stopper surfaces 21*c* and 21*b* in the cylinder 21 through the seal packings 22*a* and 22*b*, as shown in FIG. 14(*c*). Consequently, a flow path leading from the micro-clearance between the outer peripheral surface of the stopper 26*a* or 26*b* in the piston 20 and the inner peripheral surface of the cylinder 21 to the micro-clearance between the outer peripheral surface of the piston 20 and the inner peripheral surface of the opening 21*a* in the cylinder 21 is blocked off. Further, the washing water supplied from the washing water inlet 26*b* is supplied to the cylindrical swirl chamber 29 through the second flow path 27*b* in the piston 20. Consequently, the washing water supplied to the cylindrical swirl chamber 29 through the second flow path 27*b* in the piston 20 is mixed with the washing water supplied thereto through the first flow path 27*a* in the piston 20, and obtained mixed flow is sprayed from the spray hole 25.

The washing water supplied from the washing water outlets 143*c* and 143*d* in the switching valve 14 is thus introduced into the cylindrical swirl chamber 29 after passing through the washing water inlets 24*a* and 24*b* in the cylinder 21 and the first flow path 27*a* and the second flow path 27*b* in the piston 20, and is sprayed from the spray hole 25 through the cylindrical swirl chamber 29.

Figure 15:
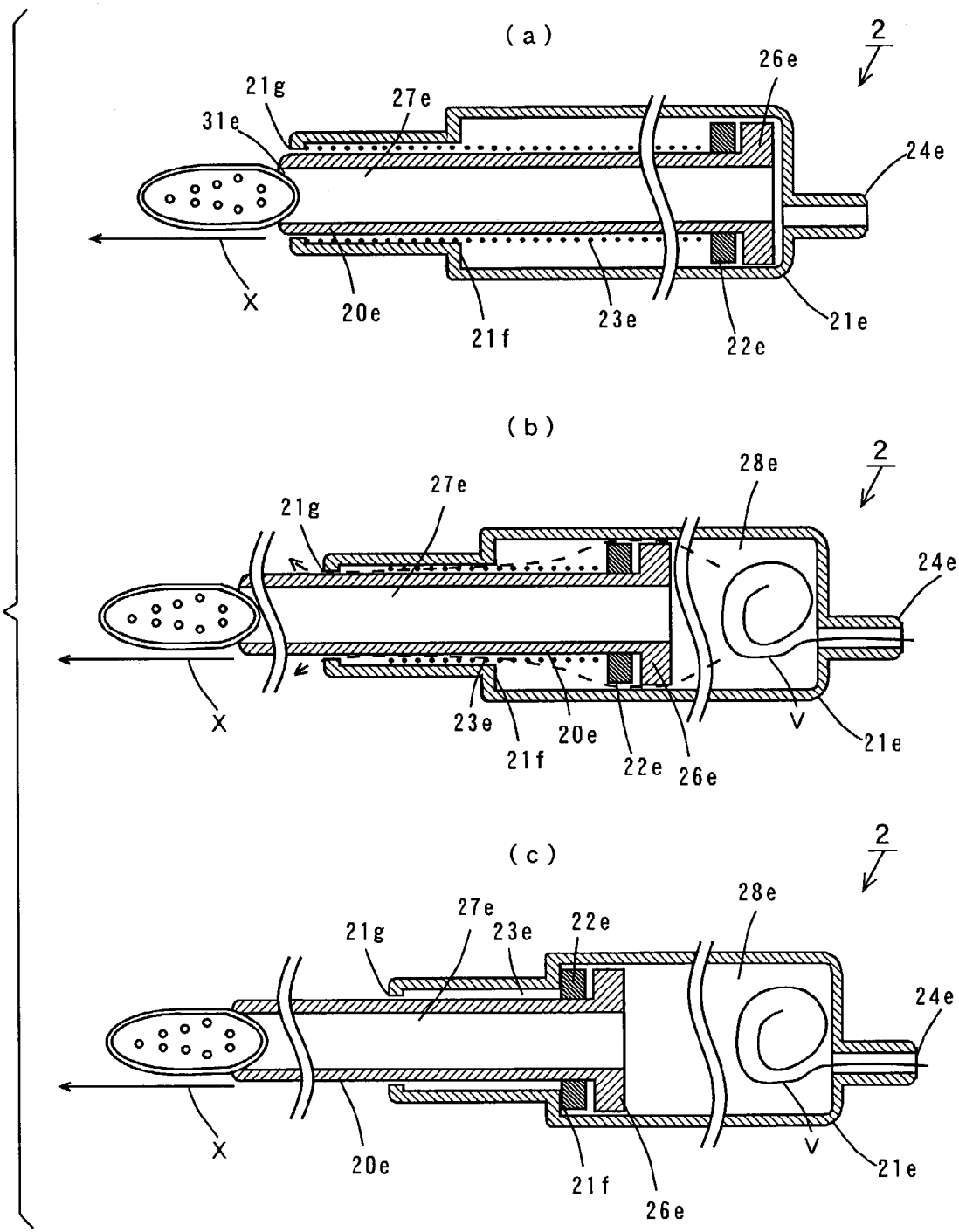
FIG. 15 is a cross-sectional view for explaining the operations of the bidet nozzle shown in FIG. 12.

Description is then made of the operations of the bidet nozzle 2 shown in FIG. 12. FIG. 15 is a cross-sectional view for explaining the operations of the bidet nozzle 2 shown in FIG. 12.

First, when no washing water is supplied from the washing water inlet 24*e* in the cylinder 21*e*, as shown in FIG. 15(*a*), the piston 20*e* retreats in the opposite direction to a direction indicated by an arrow X by the elastic force of the spring 23*e*, and is accommodated in the cylinder 21*e*. As a result, the piston 20 enters a state where it does not project most greatly from the opening 21*g* in the cylinder 21*e*. At this time, the temperature fluctuation buffering space 28*e* is not formed in the cylinder 21*e*.

When the supply of the washing water from the washing water inlet 24*e* in the cylinder 21*e* is then started, as shown in FIG. 15(*b*), the piston 20*e* gradually advances in the direction indicated by the arrow X against the elastic force of the spring 23*e* by the pressure of the washing water. Consequently, the temperature fluctuation buffering space 28*e* is formed in the cylinder 21*e*, and the washing water flows into the temperature fluctuation buffering space 28*e*.

Since the washing water inlet 24*e* is provided at a position eccentric from the central axis of the cylinder 21*e*, the washing water flowing into the temperature fluctuation buffering space 28*e* flows in a swirling state, as indicated by an arrow V. A part of the washing water in the temperature fluctuation buffering space 28*e* flows out of the micro-clearance between the outer peripheral surface of the piston 20*e* and the inner peripheral surface of the opening 21*g* in the cylinder 21*e* through the micro-clearance between the outer peripheral surface of the stopper 26*e* in the piston 20*e* and the inner peripheral surface of the cylinder 21*e*, and is slightly sprayed from the spray hole 25*e* through the flow path 27*e* in the piston 20*e*.

When the piston 20*e* further advances, the stopper 26*e* is brought into watertight contact with the stopper surface 21*f* in the cylinder 21*e* through the seal packing 22*e*, as shown in FIG. 15(*c*). Consequently, a flow path leading from the micro-clearance between the outer peripheral surface of the stopper 26*e* in the piston 20*e* and the inner peripheral surface of the cylinder 21*e* to the micro-clearance between the outer peripheral surface of the piston 20*e* and the inner peripheral surface of the opening 21*g* in the cylinder 21*e* is blocked off. Consequently, the washing water is sprayed from the spray hole 25*e* through the flow path 27*e* in the piston 20*e*.

The washing water supplied from the washing water outlet 143*b* in the switching valve 14 is thus sprayed from the spray hole 25*e* after passing through the washing water inlet 24*e* in the cylinder 21*e* and the flow path 27*e* in the piston 20*e*.

Figure 16:
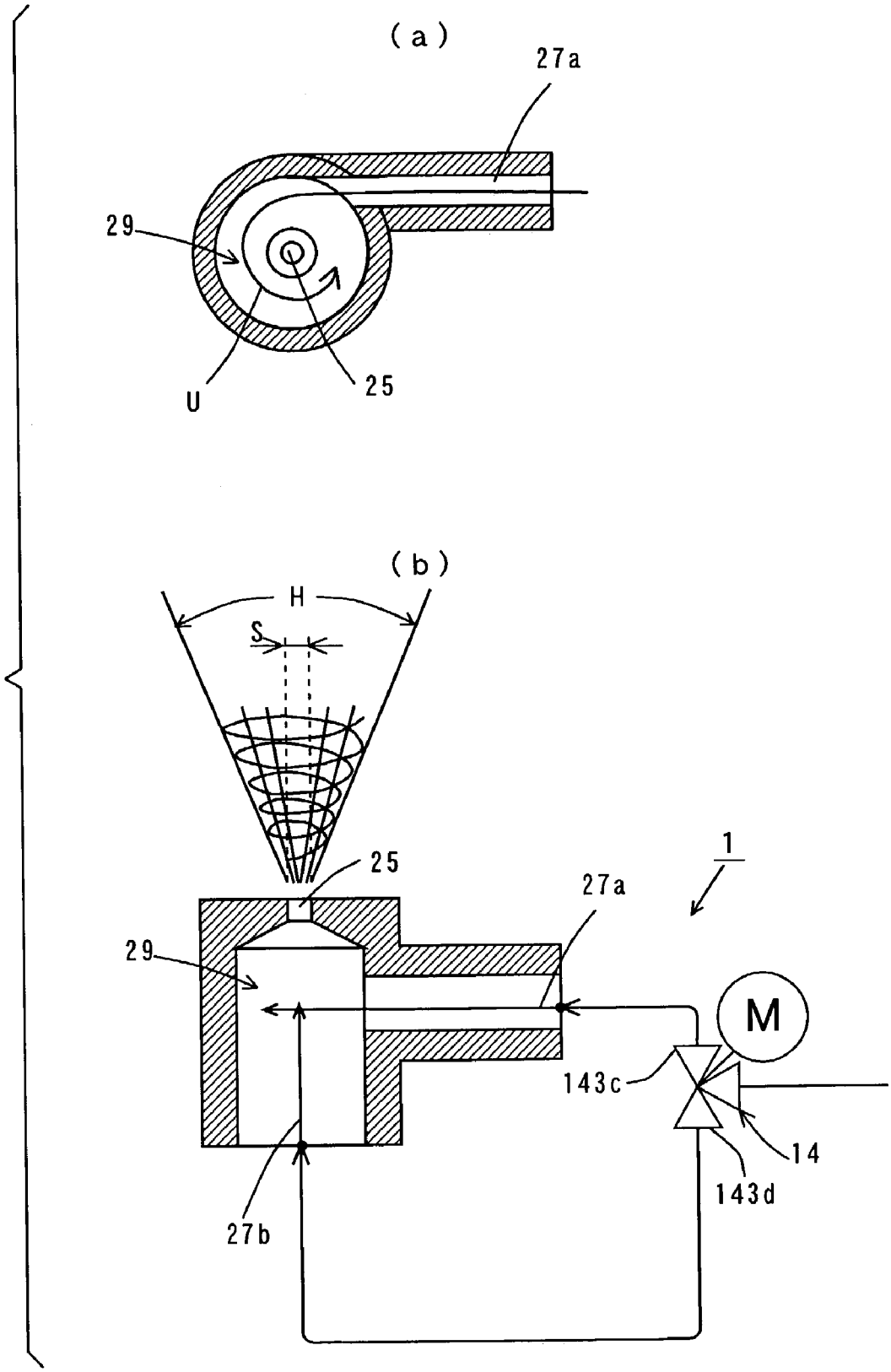
FIG. 16 is a schematic view of a front end of a piston in the posterior nozzle shown in FIG. 12.

FIG. 16 is a schematic view of the front end of the piston 20 in the posterior nozzle 1 shown in FIG. 12. FIG. 16(*a*) illustrates a case where the front end of the piston 20 is viewed from the top, and FIG. 16(*b*) illustrates a case where the front end of the piston 20 is viewed from the side.

As shown in FIG. 16(*a*), the first flow path 27*a* is first connected to a peripheral surface of the cylindrical swirl chamber 29, and the second flow path 27*b* is connected to a bottom surface of the cylindrical swirl chamber 29. The washing water from the washing water outlets 143*c* and 143*d* in the switching valve 14 is supplied to the first flow path 27*a* and the second flow path 27*b*.

As shown in FIG. 16(*a*), the washing water supplied to the cylindrical swirl chamber 29 from the first flow path 27*a* flows in a swirling state indicated by an arrow U by a curved shape of the inner peripheral surface of the cylindrical swirl chamber 29. On the other hand, the washing water supplied to the cylindrical swirl chamber 29 from the second flow path 27*b* flows in a linear state vertically upward.

The washing water in the swirling state from the first flow path 27*a* and the washing water in the linear state from the second flow path 27*b* are mixed with each other in the cylindrical swirl chamber 29, and obtained mixed washing water is sprayed from the spray hole 25.

When the flow rate of the washing water supplied from the first flow path 27*a* is higher than the flow rate of the washing water supplied from the second flow path 27*b*, for example, the washing water to be mixed in the cylindrical swirl chamber 29 is sprayed as dispersed spiral flow at a wider angle indicated by an arrow H in FIG. 16(*b*) in order to strongly maintain the swirling state caused by the curved shape of the cylindrical swirl chamber 29. On the other hand, when the flow rate of the washing water supplied from the second flow path 27*b* is higher than the flow rate of the washing water supplied from the first flow path 27*a*, the washing water to be mixed in the cylindrical swirl chamber 29 is sprayed as linear flow at a narrow angle indicated by an arrow S shown in FIG. 16(*b*) in order to strongly maintain the linear state.

Consequently, the controller 4 controls the motor 141 in the switching valve 14 to change the ratio of the respective flow rates at the washing water outlets 143*c* and 143*d*, so that the spray form of the washing water sprayed from the spray hole 25 is changed.

Although in the present embodiment, the washing area adjustment switch 302*f* is pressed after the posterior switch 303 is pressed, the flow rate of the washing water at the washing water outlet 143*d* is higher than the flow rate of the washing water at the washing water outlet 143*c*, so that the spray form of the washing water approaches linear flow. Consequently, the divergent angle of the washing water is decreased. When the washing area adjustment switch 302*e* is pressed after the posterior switch 303 is pressed, the flow rate of the washing water at the washing water outlet 143*c* is higher than the flow rate of the washing water at the washing water outlet 143*d*, so that the spray form of the washing water approaches dispersed spiral flow. Consequently, the divergent angle of the washing water is increased.

When the washing area adjustment switch 302*dd* having a low value is pressed after the posterior switch 303 is pressed, the flow rate of the washing water at the washing water outlet 143*d* is higher than the flow rate of the washing water at the washing water outlet 143*c*, so that the spray form of the washing water approaches linear flow. Consequently, the divergent angle of the washing water is decreased. When the washing area adjustment switch 302*dd* having a high value is pressed after the posterior switch 303 is pressed, the flow rate of the washing water at the washing water outlet 143*c* is higher than the flow rate of the washing water at the washing water outlet 143*d*, so that the spray form of the washing water approaches dispersed spiral flow. Consequently, the divergent angle of the washing water is increased.

Figure 17:
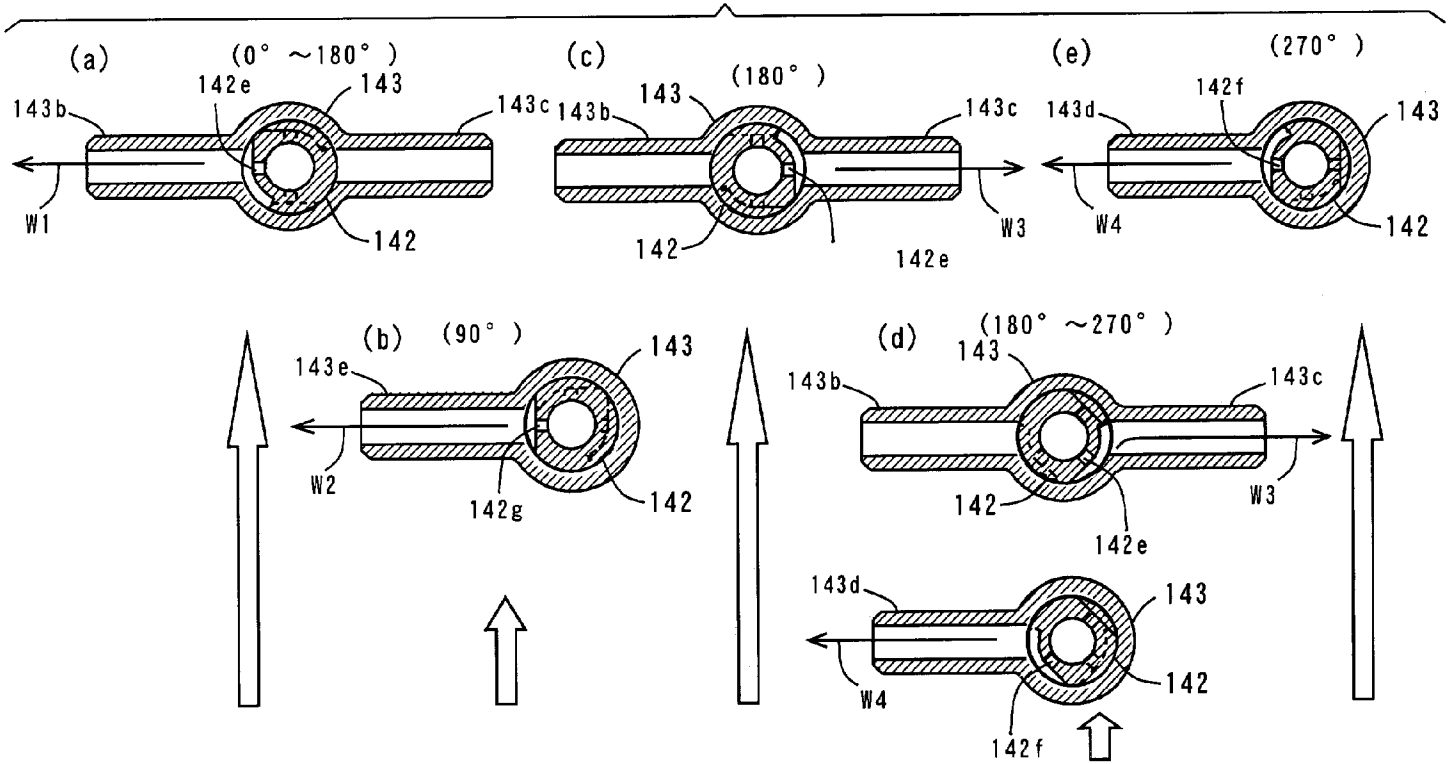
FIG. 17 is a diagram for explaining the relationship among the rotation angle of a switching valve, the driving state of a pump, and a nozzle for spraying washing water.

FIGS. 17(*a*) to 17(*e*) are diagrams for explaining the relationship among the rotation angle of the switching valve 14, the driving state of the pump 13, and the nozzle for spraying the washing water according to the first embodiment.

FIGS. 17(*a*) to 17(*e*) respectively illustrate states where the switching valve 14 is respectively rotated through angles of zero, 90 degrees, 180 degrees, 225 degrees, and 270 degrees.

First, when the switching valve 14 is not rotated (rotated through an angle of zero), the driving state of the pump 13 is on. Accordingly, the washing water flows out of the washing water outlet 143*b*, as indicated by an arrow W1 in FIG. 17(*a*), to be sprayed from the bidet nozzle 2 shown in FIG. 12.

While the switching valve 14 is then rotated through zero to 90 degrees, the driving state of the pump 13 is on. Accordingly, no washing water flows out.

When the switching valve 14 is then rotated through 90 degrees, the driving state of the pump 13 is on. Accordingly, the washing water flows out of the washing water outlet 143*e*, as indicated by an arrow W2 in FIG. 17(*b*), to be sprayed from the nozzle cleaning nozzle 3 shown in FIG. 12.

While the switching valve 14 is then rotated through 90 degrees to 180 degrees, the driving state of the pump 13 is on. Accordingly, no washing water flows out.

When the switching valve 14 is then rotated through 180 degrees, the driving state of the pump 13 is on. Accordingly, the washing water flows out of the washing water outlet 143*c*, as indicated by an arrow W3 in FIG. 17(*c*), to be sprayed from the posterior nozzle 1 shown in FIG. 12. In this case, the washing water is sprayed as dispersed spiral flow, as indicated in FIG. 16(*b*).

While the switching valve 14 is then rotated through 180 degrees to 270 degrees, the driving state of the pump 13 is on. Accordingly, the washing water flows out of the washing water outlets 143*c* and 143*d*, respectively, as indicated by arrows W3 and W4 in FIG. 17(*a*), to be sprayed from the posterior nozzle 1. In this case, the ratio of the respective flow rates of the washing water flowing out of the washing water outlet 143*c* and the washing water flowing out of the washing water outlet 143*d* is changed, so that the spray form of the washing water approaches linear flow from dispersed spiral flow, as described in FIG. 16(*b*).

When the switching valve 14 is then rotated through 270 degrees, the driving state of the pump 13 is on. Accordingly, the washing water flows out of only the washing water outlet 143*d*, as indicated by an arrow W4 in FIG. 17(*e*). Accordingly, the washing water is sprayed as linear flow, as described in FIG. 16(*b*).

Figure 18:
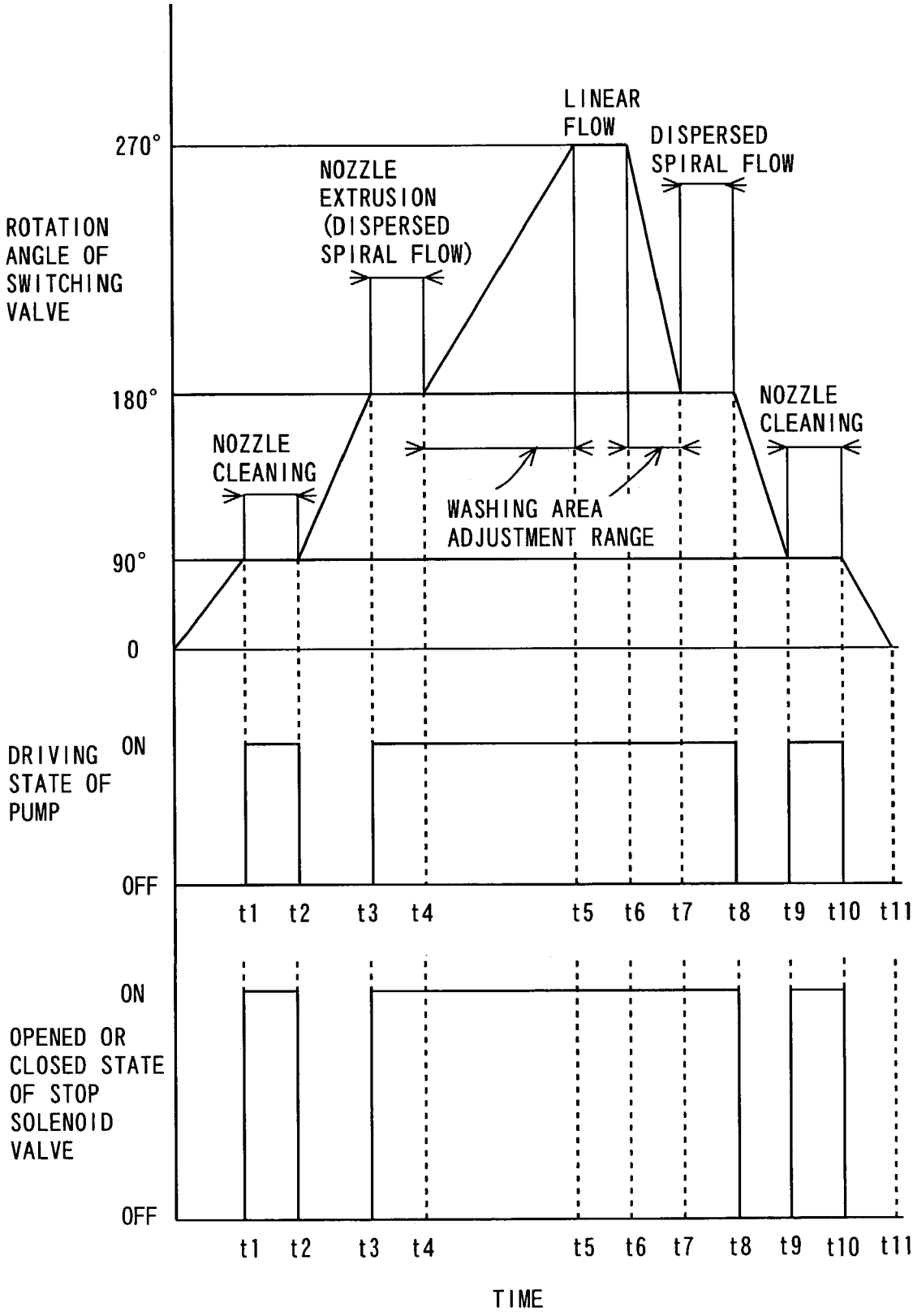
FIG. 18 is a diagram showing an example of the operations of a sanitary washing apparatus based on the operations of a remote control device.

FIG. 18 is a graph showing an example of the operations of the sanitary washing apparatus 100. In FIG. 18, the vertical axis indicates the rotation angle of the switching valve 14, the driving state of the pump 13, and the opened or closed state of the stop solenoid valve 9, and the horizontal axis indicates time.

First, when the posterior switch 303 in the remote control device 300 is pressed, the switching valve 14 is rotated through zero to 90 degrees, to be stopped at a time point t1. At the time point t1, the stop solenoid valve 9 is opened, and the driving state of the pump 13 is turned on. Accordingly, the washing water is sprayed from the nozzle cleaning nozzle 3, and the posterior nozzle 1 and the bidet nozzle 2 are cleaned until a time point t2. The switching valve 14 is then rotated through 90 degrees to 180 degrees, to be stopped at a time point t3. Between the time point t2 and the time point t3, the stop solenoid valve 9 is closed, and the driving state of the pump 13 is off. At the time point t3, the stop solenoid valve 9 is opened, and the driving state of the pump 13 is turned on. Accordingly, the washing water is sprayed from the posterior nozzle 1. In this case, the washing water is sprayed as dispersed spiral flow, as described in FIG. 16.

When the washing area adjustment switch 302*e* in the remote control device 300 is then pressed at a time point t4, the switching valve 14 is rotated through 180 degrees to 270 degrees, to be stopped at a time point t5. Between the time point t4 and the time point t5, the rotation angle of the switching valve 14 is changed from 180 degrees to 270 degrees. Accordingly, the spray form is changed from dispersed spiral flow to linear flow, as described in FIG. 16. Correspondingly, the divergent angle of the washing water is changed, so that the washing area is changed.

When the washing area adjustment switch 302*f* in the remote control device 300 is then pressed at a time point t6, the switching valve 14 is rotated in the opposite direction and is rotated through 270 degrees to 180 degrees, to be stopped at a time point t7. Between the time point t6 and the time point t7, the spray form is changed from linear flow to dispersed spiral flow. Correspondingly, the divergent angle of the washing water is changed, so that the washing area is changed. As apparent from the graph shown in FIG. 18, the speed at which the switching valve 14 is rotated through 180 degrees to 270 degrees and the speed at which it is rotated through 270 degrees to 180 degrees differ from each other. The details thereof will be described later.

When the stop switch 305 in the remote control device 300 is then pressed at a time point t8, the switching valve 14 is rotated through 180 degrees to 90 degrees, to be stopped at a time point t9. Between the time point t8 and the time point t9, the stop solenoid valve 9 is closed, and the driving state of the pump 13 is off. Accordingly, no washing water is sprayed. At the time point t9, the stop solenoid valve 9 is opened, and the driving state of the pump 13 is turned on. Accordingly, the washing water is sprayed from the nozzle cleaning nozzle 3, thereby cleaning the posterior nozzle 1 and the bidet nozzle 2. At a time point t10, the switching valve 14 is rotated through 90 degrees to zero, to be stopped at a time point t11. Between the time point t10 and the time point t11, the stop solenoid valve 9 is closed, and the driving state of the pump 13 is off. Accordingly, no washing water is sprayed.

Figure 19:
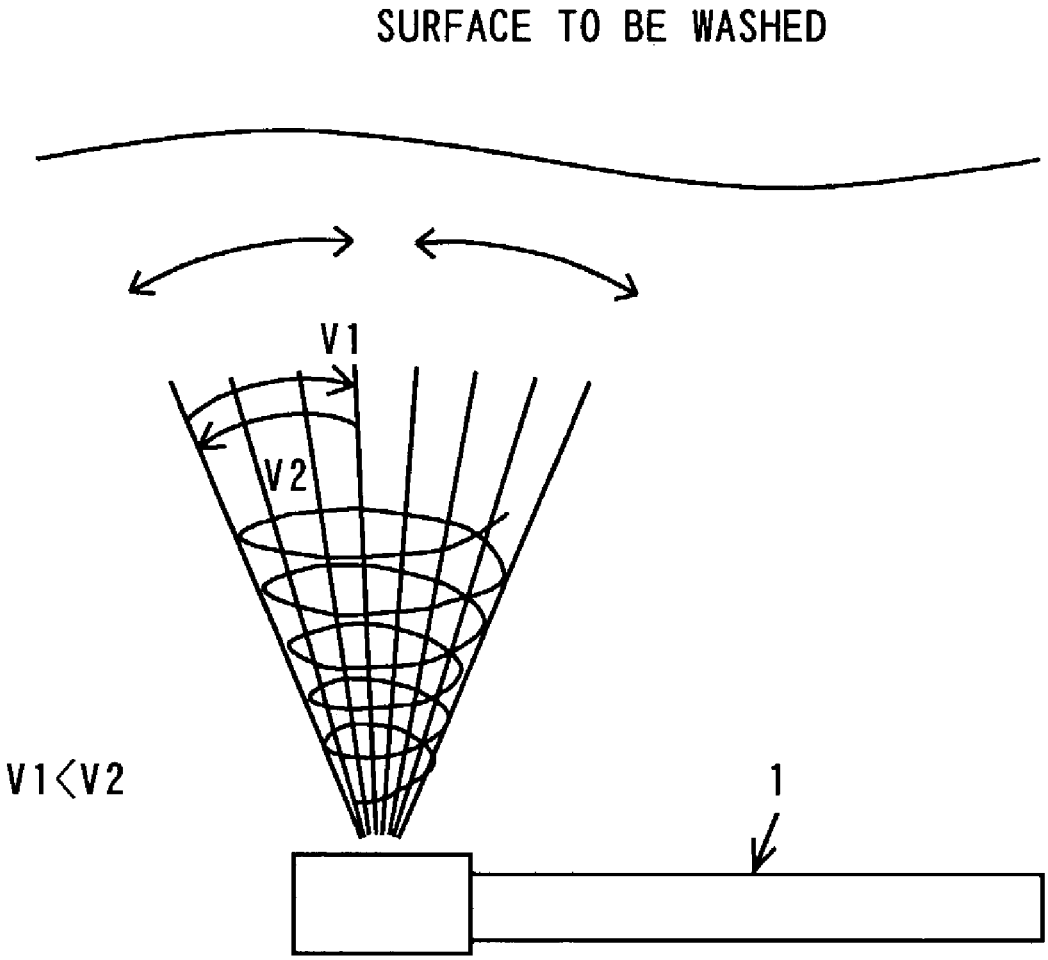
FIG. 19 is a schematic view showing the change in the spray form of washing water sprayed from a posterior nozzle.

FIG. 19 is a schematic view showing the change in the spray form of washing water sprayed from the posterior nozzle 1.

As shown in FIG. 19, let V1 be the change speed of the divergent angle of the washing water in a case where the divergent angle is reduced (hereinafter referred to as reduction speed), and V2 be the change speed of the divergent angle of the washing water in a case where the divergent angle is enlarged (hereinafter referred to as an enlargement speed). As shown in FIG. 19, the rotation speed of the motor 141 shown in FIG. 9 is controlled such that the reduction speed V1 is smaller than the enlargement speed V2. In the graph shown in FIG. 18, therefore, a time period during which the rotation angle of the switching valve 14 is changed from 270 degrees to 180 degrees is smaller than a time period during which the rotation angle of the switching valve 14 is changed from 180 degrees to 270 degrees. That is, the speed at which the washing area is increased is set to a value lower than the speed at which it is decreased.

When the area change switch 311 in the remote control device 300 is pressed, the divergent angle of the washing water is repeatedly enlarged and reduced automatically. At this time, the reduction speed is smaller than the enlargement speed. As a result, the washing water functions to remove dirt inward from the outside, thereby making it possible to prevent the dirt from being scattered toward the outer periphery.

Figure 20:
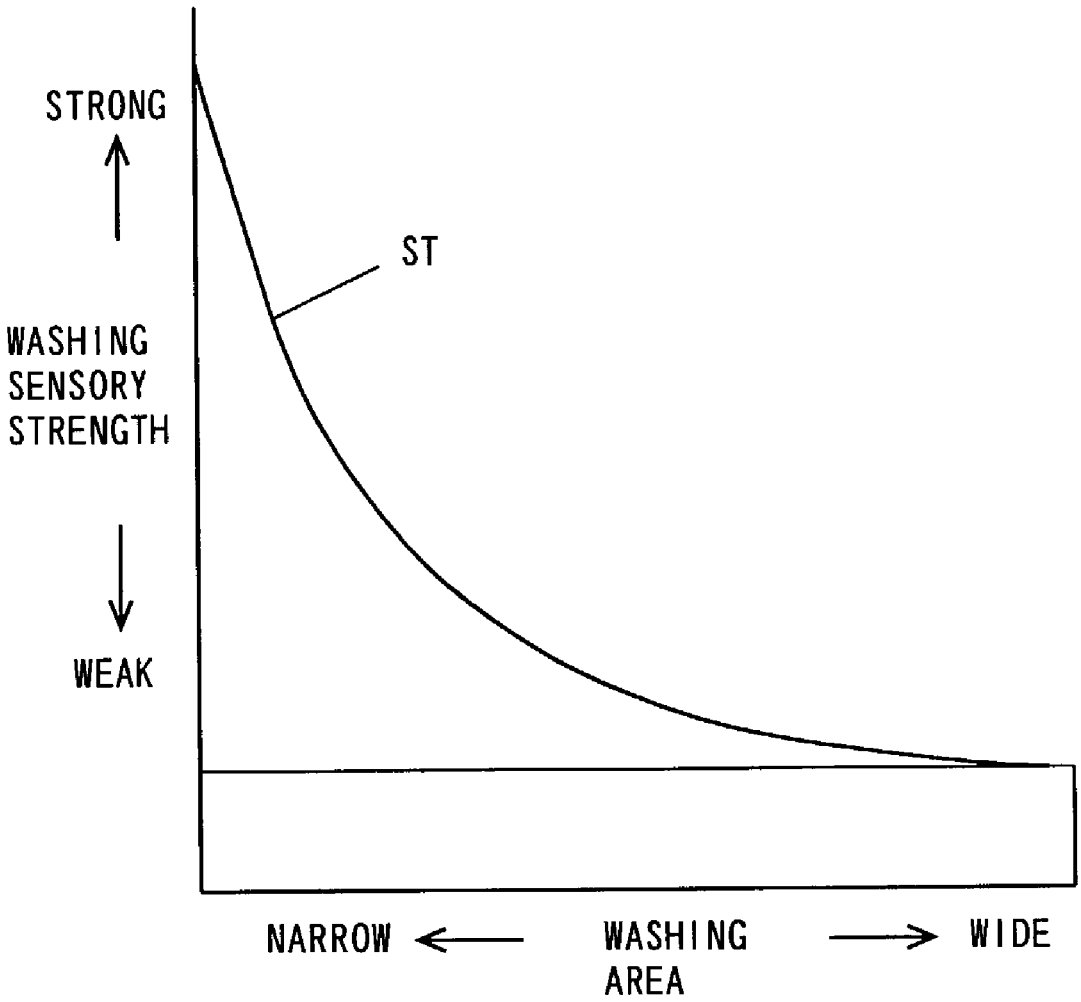
FIG. 20 is a diagram showing the washing sensory strength against the washing area in a case where the flow rate of washing water is fixed.

FIG. 20 is a graph of washing sensory strength against a washing area in a case where the flow rate of washing water is fixed. The vertical axis indicates the washing sensory strength, and the horizontal axis indicates the washing area by washing water sprayed from the posterior nozzle 1. As shown in a curved line ST in FIG. 20, the washing sensory strength is decreased when the washing area is increased, while being increased when the washing area is decreased. Consequently, the washing sensory strength can be changed by changing the washing area.

Figure 21:
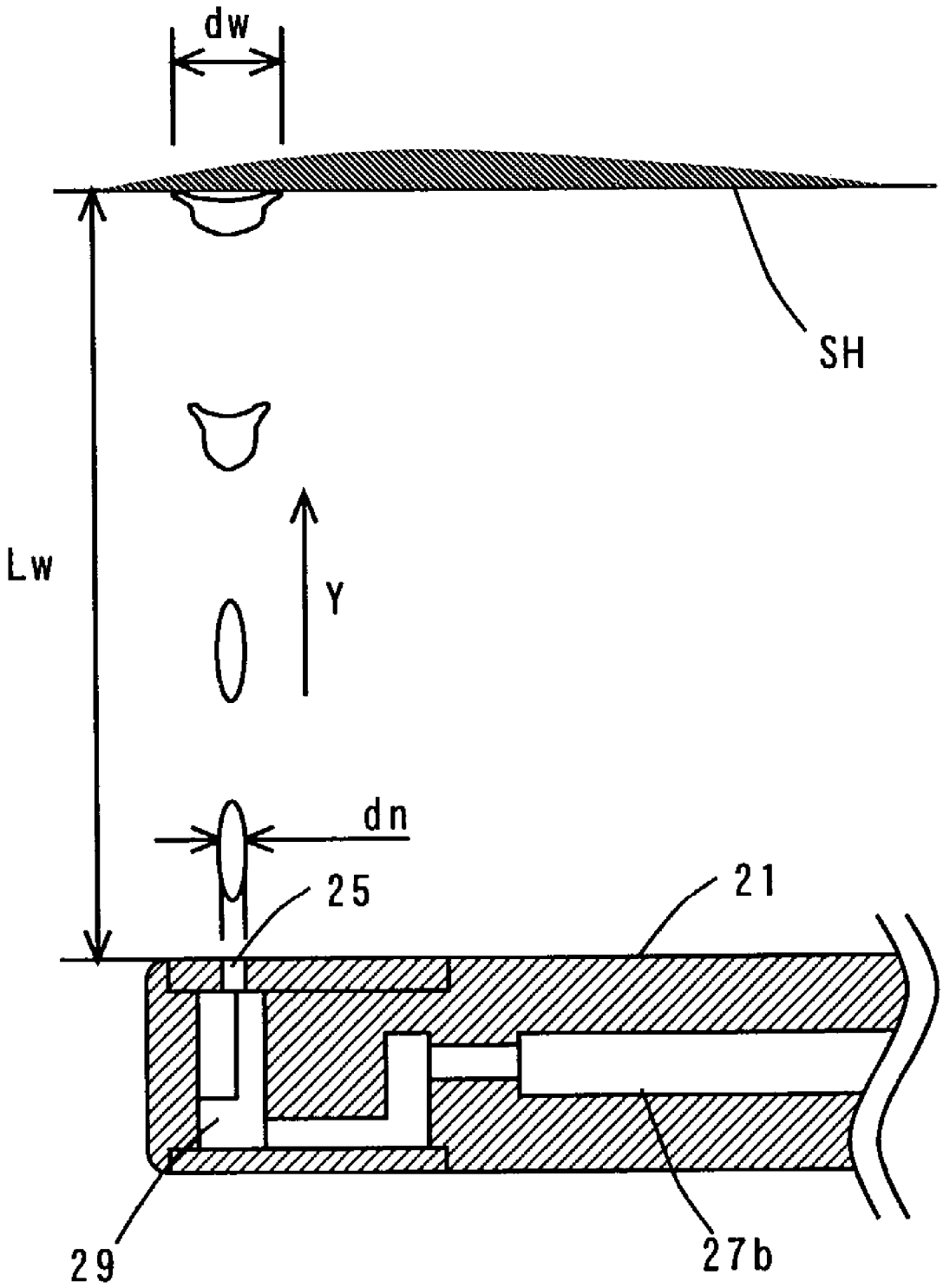
FIG. 21 is a diagram for explaining washing water sprayed from a spray hole 25 in the posterior nozzle 1 in the present embodiment.

FIG. 21 is a diagram for explaining washing water sprayed from the spray hole 25 in the posterior nozzle 1 in the first embodiment.

As shown in FIG. 21, round washing water grained by surface tension and having a diameter of dn is sprayed from the spray hole 25 in the posterior nozzle 1. Further, the washing water having a diameter dn is sprayed onto a surface to be washed SH at a velocity of flow Y by the pressure in the pump 13.

In this case, the round grained washing water expands in the horizontal direction by the function of air resistance until it reaches the surface to be washed SH at a distance Lw from the spray hole 25 in the posterior nozzle 1. Consequently, the round grained washing water having a diameter of dn is changed into flat grained washing water having a diameter of dw larger than the diameter dn. As a result, the human body receives the washing water having a diameter of dw on the surface to be washed SH irrespective of the fact that a small amount of washing water is sprayed from the spray hole 25, thereby making it possible to obtain such a washing feeling that a large amount of washing water is sprayed.

Figure 22:
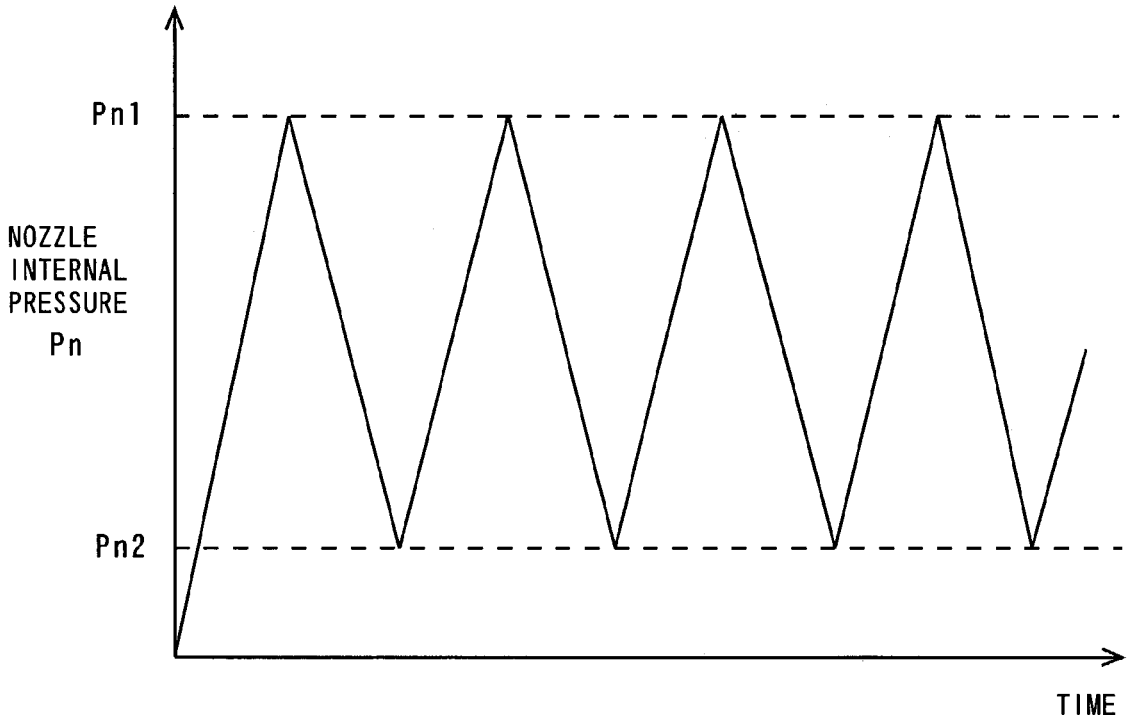
FIG. 22 is a diagram showing the internal pressure of the posterior nozzle 1 against time.

FIG. 22 is a diagram showing the change in nozzle internal pressure caused by intermittently pressurizing and discharging washing water by the pump 13. The vertical axis indicates the nozzle internal pressure of the washing water, and the horizontal axis indicates time. The washing water is sprayed, as shown in FIG. 21, when the nozzle internal pressure reaches Pn1 by being pressed by the pump 13.

It is preferable that a range suitable for bodily sensation is set as the range of the discharge frequency, that is, the range of the frequency of fluctuations of the discharge pressure. The lower the discharge frequency is, the more easily it can be sensorially perceived. Conversely, the higher the discharge frequency is, the closer the spray form of the washing water is to continuous flow. According to sensory experiments, the discharge frequency is in a range of 1 to 60 Hz and preferably, a range of 20 to 50 Hz. The same washing feeling as that in a case where a smaller amount of washing water is continuously supplied is obtained.

As described in the foregoing, in the sanitary washing apparatus according to the first embodiment, the washing water supplied from the water supply source is pressurized by the pump 13, and the washing water pressurized by the pump 13 is always supplied from any one of the washing water outlets 143*b* to 143*e* provided in the switching valve 14 to one or more of the posterior nozzle 1, the bidet nozzle 2, and the nozzle cleaning nozzle 3. The washing water pressurized by the pump 13 is discharged from any one or more of the posterior nozzle 1, the bidet nozzle 2, and the nozzle cleaning nozzle 3.

Even when the washing water pressurized by the pump 13 is supplied to the switching valve 14 due to any failure in a case where the nozzle unit 30 is not used, therefore, the washing water can be caused to flow out of any one of the washing water outlets 143*b* to 143*e* in the switching valve 14, thereby making it possible to prevent the pressure in the pipe from rising. As a result, damage to the pipe or leakage of water can be prevented, thereby making it possible to prevent electrical shock to the user.

In the sanitary washing apparatus 100 according to the present embodiment, the tap water pipe 201 corresponds to a water supply source, the nozzle unit 30 corresponds to a spray device, the pump 13 corresponds to a pressure device and a reciprocating pump, the pressure feeding piston 136 corresponds to a pressure member, the first flow path 27*a* corresponds to a first flow path, the second flow path 27*b* corresponds to a second flow path, the cylindrical swirl chamber 29 corresponds to a rotating flow generator, the switching valve 14 corresponds to a flow rate adjustment device, the controller 4 corresponds to a control device and a command device, the water power adjustment switches 302*a*, 302*b*, and 302*aa* correspond to a pressure fluctuation setting device, the washing area adjustment switches 302*e*, 302*f*, and 302*dd* correspond to a divergent angle setting device, and the ceramic heater 505 corresponds to a heating device.

(2) Second Embodiment

Description is now made of a main body 200*a* in a sanitary washing apparatus 100 according to a second embodiment.

Figure 23:
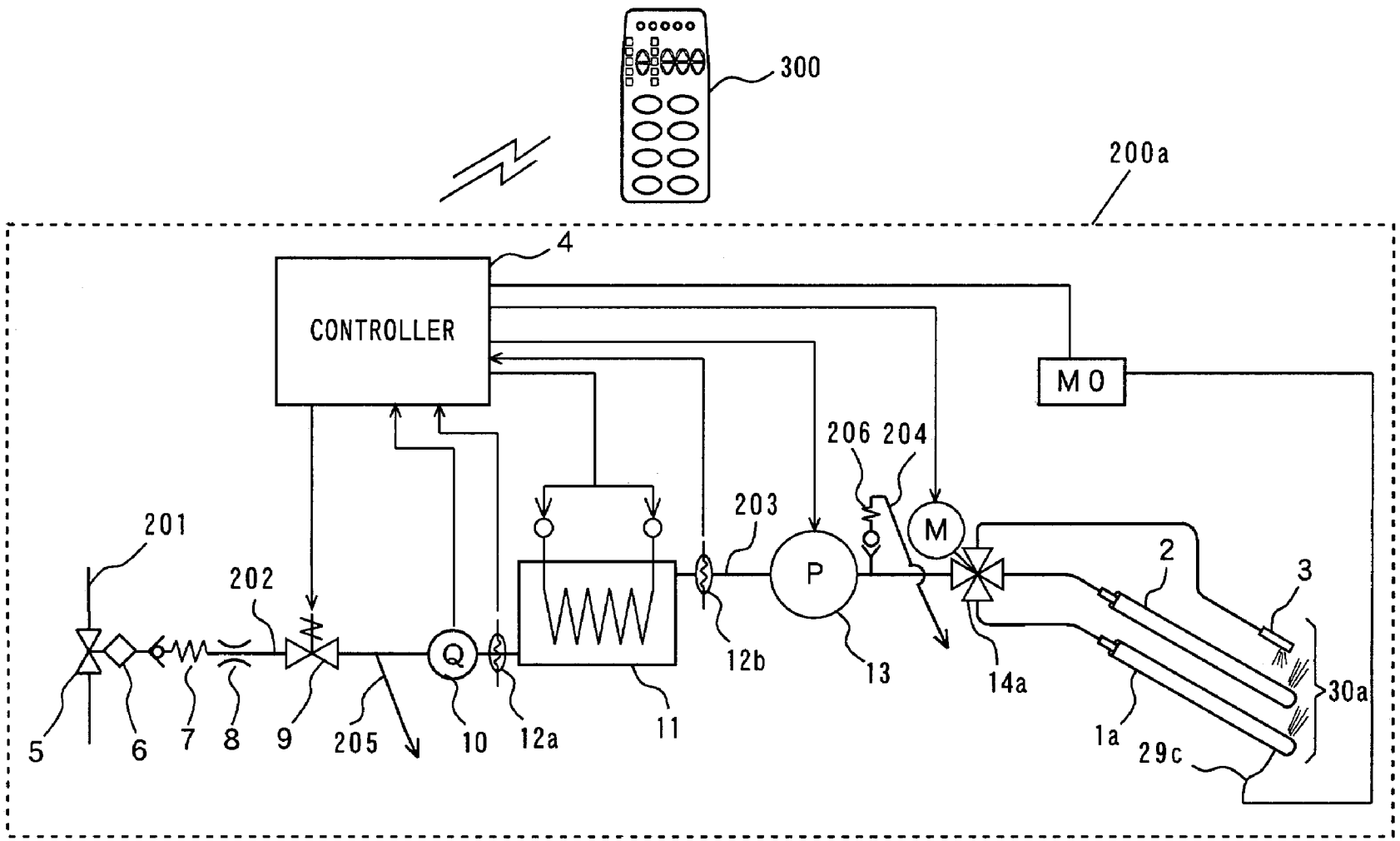
FIG. 23 is a schematic view showing the configuration of a main body in a sanitary washing apparatus according to a second embodiment.

FIG. 23 is a schematic view showing the configuration of the main body 200*a* in the sanitary washing apparatus 100 according to the second embodiment.

The main body 200*a* shown in FIG. 23 differs from the main body 200 shown in FIG. 3 in that there are provided a wire 29*c* for changing the spray form of washing water sprayed from the posterior nozzle 1*a* and a motor M0 for controlling the wire 29*c*, and the switching valve 14 is so configured as to be switched to three flow paths, i.e., a posterior nozzle 1*a*, a bidet nozzle 2, and a nozzle cleaning nozzle 3. The details of the change in the spray form of the posterior nozzle 1*a* by the motor M0 will be described later.

Figure 24:
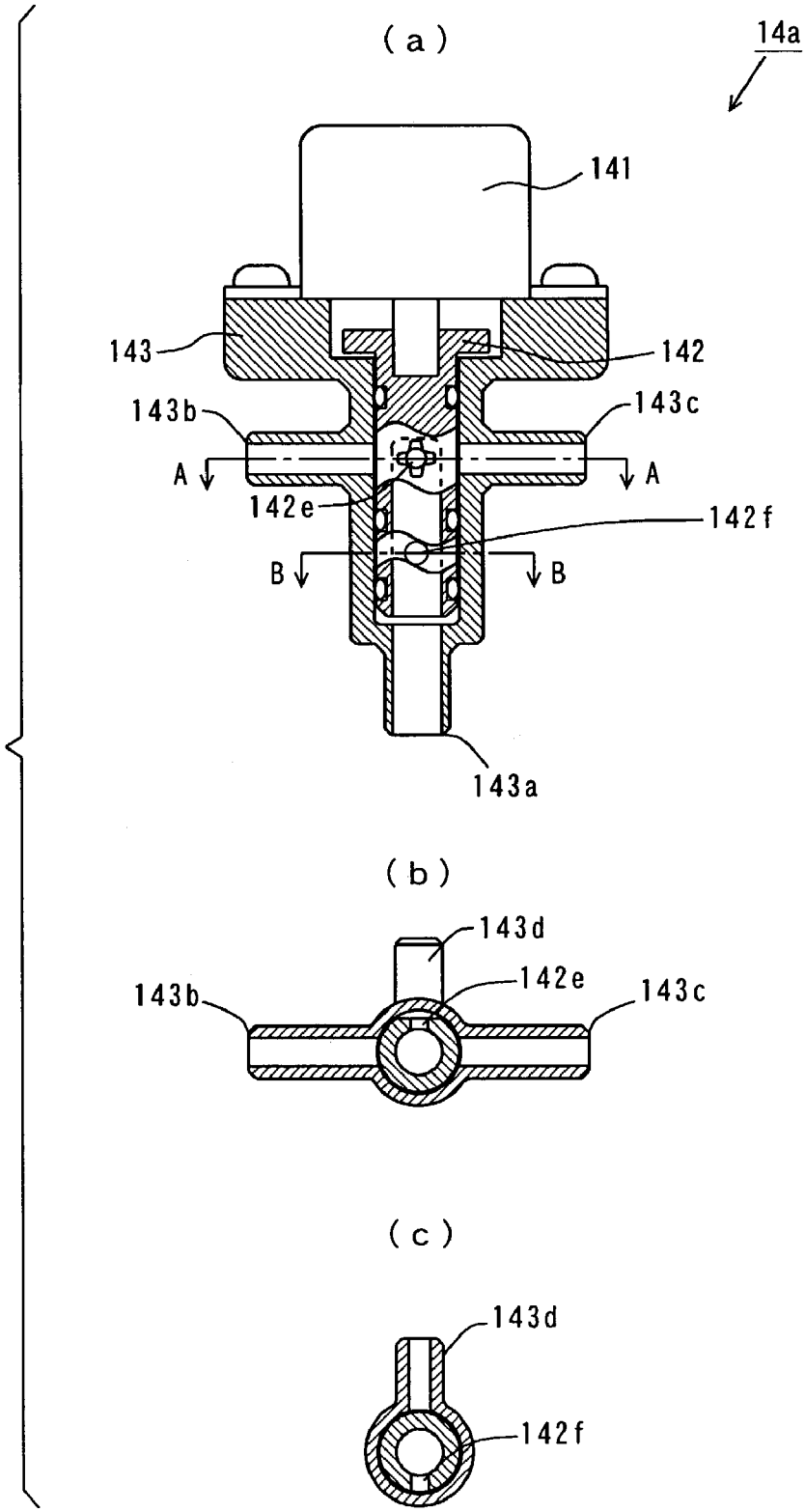
FIG. 24 is a diagram showing the configuration of a switching valve.

FIG. 24(*a*) is a vertical sectional view of a switching valve 14*a*, FIG. 24(*b*) is a cross-sectional view taken along a line A—A of the switching valve 14*a* shown in FIG. 24(*a*), and FIG. 24(*c*) is a cross-sectional view taken along a line B—B of the switching valve 14*a*.

The switching valve 14*a* shown in FIG. 24 comprises a motor 141, an inner cylinder 142, and an outer cylinder 143.

The inner cylinder 142 is inserted into the outer cylinder 143, and the axis of rotation of the motor 141 is attached to the inner cylinder 142. The motor 141 performs a rotating operation on the basis of a control signal fed by a controller 4. The motor 141 is rotated so that the inner cylinder 142 is rotated.

As shown in FIGS. 24(*a*), 24(*b*), and 24(*c*), a washing water inlet 143*a* is provided at one end of the outer cylinder 143, and washing water outlets 143*b* and 143*c* are respectively provided at opposite positions on the sides thereof, and a washing water outlet 143*d* is provided at a position, different from the washing water outlets 143*b* and 143*c*, on the side thereof Holes 142*e* and 142*f* are provided at different positions of the inner cylinder 142. A chamfer is formed, as shown in FIG. 24(*b*), around the hole 142*e*. By the rotation of the inner cylinder 142, the hole 142*e* is opposable to the washing water outlet 143*b* or 143*c* in the outer cylinder 143, and the hole 142*f* is opposable to the washing water outlet 143*d* in the outer cylinder 143.

A pipe 203 shown in FIG. 23 is connected to the washing water inlet 143*a*, the posterior nozzle 1*a* is connected to the washing water outlet 143*b*, the bidet nozzle 2 is connected to the washing water outlet 143*c*, and the nozzle cleaning nozzle 3 is connected to the washing water outlet 143*d*.

Figure 25:
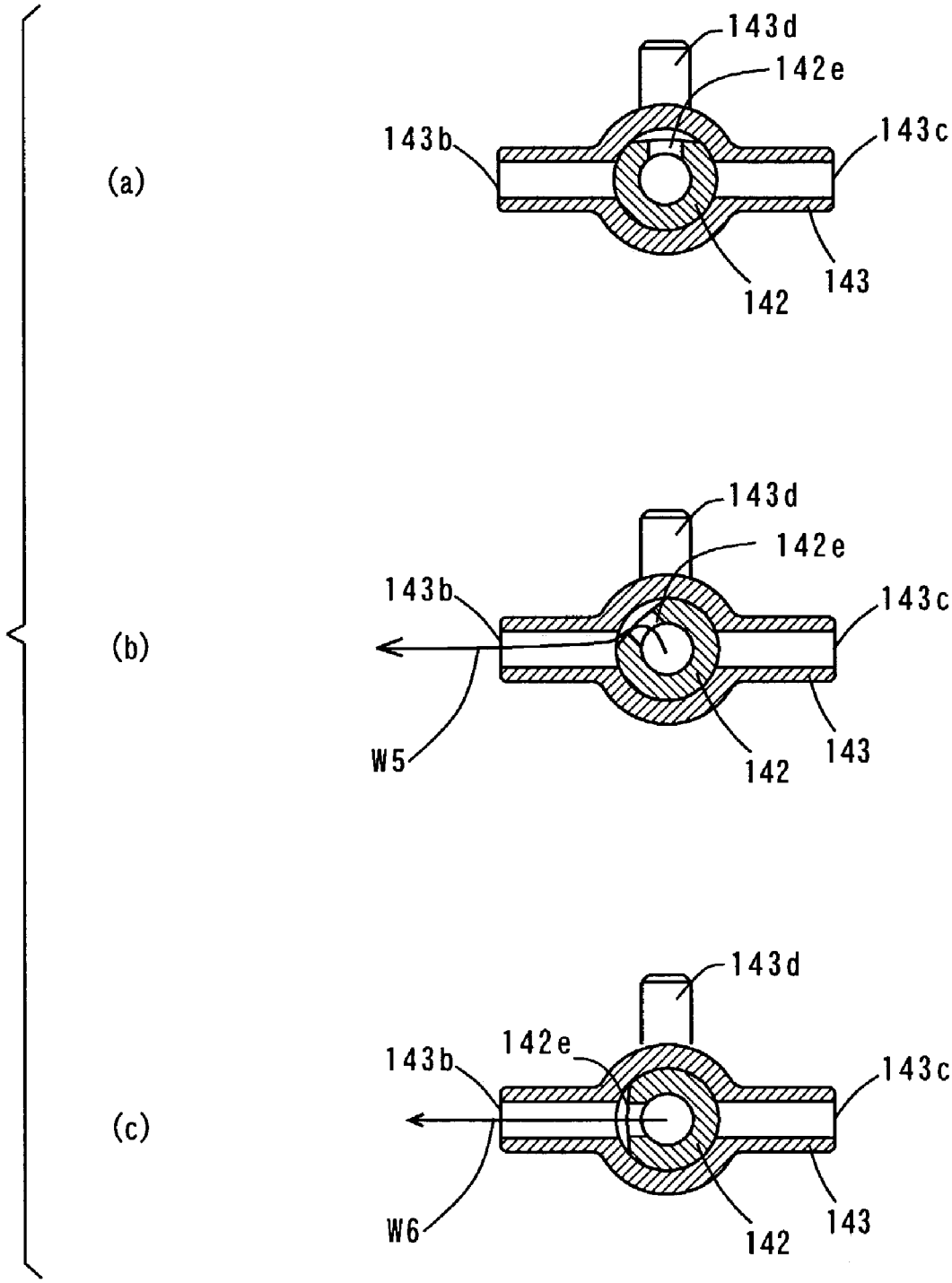
FIG. 25 is a cross-sectional view showing the operations of the switching valve shown in FIG. 24.

FIG. 25 is a cross-sectional view showing the operations of the switching valve 14*a* shown in FIG. 24.

When the motor 141 is not rotated, and the hole 142*e* in the inner cylinder 142 is on the same side as the washing water outlet 143*d* in the outer cylinder 143, as shown in FIG. 25(*a*), the hole 142*e* in the inner cylinder 142 is opposed to neither one of the washing water outlets 143*b* and 143*c* in the outer cylinder 143, and the hole 142*f* in the inner cylinder 142 is not opposed to the washing water outlet 143*d* in the outer cylinder 143. Consequently, no washing water flows out of any one of the washing water outlets 143*b*, 143*c*, and 143*d*.

When the motor 141 then rotates the inner cylinder 142 through 45 degrees, as shown in FIG. 25(*b*), a part of the chamfer around the hole 142*e* in the inner cylinder 142. is opposed to the washing water outlet 143*b* in the outer cylinder 143. Consequently, a small amount of washing water passes in the inner cylinder 142 from the washing water inlet 143*a*, to flow out of the washing water outlet 143*b*, as indicated by an arrow W5.

When the motor 141 rotates the inner cylinder 142 through 90 degrees, as shown in FIG. 25(*c*), the hole 142*e* in the inner cylinder 142 is opposed to the washing water outlet 143*b* in the outer cylinder 143. Consequently, a large amount of washing water passes in the inner cylinder 142 from the washing water inlet 143*a*, to flow out of the washing water outlet 143*b*, as indicated by an arrow W6.

Furthermore, when the motor 141 then rotates the inner cylinder 142 through 270 degrees, the hole 142*e* in the inner cylinder 142 is opposed to the washing water outlet 143*c* in the outer cylinder 143. Consequently, a large amount of washing water passes in the inner cylinder 142 from the washing water inlet 143*a*, to flow out of the washing water outlet 143*c*.

When the motor 141 then rotates the inner cylinder 142 through 180 degrees, the hole 142*f* in the inner cylinder 142 is opposed to the washing water outlet 143*d* in the outer cylinder 143. Consequently, a large amount of washing water passes in the inner cylinder 142 from the washing water inlet 143*a*, to flow out of the washing water outlet 143*d*.

As described in the foregoing, the washing water flows out when either one of the holes 142*e* and 142*f* in the inner cylinder 142 is opposed to any one of the washing water outlets 143*b* to 143*d* in the outer cylinder 143 by the rotation of the motor 141 on the basis of a control signal from the controller 4, while not flowing out when neither one of the holes 142*e* and 142*f* in the inner cylinder 142 is opposed to any one of the washing water outlets 143*b* to 143*d* in the outer cylinder 143.

Figure 26:
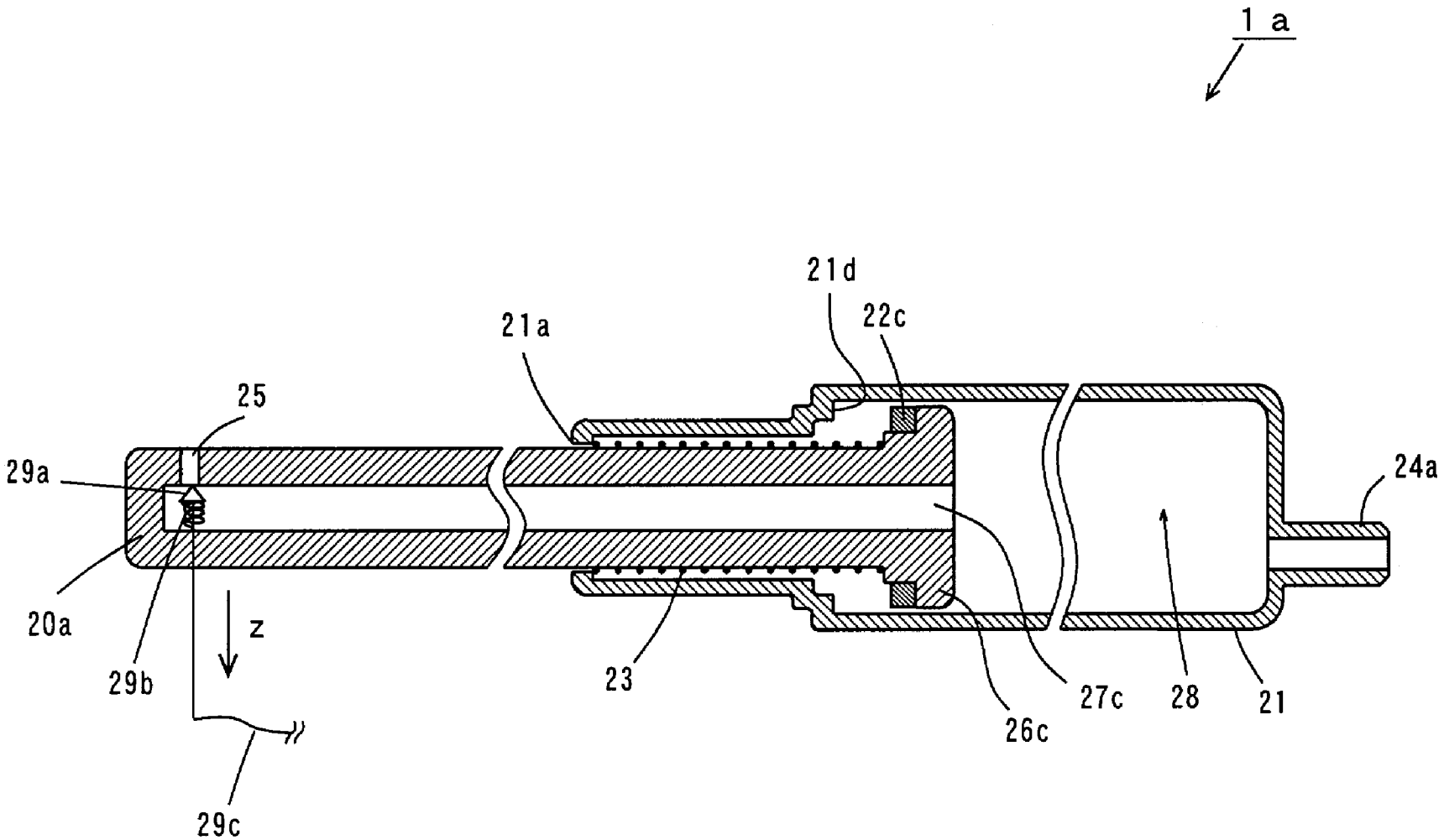
FIG. 26 is a cross-sectional view of a posterior nozzle shown in FIG. 23.

Description is now made of the posterior nozzle 1*a* in the nozzle unit 30*a* shown in FIG. 23. FIG. 26 is a cross-sectional view of the posterior nozzle 1*a* in the nozzle unit 30*a* shown in FIG. 21.

As shown in FIG. 26, the posterior nozzle 1*a* comprises a cylindrical piston 20*a*, a cylinder 21, a seal packing 22*c*, and a spring 23.

A spray hole 25 for spraying washing water is formed in the vicinity of a front end of the piston 20*a*. Further, a spray form adjustment member 29*a* in a conical shape for adjusting the spray form of the washing water sprayed from the spray hole 25 and a spring 29*b* and a sprays form adjustment member 29*c* for adjusting the position of the spray form adjustment member 29*a* are provided in the vicinity of the spray hole 25. The spray form adjustment member 29*a* is so urged as to be inserted into the spray hole 25 by the spring 29*b*. The position of the spray form adjustment member 29*a* can be adjusted against the elasticity of the spring 29*b* by pulling the wire 29*c* in a direction indicated by an arrow z by the motor M0 shown in FIG. 23. A stopper 26*c* in a flange shape is provided at a rear end of the piston 20*a*. Further, the seal packing 22*c* is mounted on the stopper 26*c*. Inside the piston 20*a*, a flow path 27*c* communicating with the spray hole 25 from a rear end surface of the piston 20*a* is formed.

On the other hand, the cylinder 21 comprises a small diameter portion at its front end and a large diameter portion at its rear end. Consequently, a stopper surface 21*d* against which the stopper 26*c* can abut through the seal packing 22*c* is formed between the small diameter portion and the large diameter portion. A washing water inlet 24*a* is provided on a rear end surface of the cylinder 21, and an opening 21*a* is provided on a front end surface of the cylinder 21. An inner space of the cylinder 21 is a temperature fluctuation buffering space 28. The washing water inlet 24*a* is provided eccentrically at a position different from the central axis of the cylinder 21. The washing water inlet 24*a* is connected to the washing water outlet 143*b* in the switching valve 14*a* shown in FIG. 23.

The piston 20*a* is inserted into the cylinder 21 so as to be movable such that the stopper 26*c* is positioned in the temperature fluctuation buffering space 28, and the front end projects from the opening 21*a*.

Furthermore, the spring 23 is disposed between the stopper 26*c* in the piston 20*a* and a peripheral edge of the opening 21*a* in the cylinder 21, to urge the piston 20*a* toward the rear end of the cylinder 21.

A micro-clearance is formed between an outer peripheral surface of the stopper 26*c* in the piston 20*a* and an inner peripheral surface of the cylinder 21, and a micro-clearance is formed between an outer peripheral surface of the piston 20*a* and an inner peripheral surface of the opening 21*a* in the cylinder 21.

Figure 27:
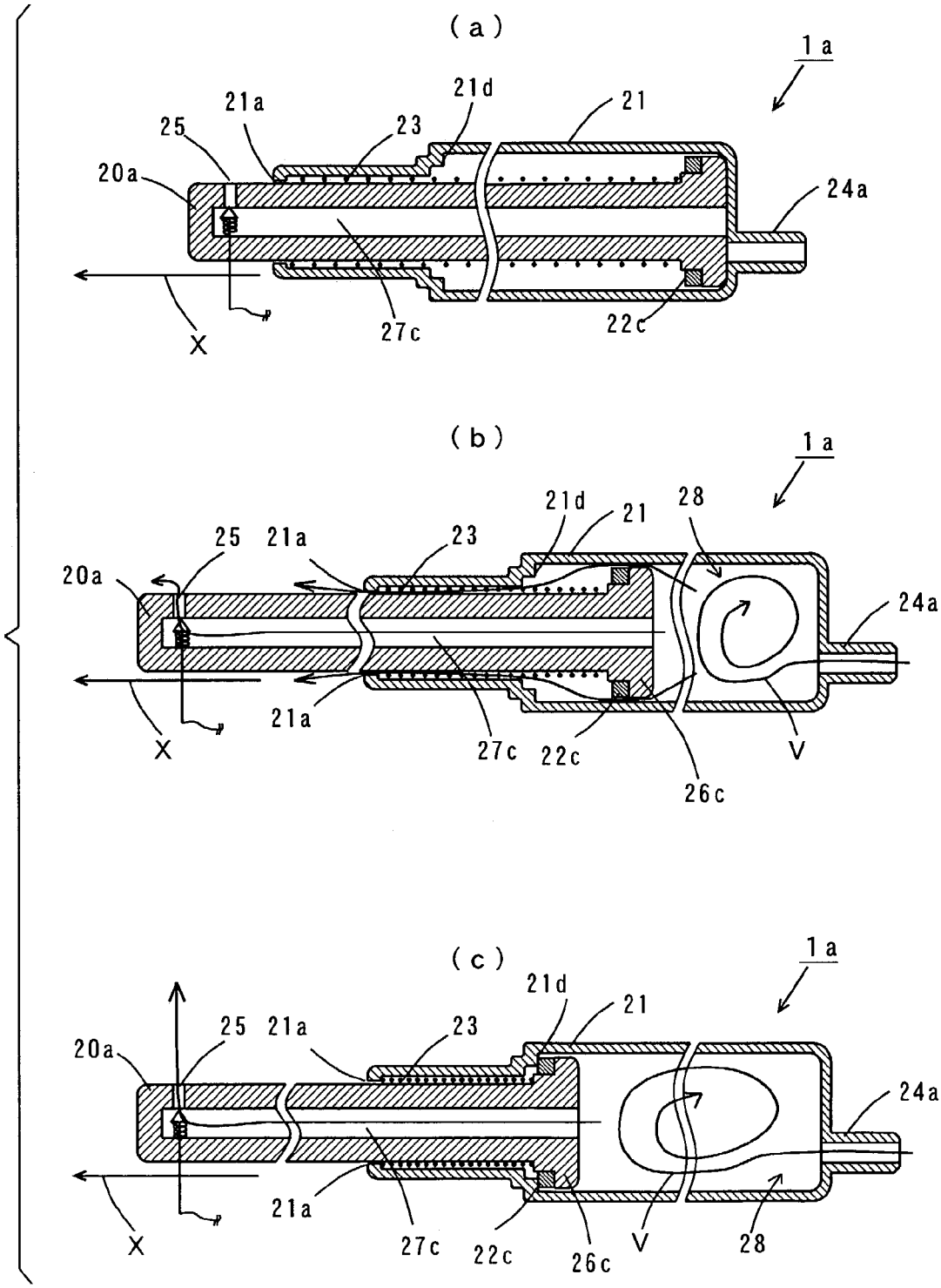
FIG. 27 is a cross-sectional view for explaining the operations of the posterior nozzle shown in FIG. 23.

Description is now made of the operations of the posterior nozzle 1*a* shown in FIG. 26. FIG. 27 is a cross-sectional view for explaining the operations of the posterior nozzle 1*a*.

First, when no washing water is supplied from the washing water inlet 24*a* in the cylinder 21, as shown in FIG. 27(*a*), the piston 20*a* retreats in the opposite direction to a direction indicated by an arrow X by the elastic force of the spring 23, and is accommodated in the cylinder 21. As a result, the piston 20*a* enters a state where it does not project most greatly from the opening 21*a* in the cylinder 21. At this time, the temperature fluctuation buffering space 28 is not formed in the cylinder 21.

When the supply of washing water from the washing water inlet 24*a* in the cylinder 21 is then started, as shown in FIG. 27(*b*), the piston 20*a* gradually advances in the direction indicated by the arrow X against the elastic force of the spring 23 by the pressure of the washing water. Consequently, the temperature fluctuation buffering space 28 is formed in the cylinder 21, and the washing water flows into the temperature fluctuation buffering space 28.

Since the washing water inlet 24*a* is provided at a position eccentric from the central axis of the cylinder 21, the washing water flowing into the temperature fluctuation buffering space 28 flows in a swirling state, as indicated by an arrow V. A part of the washing water in the temperature fluctuation buffering space 28 flows out of a micro-clearance between the outer peripheral surface of the piston 20*a* and the inner peripheral surface of the opening 21*a* in the cylinder 21 through a micro-clearance between the outer peripheral surface of the stopper 26*c* in the piston 20*a* and the inner peripheral surface of the cylinder 21, and is sprayed from the spray hole 25 through the flow path 27*c* in the piston 20*a*.

When the piston 20*a* further advances, the stopper 26*c* is brought into watertight contact with the stopper surface 21*d* in the cylinder 21 through the seal packing 22*c*, as shown in FIG. 27(*c*). Consequently, a flow path leading from the micro-clearance between the outer peripheral surface of the stopper 26*c* in the piston 20*a* and the inner peripheral surface of the cylinder 21 to the micro-clearance between the outer peripheral surface of the piston 20*a* and the inner peripheral surface of the opening 21*a* in the cylinder 21 is blocked off. Consequently, the washing water in the temperature fluctuation buffering space 28 is sprayed from only the spray hole 25 through the flow path 27*c* in the piston 20*a*.

Figure 28:
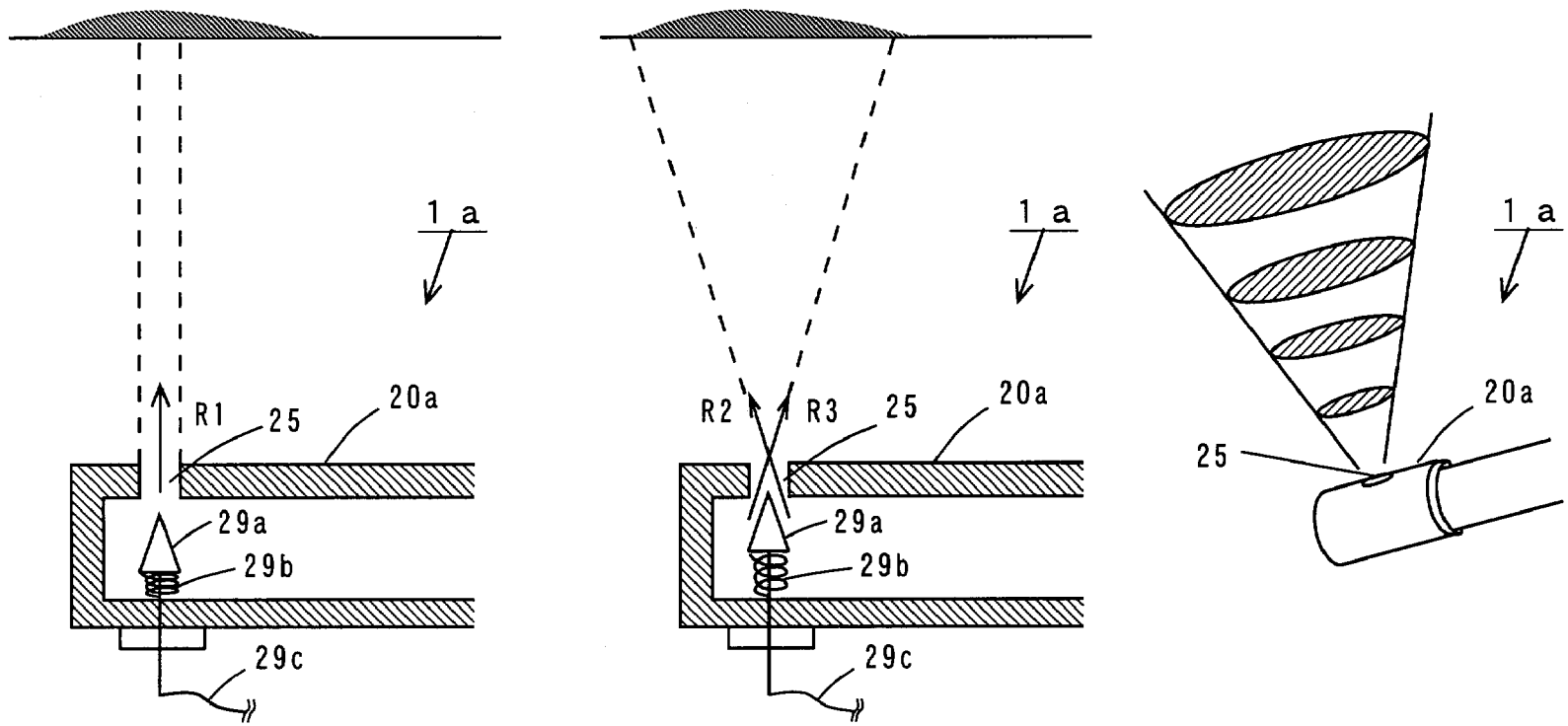
FIG. 28 is a schematic view for explaining washing water sprayed from a spray hole in the posterior nozzle according to the second embodiment.

FIGS. 28(*a*) to 28(*c*) are diagrams for explaining washing water sprayed from the spray hole 25 in the posterior nozzle 1*a* in the second embodiment.

FIG. 28(*a*) is a schematic view showing the spray form of washing water in a case where a front end of the spray form adjustment member 29*a* is extruded from the spray hole 25. In a state where the front end of the spray form adjustment member 29*a* is extruded from the spray hole 25, the distance between an outer peripheral surface of the spray form adjustment member 29*a* and the spray hole 25 is sufficiently large. Accordingly, the washing water is unaffected by the outer peripheral surface of the spray form adjustment member 29*a*. Consequently, the spray form of the washing water sprayed from the spray hole 25 is linear flow, as indicated by a broken line.

FIG. 28(*b*) is a schematic view showing the spray form of washing water in a case where the front end of the spray form adjustment member 29*a* is inserted into the spray hole 25. In a state where the front end of the spray form adjustment member 29*a* is inserted into the spray hole 25, the distance between the outer peripheral surface of the spray form adjustment member 29*a* and the spray hole 25 is decreased. Accordingly, the washing water flows along the outer peripheral surface in a conical shape of the spray form adjustment member 29*a*, and is sprayed so as to expand from the spray hole 25, as indicated by arrows R2 and R3. Consequently, the washing water is sprayed as sprayed flow having an expanse, as indicated by a broken line. As shown in FIG. 28(*c*), the washing water sprayed from the spray hole 25 is circular in cross section. The position of the spray form adjustment member 29*a* in the spray hole 25 is adjusted by the wire 29*c*, thereby making it possible to change the divergent angle of the washing water sprayed from the spray hole 25. Consequently, the washing area of a surface to be washed can be changed.

Figure 29:
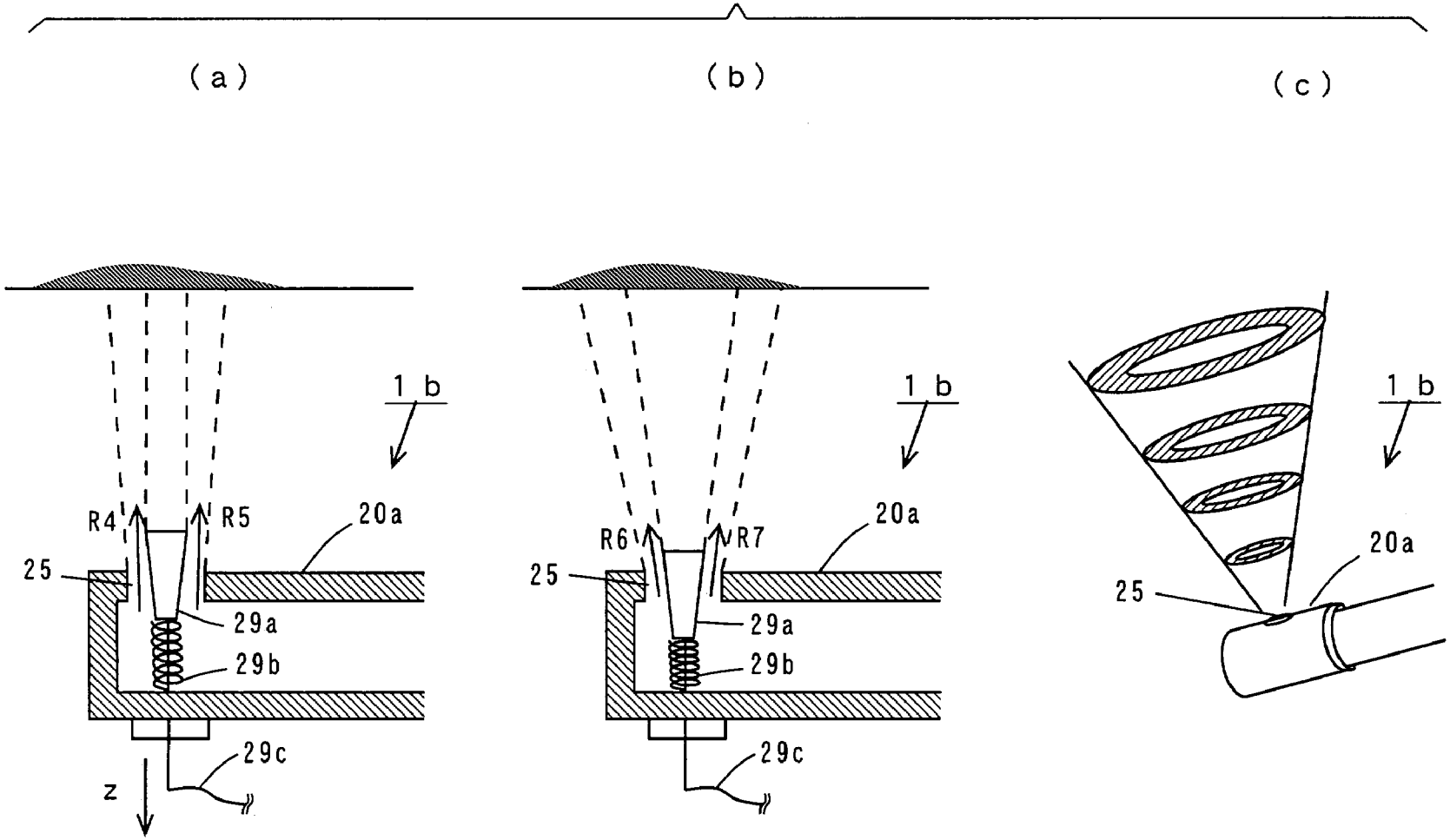
FIG. 29 is a diagram showing another example of a spray form adjustment member provided in the posterior nozzle according to the second embodiment.

FIGS. 29(*a*) to 29(*c*) are diagrams showing another example of the spray form adjustment member provided in the posterior nozzle 1*a* in the second embodiment. The spray form adjustment member 29*a* shown in FIG. 29 has an outer peripheral surface in the shape of an inverted truncated cone. The spray form adjustment member 29*a* is urged so as to be extruded from the spray hole 25 by the spring 29*b*. The wire 29*c* is pulled in a direction indicated by an arrow z by the motor MO shown in FIG. 23, thereby making it possible to adjust the position of the spray form adjustment member 29*a* against the elasticity of the spring 29*b*.

FIG. 29(*a*) is a schematic view showing the spray form of washing water in a case where the spray form adjustment member 29*a* is extruded from the spray hole 25. In a state where the spray form adjustment member 29*a* is extruded from the spray hole 25, the distance between the outer peripheral surface of the spray form adjustment member 29*a* and the spray hole 25 is sufficiently large. Accordingly, the washing water is unaffected by the outer peripheral surface of the spray form adjustment member 29*a*. Consequently, the spray form of the washing water sprayed from the spray hole 25 is linear flow, as indicated by a broken line.

FIG. 29(*b*) is a schematic view showing the spray form of washing water in a case where the spray form adjustment member 29*a* is inserted into the spray hole 25. In a state where the spray form adjustment member 29*a* is inserted into the spray hole 25, the distance between the outer peripheral surface of the spray form adjustment member 29*a* and the spray hole 25 is decreased. Accordingly, the washing water flows along the outer peripheral surface in the shape of an inverted truncated cone of the spray form adjustment member 29*a*, and is sprayed so as to expand from the spray hole 25, as indicated by arrows R6 and R7. Consequently, the washing water is sprayed as sprayed flow having an expanse, as indicated by a broken line. As shown in FIG. 29(*c*), the washing water sprayed from the spray hole 25 is annular in cross section. The position of the spray form adjustment member 29*a* in the spray hole 25 is adjusted by the wire 29*c*, thereby making it possible to change the divergent angle of the washing water sprayed from the spray hole 25. Consequently, the washing area of a surface to be washed can be changed.

(3) Third Embodiment

Description is now made of a main body 200*b* in a sanitary washing apparatus 100 according to a third embodiment.

Figure 30:
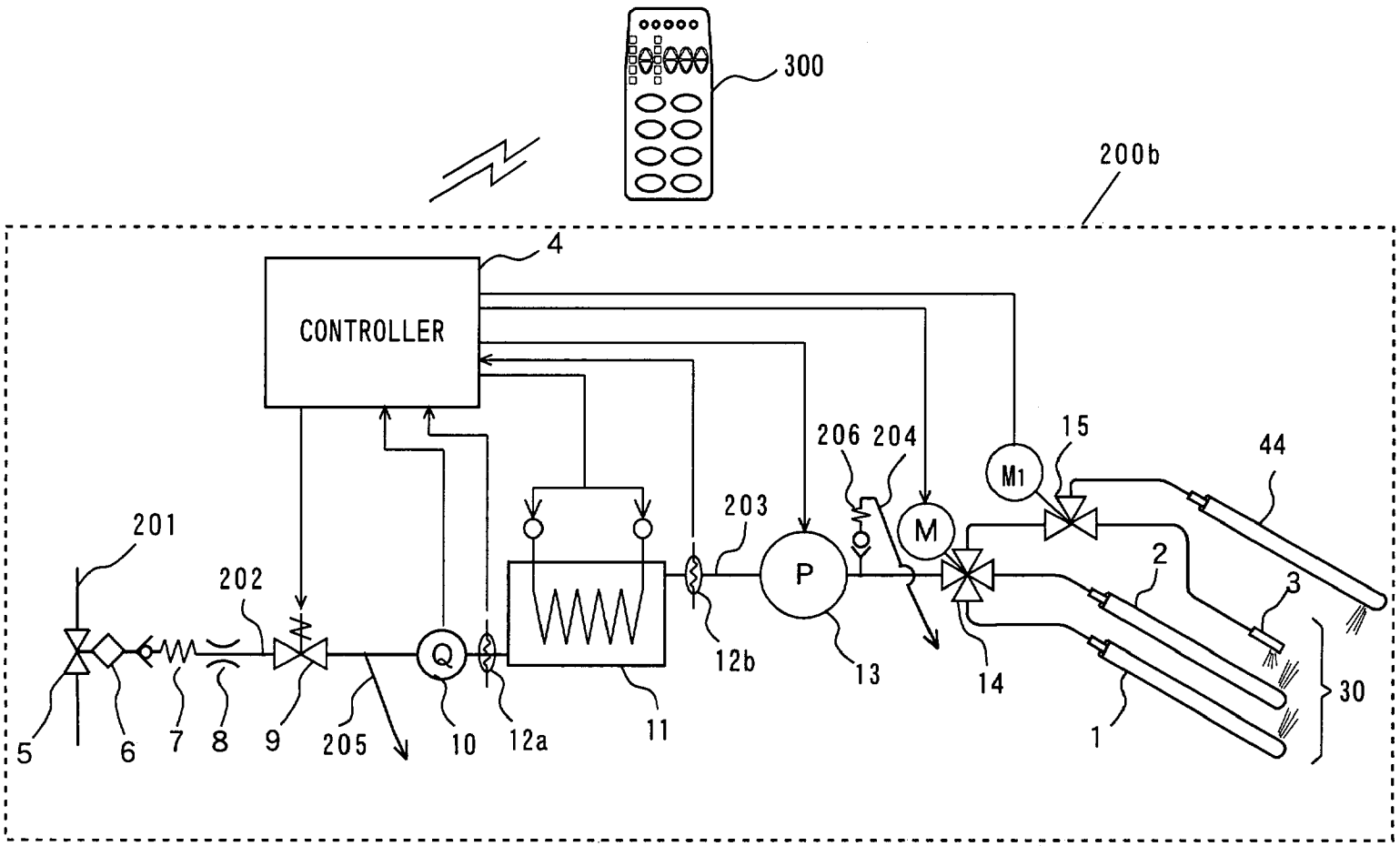
FIG. 30 is a schematic view showing the configuration of a main body in a sanitary washing apparatus according to a third embodiment.

FIG. 30 is a schematic view showing an example of the configuration of the main body 200*b* in the sanitary washing apparatus 100 according to the third embodiment.

The main body 200*b* shown in FIG. 30 differs from the main body 200 shown in FIG. 3 in that there are provided a toilet bowl cleaning nozzle 44, a switching valve 15 for switching flow paths in the toilet bowl cleaning nozzle 44 and a nozzle cleaning nozzle 3, and a motor M1 for controlling the switching valve 15.

A controller 4 rotates the motor M1 on the basis of a signal transmitted by radio from a remote control device 300 shown in FIG. 30. Consequently, the switching valve 15 supplies washing water to either one of the toilet bowl cleaning nozzle 44 and the nozzle cleaning nozzle 3 in a nozzle unit 30.

Figure 31:
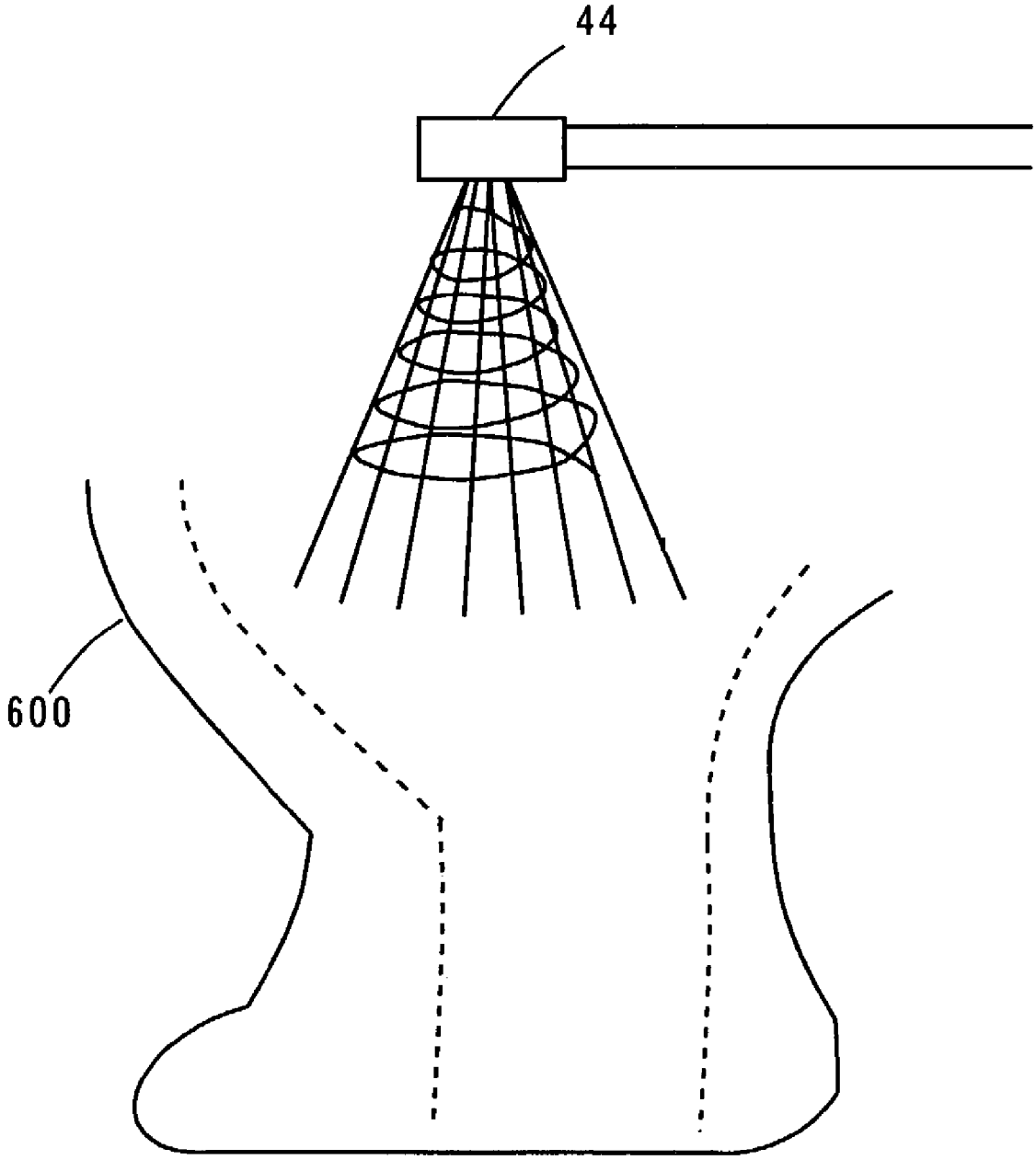
FIG. 31 is a schematic view for explaining how washing water is sprayed from a toilet bowl cleaning nozzle.

FIG. 31 is a schematic view showing how the washing water is sprayed from the toilet bowl cleaning nozzle 44. The toilet bowl cleaning nozzle 44 moves by a signal from the remote control device 300 so that the washing water is sprayed downward toward a toilet bowl 600. The toilet bowl cleaning nozzle 44 may be a nozzle in the form described in any one of FIGS. 16, 28, and 29. Consequently, the toilet bowl 600 can be effectively cleaned.

(4) Fourth Embodiment

Description is now made of a sanitary washing apparatus 100 according to a fourth embodiment.

Figure 32:
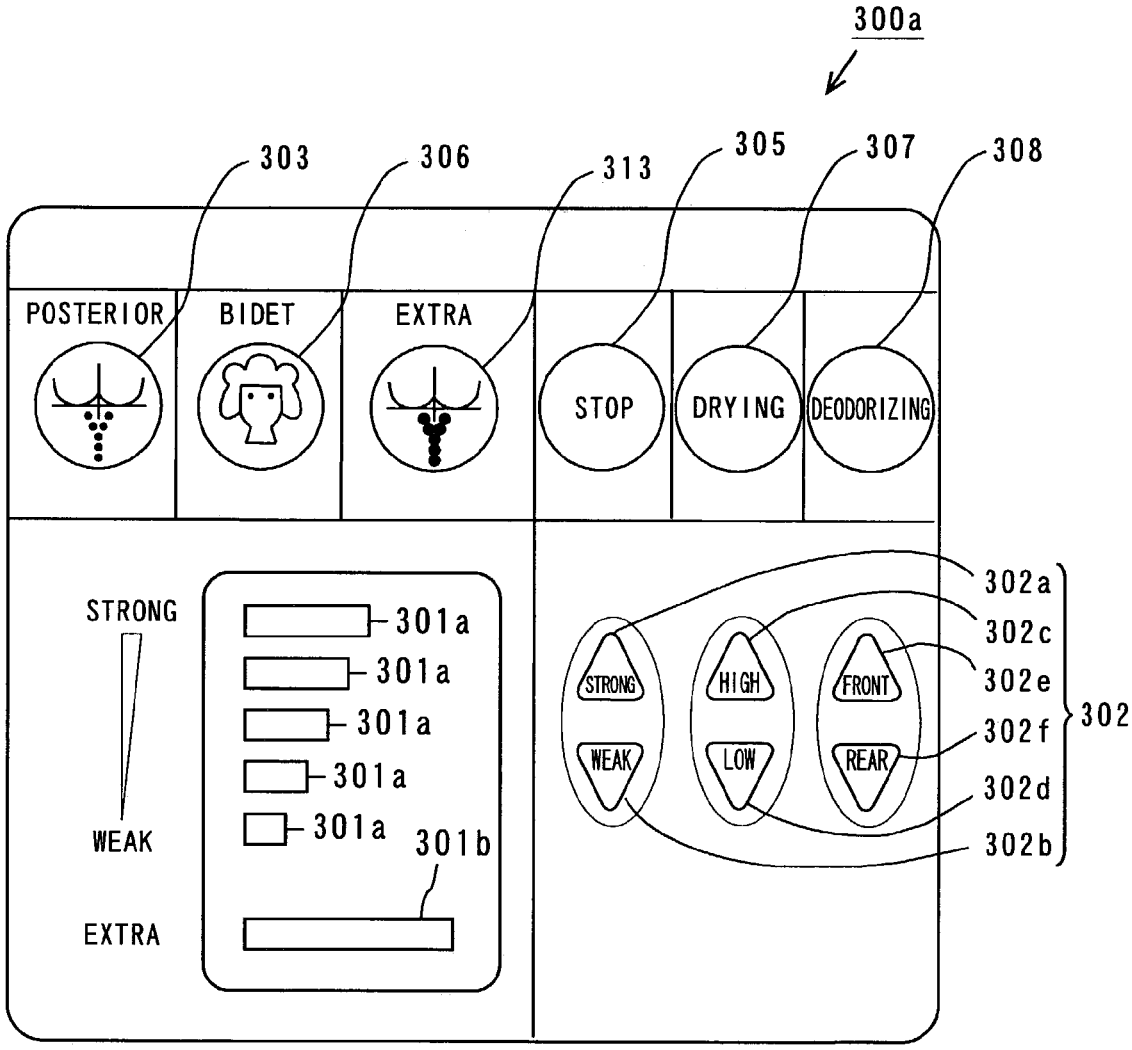
FIG. 32 is a schematic view showing another example of the remote control device 300 shown in FIG. 2.

FIG. 32 is a schematic view showing a remote control device 300*a* in another example of the remote control device 300 shown in FIG. 2.

The remote control device 300*a* differs from the remote control device 300 shown in FIG. 2 in that the plurality of LEDs (Light Emitting Diodes) 301, the water power adjustment switch 302*aa*, the washing area adjustment switches 302*dd*, 302*e*, and 302*f*, the stimulation switch 304, the water power change switch 310, and the area change switch 311 are not provided, and a plurality of water power displays 301*a* respectively having different lengths, an extra washing water power display 301*b*, and an extra switch 313 are further provided.

The various types of switches provided in the remote control device 300*a* shown in FIG. 32 are pressed by a user, as in the remote control device 300 shown in FIG. 2. Consequently, the remote control device 300*a* transmits by radio a predetermined signal to a controller provided in a main body 200 in the sanitary washing apparatus 100, as in the foregoing. The controller 4 in the main body 200 receives the predetermined signal transmitted by radio by the remote control device 300*a*, to control a washing water supply mechanism or the like.

The user presses a posterior switch 303 or a bidet switch 306, for example, so that a nozzle unit 30 in the main body 200 shown in FIG. 1 moves, thereby spraying washing water. When a stop switch 305 is pressed, the spray of the washing water from the nozzle unit 30 is stopped.

When the user presses the extra switch 313, washing water for simulating the private parts of the human body is sprayed from the nozzle unit 30 in the main body 200 shown in FIG. 1. When the water power adjustment switch 302*a* or 302*b* is pressed, the amount, the pressure, the spray form, etc. of the washing water sprayed from the nozzle unit 30 are changed. In the present embodiment, the water power of the washing water is adjusted by changing the pressure in the center of fluctuations, the width of fluctuations, and the period of fluctuations (the frequency of fluctuations) in periodical pressure fluctuations. When the water power adjustment switch 302*a* or 302*b* is pressed, the water power displays 301*a* whose number corresponds to the water power light up. When the five water power displays 301*a* light up, as shown in FIG. 32, the water power is set to "strong". Further, when the extra switch 313 is pressed, to do extra washing, described later, the extra washing water display 301*b* lights up.

Figure 33:
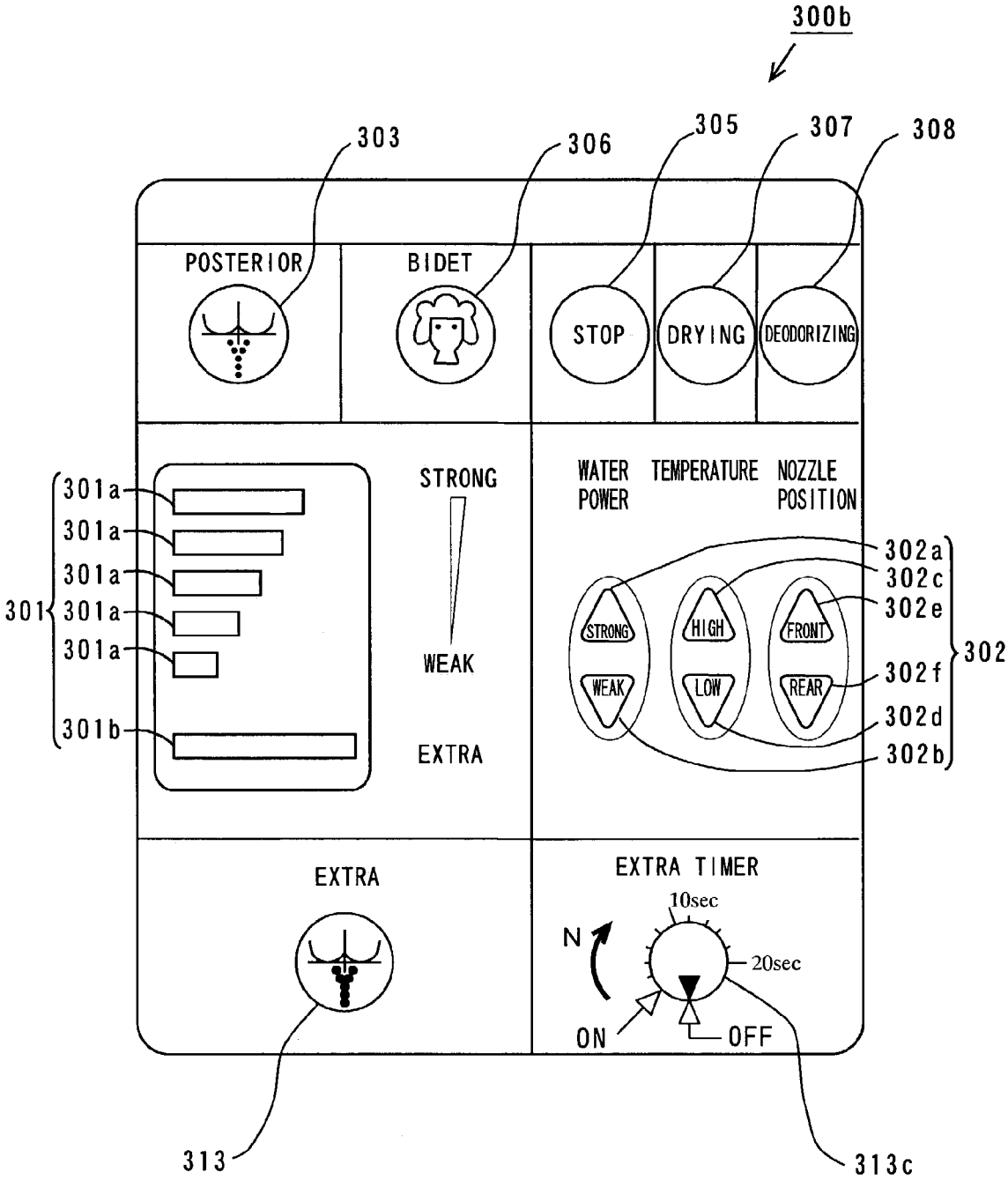
FIG. 33 is a schematic view showing another example of the remote control device 300 shown in FIG. 2.

The remote control device 300*a* shown in FIG. 32, described above, may have the following configuration. FIG. 33 is a schematic view showing a remote control device 300*b* in another example of the remote control device 300 shown in FIG. 2.

The remote control device 300*b* shown in FIG. 33 comprises an extra timer dial 313*c* in addition to various types of switches and various types of displays which are provided in the remote control device 300*a* shown in FIG. 32.

The various types of switches provided in the remote control device 300*b* shown in FIG. 33 are pressed by the user, as in the remote control device 300*a* shown in FIG. 32, described above. The extra timer dial 313*c* provided in the remote control device 300*b* shown in FIG. 33 is rotated by the user. Consequently, the remote control device 300*b* transmits by radio a predetermined signal to the controller provided in the main body 200 in the sanitary washing apparatus 100, as in the foregoing. The controller in the main body 200 receives the predetermined signal transmitted by radio by the remote control device 300*b*, to control a washing water supply mechanism or the like.

When a posterior nozzle unit 303 or a bidet nozzle unit 306 is pressed by the user, for example, the nozzle unit 30 in the main body 200 shown in FIG. 1 moves, thereby spraying washing water. When the stop switch 305 is pressed, the spray of the washing water from the nozzle unit 30 is stopped.

When the posterior switch 303 is pressed, and the extra switch 313 is further pressed, the spray form of the washing water sprayed from the nozzle unit 30 is changed, thereby spraying washing water for simulating the private parts of the human body (extra washing).

When the extra switch 313 is continuously pressed, the extra washing is continuously done. Thereafter, the pressing operation of the extra switch 313 by the user is interrupted, whereby the spray form of the washing water sprayed from the nozzle unit 30 is returned to the spray form at the time of normal washing.

As described in the foregoing, a time period required to spray the washing water in the extra washing can be set by the extra timer dial 313*c*. A timer-on scale, a timer-off scale, and a time setting scale are provided in the vicinity of the extra timer dial 313*c*. The user rotates the extra timer dial 313*c* in a direction indicated by an arrow N, whereby the time period required to spray the washing water in the extra washing is set.

When the user sets the extra timer dial 313*c* on the timer-off scale, for example, the extra washing is started by the user pressing the extra switch 313, and is stopped by the user interrupting the pressing of the extra switch 313.

On the other hand, when the user sets the extra timer dial 313*c* on a particular time setting scale beyond the timer-on scale, the extra washing is started by the user pressing the extra switch 313, and is automatically stopped after an elapse of a set time period.

The operations of the sanitary washing apparatus 100 performed as the user presses a drying switch 307 and a deodorizing switch 308 are as described above. The operations of the sanitary washing apparatus 100 performed as the various types of switches provided in an adjustment switch 302 are performed are as described above.

As described in the foregoing, the extra washing is terminated by interrupting the pressing operation of the extra switch 313 or an elapse of the set time by the extra timer dial 313*c*.

The remote control device 300*b* shown in FIG. 33 may be provided with an extra off switch for stopping the extra washing in addition to the above-mentioned various types of switches. In this case, the user need not press the extra switch 313 continuously at the time of the extra washing.

In the foregoing, the remote control device 300*b* outputs, when the extra washing is terminated, an extra washing stop signal representing the stop of extra washing to the controller 4, described later. Consequently, the spray form of the washing water sprayed from the nozzle unit 30 is returned to the spray form at the time of the normal washing.

Figure 34:
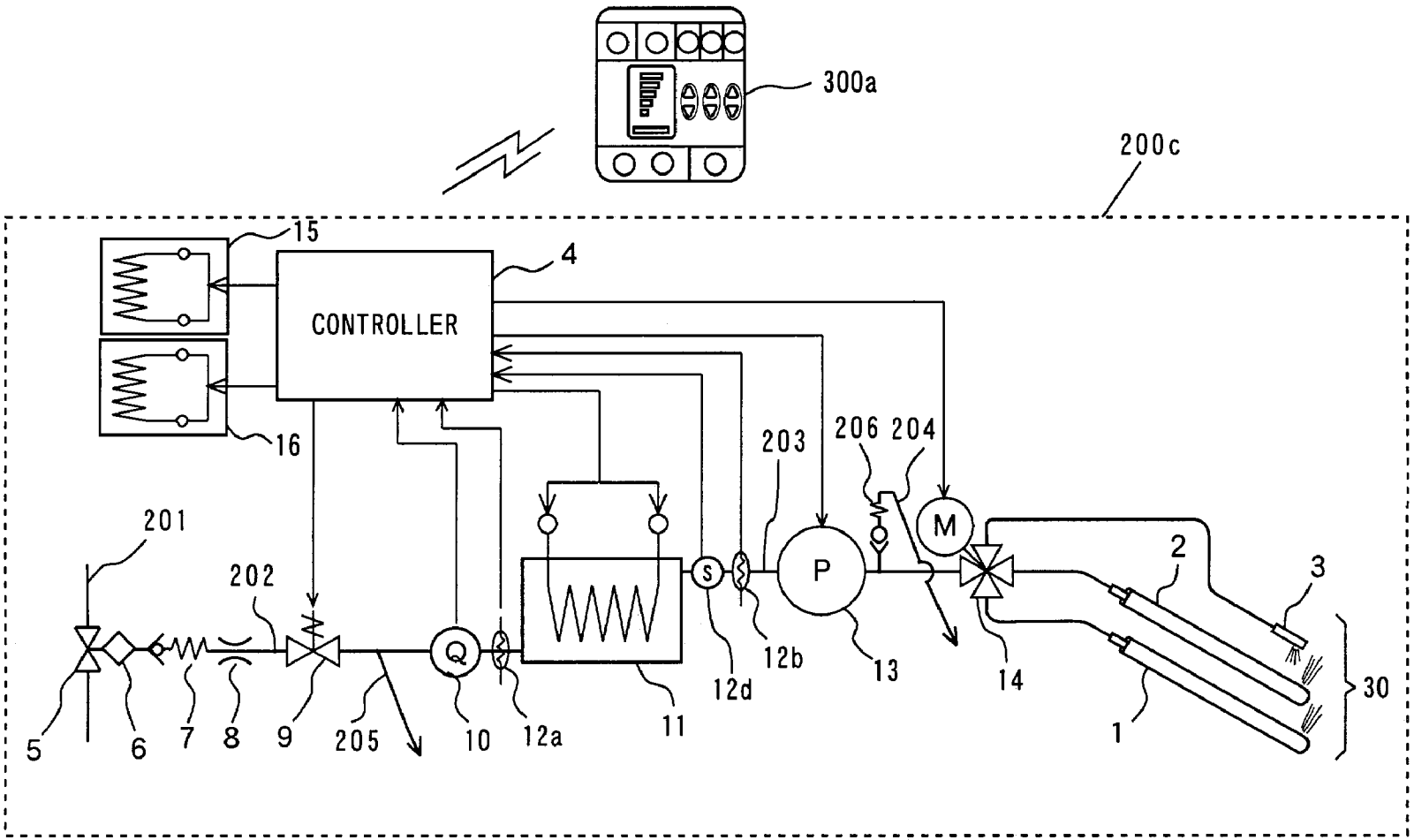
FIG. 34 is a schematic view showing the configuration of a main body 200*c* in a sanitary washing apparatus 100 according to a fourth embodiment.

FIG. 34 is a schematic view showing the configuration of a main body 200*c* in the sanitary washing apparatus 100 according to the fourth embodiment.

The main body 200*c* shown in FIG. 34 differs from the main body 200 shown in FIG. 3 in that a water passage sensor 12*d*, a heater for indoor heating 15, a heater for toilet seat heating 16 are further provided.

As shown in FIG. 34, the water passage sensor 12*d* is inserted into a pipe 203 connected between a heat exchanger 11 and a switching valve 14.

The water passage sensor 12*d* detects that the pipe 203 is filled with washing water, to feed a water passage signal to a controller 4.

The heater for indoor heating 15 heats a room on the basis of the control signal fed from the controller 4. Further, the heater for toilet seat heating 16 heats a toilet seat 400.

Figure 35:
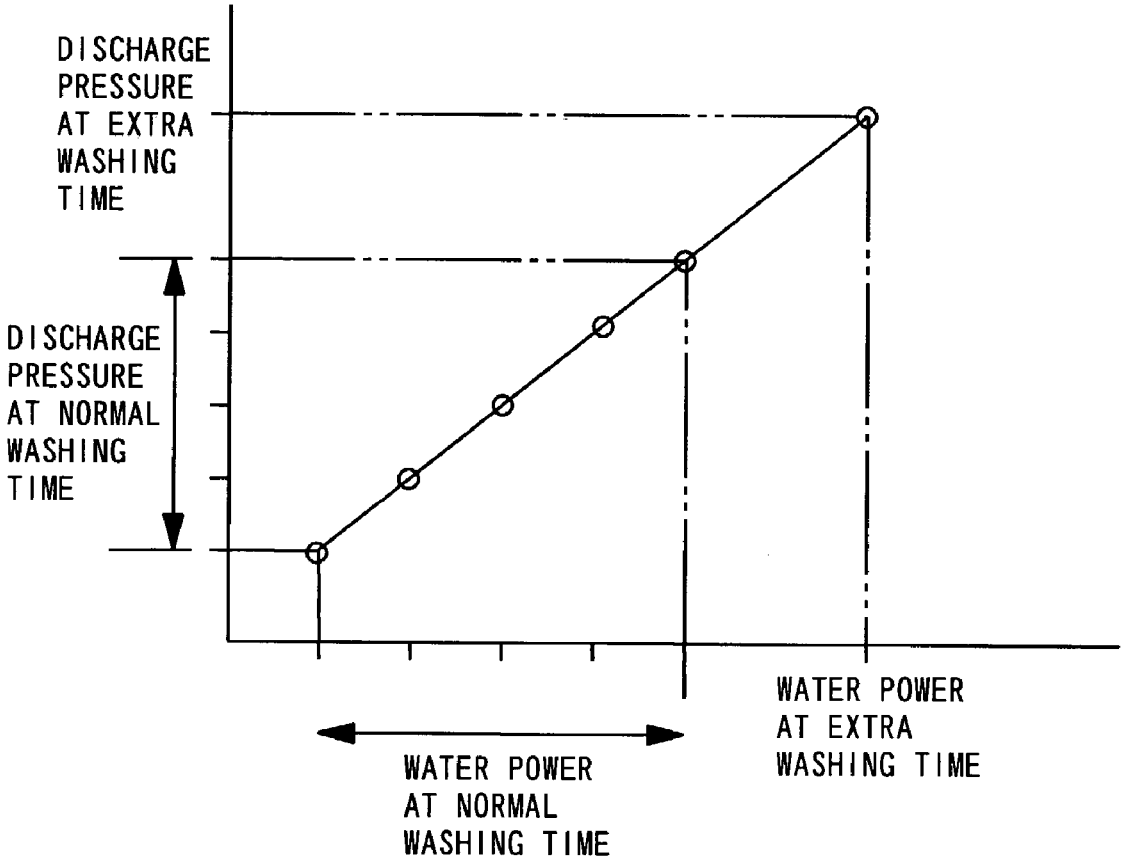
FIG. 35 is a diagram showing the relationship between the setting of the water power of washing water at the time of extra washing and at the time of normal washing and the discharge pressure (central pressure) of washing water from a pump 13.

FIG. 35 is a diagram showing the relationship between the setting of the water power of washing water at the time of extra washing and at the time of normal washing and the discharge pressure (central pressure) of washing water from a pump 13.

As described in the foregoing, at the time of the extra washing, the controller 4 makes the number of revolutions of the pump 13 larger, as compared with that in the case where the user sets the water power to "strong" by the water power adjustment switch 302*a* shown in FIG. 32 or FIG. 33 at the time of posterior washing or at the time of bidet washing (hereinafter referred to as the time of normal washing). Consequently, the discharge pressure of the washing water sprayed from a posterior nozzle 1 is higher than the discharge pressure of the washing water sprayed from the posterior nozzle 1 or a bidet nozzle 2 at the time of the normal washing, as shown in FIG. 35. As a result, at the time of the extra washing, the washing water pressurized at a higher pressure than that at the time of the normal washing is sprayed from the posterior nozzle 1. In this case, the velocity of flow and the flow rate of the washing water sprayed from the posterior nozzle 1 are increased.

Figure 36:
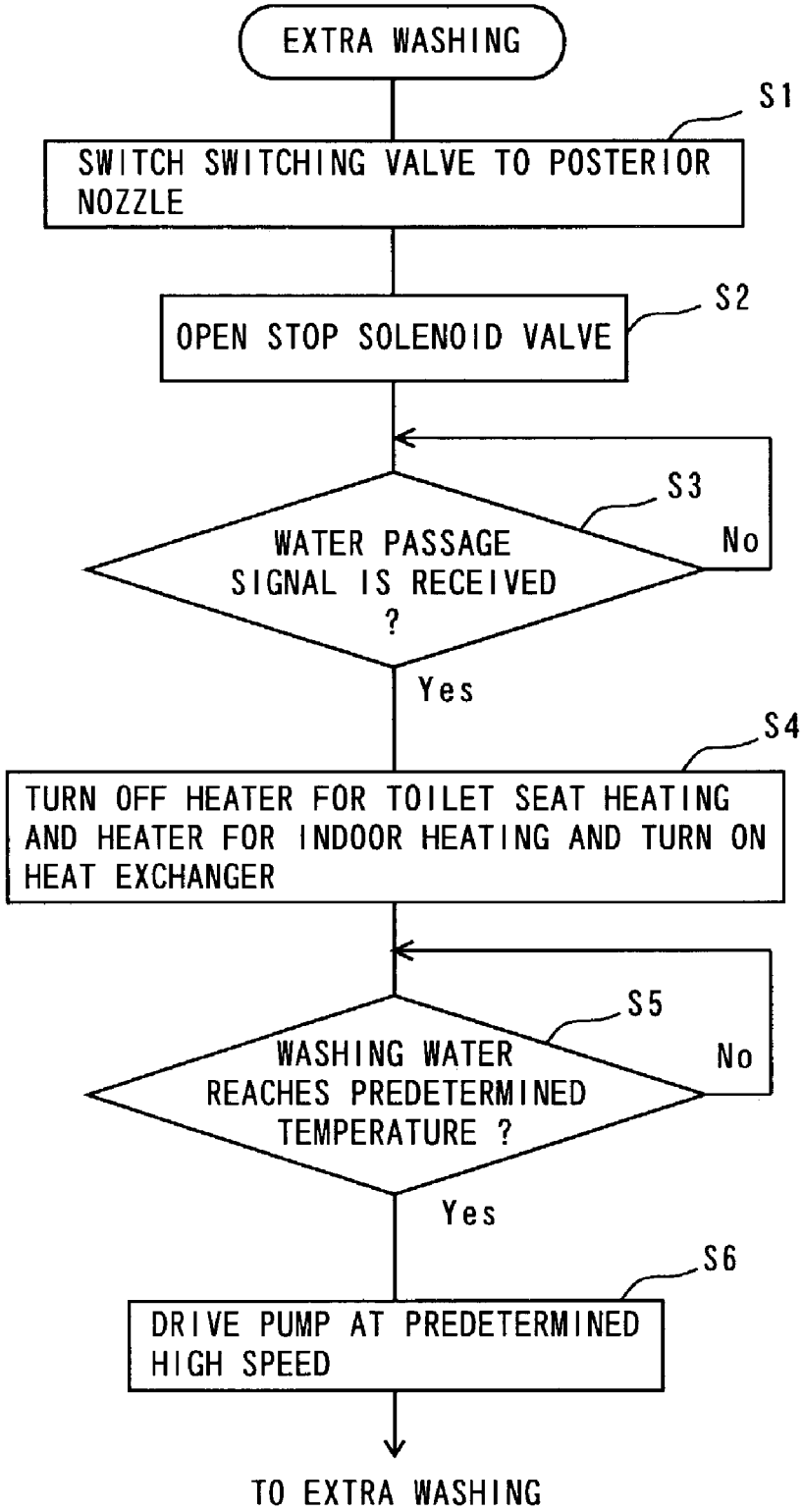
FIG. 36 is a flow chart showing the detailed operations of a sanitary washing apparatus in extra washing.

FIG. 36 is a flow chart showing the detailed operations of the sanitary washing apparatus 100 in extra washing.

Description is made of the operations of the sanitary washing apparatus 100 in the extra washing using FIGS. 32, 33, and 36.

The controller 4 switches, when it judges that the user presses the extra switch 313 shown in FIG. 33, the switching valve 14 to the posterior nozzle 1 (step S1). The controller 4 then opens a stop solenoid valve 9, to supply washing water to the heat exchanger 11 (step S2). Further, the controller 4 judges whether or not a water passage signal is received from the water passage sensor 12*d* provided on the outlet side (on the downstream side) of the heat exchanger 11 (step S3). The water passage sensor 12*d* transmits the water passage signal to the controller 4 only when the pipe 203 is filled with the washing water. Consequently, the controller 4 judges, when it receives the water passage signal from the water passage sensor 12*d*, that a snaked pipe 510 in the heat exchanger 11 connected to the pipe 203 is filled with the washing water.

Furthermore, the controller 4 turns the heater for toilet seat heating 16 and the heater for indoor heating 15 off and turns the heat exchanger 11 on, to start the heating of the washing water (step S4). Consequently, a large part of power supplied to the sanitary washing apparatus 100 is concentrically applied to the heat exchanger 11.

Furthermore, the controller 4 judges whether or not the temperature of the washing water reaches a predetermined temperature on the basis of the measured temperature value given from a temperature sensor 12*b* (step S5).

When it is judged that the temperature of the washing water reaches the predetermined temperature, the controller 4 rotates the pump 13 at a predetermined high speed (step S6). Consequently, the washing water pressurized at a high pressure by the pump 13 is sprayed from the posterior nozzle 1 at a high velocity of flow and a high flow rate.

It is preferable that the predetermined temperature shown in the step 5 is set such that the temperature of the washing water sprayed from the posterior nozzle 1 is a temperature at which no uncomfortable feeling is given to the user.

Figure 37:
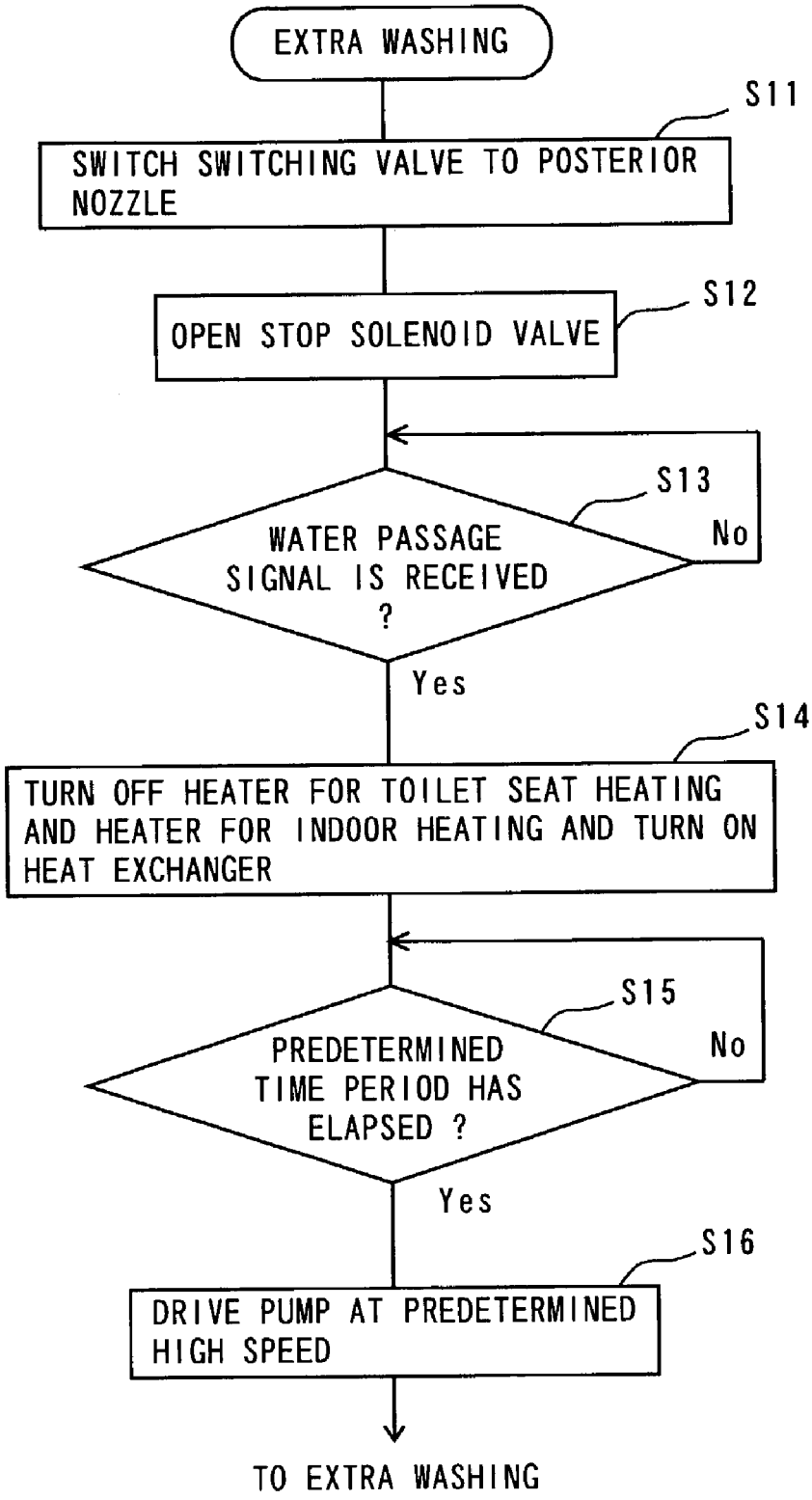
FIG. 37 is a flow chart showing the detailed other operations of a sanitary washing apparatus in extra washing.

FIG. 37 is a flow chart showing the detailed other operations of the sanitary washing apparatus 100 in extra washing.

Description is made of the other operations of the sanitary washing apparatus 100 in the extra washing using FIGS. 33, 36, and 37.

The controller 4 switches, when it judges that the user presses the extra switch 313 shown in FIG. 33, the switching valve 14 to the posterior nozzle 1 (step S11). The controller 4 then opens the stop solenoid valve 9, to supply washing water to the heat exchanger 11 (step S12). Further, the controller 4 judges whether or not a water passage signal is received from the water passage sensor 12*d* provided on the outlet side (on the downstream side) of the heat exchanger 11 (step S13). The water passage sensor 12*d* transmits the water passage signal to the controller 4 only when the pipe 203 is filled with the washing water. Consequently, the controller 4 judges, when it receives the water passage signal from the water passage sensor 12*d*, that the snaked pipe 510 in the heat exchanger 11 connected to the pipe 203 is filled with washing water.

Furthermore, the controller 4 turns the heater for toilet seat heating 16 and the heater for indoor heating 15 off and turns the heat exchanger 11 on, to start the heating of the washing water (step S14). Consequently, a large part of power supplied to the sanitary washing apparatus 100 is concentrically applied to the heat exchanger 11.

Furthermore, the controller 4 judges whether or not a predetermined time period has elapsed (step S15).

When it is judged that the predetermined time period has elapsed, the controller 4 rotates the pump 13 at a predetermined high speed (step S16). Consequently, the washing water pressurized at a high pressure by the pump 13 is sprayed from the posterior nozzle 1 at a high velocity of flow and a high flow rate.

It is preferable that the predetermined time period in the step 15 is set to a time period sufficient for the temperature of the washing water sprayed from the posterior nozzle 1 to be heated to a temperature at which no uncomfortable feeling is given to the user.

As described in the foregoing, at the time of the extra washing, the pump 13 is rotated at a larger number of revolutions than that in the case where the water power is set to "strong" by the water power adjustment switch 302*a*, thereby making it possible to spray the washing water pressurized at a high pressure to the anus of the user from the posterior nozzle 1 at a high velocity of flow and a high flow rate. Consequently, the user can instantaneously wash the anus of the user and its surroundings at a high velocity of flow and a high flow rate. Further, the anus of the user and the surroundings are stimulated, and the washing water enters the anus. Accordingly, the musculus sphincter ani internus can be relaxed by stimulating involuntary muscle, thereby making it possible to hasten the bowels of the user efficiently and reliably.

The sanitary washing apparatus 100 according to the present embodiment may be provided with an adjusting function for adjusting the temperature of the washing water sprayed from the posterior nozzle at the time of the extra washing to a temperature at which no uncomfortable feeling is given to the user.

Figure 38:
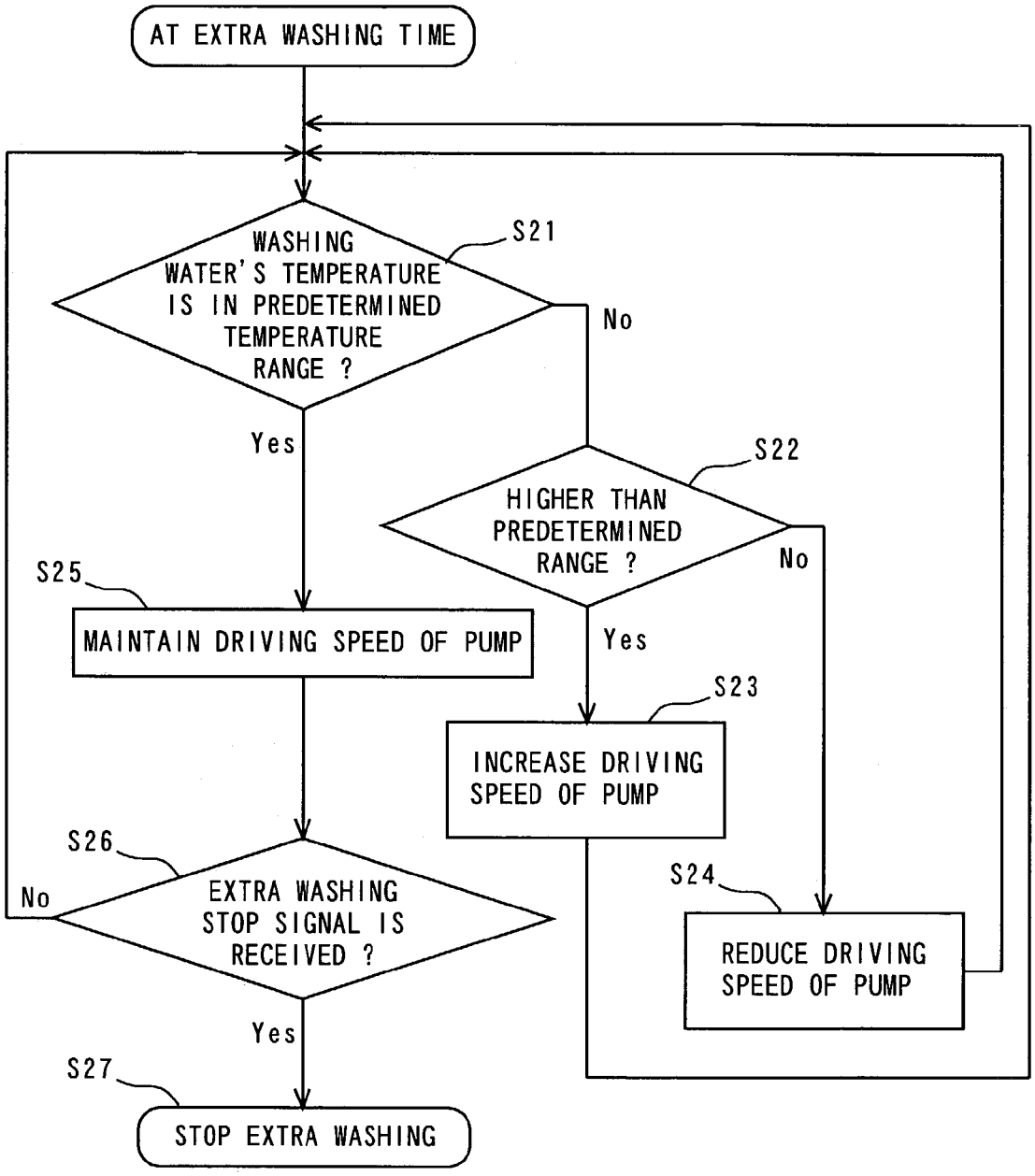
FIG. 38 is a flow chart showing the operations of a sanitary washing apparatus having the function of adjusting the temperature of washing water at the time of extra washing.

FIG. 38 is a flow chart showing the operations of a sanitary washing apparatus 100 having a temperature adjusting function of washing water at the time of the extra washing.

Description is made of the operations of the sanitary washing apparatus 100 with respect to the adjustment of the temperature of the washing water at the time of the extra washing using FIGS. 33, 34, and 38.

In the sanitary washing apparatus having the temperature adjusting function of the washing water at the time of the extra washing, a predetermined temperature range of the washing water in which no uncomfortable feeling is given to the user is previously set in the controller 4 shown in FIG. 34.

At the time of the extra washing, the controller 4 judges whether or not the temperature of the washing water currently sprayed from the nozzle is within the predetermined temperature range previously set on the basis of the measured temperature value given from the temperature sensor 12*b* (step S21).

The controller 4 judges, when it judges that the temperature of the washing water currently sprayed from the nozzle is not within the predetermined temperature range, whether or not the temperature of the washing water is higher than the predetermined temperature range (step S22). The controller 4 raises, when it judges that the temperature of the washing water is higher than the predetermined temperature range, the driving speed of the pump 13 (the rotation speed of the motor 130 shown in FIG. 5 in the pump 13) by a predetermined speed (step S23), to repeat the above-mentioned operation in the step S21. Further, the controller 4 reduces, when it judges that the temperature of the washing water is not higher than the predetermined temperature range, the driving speed of the pump 13 by a predetermined speed (step S24), to repeat the above-mentioned operation in the step S21.

The controller 4 maintains, when it judges in the foregoing step S21 that the temperature of the washing water currently sprayed from the nozzle is within the predetermined temperature range, the driving speed of the pump 13 at a speed at which the pump 13 is currently operated (step S25).

The controller 4 judges whether or not an extra washing stop signal representing the stop of extra washing is received from the remote control device 300*b* shown in FIG. 33 after performing the above-mentioned operations in the steps S21 to S25 (step S26). The controller 4 stops, when it receives the extra washing stop signal, the extra washing (step S27). Further, the controller 4 repeats the above-mentioned operations in the steps S21 to S26 when it does not receive the extra washing stop signal.

Although in the foregoing step S23, the controller 4 reduces the driving speed of the pump 13, the driving speed must be set to a value higher than at least the driving speed at the time of the normal washing.

According to the temperature adjusting function of the washing water at the time of the extra washing, described above, the temperature of the washing water sprayed from the nozzle is always set within the predetermined temperature range even at the time of the extra washing. Consequently, the user does not obtain an uncomfortable feeling due to the decrease in the temperature of the washing water, for example, at the time of the extra washing in which a large amount of washing water is sprayed from the nozzle.

In the sanitary washing apparatus 100 according to the present embodiment, the posterior switch 303 and the bidet switch 306 correspond to a normal washing instruction device, the extra switch 313 corresponds to a stimulatory washing instruction device, the extra timer dial 313*c* corresponds to a timer, the water power adjustment switches 302*a* and 302*b* correspond to a water power setting device, and the heat exchanger 11 corresponds to a heating device and an instantaneous heating device. Further, the heater for indoor heating 15 and the heater for toilet seat heating 16 correspond to a heating system, the temperature sensor 12*b* corresponds to a temperature sensing device, and the extra washing corresponds to stimulatory washing.

(Another Example of Remote Control Device)

Figure 39:
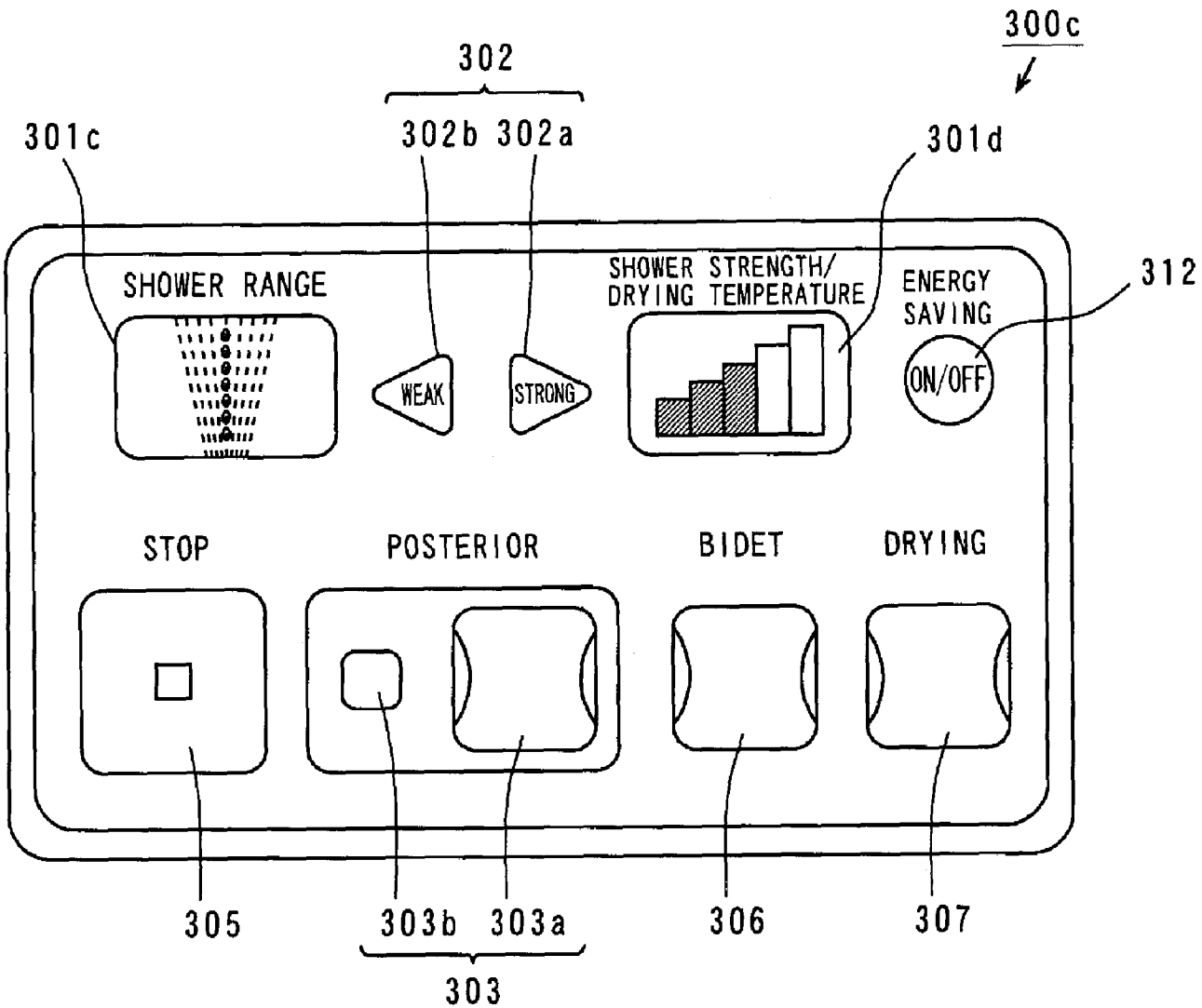
FIG. 39 is a schematic view showing an example of the configuration of the remote control device in the sanitary washing apparatus according to the first embodiment.

FIG. 39 is a schematic view showing another example of the remote control device 300 in the sanitary washing apparatus 100 according to the first embodiment.

A remote control device 300*c* shown in FIG. 39 comprises a water power display panel 301*d*, a spray form display panel 301*c*, and an energy saving switch 312 in addition to the various types of adjustment switches provided in the remote control device 300 shown in FIG. 2. Further, a posterior switch 303 comprises a posterior on-off switch 303*a* and a washing area variable switch 303*b*.

The posterior on-off switch 303*a* is pressed when a user desires to start washing by spraying washing water from the posterior nozzle 1 in the nozzle unit 30 shown in FIG. 2. Further, the washing area variable switch 303*b* is pressed when the user desires to change the spray form of the washing water sprayed from the posterior nozzle 1 in the nozzle unit 30.

In the remote control device 300*c*, the spray form is continuously changed from dispersed spiral flow to linear flow by continuously pressing the washing area variable switch 303*b* for a predetermined time period, and is continuously changed from linear flow to dispersed spiral flow by further continuously pressing the washing area variable switch 303*b*. Further, the spray form is gradually changed from linear flow to dispersed spiral flow by intermittently pressing the washing area variable switch 303*b* for a predetermined time period, and is gradually changed from linear flow to dispersed spiral flow by further continuously pressing the washing area variable switch 303*b*. The energy saving switch 312 is pressed in a case where the user desires to reduce power consumed by the sanitary washing apparatus 100.

Description is now made of the operations of the controller 4 shown in FIG. 2 in a case where the user presses the posterior on-off switch 303*a*, the washing area variable switch 303*b*, and the energy saving switch 312.

The user presses, when he or she desires to start washing by spraying the washing water from the posterior nozzle 1 in the nozzle unit 30 shown in FIG. 3, the posterior on-off switch 303*a* shown in FIG. 39. Consequently, the remote control device 300*c* transmits to the controller 4 a control signal for rotating the pump 13 and a control signal for operating the switching valve 14 in order to spray washing water in dispersed spiral flow from the posterior nozzle 1. Therefore, the controller 4 controls the operations of the pump 13 and the switching valve 14 shown in FIG. 3, respectively, on the basis of the control signals transmitted from the remote control device 300*c*. Consequently, the washing water in the form of dispersed spiral flow is sprayed onto a surface to be washed from the posterior nozzle 1.

The user then presses, when he or she desires to change the spray form of the washing water sprayed from the posterior nozzle 1, the washing area variable switch 303*b* shown in FIG. 39. Consequently, the remote control device 300*c* transmits a control signal for changing the spray form of the washing water discharged from the posterior nozzle 1. Therefore, the controller 4 instructs the motor 141 in the switching valve 14 shown in FIG. 3 to rotate on the basis of the control signal transmitted from the remote control device 300*c*. Consequently, the spray form of the washing water sprayed onto the surface to be washed from the posterior nozzle 1 is changed.

The user presses, when he or she desires to reduce power consumed by the sanitary washing apparatus 100, the energy saving switch 312 shown in FIG. 39. Consequently, the remote control device 300*c* transmits to the controller 4 a signal for reducing the consumption of the power. The controller 4 reduces the consumption of the power of each type of device shown in FIG. 3 on the basis of the signal, for reducing the power consumption, transmitted from the remote control device 300*c*. For example, a time period elapsed since a stop switch 305 was pressed is measured by a timer or the like provided in the remote control device 300*c*, to reduce the power consumption by stopping the supply of power from a power supply circuit when the predetermined time period has elapsed.

The spray form display panel 301*c* displays the current spray form (washing area) of the washing water in response to the pressing operation of the washing area variable switch 303*b*, described above. The user views the display on the spray form display panel 301*c*, thereby making it possible to easily grasp the spray form of the washing water, for example, "a wide area is cleaned by washing water in the form of dispersed spiral flow" or "concentrically cleaned by washing water in the form of linear flow". The displayed state on the spray form display panel 301*c* will be described later.

On the other hand, the water power display panel 301*d* gradually displays the current state of the water power of the washing water in the shape of a bar graph in response to the pressing operations of the water power adjustment switches 302*a* and 302*b* in the remote control device 300*c*. Herein, the water power of the washing water indicates the average flow rate of the washing water sprayed from the nozzle unit 30 (the pressure at the center of fluctuations in the periodical pressure fluctuations of the washing water). The user views the display on the water power display panel 301*d*, thereby making it possible to easily grasp the water power of the washing water, for example, to judge "water power is the maximum" if a display with five bar graphs lights up, judge "water power is the minimum" if a display with one bar graph lights up, and judge "water power is standard" if a display with three bar graphs lights up.

Figure 40:
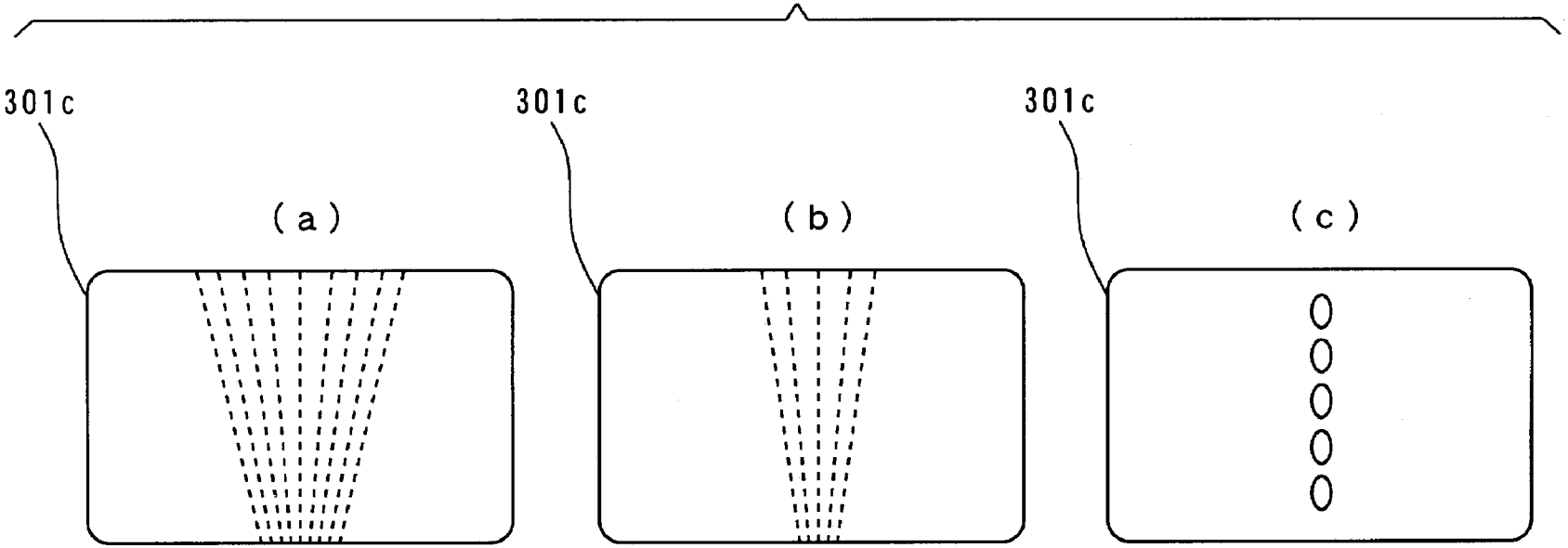
FIG. 40 is a schematic view showing the state of display on a spray form display panel.

FIG. 40 is a schematic view showing the displayed state on the spray form display panel 301*c*.

FIG. 40(*a*) shows the display on the spray form display panel 301*c* in a case "a wide area is cleaned by washing water in the form of dispersed spiral flow", 40(*c*) shows the display on the spray form display panel 301*c* in a case "concentrically cleaned by washing water in the form of linear flow", and FIG. 40(*b*) shows the display on the spray form display panel 301*c* in an intermediate state between FIG. 40(*a*) and FIG. 40(*c*).

The spray form display panel 301*c* shown in FIG. 40 is composed of a liquid crystal display device. By pressing the washing area variable switch 303*b* in the remote control device 300*c*, the spray form of the washing water sprayed from the posterior nozzle 1 is changed, the display on the spray form display panel 301*c* in the remote control device 300*c* is changed from the display shown in FIG. 40(*a*) to the display shown in FIG. 40(*b*) and the display shown in FIG. 40(*c*). Further by continuously pressing the washing area variable switch 303*b*, the spray form of the washing water sprayed from the posterior nozzle 1 is changed, the display on the spray form display panel 301*c* in the remote control device 300 is changed from the display shown in FIG. 40(*c*) to the display shown in FIG. 40(*b*) and the display shown in FIG. 40(*a*).

Although in the present embodiment, the displays shown in FIGS. 40(*a*) to FIG. 40(*c*) are on the spray form display panel 301*c*, the present invention is not limited to the same. For example, the area of the washing water sprayed onto the surface to be washed of the user may be displayed on the spray form display panel 301*c*. For example, a large circle is displayed on the spray form display panel 301*c* when the washing water in the form of dispersed spiral flow is sprayed from the posterior nozzle 1, while a small circle is displayed on the spray form display panel 301*c* when the washing water in the form of linear flow is sprayed from the posterior nozzle 1.

As described in the foregoing, the user views the display on the spray form display panel 301*c*, thereby making it possible to grasp the spray form of the washing water in real time and easily while adjusting the spray form of the washing water in conformity with his or her physical conditions or taste.

The display on the spray form display panel 301*c* can be directly changed without passing through the controller 4 from the washing area variable switch 303*b*, thereby making it possible to simplify the configuration of an electrical circuit.

The spray form display panel 301*c* and the water power display panel 301*d* may be composed of one liquid crystal display device. In this case, it is possible to further simplify the configuration of the electrical circuit.

(Still Another Example of Remote Control Device)

Figure 41:
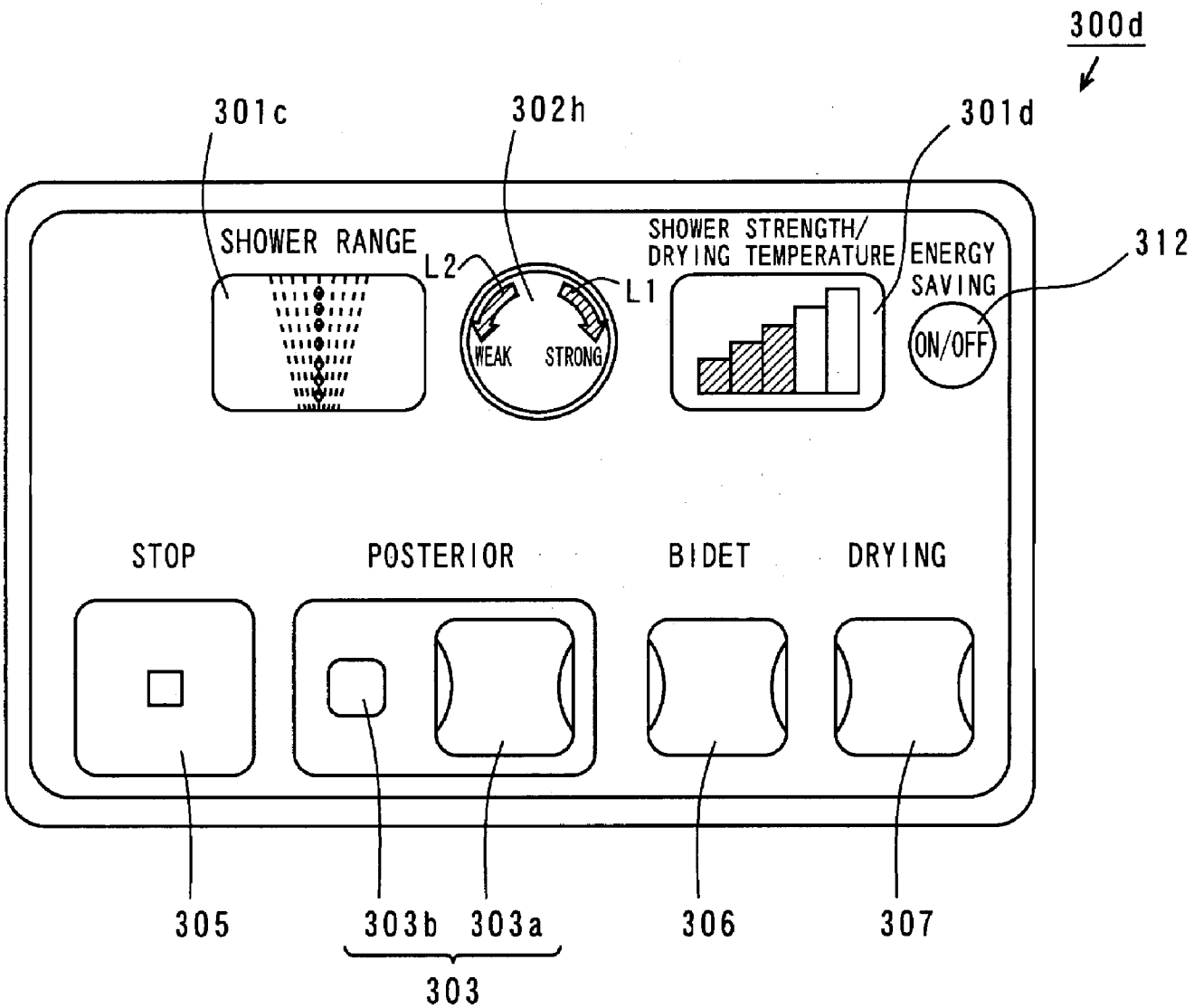
FIG. 41 is a schematic plan view showing another example of a remote control device that is applicable to the sanitary washing apparatus according to the first embodiment.
Figure 42:
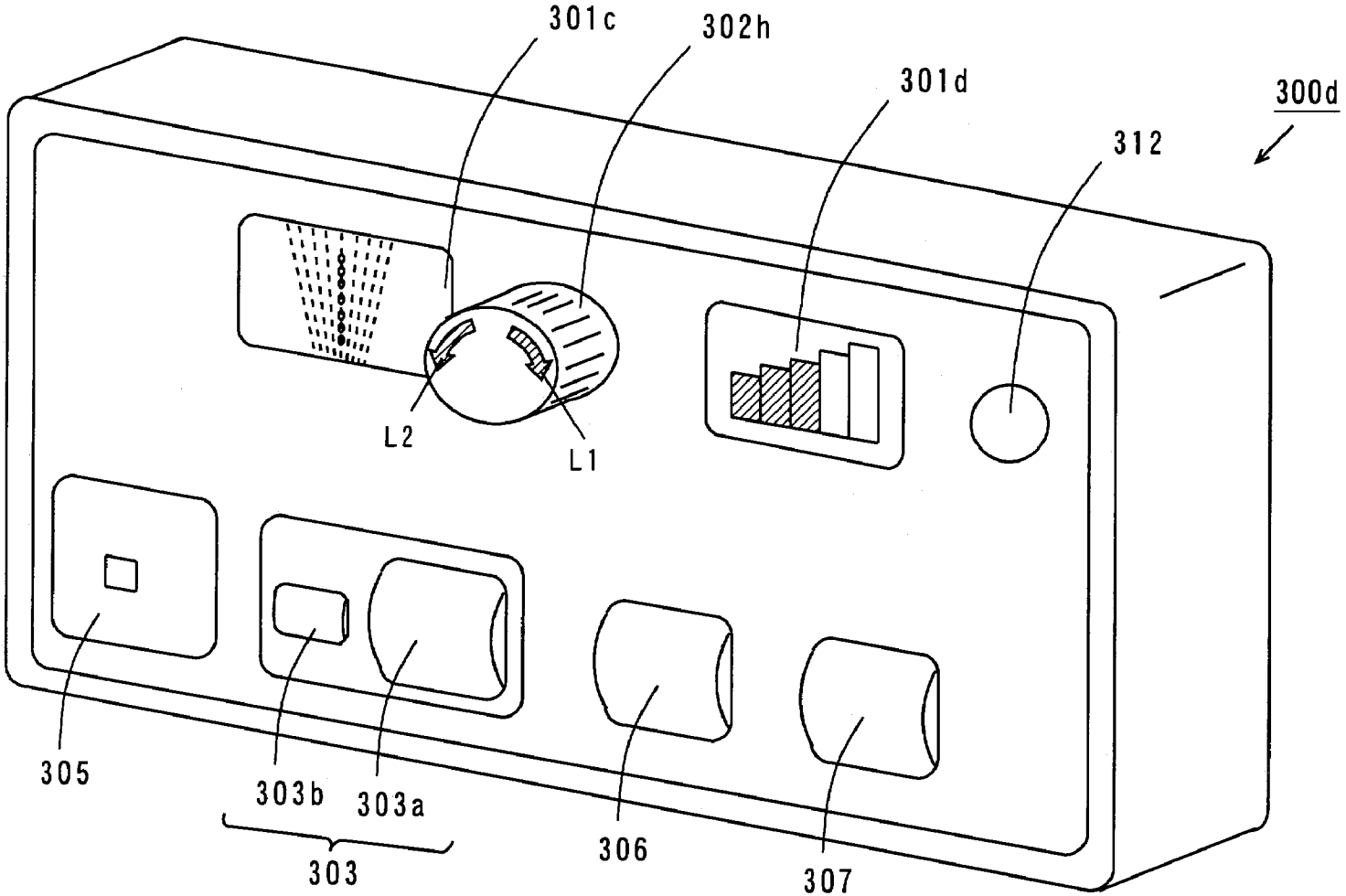
FIG. 42 is a perspective view of the remote control device shown in FIG. 41.

FIG. 41 is a schematic plan view showing still another example of a remote control device that is applicable to the sanitary washing apparatus 100 according to the first embodiment, and FIG. 42 is a perspective view of the remote control device shown in FIG. 41.

A remote control device 300*d* shown in FIGS. 41 and 42 is provided with a water power adjustment dial 302*h* in place of the water power adjustment switches 302*a* and 302*b* in the remote control device 300 shown in FIG. 2. The water power adjustment dial 302*h* is attached to an operation surface of a remote control device 300*d* so as to be rotatable in a direction indicated by an arrow L1 and a direction indicated by an arrow L2, as shown in FIGS. 41 and 41.

As shown in FIGS. 41 and 42, a user rotates, when he or she desires to set the water power of washing water sprayed from the nozzle unit 30 to "strong", the water power adjustment dial 302*h* in the direction indicated by the arrow L1. Consequently, the water power of the washing water sprayed from the nozzle unit 30 is set to "strong". On the other hand, the user rotates, when he or she desires to set the water power of the washing water sprayed from the nozzle unit 30 to "weak", the water power adjustment dial 302*h* in the direction indicated by the arrow L2. Consequently, the water power of the washing water sprayed from the nozzle unit 30 is set to "weak.

(Still Another Example of Remote Control Device)

Figure 43:
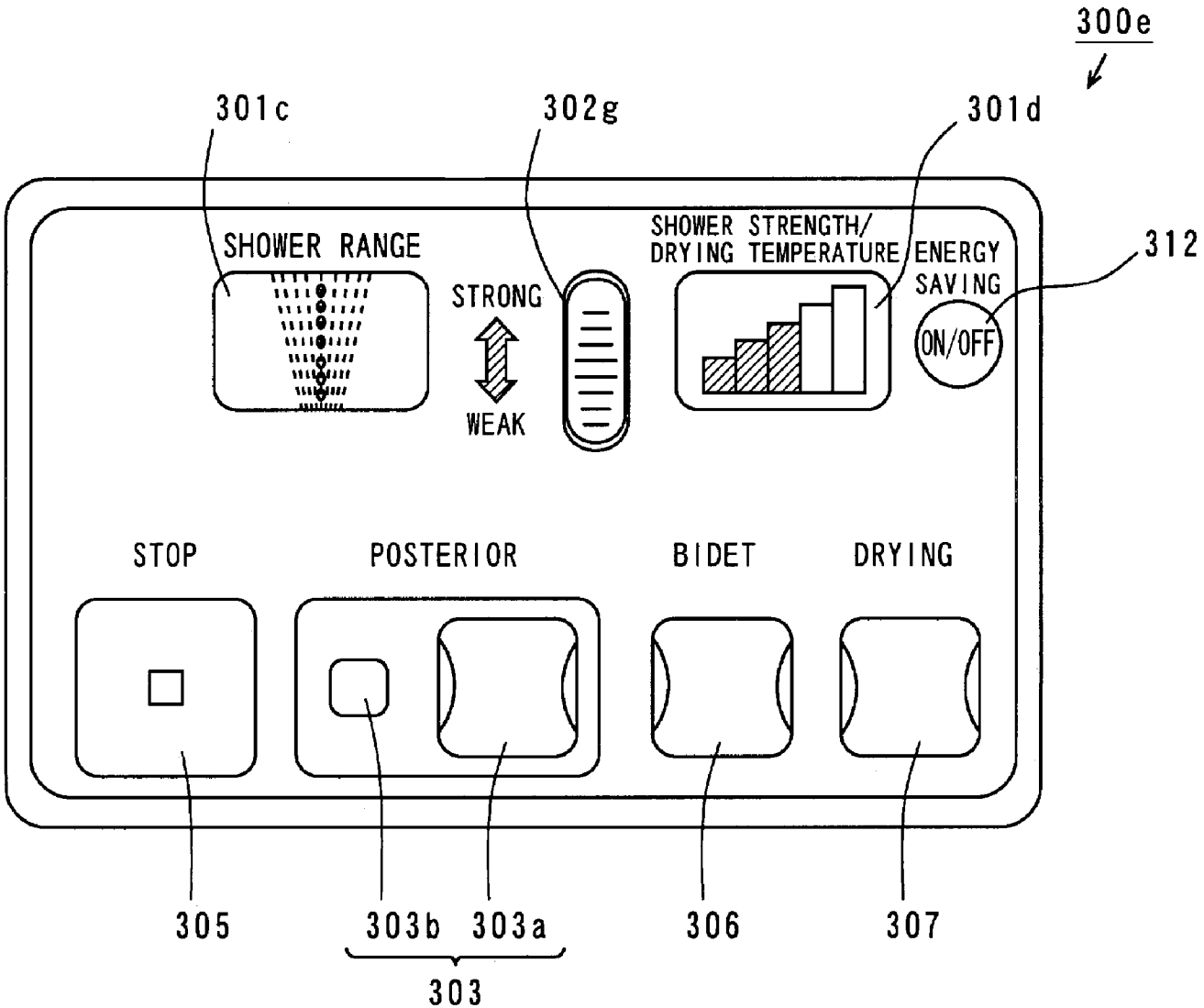
FIG. 43 is a schematic plan view showing still another example of a remote control device that is applicable to the sanitary washing apparatus according to the first embodiment.
Figure 44:
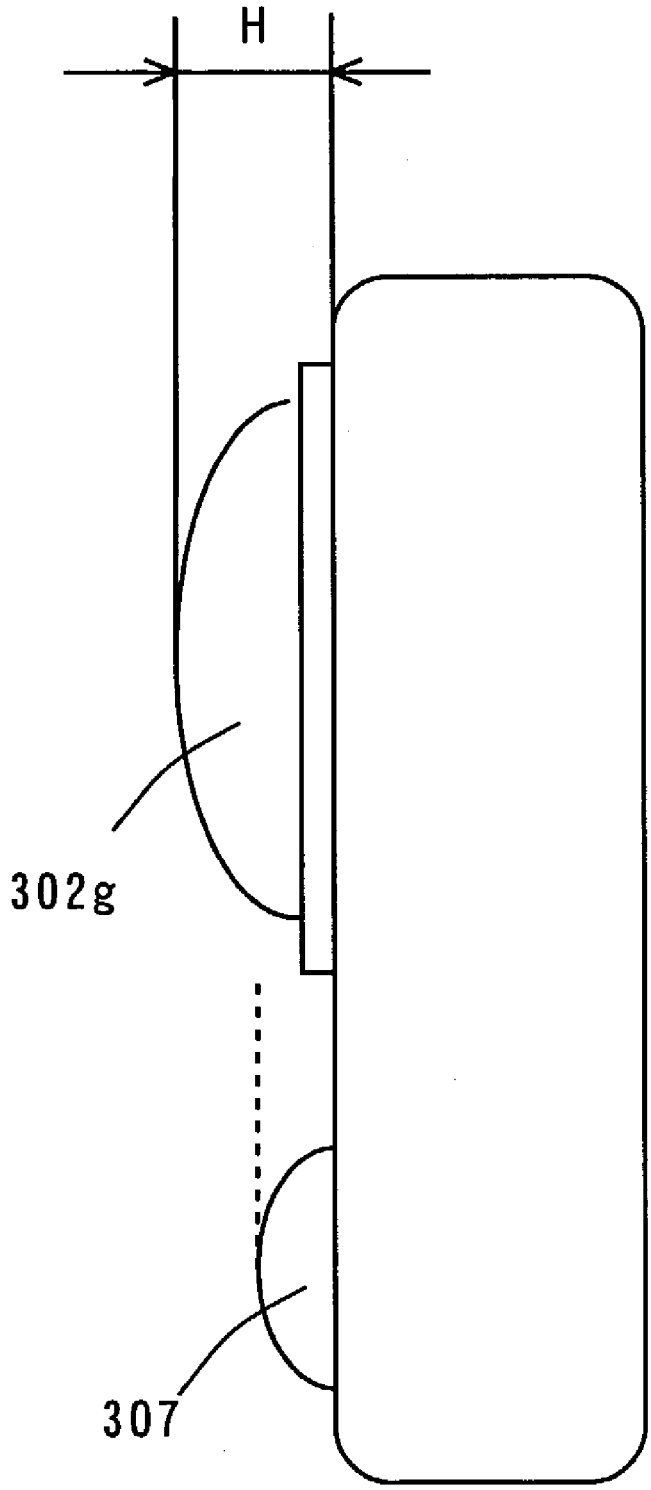
FIG. 44 is a side view of the remote control device shown in FIG. 43.
Figure 45:
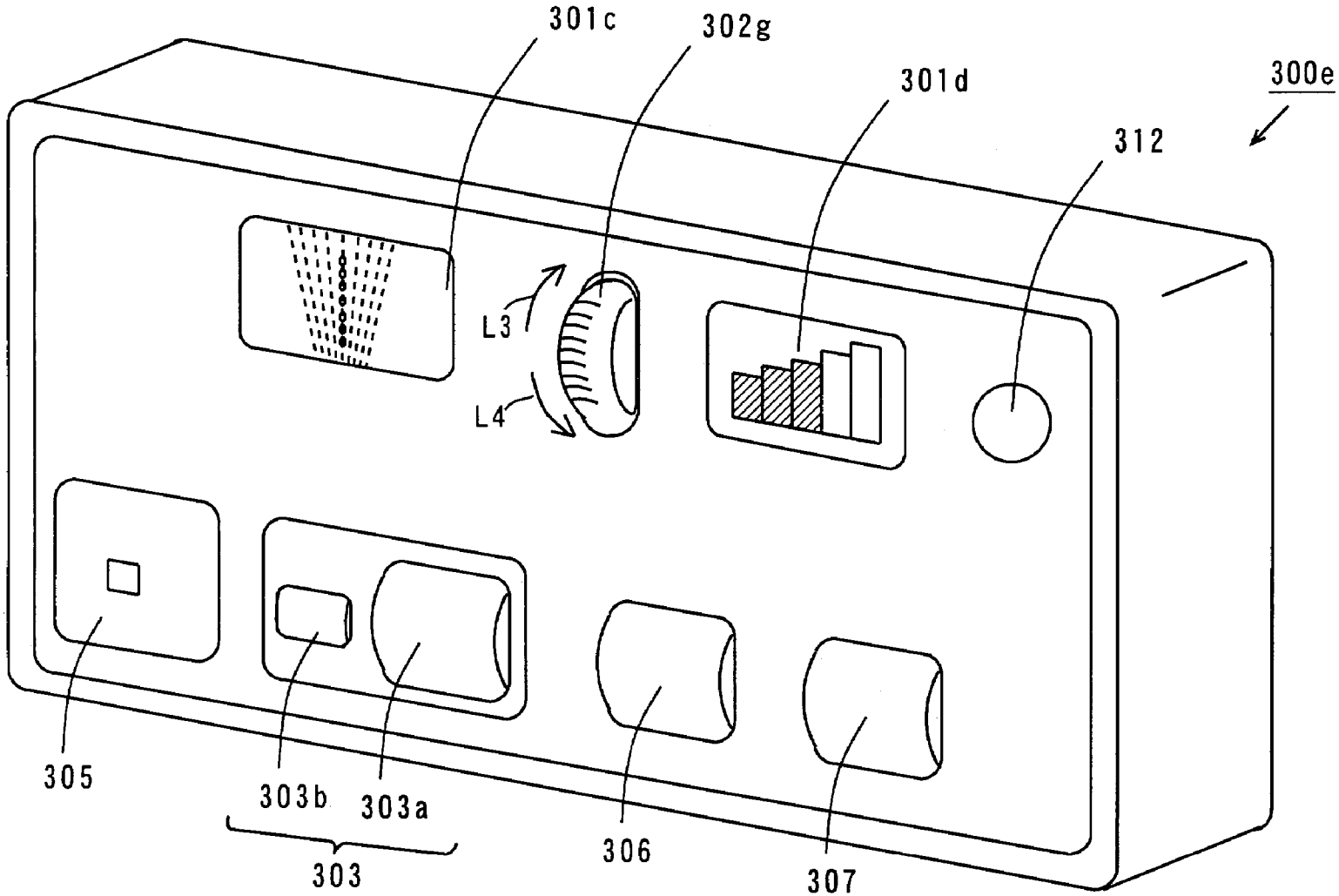
FIG. 45 is a perspective view of the remote control device shown in FIG. 43.

FIG. 43 is a schematic plan view showing still another example of a remote control device that is applicable to the sanitary washing apparatus 100 according to the first embodiment, FIG. 44 is a side view of the remote control device shown in FIG. 43, and FIG. 45 is a perspective view of the remote control device shown in FIG. 43.

A remote control device 300*e* shown in FIGS. 43, 44, and 45 is provided with a water power adjustment dial 302*g* in place of the water power adjustment switches 302*a* and 302*b* in the remote control device 300 shown in FIG. 2. The water power adjustment dial 302*g* is attached so as to be rotatable in a direction indicated by an arrow L3 and a direction indicated by an arrow L4 in the upward and downward direction of a remote control device 300*e*, as shown in FIG. 45.

As shown in FIG. 44, the water power adjustment dial 302*g* in the remote control device 300*e* is formed so as to project forward from an operation surface of the remote control device 300*e*, as compared with other various types of adjustment switches (e.g., a drying switch 307).

For example, it is desirable that the amount of projection H of the water power adjustment dial 302*g* satisfies 3 mm H 100 mm. When the amount of projection H of the water power adjustment dial 302*g* is smaller than 3 mm, the water power adjustment dial 302*g* is not easily noticeable, thereby degrading operability. When the amount of projection H is larger than 100 mm, the water power adjustment dial 302*g* forms an obstacle in a narrow space, thereby degrading operability. Since the water power adjustment dial 302*g* in the remote control device 300*e* thus has a predetermined amount of projection H, operability is improved, thereby making it possible to prevent a malfunction.

A user rotates, when he or she desires to set the water power of washing water sprayed from the nozzle unit 30 to "strong", the water power adjustment dial 302*g* in the direction indicated by the arrow L3. Consequently, the water power of the washing water sprayed from the nozzle unit 30 is set to "strong". On the other hand, the user rotates, when he or she desires to set the water power of the washing water sprayed from the nozzle unit 30 to "weak", the water power adjustment dial 302*g* in the direction indicated by the arrow L4. Consequently, the water power of the washing water sprayed from the nozzle unit 30 is set to "weak.

(Still Another Example of Remote Control Device)

Figure 46:
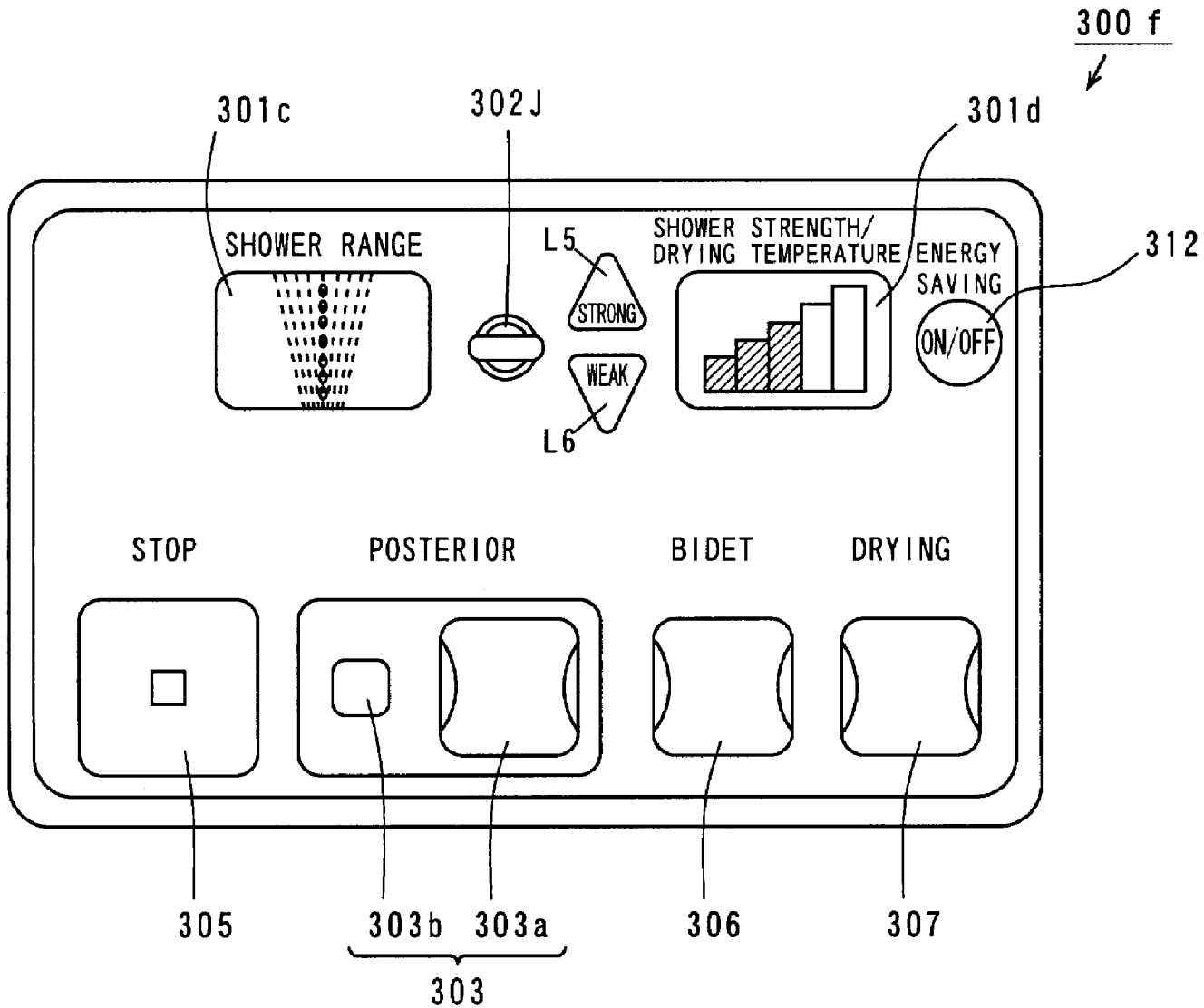
FIG. 46 is a schematic plan view showing a further example of a remote control device that is applicable to the sanitary washing apparatus according to the first embodiment.
Figure 47:
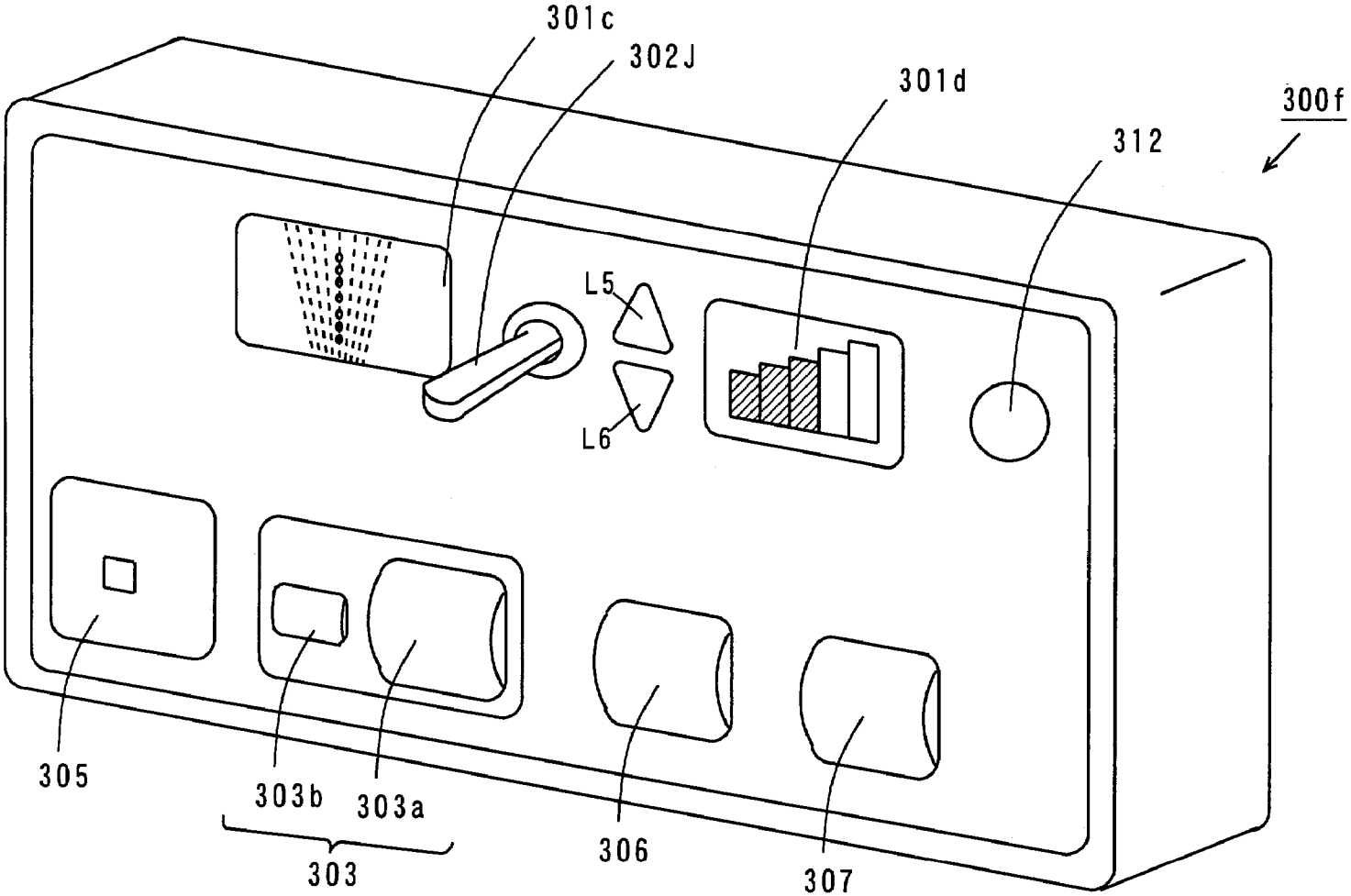
FIG. 47 is a perspective view of the remote control device shown in FIG. 46.

FIG. 46 is a schematic plan view showing still another example of a remote control device that is applicable to the sanitary washing apparatus 100 according to the first embodiment, and FIG. 47 is a perspective view of the remote control device shown in FIG. 46.

A remote control device 300*f* shown in FIGS. 46 and 47 is provided with a water power adjustment lever 302J in place of the water power adjustment switches 302*a* and 302*b* in the remote control device 300*f* shown in FIG. 2. The water power adjustment lever 302J is attached such that it can be inclined in a direction indicated by a triangular arrow L5 and a direction indicated by a triangular arrow L6 in the upward and downward direction of a remote control device 300*f*, as shown in FIG. 47.

A user inclines, when he or she desires to set the water power of washing water sprayed from the nozzle unit 30 to "strong", the water power adjustment lever 302J in the direction indicated by the triangular arrow L5. Consequently, the water power of the washing water sprayed from the nozzle unit 30 is set to "strong". On the other hand, the user inclines, when he or she desires to set the water power of the washing water sprayed from the nozzle unit 30 to "weak", the water power adjustment lever 302J in the direction indicated by the triangular arrow L6. Consequently, the water power of the washing water sprayed from the nozzle unit 30 is set to "weak.

As described in the foregoing, the user views the state of pressure fluctuations of the washing water displayed on the remote control devices 300*c* to 300*f* and the spray form of the washing water, thereby making it possible to know on what pressure fluctuations and what spray form a washing feeling to be currently obtained is based. Consequently, the user can know the pressure fluctuations and the spray form of the washing water sprayed from the nozzle unit 30 when the water power of the washing water is adjusted, thereby making it possible to easily adjust various types of washing feelings conforming to his or her taste.

(Still Another Example of Remote Control Device)

Figure 48:
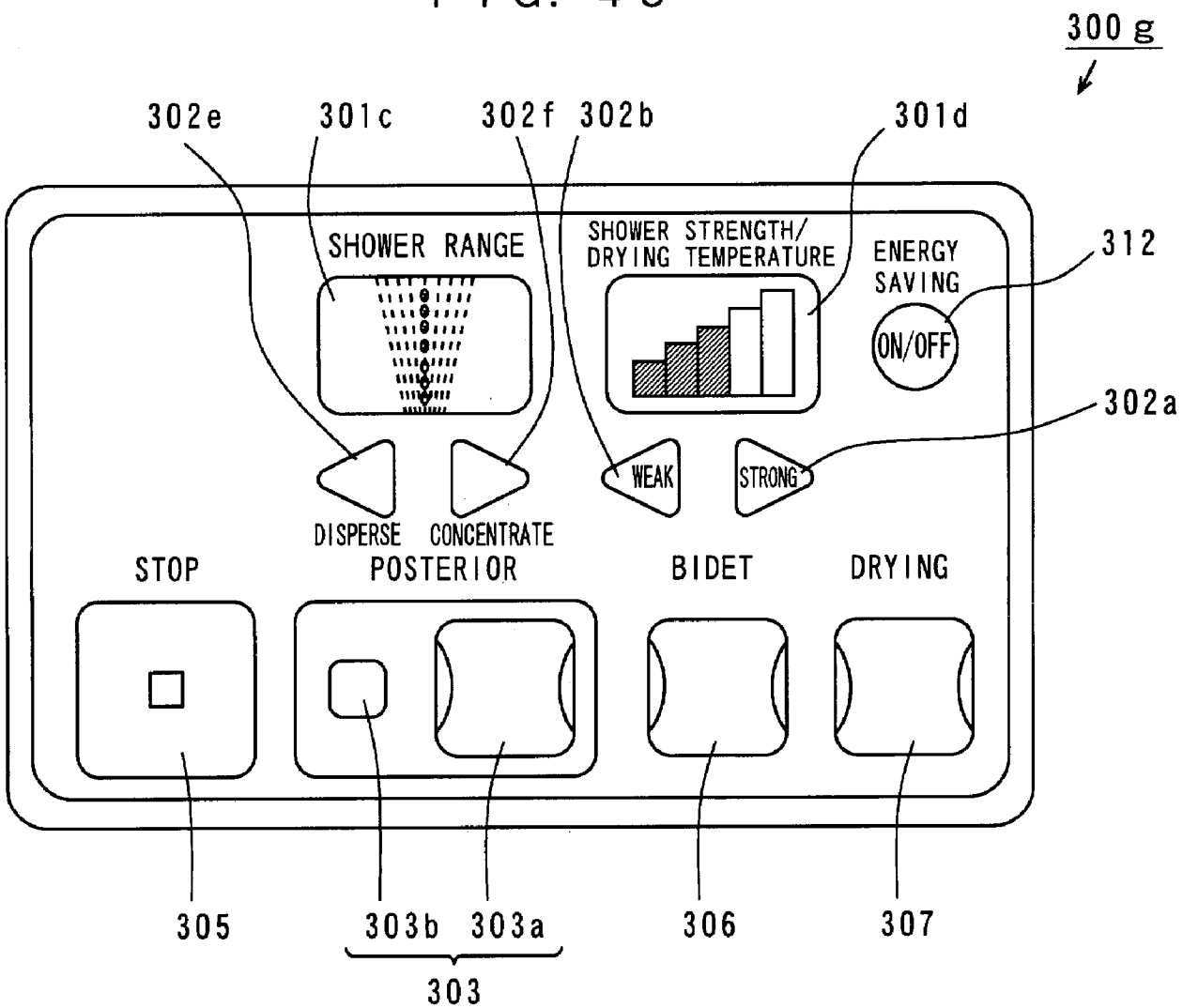
FIG. 48 is a schematic view showing an example of the configuration of a remote control device that is applicable to the sanitary washing apparatus according to the first embodiment.

FIG. 48 is a schematic view showing still another example of a remote control device that is applicable to the sanitary washing apparatus 100 according to the first embodiment.

A remote control device 300*g* shown in FIG. 48 comprises spray form adjustment switches 302*e* and 302*f* in addition to various types of adjustment switches provided in the remote control device 300*c* shown in FIG. 39.

The spray form adjustment switches 302*e* and 302*f* are pressed when a user desires to change the spray form of washing water sprayed from the nozzle unit 30.

Description is now made of the operations of the controller 4 shown in FIG. 2 in a case where the user presses the spray form adjustment switches 302*e* and 302*f*.

The user presses, when he or she desires to change the spray form of the washing water sprayed from the posterior nozzle 1 from dispersed spiral flow to linear flow, the spray form adjustment switch 302*f* shown in FIG. 48. Consequently, the remote control device 300*g* transmits a control signal for changing the spray form of the washing water sprayed from the posterior nozzle 1 from dispersed spiral flow to linear flow. The controller 4 controls the operations of the switching valve 14 shown in FIG. 3 on the basis of the control signal transmitted from the remote control device 300*g*.

On the other hand, the user presses, when he or she desires to change the spray form of the washing water sprayed from the posterior nozzle 1 from linear flow to dispersed spiral flow, the spray form adjustment switch 302*e* shown in FIG. 48. Consequently, the remote control device 300*g* transmits a control signal for changing the spray form of the washing water sprayed from the posterior nozzle 1 from linear flow to dispersed spiral flow. The controller 4 controls the operations of the switching valve 14 shown in FIG. 3 on the basis of the control signal transmitted from the remote control device 300*g*.

(Still Another Example of Remote Control Device)

Figure 49:
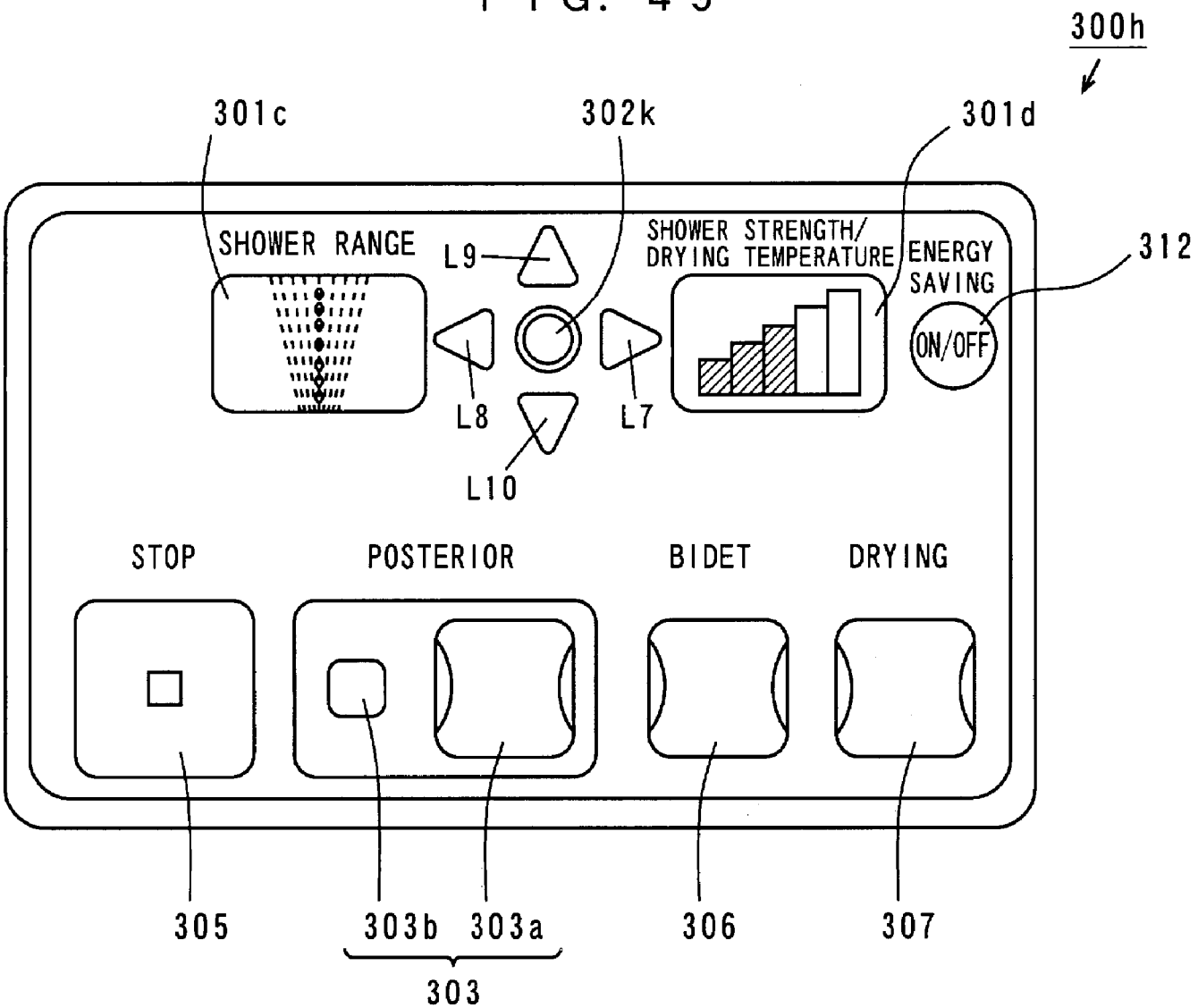
FIG. 49 is a schematic plan view showing still another example of a remote control device that is applicable to the sanitary washing apparatus according to the first embodiment.
Figure 50:
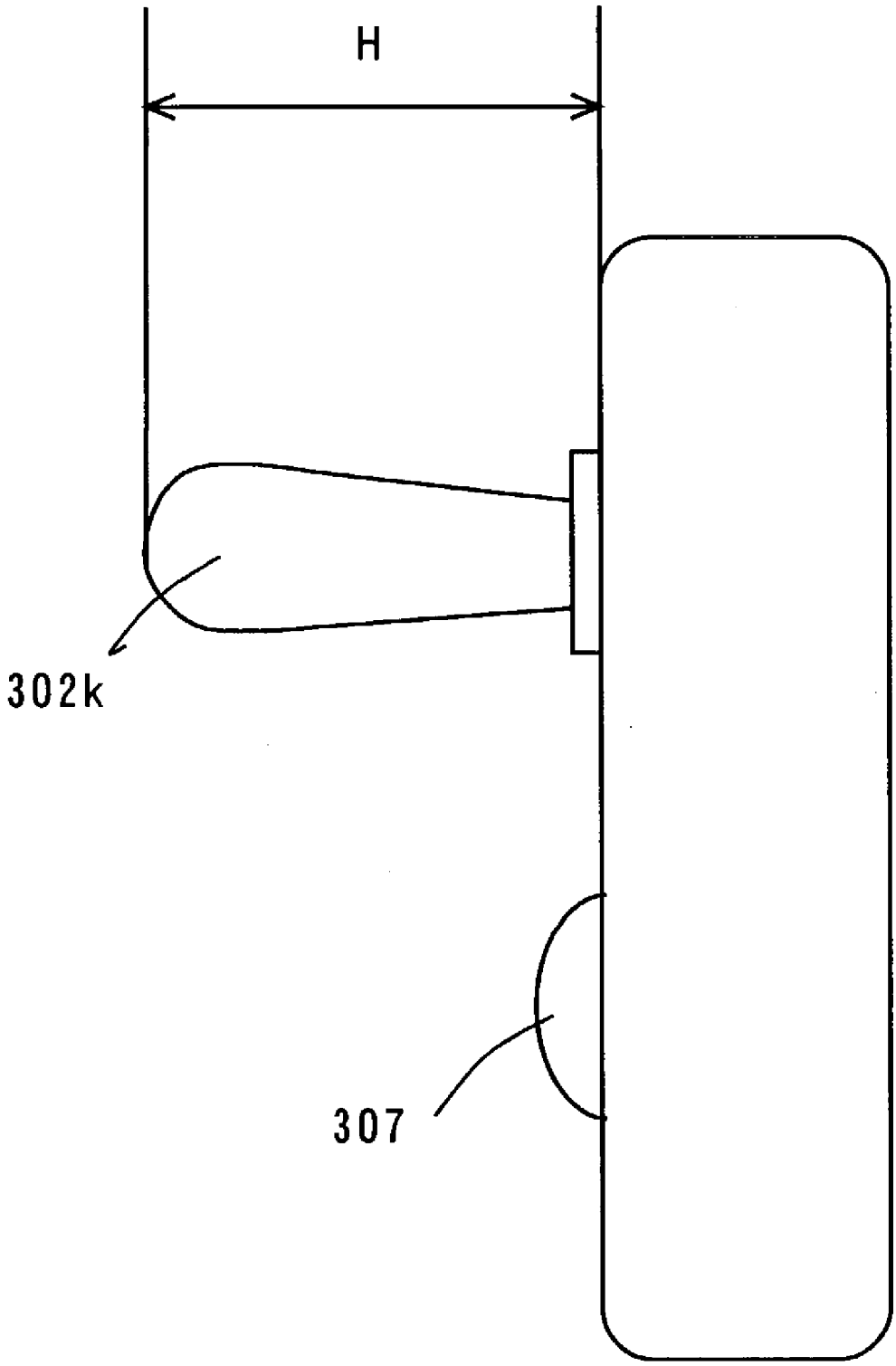
FIG. 50 is a side view of the remote control device shown in FIG. 49.
Figure 51:
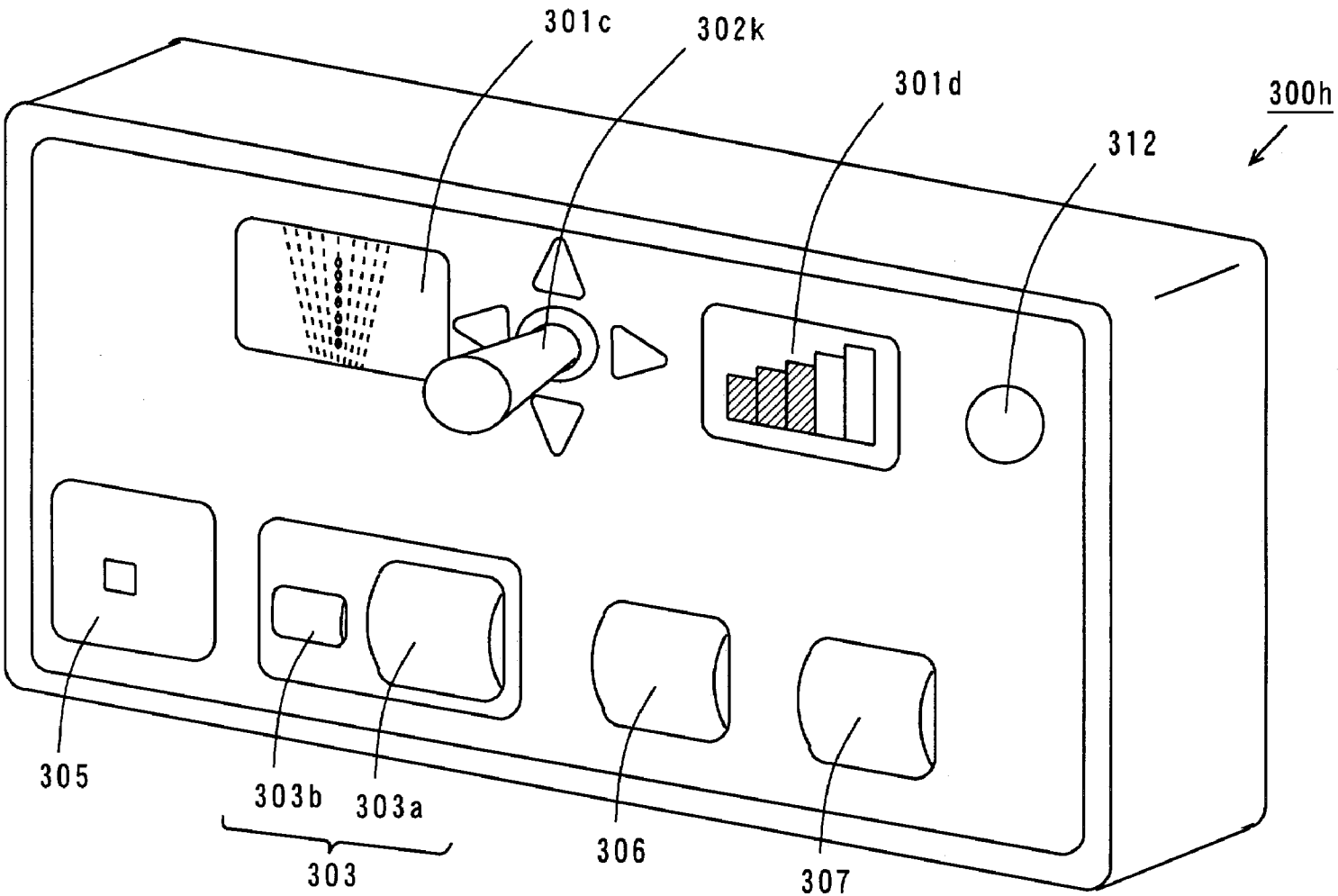
FIG. 51 is a perspective view of the remote control device shown in FIG. 49.

FIG. 49 is a schematic plan view showing still another example of a remote control device that is applicable to a sanitary washing apparatus 100 according to the first embodiment, FIG. 50 is a side view of the remote control device shown in FIG. 49, and FIG. 51 is a perspective view of the remote control device shown in FIG. 49.

A remote control device 300*h* shown in FIGS. 49, 50, and 51 is provided with a four-direction toggle switch (a four-direction jog stick switch) 302*k* in place of water power adjustment switches 302*a* and 302*b* and the spray form adjustment switches 302*e* and 302*f* in the remote control device 300*g* shown in FIG. 48. The four-direction toggle switch 302*k* is attached such that it can be inclined in a direction indicated by a triangular arrow L7, a direction indicated by a triangular arrow L8, a direction indicated by a triangular arrow L9, and a direction indicated by a triangular arrow L10 in the upward and downward and rightward and leftward directions of a remote control device 300*h*.

A user inclines, when he or she desires to set the water power of washing water sprayed from the nozzle unit 30 to "strong", the four-direction toggle switch 302*k* in the direction indicated by the triangular arrow L7. Consequently, the water power of the washing water sprayed from the nozzle unit 30 is set to "strong". On the other hand, the user inclines, when he or she desires to set the water power of the washing water sprayed from the nozzle unit 30 to "weak", the four-direction toggle switch 302*k* in the direction indicated by the triangular arrow L8. Consequently, the water power of the washing water sprayed from the nozzle unit 30 is set to "weak". Further, the user inclines, when he or she desires to change the spray form of the washing water sprayed from the nozzle unit 30 to dispersed spiral flow, the four-direction toggle switch 302*k* in the direction indicated by the triangular arrow L9. Consequently, the spray form of the washing water sprayed from the nozzle unit 30 is changed to dispersed spiral flow. On the other hand, the user inclines, when he or she desires to change the spray form of the washing water sprayed from the nozzle unit 30 to linear flow, the four-direction toggle switch 302*k* in the direction indicated by the triangular arrow L10. Consequently, the spray form of the washing water sprayed from the nozzle unit 30 is changed to linear flow.

As shown in FIG. 50, the four-direction toggle switch 302*k* in the remote control device 300*h* is formed so as to project forward from an operation surface of the remote control device 300*h*, as compared with other various types of adjustment switches (e.g., a drying switch 307).

For example, it is desirable that the amount of projection H of the four-direction toggle switch 302*k* satisfies 3 mm H 100 mm. When the amount of projection H of the four-direction toggle switch 302*k* is smaller than 3 mm, the four-direction toggle switch 302*k* is not easily noticeable, thereby degrading operability. When the amount of projection H is larger than 100 mm, the four-direction toggle switch 302*k* forms an obstacle in a narrow space, thereby degrading operability. Since the four-direction toggle switch 302*k* in the remote control device 300*g* thus has a predetermined amount of projection H, operability is improved, thereby making it possible to prevent a malfunction.

As described in the foregoing, the user views the state of pressure fluctuations of the washing water displayed on the remote control devices 300*g* and 300*h* and the spray form of the washing water, thereby making it possible to know on what pressure fluctuations and what spray form a washing feeling to be currently obtained is based. Consequently, the user can know the pressure fluctuations and the spray form of the washing water sprayed from the nozzle unit 30 when the water power of the washing water is adjusted, thereby making it possible to easily adjust various types of washing feelings conforming to his or her taste.

(Another Example of Pump)

Figure 52:
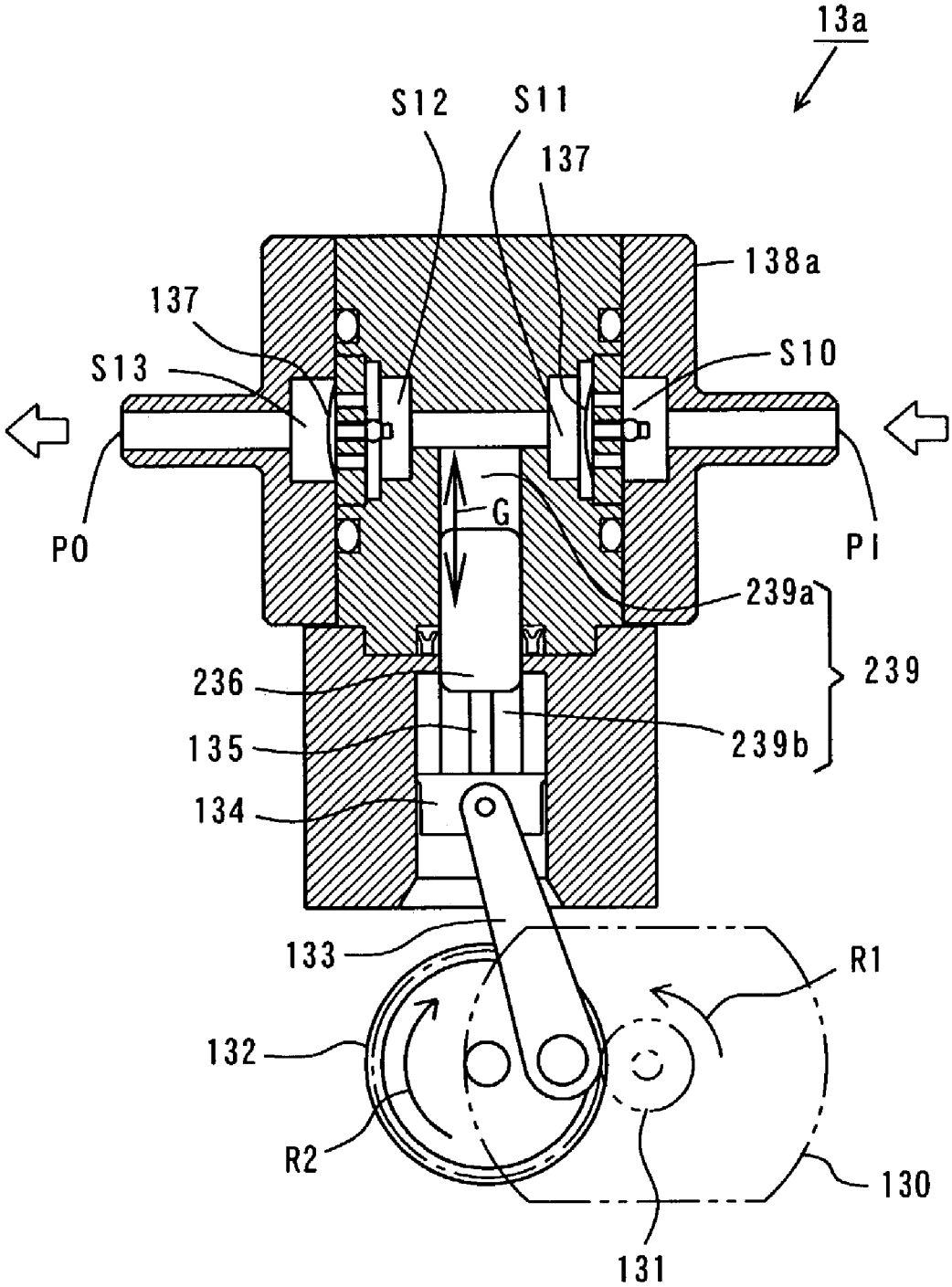
FIG. 52 is a cross-sectional view showing another example of a pump used in the sanitary washing apparatus according to the first embodiment.

FIG. 52 is a cross-sectional view showing another example of a pump that is applicable to the sanitary washing apparatus 100 according to the first embodiment.

A pump 13*a* shown in FIG. 52 is a single acting type reciprocating pump. In FIG. 52, a columnar space 239 is formed in a main body 138*a*. A pressure feeding piston 236 is provided in the columnar space 239. The columnar space 239 is divided into a pump chamber 239*a* and a pump chamber 239*b* by the pressure feeding piston 236.

A washing water inlet PI is provided on one side of the main body 138*a*, and a washing water outlet PO is provided on the other side thereof. The heat exchanger 11 is connected to the washing water inlet PI through the pipe 203 shown in FIG. 3, and the switching valve 14 is connected to the washing water outlet PO through the pipe 203.

The washing water inlet PI communicates with the pump chamber 239*a* through a small chamber S10 and a small chamber S11.

The pump chamber 239*a* communicates with the washing water outlet PO through a small chamber S12 and a small chamber S13.

A gear 131 is attached to the axis of rotation of a motor 130, and a gear 132 is engaged with the gear 131. Further, one end of a crank shaft 133 is attached to the gear 132 so as to be rotatable with its one point supported thereon. A pressure feeding piston 236 is attached to the other end of the crank shaft 133 through a piston holder 134 and a piston holding bar 135.

When the axis of rotation of the motor 130 is rotated on the basis of a control signal fed by the controller 4 shown in FIG. 3, the gear 131 attached to the axis of rotation of the motor 130 is rotated in a direction indicated by an arrow R1, and the gear 132 is rotated in a direction indicated by an arrow R2. Consequently, the pressure feeding piston 236 moves up and down in a direction indicated by an arrow G.

An umbrella packing 137 is provided in each of the small chambers S11 and S13. The configuration and the operations of the umbrella packing 137 are the same as the configuration and the operations of the umbrella packing 137 shown in FIG. 6, described above.

When the pressure feeding piston 236 shown in FIG. 52 moves downward, to increase the volume of the pump chamber 239*a*, for example, the pressure in the pump chamber 239*a* is lower than the pressure in the small chamber S10, whereby the umbrella packing 137 provided in the small chamber S11 is deformed, as shown in FIG. 6(*b*). As a result, the washing water supplied from the washing water inlet PI flows into the pump chamber 239*a* through the small chamber S10 and the small chamber S11. In this case, the pressure in the pump chamber 239*a* is lower than the pressure in the small chamber S13, whereby the umbrella packing 137 provided in the small chamber S13 is not deformed from the state shown in FIG. 6(*a*). As a result, the washing water inside the pump chamber 239*a* is not discharged from the washing water outlet PO.

On the other hand, when the pressure feeding piston 236 shown in FIG. 52 moves upward, to decrease the volume of the pump chamber 239*a*, the pressure in the pump chamber 239*a* is higher than the pressure in the small chamber S10, whereby the umbrella packing 137 provided in the small chamber S11 is not deformed from the state shown in FIG. 6(*a*). As a result, the washing water in the pump chamber 239*a* does not flow into the small chamber S10. In this case, the pressure in the pump chamber 239*a* is higher than the pressure in the small chamber S13, whereby the umbrella packing 137 provided in the small chamber S13 is deformed, as shown in FIG. 6(*b*). As a result, the washing water inside the pump chamber 239*a* is discharged from the washing water outlet PO through the small chamber S12 and the small chamber S13.

Figure 53:
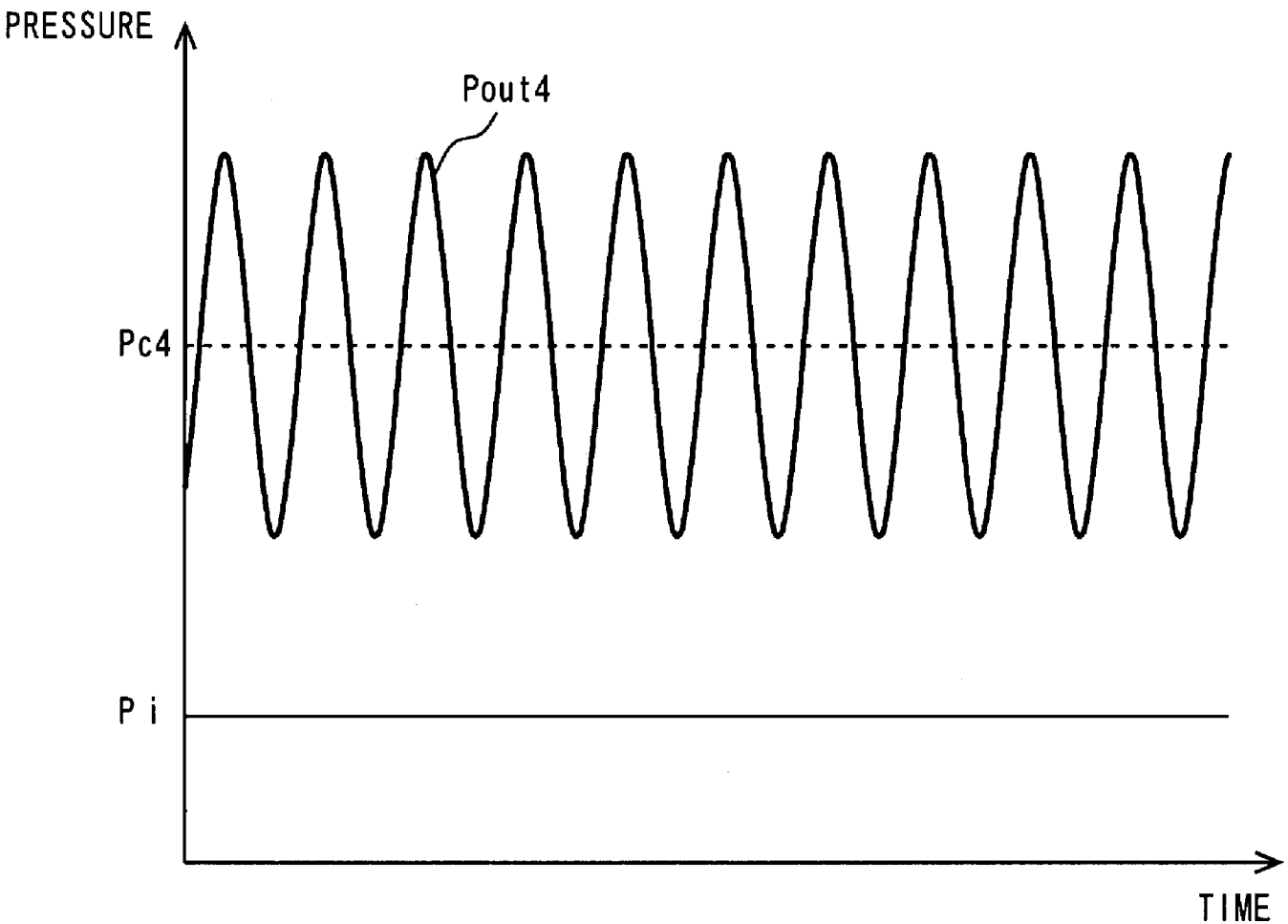
FIG. 53 is a diagram showing the change in pressure in each portion of the pump shown in FIG. 52.

FIG. 53 is a diagram showing the change in pressure in each portion of the pump 13*a* shown in FIG. 52. In FIG. 53, the vertical axis indicates pressure, and the horizontal axis indicates time.

As shown in FIG. 53, washing water at a water supply pressure Pi is supplied to the washing water inlet PI in the pump 13*a*. In this case, the pressure feeding piston 236 shown in FIG. 52 moves up and down, so that the pressure of the washing water in the pump chamber 239*a* is changed. Consequently, the pressure Pout4 of the washing water discharged from the washing water outlet PO in the pump 13*a* is periodically changed up and down, centered at a pressure Pc4, as indicated by a thick solid line.

In the pump 13*a*, the pressure feeding piston 236 thus moves up and down. Consequently, the washing water inside the pump chamber 239*a* is pressurized so that the pressure thereof at the washing water inlet PI is raised, to be discharged from the washing water outlet PO.

Even in a case where the pump 13 shown in FIG. 52 is used, the washing water is subjected to periodical pressure fluctuations, thereby making it possible to obtain a high washing feeling by washing water with a low flow rate. In this case, the respective flow paths in the switching valves 14 and 14*a* are not also closed. Even when the pressurized washing water is supplied to the switching valves 14 and 14*a* from the pump 13 due to any failure when the nozzle unit 30 is not used, therefore, the washing water can be caused to flow out of any one of the washing water outlets 143*b* and 143*e* in the switching valve 14 or the washing water outlets 143*b* and 143*c* in the switching value 14*a*. Consequently, the pressure in the pipe can be prevented from rising. As a result, damage to the pipe or leakage of water can be prevented, thereby making it possible to prevent electrical shock to the user.

(Still Another Example of Pump)

Figure 54:
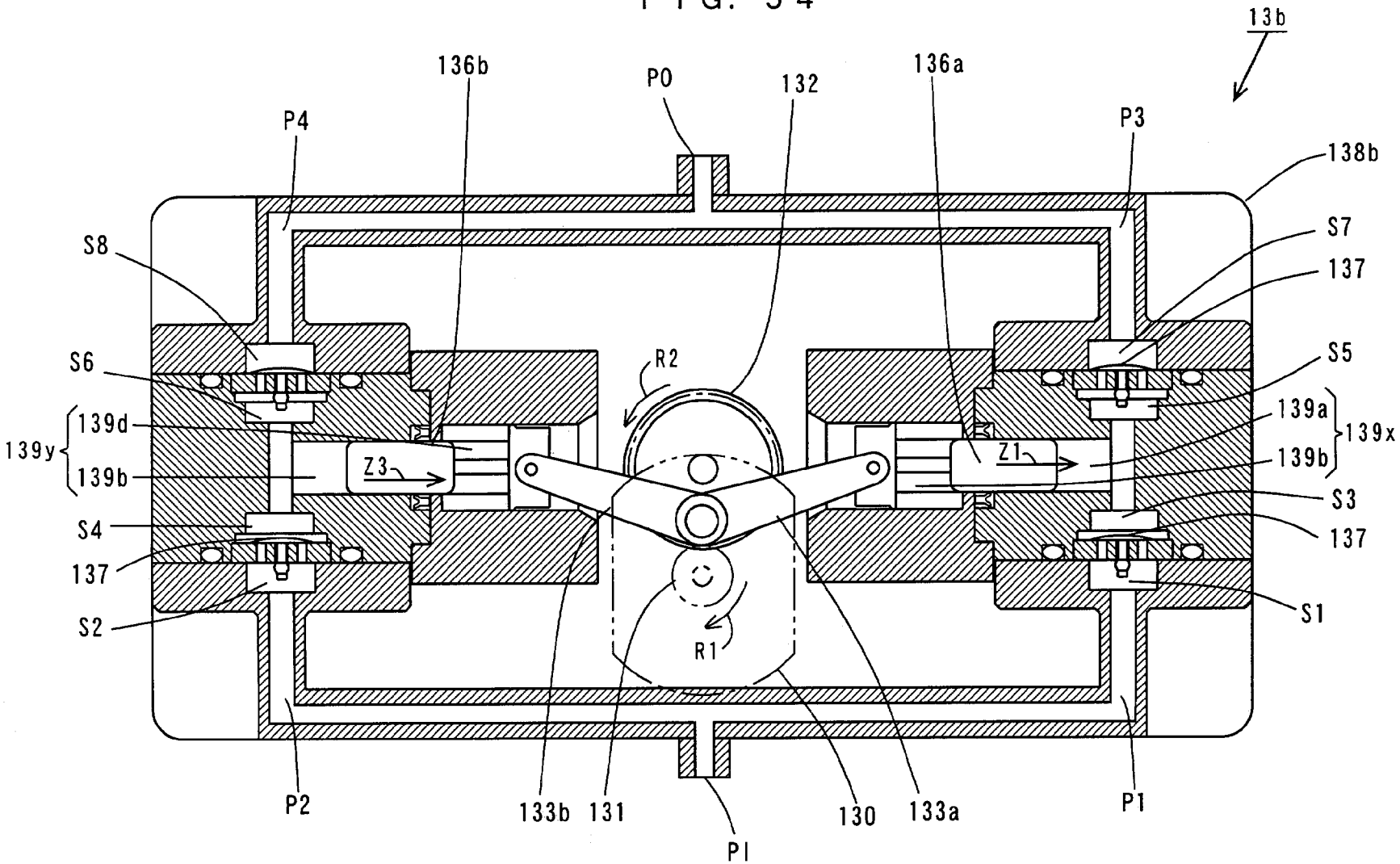
FIG. 54 is a cross-sectional view showing still another example of the pump used in the sanitary washing apparatus according to the first embodiment.

FIG. 54 is a cross-sectional view showing another example of a pump that is applicable to the sanitary washing apparatus 100 according to the first embodiment.

A pump 13*b* shown in FIG. 54 is a reciprocating pump. In FIG. 54, columnar spaces 139*x* and 139*y* are formed in a main body 138*b*. A pressure feeding piston 136*a* is provided in the columnar space 139*x*, and a pressure feeding piston 136*b* is provided in the columnar space 139*y*. The columnar space 136*x* is divided into a pump chamber 139*a* and a pump chamber 139*c* by the pressure feeding piston 136*a*. The columnar space 136*y* is divided into a pump chamber 139*b* and a pump chamber 139*d* by the pressure feeding piston 136*b*. The operations of the pistons 136*a* and 136*b* will be described later.

A washing water inlet PI is provided on one side of the main body 138*b*, and a washing water outlet PO is provided on the other side thereof. The heat exchanger 11 is connected to the washing water inlet PI through the pipe 203 shown in FIG. 3, and the switching valve 14 is connected to the washing water outlet PO through the pipe 203.

The washing water inlet PI communicates with the pump chamber 139*a* through an internal flow path P1, a small chamber S1, and a small chamber S3, and communicates with the pump chamber 139*b* through an internal flow path P2, a small chamber S2, and a small chamber S4.

The pump chamber 139*a* communicates with the washing water outlet PO through a small chamber S5, a small chamber S7, and an internal flow path P3. The pump chamber 139*b* communicates with the washing water outlet PO through a small chamber S6, a small chamber S8, and an internal flow path P4.

An umbrella packing 137 is provided in each of the small chamber S3, the small chamber S4, the small chamber S7, and the small chamber S8.

A gear 131 is attached to the axis of rotation of a motor 130, and a gear 132 is engaged with the gear 131. Further, one end of a crank shaft 133*a* and one end of a crank shaft 133*b* are attached to the gear 132 so as to be rotatable with their respective one points supported thereon. A pressure feeding piston 136*a* is attached to the other end of the crank shaft 133*a*, and the pressure feeding piston 136*b* is attached to the other end of the crank shaft 133*b*.

When the axis of rotation of the motor 130 is rotated on the basis of a control signal fed by the controller 4 shown in FIG. 3, the gear 131 attached to the axis of rotation of the motor 130 is rotated in a direction indicated by an arrow R1, and the gear 132 is rotated in a direction indicated by an arrow R2. Consequently, the pressure piston 136*a* moves in a direction indicated by an arrow Z1, and the pressure feeding piston 136*b* moves in a direction indicated by an arrow Z3.

When the pressure feeding piston 136*a* shown in FIG. 54 moves in the direction indicated by the arrow Z1, to decrease the volume of the pump chamber 139*a*, for example, the pressure feeding piston 136*b* shown in FIG. 54 moves in the direction indicated by the arrow Z3, to increase the volume of the pump chamber 139*b*. In this case, the pressure in the pump chamber 139*a* is higher than the pressure in the small chamber S1, whereby the umbrella packing 137 provided in the small chamber S3 is not deformed from the state shown in FIG. 6(*a*). As a result, the washing water does not flow into the pump chamber 139*a* from the washing water inlet PI. In this case, the pressure in the pump chamber 139*a* is higher than the pressure in the small chamber S7, whereby the umbrella packing 137 provided in the small chamber S7 is deformed, as shown in FIG. 6(*b*). As a result, the washing water in the pump chamber 139*a* is discharged from the washing water outlet PO through the internal flow path P3.

Furthermore, in this case, the pressure in the pump chamber 139*b* is lower than the pressure in the small chamber S2, whereby the umbrella packing 137 provided in the small chamber S4 is deformed, as shown in FIG. 6(*b*). As a result, the washing water flows into the pump chamber 139*b* from the washing water inlet PI through the internal flow path P2. In this case, the pressure in the pump chamber 139*b* is lower than the pressure in the small chamber S8, so that the umbrella packing 137 provided in the small chamber S8 is not deformed from the state shown in FIG. 6(*a*). As a result, the washing water in the pump chamber 139*b* is not discharged from the washing water outlet PO.

On the other hand, when the pressure feeding piston 136*a* shown in FIG. 54 moves in the opposite direction to the direction indicated by the arrow Z1, to increase the volume of the pump chamber 139*a*, the pressure feeding piston 136*b* shown in FIG. 54 moves in the opposite direction to the direction indicated by the arrow Z3, to decrease the volume of the pump chamber 139*b*. In this case, the pressure in the pump chamber 139*a* is lower than the pressure in the small chamber S1, whereby the umbrella packing 137 provided in the small chamber S3 is deformed, as shown in FIG. 6(*a*). As a result, the washing water supplied from the washing water inlet PI flows into the pump chamber 139*a* from the small chamber S1 and the small chamber S3. In this case, the pressure in the pump chamber 139*a* is lower than the pressure in the small chamber S7, whereby the umbrella packing 137 provided in the small chamber S7 is not deformed from the state shown in FIG. 6(*a*). As a result, the washing water in the pump chamber 139*a* is not discharged from the washing water outlet PO.

Furthermore, in this case, the pressure in the pump chamber 139*b* is higher than the pressure in the small chamber S2, whereby the umbrella packing 137 provided in the small chamber S4 is not deformed from the state shown in FIG. 6(*b*). As a result, the washing water does not flow into the pump chamber 139*b*. In this case, the pressure in the pump chamber 139*b* is higher than the pressure in the small chamber S8, so that the umbrella packing 137 provided in the small chamber S8 is deformed, as shown in FIG. 6(*b*). As a result, the washing water in the pump 139 is discharged from the washing water outlet PO through the small chambers S6 and S8 and the internal flow path P4.

(Still Another Example of Pump)

Figure 55:
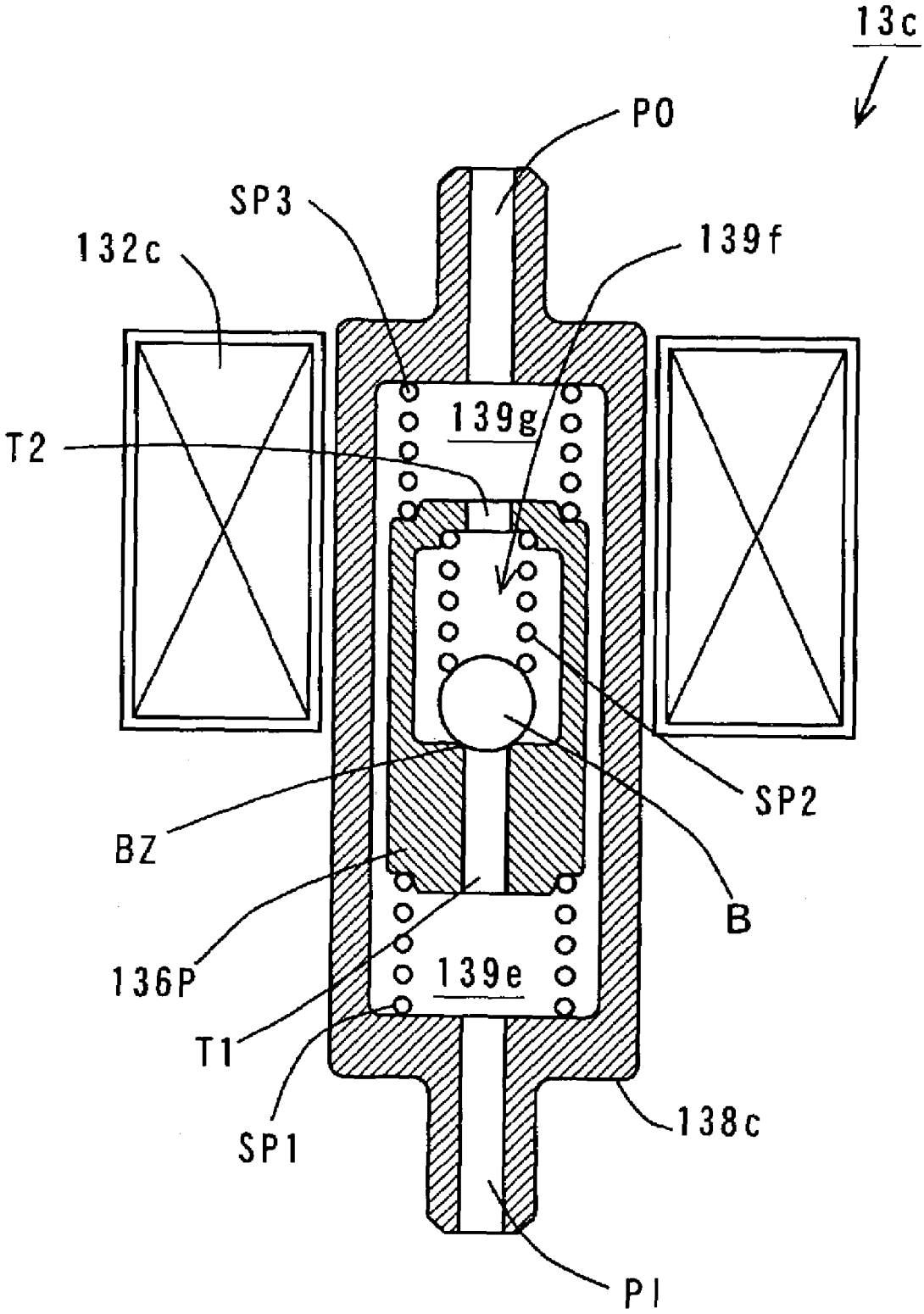
FIG. 55 is a cross-sectional view showing a further example of the pump used in the sanitary washing apparatus according to the first embodiment.

FIG. 55 is a cross-sectional view showing another example of a pump that is applicable to the sanitary washing apparatus 100 according to the first embodiment.

A pump 13*c* shown in FIG. 55 is an electromagnetic pump. In the pump 13*c* shown in FIG. 55, a magnet coil 132*c* is wound around the upper half of an outer peripheral surface of a cylinder 138*c*.

In the cylinder 138*c*, there are provided springs SP1 and SP3 and a columnar plunger 136P. The cylinder 138*c* is divided into a pump chamber 139*e* and a pump chamber 139*g* by the plunger 136P.

Here, a columnar pump chamber 139*f* is formed in the columnar plunger 136P. The pump chamber 139*f* communicates with the pump chamber 139*e* through an internal flow path T1, and communicates with a pump chamber 139*g* through an internal flow path T2. A sphere B and a spring SP2 are provided in the pump chamber 139*f*.

A washing water inlet PI is provided at a lower end of the cylinder 138*c*, and a washing water outlet PO is provided at an upper end thereof. The heat exchanger 11 is connected to the washing water inlet PI through the pipe 203 shown in FIG. 3, and the switching valve 14 is connected to the washing water outlet PO through the pipe 203.

In the cylinder 138*c*, the spring SP1 urges the plunger 136P upward, and the spring SP3 urges the plunger 136P downward.

In the pump chamber 139*f* in the plunger 136P, the spring SP2 urges the sphere B downward. Consequently, the sphere B is pressed against a valve seat BZ positioned in the boundary between the pump chamber 139*f* and the internal flow path T1.

The pump 13*c* having the foregoing configuration is operated by applying a voltage to the magnet coil 132*c*. The operations of the pump 13*c* will be described on the basis of FIG. 56.

Figure 56:
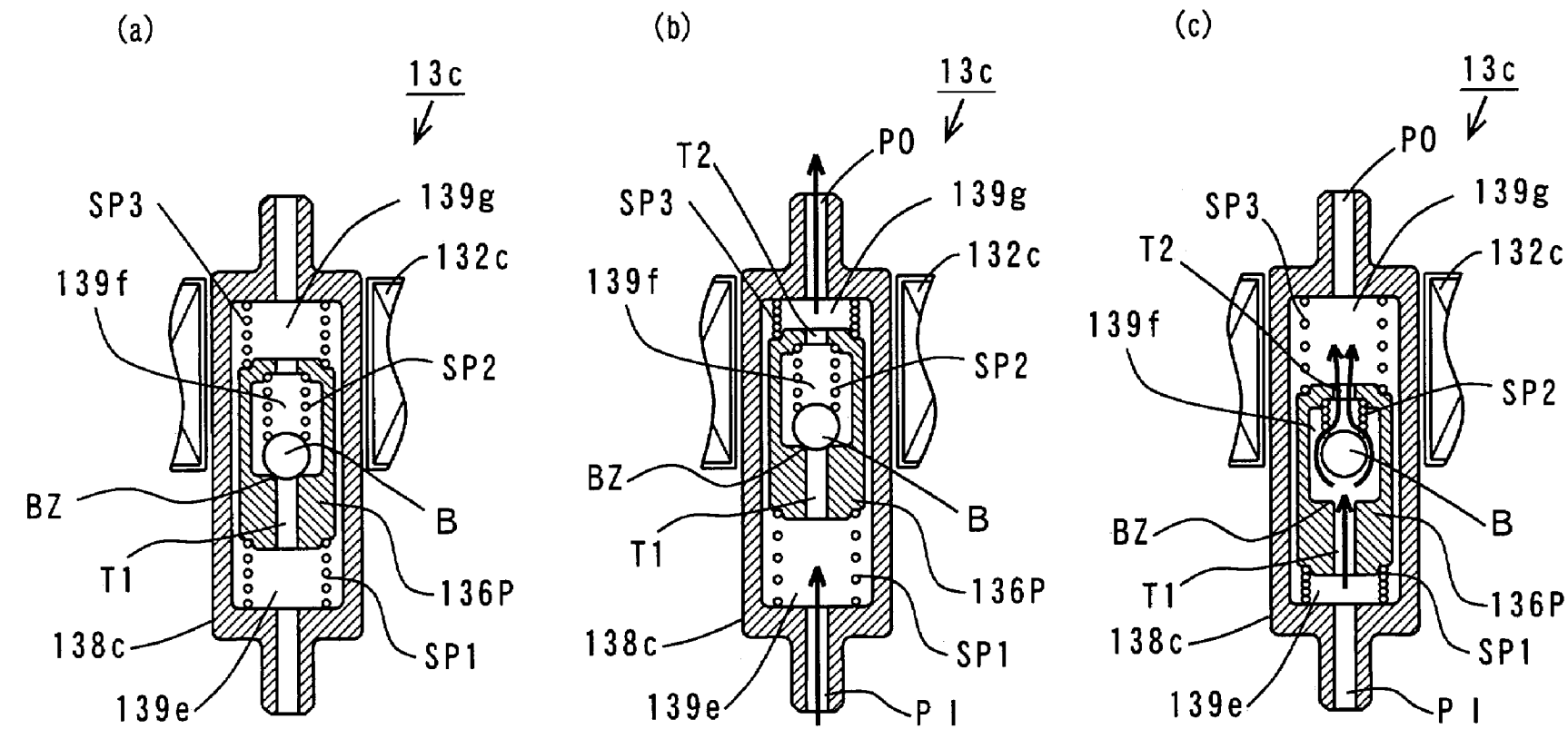
FIG. 56 is a schematic sectional view showing the operations of the pump.

FIG. 56 is a schematic sectional view showing the operations of the pump 13*c*.

FIG. 56(*a*) illustrates the internal state of the pump 13*c* in a case where the pump 13*c* is not operated. In this case, in the cylinder 138*c*, the plunger 136P is held at the center in the cylinder 138*c* by the spring SP1 and the spring SP3. In the pump chamber 139*f* in the plunger 136P, the spring SP2 presses the sphere B against the valve seat BZ, to prevent the communication between the pump chamber 139*f* and the pump chamber 139*e* through the internal flow path T1.

FIG. 56(*b*) illustrates the internal state of the pump 13*c* in a case where a voltage is applied to the magnet coil 132*c* when the pump 13*c* is operated. In this case, in the cylinder 138*c*, the plunger 136P moves toward the washing water outlet PO in the cylinder 138*c* against the elastic force of the spring SP3. Consequently, the spring SP3 is compressed, and the spring SP1 is expanded. At this time, in the pump chamber 139*f* in the plunger 136P, the spring SP2 presses the sphere B against the valve sheet BZ, as in the case where the pump 13*c* is not operated, to present the communication between the pump chamber 139*f* and the pump chamber 139*e* through the internal flow path T2.

As the above-mentioned operations are performed, the pressure in the pump chamber 139*e* drops, so that the washing water flows into the pump chamber 139*e* from the washing water inlet PI. On the other hand, as the above-mentioned operations are performed, the pressure in the pump chamber 139*g* rises, so that the washing water in the pump chamber 139*g* flows out of the washing water outlet PO. The sphere B thus functions as a check valve.

FIG. 56(*c*) illustrates the internal state of the pump 13*c* in a case where no voltage is applied to the magnet coil 132*c* when the pump 13*c* is operated. In this case, in the cylinder 138*c*, the plunger 136P moves toward the washing water inlet PI in the cylinder 138*c* by the respective restoring forces of the expanded spring SP1 and the compressed spring SP3. Consequently, the spring SP3 is expanded, and the spring SP1 is compressed.

As the above-mentioned operations are performed, the pressure in the pump chamber 139*e* rises, so that the washing water extrudes the sphere B in the pump chamber 139*f* from the valve seat BZ through the internal flow path T1 in the plunger 136P, to flow into the pump chamber 139*f*. Further, the pressure in the pump chamber 139*f* rises by the washing water flowing into the pump chamber 139*f* from the pump chamber 139*e*, so that the washing water in the pump chamber 139*f* flows into the pump chamber 139*g* through the internal flow path T2 in the plunger 136P, to be discharged from the washing water outlet PO.

In the electromagnetic pump 13*c*, no sealing member is interposed between the plunger 136P and the cylinder 138*c*. Accordingly, the discharge flow rate differs depending on the pressure loss on the downstream side of the washing water outlet PO.

Figure 57:
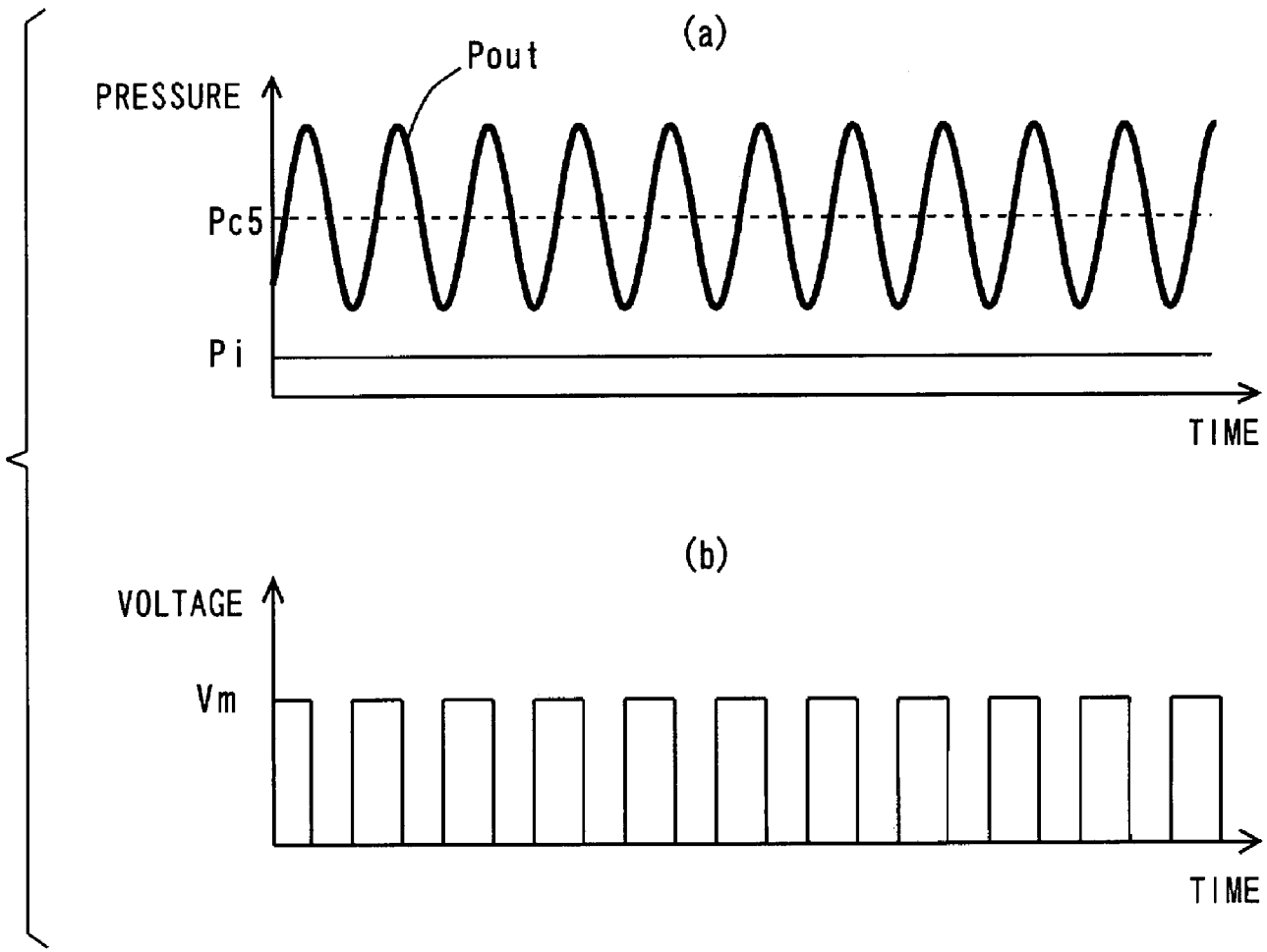
FIG. 57 is a diagram showing the change in pressure in the pump shown in FIG. 55 and the change in voltage applied to a magnet coil in a case where the pump is operated.

FIG. 57 is a diagram showing the change in pressure in the pump chamber 139*g* in a case where the pump 13*c* shown in FIG. 55 is operated and the change in voltage applied to the magnet coil 132*c*. FIG. 57(*a*) shows the change in pressure in the pump 13*c*, and FIG. 57(*b*) shows the change in voltage applied to the magnet coil 132*c*.

As shown in FIG. 57, washing water at a water supply pressure Pi is supplied to the washing water inlet PI in the pump 13*c*. A voltage Vm is intermittently applied to the magnet coil 132*c* so that the plunger 136P reciprocates in the cylinder 138*c*. Consequently, the pressure Pout of the washing water discharged from the washing water outlet PO in the pump 13*c* is periodically changed up and down, centered at a pressure Pc5 indicated by a dotted line, as indicated by a thick solid line.

As described in the foregoing, in the pump 13*c*, a periodical pulse voltage is applied to the magnet coil 132*c*. Consequently, the washing water inside the pump chamber 139*g* is pressurized so that the pressure thereof at the washing water inlet PI is raised, to be discharged from the washing water outlet PO.

In the pump 13*c* shown in FIG. 55, the amount of displacement of the plunger 136P (hereinafter referred to as an operating stroke) differs depending on the voltage value of a pulse voltage applied to the magnet coil 132*c*. That is, the operating stroke of the plunger 136P can be changed by changing the value Vm or the duty ratio of the pulse voltage applied to the magnet coil 132*c*.

Even in a case where the pump 13*c* shown in FIG. 55 is used, the washing water is subjected to periodical pressure fluctuations, thereby making it possible to obtain a high washing feeling by washing water with a low flow rate. In this case, the respective flow paths in the switching valves 14 and 14*a* are not also closed. Even when the pressurized washing water is supplied to the switching valves 14 and 14*a* from the pump 13 due to any failure when the nozzle unit 30 is not used, therefore, the washing water can be caused to flow out of any one of the washing water outlets 143*b* to 143*e* in the switching valve 14 or the washing water outlets 143*b* and 143*c* in the switching valve 14*a*. Consequently, the pressure in the pipe can be prevented from rising. As a result, damage to the pipe or leakage of water can be prevented, thereby making it possible to prevent electrical shock to the user.

In the sanitary washing apparatus 100 according to the fourth embodiment, the tap water pipe 201 corresponds to a water supply source, the nozzle unit 30 corresponds to a spray device, the pump 13 corresponds to a pressure device and a reciprocating pump, the first flow path 27*a* corresponds to a first flow path, the second flow path 27*b* corresponds to a second flow path, the spray form display panel 301*c* and the water power display panel 301*d* correspond to a display device, the cylindrical swirl chamber 29 corresponds to a rotating flow generator, the switching valve 14 corresponds to a flow rate adjustment device, the controller 4 corresponds to a control device and a command device, the water power adjustment switches 302*a*, 302*b*, and 302*aa*, the water power adjustment dials 302*h* and 302*g*, the water power adjustment lever 302J, and the four-direction toggle switch (four-direction jog stick switch) 302*k* correspond to a pressure fluctuation setting device, the washing area adjustment switches 302*e*, 302*f*, and 302*dd*, and the four-direction toggle switch (four-direction jog stick switch) 302*k* correspond to a divergent angle setting device, and the ceramic heater 505 corresponds to a heating device.

(5) Fifth Embodiment

Figure 58:
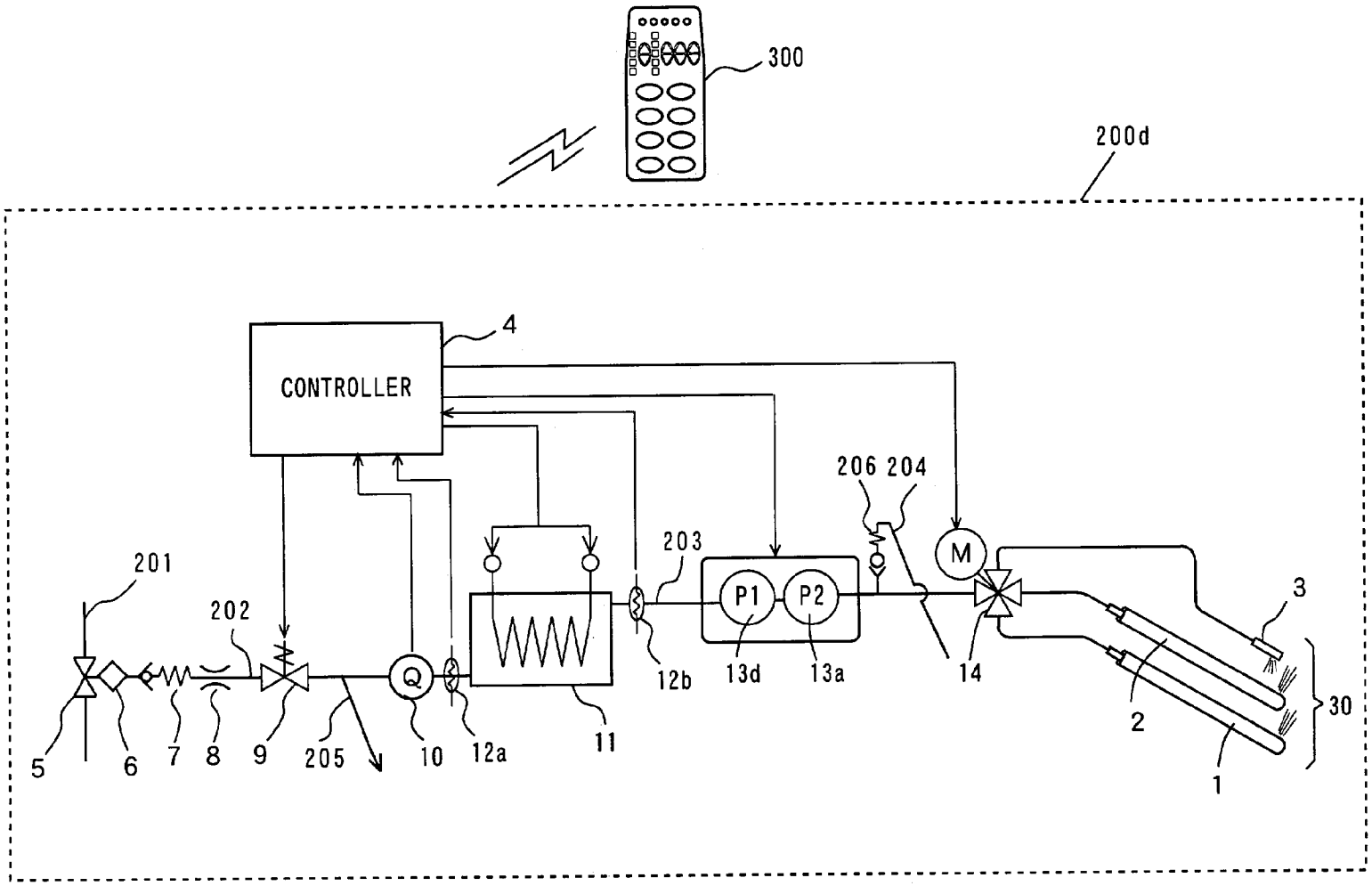
FIG. 58 is a schematic view showing an example of the configuration of a sanitary washing apparatus according to a fifth embodiment.

Description is now made of a sanitary washing apparatus 100 according to a fifth embodiment. FIG. 58 is a schematic view showing an example of the configuration of the sanitary washing apparatus 100 according to the fifth embodiment.

Figure 59:
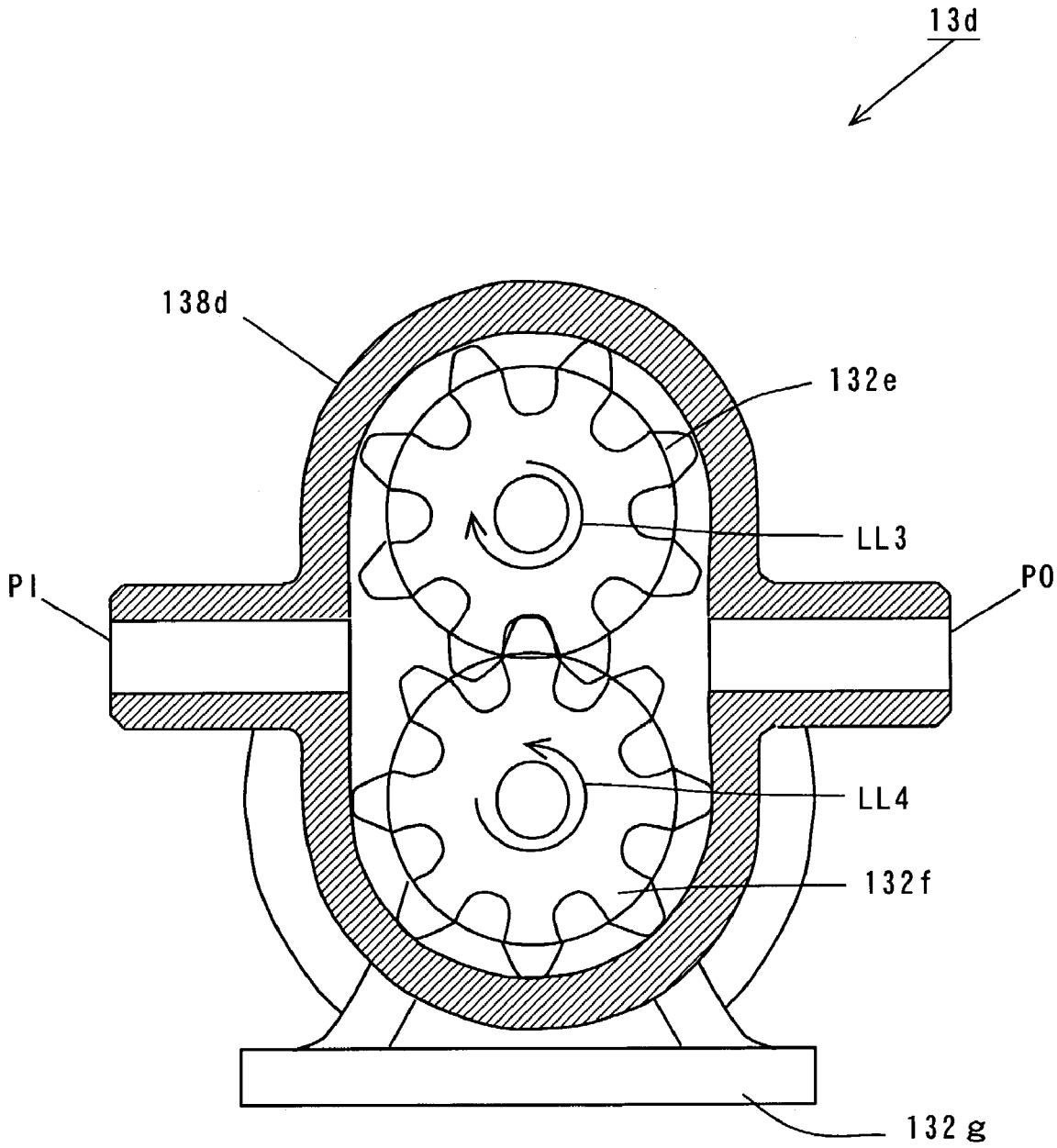
FIG. 59 is a schematic sectional view showing an example of a pump in the sanitary washing apparatus according to the fifth embodiment.

The sanitary washing apparatus 100 according to the present embodiment comprises a pump 13*d* shown in FIG. 59 and the pump 13*a* shown in FIG. 52 in series connection in place of the pump 13 provided in the sanitary washing apparatus 100 according to the first embodiment. Respective components in the sanitary washing apparatus 100 according to the present embodiment perform the same operations as those of the components in the sanitary washing apparatus 100 according to the first embodiment except for the following operations.

FIG. 59 is a schematic sectional view showing an example of the pump 13*d* in the sanitary washing apparatus 100 according to the fifth embodiment.

The pump 13*d* shown in FIG. 59 is a gear pump.

As shown in FIG. 59, the pump 13*d* comprises a gear case 138*d*, gears 132*e* and 132*f*, a base 132*g*, and a motor (not shown). Here, a washing water inlet PI is provided on one side of the gear case 138*d*, and a washing water outlet PO is provided on the other side thereof. The two gears 132*e* and 132*f* which rotate by the motor (not shown) are incorporated into the gear case 138*d*. The gear case 138*d* is held by the base 132*g*. Here, the rotation of the motor (not shown) is controlled by the controller 4 shown in FIG. 3.

The pump 13*d* extrudes washing water supplied to the washing water inlet PI from the washing water outlet PO by the rotation of the two gears 132*e* and 132*f*. In FIG. 59, the gear 132*e* is rotated in a direction indicated by an arrow LL3 (in a clockwise direction), and the gear 132*f* engaged with the gear 132*e* is rotated in a direction indicated by an arrow LL4 (in a counterclockwise direction).

Consequently, the washing water from the washing water inlet PI is introduced into a space produced between the two gears 132*e* and 132*f* and the gear case 138*d* (toughs of the teeth of the gears 132*e* and 132*f*), and the washing water is supplied to the washing water outlet PO in response to the rotation of the gears 132*e* and 132*f*.

The above-mentioned pump 13*d* has features of having a simple configuration, hardly developing a fault, and being low in production cost.

Figure 60:
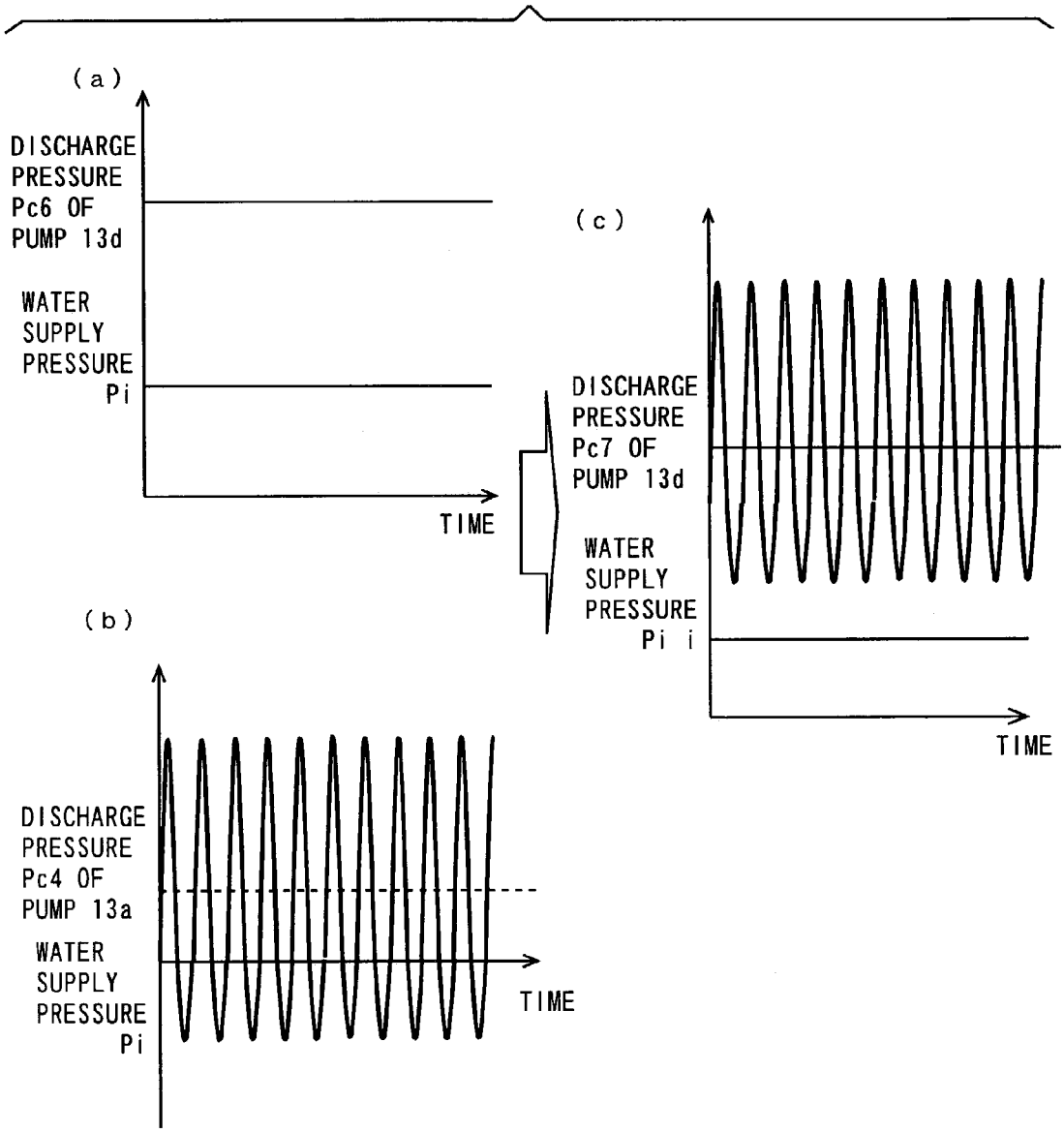
FIG. 60 is a diagram showing the change in pressure in a pump.

FIG. 60(*a*) is a diagram showing the change in pressure in the pump 13*d*, FIG. 60(*b*) is a diagram showing the change in pressure in the pump 13*a* shown in FIG. 52, and FIG. 60(*c*) is a diagram showing the synthesis of the discharge pressure of the pump 13*d* and the discharge pressure of the pump 13*a*. In FIGS. 60(*a*) to 60(*c*), the vertical axis indicates pressure, and the horizontal axis indicates time.

As shown in FIG. 60(*a*), washing water at a water supply pressure Pi is supplied to the washing water inlet PI in the pump 13*d*. In this case, the gear pump 13*d* shown in FIG. 59 is driven so that the discharge pressure of the washing water discharged from the washing water outlet PO rises to a predetermined pressure Pc6 higher than the water supply pressure.

On the other hand, as shown in FIG. 60(*b*), washing water at a water supply pressure Pi is supplied to the washing water inlet PI in the pump 13*a*. In this case, the pump 13*a* shown in FIG. 52 is driven so that the discharge pressure of the washing water discharged from the washing water outlet PO is periodically changed up and down, centered at a pressure Pc4.

When the pump 13*d* and the pump 13*a* are connected in series, therefore, the discharge pressure of the washing water is a pressure Pc7 obtained by adding the discharge pressure Pc6 to the discharge pressure Pc4, as shown in FIG. 60(*c*). Consequently, the discharge pressure of the washing water is periodically changed up and down, centered at the constant pressure Pc7 higher than the water supply pressure Pi.

Although in the sanitary washing apparatus 100 according to the present embodiment, the pump 13*a* shown in FIG. 52 and the gear pump 13*d* shown in FIG. 59 are used, the present invention is not limited to the same. For example, another arbitrary reciprocating pump may be used, or a diaphragm pump, an electromagnetic pump, or the like may be used.

Figure 61:
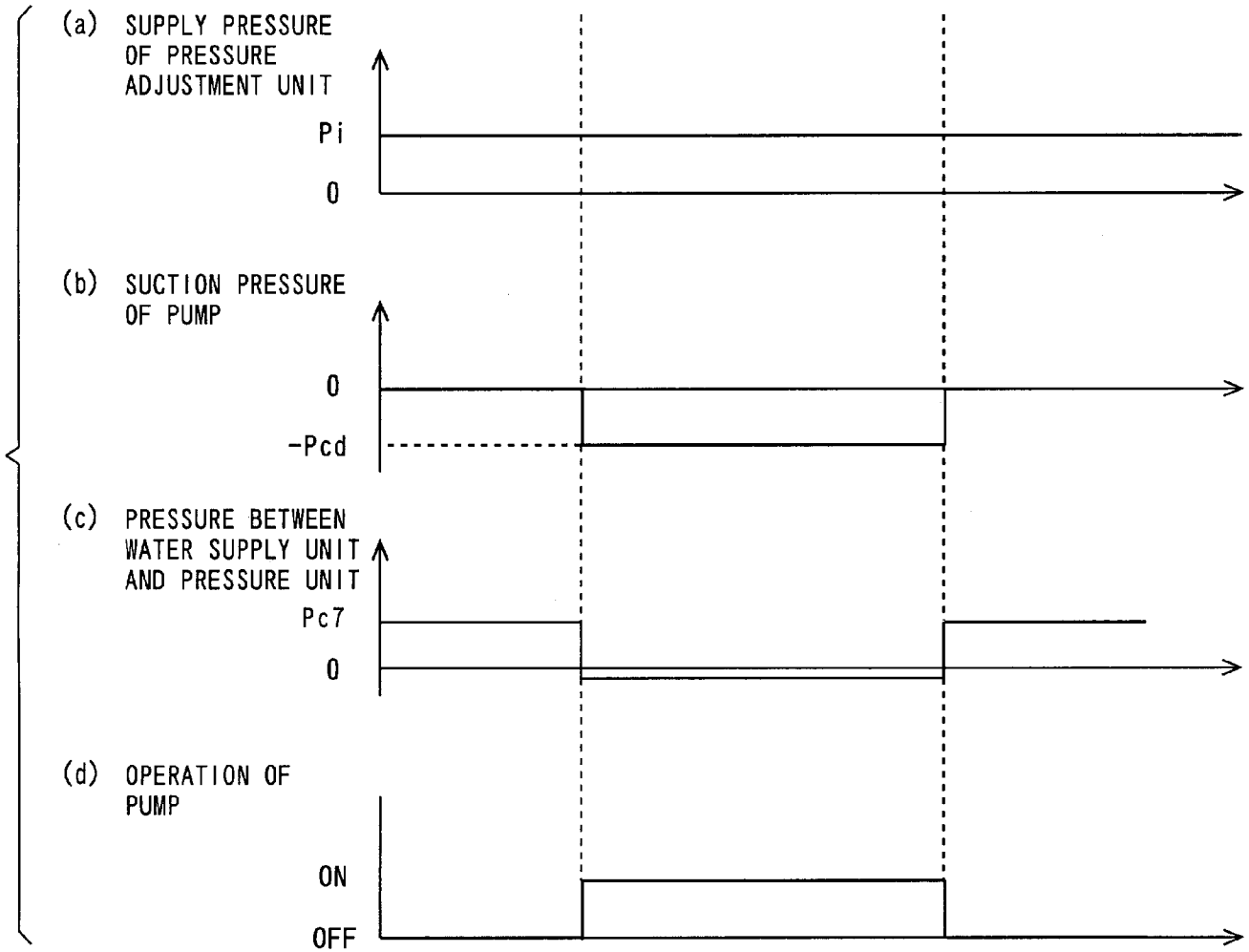
FIG. 61 is a diagram showing the change in pressure by turning a pump on or off.

FIG. 61 is a diagram showing the change in pressure caused by turning the pump 13*a* and the pump 13*d* on or off.

FIG. 61(*a*) shows the change in pressure on the downstream side of the constant flow valve 8, FIG. 61(*b*) shows the sum of the suction pressure of the pump 13*d* and the suction pressure of the pump 13*a*, FIG. 61(*c*) shows the change in pressure at the washing water inlet PI in the pump 13*d*, and FIG. 61(*d*) indicates the on-off operations of the pump 13*d* and the pump 13*a*.

As shown in FIG. 61(*a*), the pressure on the downstream side of the constant flow valve 8 is adjusted to a predetermined pressure Pi. Further, as shown in FIGS. 61(*b*) and 61(*d*), the sum of the respective suction pressures in a case where the pump 13*a* and the pump 13*d* are turned on is—Pcd. Here, the relationship between the pressure Pi on the downstream side of the constant flow valve 8 and the suction pressure Pcd in a case where both the pump 13*a* and the pump 13*d* are turned on satisfies Pi Pcd.

Therefore, as shown in FIGS. 61(*c*) and 61(*d*), the change in pressure at the washing water inlet Pi in the pump 13*d* is adjusted to a pressure Pi when both the pump 13*a* and the pump 13*d* are off, while being adjusted to a pressure Pi—Pcd when both the pump 13*a* and the pump 13*d* are on. As a result, when both the pump 13*a* and the pump 13*d* are on, the pressure on the upstream side of the pump 13*a* is zero or a negative pressure (back pressure). Even if there are pressure fluctuations from the water supply source, therefore, the washing water at the washing water outlet PO in the pump 13*d* is unaffected.

(Another Example of Pump)

Figure 62:
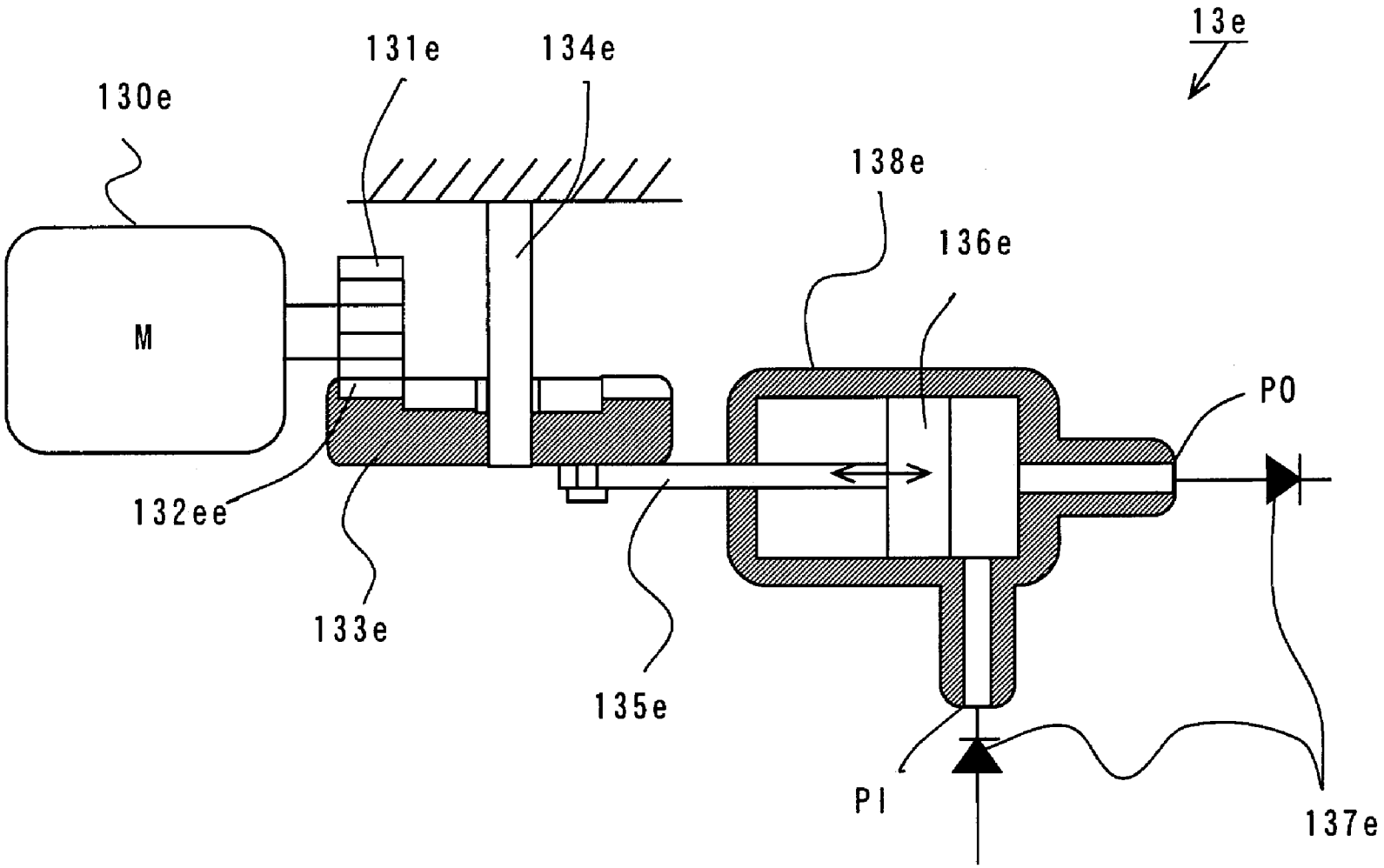
FIG. 62 is a cross-sectional view showing another example of the pump used in the sanitary washing apparatus according to the fifth embodiment.

FIG. 62 is a cross-sectional view showing another example of the pump used in the sanitary washing apparatus 100 according to the fifth embodiment.

A pump 13*e* shown in FIG. 62 is a positive displacement pump. The pump 13*e* comprises a motor 130*e*, a gear 131*e*, a gear 132*ee*, a rotating board 133*e*, a rotating board supporting bar 134*e*, a link mechanism 135*e*, a piston 136*e*, a pair of check valves 137*e*, and a main body 138*e*. Further, a washing water inlet PI is provided on one side of the main body 138*e*, and a washing water outlet PO is provided on the other side thereof.

The motor 130*e* is rotated so that the gear 131*e* attached to the axis of the motor 130*e* is rotated, so that the gear 132*ee* engaged with the gear 131*e* is rotated. Consequently, the rotating board 133*e* having the gear 132*ee* attached thereto is rotated around the rotating board supporting bar 134*e*. The rotating board 133*e* is rotated so that the piston 136*e* reciprocates through the link mechanism 135*e*. As a result, the washing water is intermittently pressurized and discharged from the washing water outlet PO through the pair of check valve 137*e*.

Figure 63:
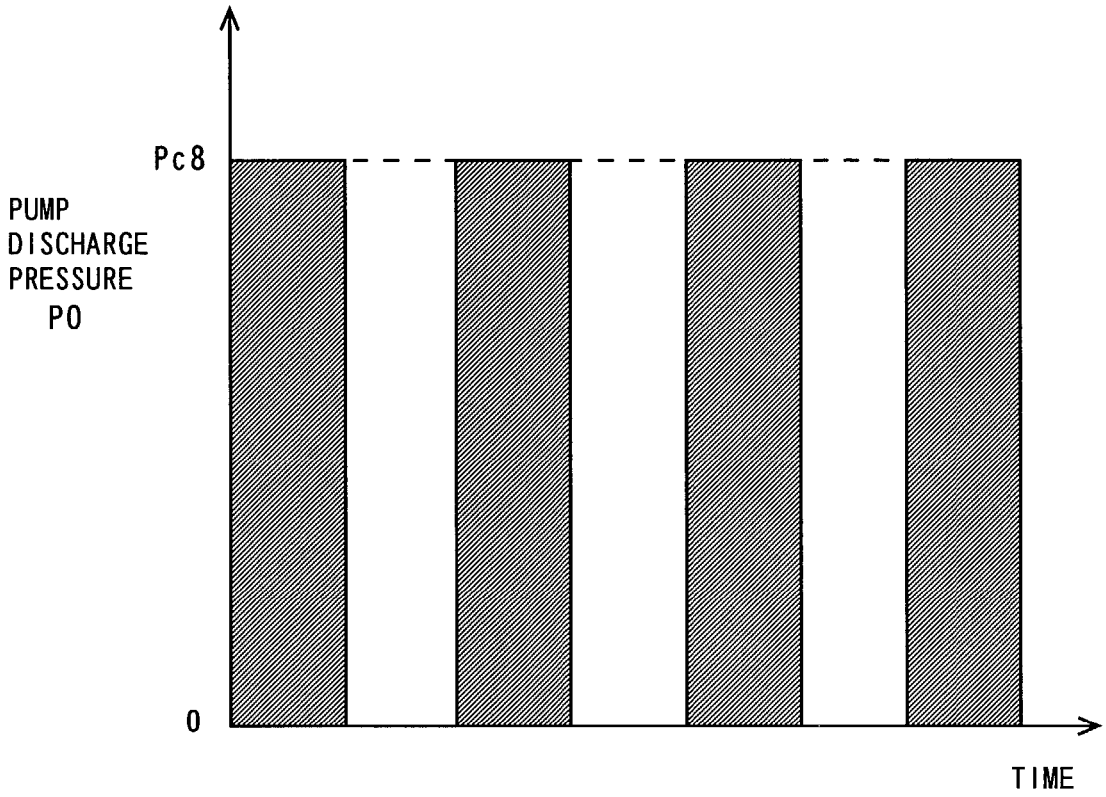
FIG. 63 is a diagram showing the change in pressure at a washing water outlet in the pump shown in FIG. 62 in a case where the pump is operated.

FIG. 63 is a diagram showing the change in pressure at the washing water outlet PO in a case where the pump 13*e* shown in FIG. 62 is operated. In FIG. 63, the vertical axis indicates the pressure at the washing water outlet PO in the pump 13*e*, and the horizontal axis indicates time.

As shown in FIG. 63, when the piston 136*e* in the pump 13*e* is extruded by the link mechanism 135*e*, the washing water is pressurized and discharged so that the discharge pressure thereof rises to Pc8. On the other hand, when the piston 136*e* in the pump 13*e* is pulled back by the link mechanism 135*e*, the pressure in a space enclosed by the main body 138*e* and the piston 136*e* is a negative pressure (back pressure), so that the washing water is sucked. By thus configuring the pump 13*e* such that the washing water can be intermittently pressurized and discharged, the washing water which is intermittently pressurized is supplied to the nozzle unit 30. Accordingly, the spray speed of the washing water can be further increased, thereby making it possible to obtain the same washing feeling by a smaller amount of washing water.

(Still Another Example of Switching Valve)

Figure 64:
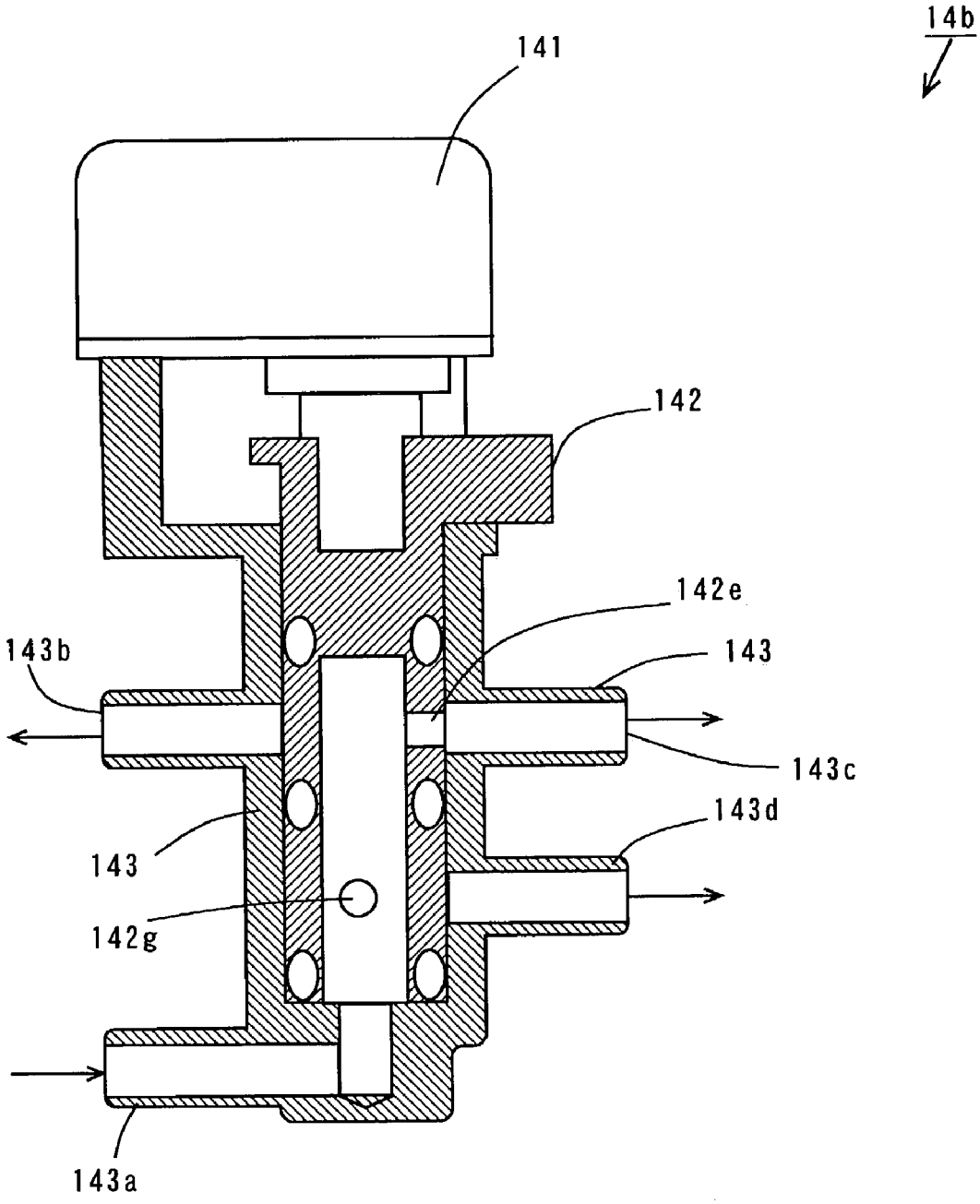
FIG. 64 is a longitudinal sectional view showing another example of a switching valve.

FIG. 64 is a vertical sectional view showing still another example of a switching valve.

A switching valve 14*b* shown in FIG. 64 is a fluid control valve having three washing water outlets. The switching valve 14*b* is employed for a sanitary washing apparatus comprising a posterior nozzle having two flow paths and a bidet nozzle having one flow path, for example. Description is now made of a case where the switching valve 14*b* shown in FIG. 64 is employed for a sanitary washing apparatus comprising a posterior nozzle having two flow paths and a bidet nozzle having one flow path.

The switching valve 14*b* shown in FIG. 64 comprises a motor 141, an inner cylinder 142, and an outer cylinder 143, similarly to the switching valve 14 shown in FIG. 9. The switching valve 14*b* shown in FIG. 64 has a configuration in which the washing water outlet 143*e* on the side of the outer cylinder 143 and the hole 142*g* in the inner cylinder 142 in the switching valve 14 shown in FIG. 9 are removed.

The inner cylinder 142 is inserted into the outer cylinder 143, and the axis of rotation of the motor 141 is attached to the inner cylinder 142. The motor 141 performs a rotating operation on the basis of a control signal fed by the controller 4. The motor 141 is rotated so that the inner cylinder 142 is rotated.

As shown in FIG. 64, a washing water inlet 143*a* is provided at one end of the outer cylinder 143, washing water outlets 143*b* and 143*c* are provided at opposite positions on the sides thereof, and a washing water outlet 143*d* is provided at a position, different from the washing water outlets 143*b* and 143*c*, on the side thereof. Holes 142*e* and 142*f* are provided at different positions of the inner cylinder 142. Chamfers (recesses) composed of a curved line and a straight line are respectively formed, as in the switching valve 14 shown in FIG. 9, around the holes 142*e* and 142*f*. By the rotation of the inner cylinder 142, the hole 142*e* is opposable to the washing water outlet 143*b* or 143*c* in the outer cylinder 143, and the hole 142*f* is opposable to the washing water outlet 143*d* in the outer cylinder 143.

The pipe 203 shown in FIG. 3 is connected to the washing water inlet 143*a*, the bidet nozzle 2 is connected to the washing water outlet 143*b*, and the flow path in the posterior nozzle 1 is connected to the washing water outlets 143*c* and 143*d*.

A projection for setting the position of the origin for rotation of the inner cylinder 142 may be provided at a base end of the inner cylinder 142 so as to abut against one end surface (not shown) of the outer cylinder 143.

Figure 65:
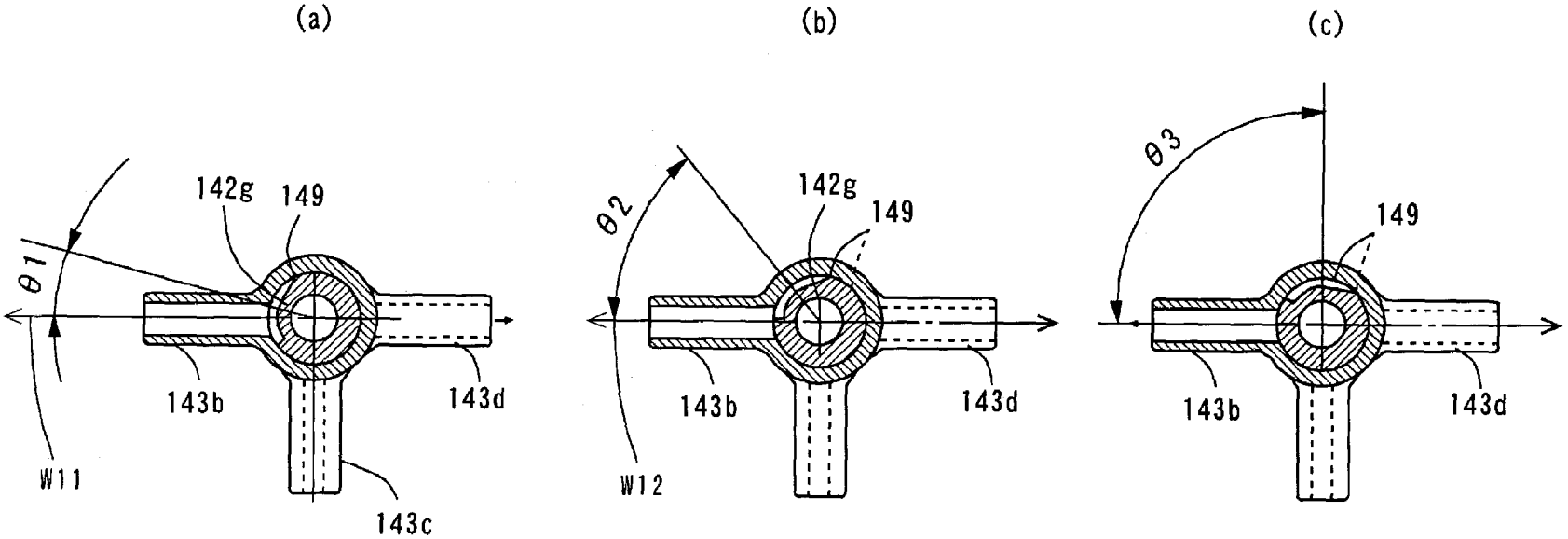
FIG. 65 is a cross-sectional view showing the operations of the switching valve shown in FIG. 64.

FIG. 65 is a cross-sectional view showing the operations of the switching valve 14*b* shown in FIG. 64.

FIGS. 65(*a*) to 65(*c*) respectively illustrate states where the motor 141 in the switching valve 14*b* is rotated through angles of 30 degrees, 60 degrees, and 90 degrees.

First, when the motor 141 rotates the inner cylinder 142 through 30 degrees (1), as shown in FIG. 65(*a*), the hole 142*g* in the inner cylinder 142 is opposed to the washing water outlet 143*b* in the outer cylinder 143. Consequently, the washing water passes in the inner cylinder 142 from the washing water inlet 143*a*, to flow out of the washing water outlet 143*b*, as indicated by an arrow W11.

When the motor 141 then rotates the inner cylinder 142 through 60 degrees (2), as shown in FIG. 65(*b*), a part of the chamfer (recess) around the hole 142*g* in the inner cylinder 142 is opposed to the washing water outlet 143*b* in the outer cylinder 143. Consequently, the washing water passes in the inner cylinder 142 from the washing water inlet 143*a*, to flow out of the washing water outlet 143*b*, as indicated by an arrow W12.

When the motor 141 then rotates the inner cylinder 142 through 90 degrees (3), as shown in FIG. 65(*c*), the hole 142*g* in the inner cylinder 142 is not opposed to the washing water outlet 143*b* in the outer cylinder 143. Consequently, no washing water flows out of the washing water outlet 143*b* after passing in the inner cylinder 142 from the washing water inlet 143*a*.

Figure 66:
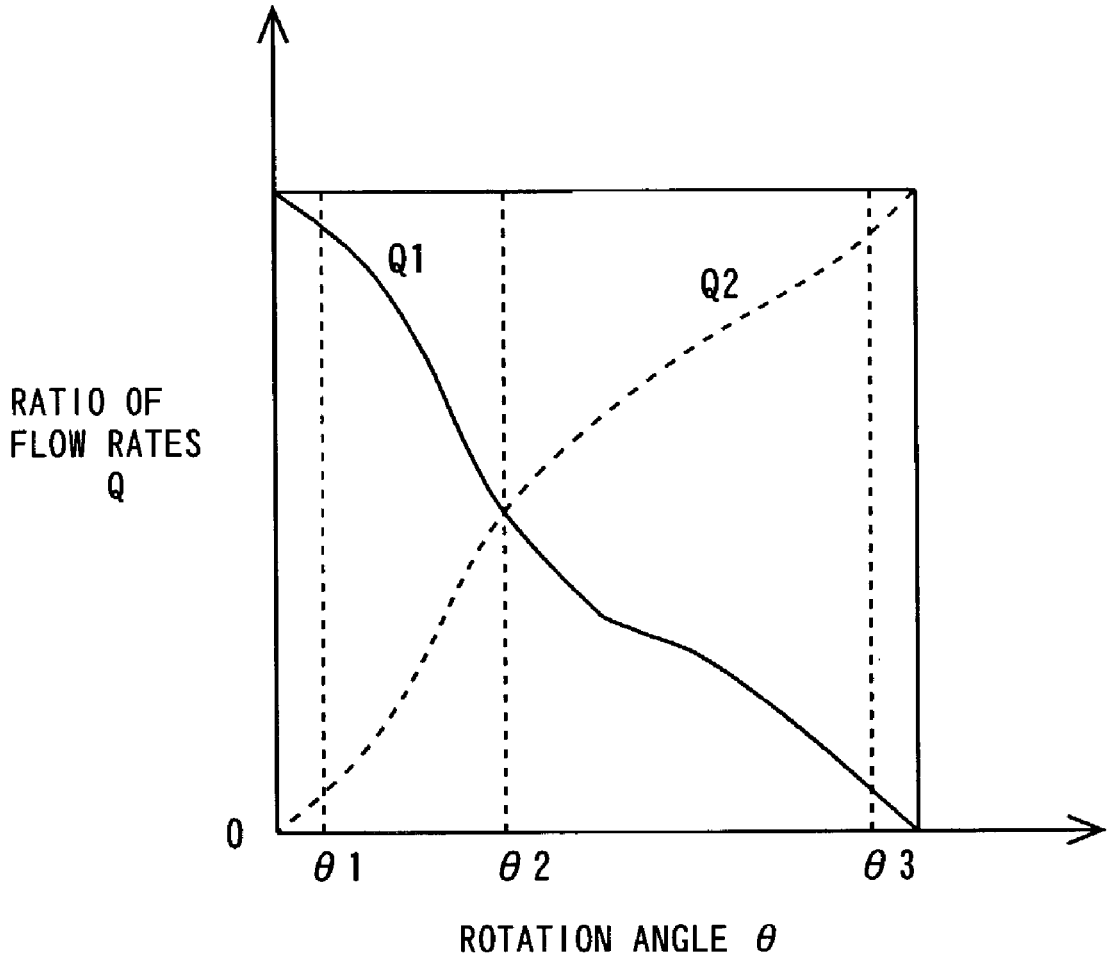
FIG. 66 is a diagram showing the flow rate of washing water flowing into a posterior nozzle from a washing water outlet in the switching valve shown in FIG. 64.

FIG. 66 is a diagram showing the flow rate of washing water flowing into the posterior nozzle 1 from the washing water outlets 143*c* and 143*d* in the switching valve 14*b* shown in FIG. 64. In FIG. 66, the horizontal axis indicates the rotation angle of the motor 141, and the vertical axis indicates the respective flow rates of the washing water flowing out of the washing water outlets 143*b* and 143*c*. A solid line Q1 indicates the change in the flow rate of the washing water flowing from the washing water outlet 143*b* to the posterior nozzle 1, and a one-dot and dash line Q2 indicates the change in the flow rate of the washing water flowing from the washing water outlet 143*c* to the posterior nozzle 1.

According to the graph of FIG. 66, the flow rate Q1 of the washing water flowing into the first flow path 27*a* in the posterior nozzle 1 and the flow rate of the washing water flowing into the second flow path 27*b* in the posterior nozzle 1 are roughly inversely proportional to each other.

The graph of FIG. 66 is the same as a graph, in which the rotation angle is 180 degrees to 270 degrees, shown in FIG. 11.

As described in the foregoing, the controller 4 controls the rotation angle of the motor 141 in the switching valve 14*b*, thereby making it possible to control the respective flow rates of the washing water flowing out of the washing water outlets 143*b* to 143*d*. When the ratio of the flow rate Q1 of the washing water flowing into the first flow path 27*a* in the posterior nozzle 1 to the flow rate Q2 of the washing water flowing into the second flow path 27*b* in the posterior nozzle 1 is continuously changed, the divergent angle of the washing water sprayed from a spray hole 25 in the posterior nozzle 1 is changed. Accordingly, the washing area can be continuously changed.

(Still Another Example of Switching Valve)

Figure 67:
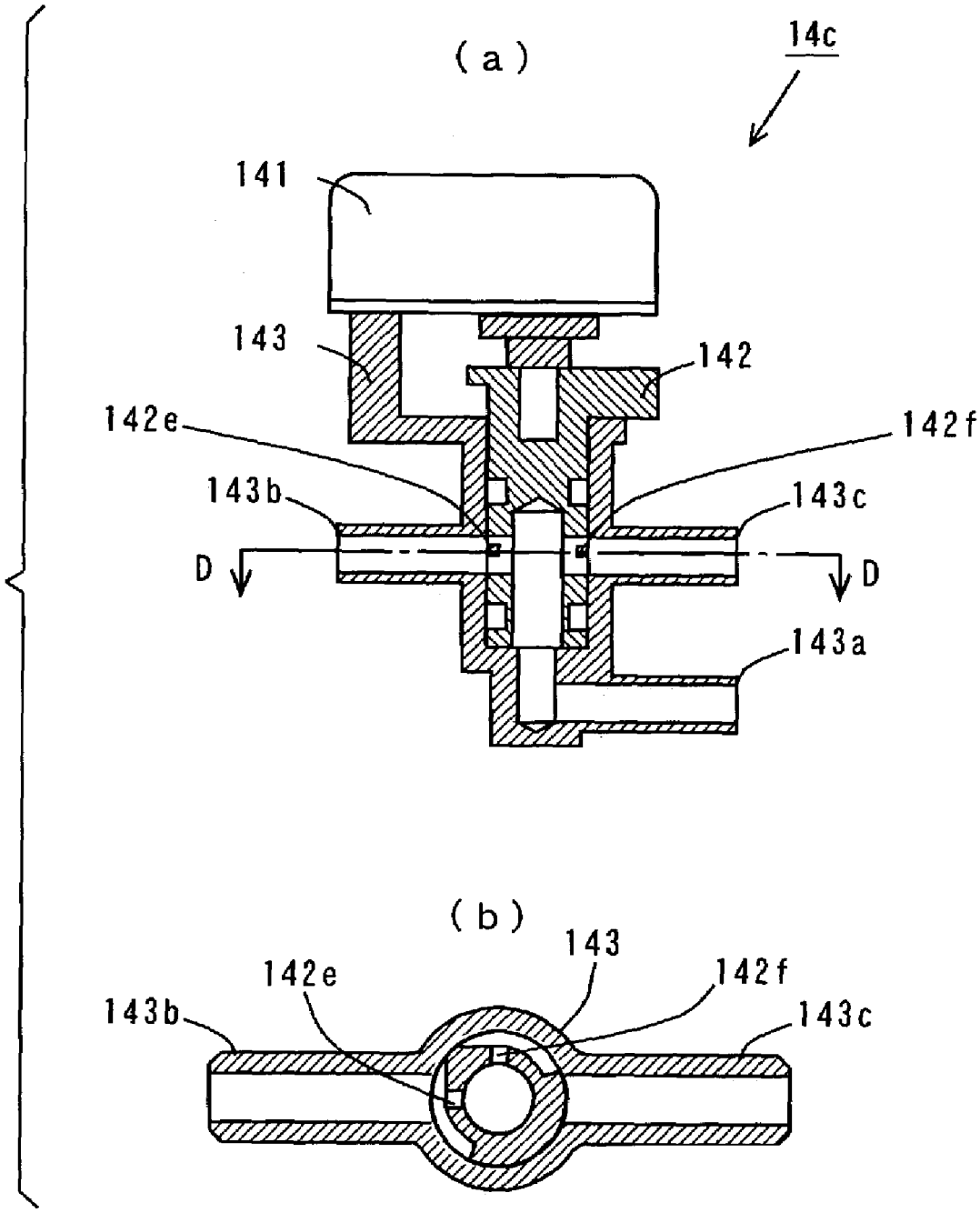
FIG. 67 is a cross-sectional view showing still another example of the switching valve.

FIG. 67 is a cross-sectional view showing still another example of a switching valve.

FIG. 67(*a*) is a vertical sectional view of the switching valve, and FIG. 67(*b*) is a cross-sectional view taken along a line D—D of the switching valve shown in FIG. 67(*a*).

A switching valve 14*c* shown in FIG. 67 is a fluid control valve having two washing water outlets. The switching valve 14*c* is employed for a sanitary washing apparatus comprising a posterior nozzle 1 having one flow path and a bidet nozzle 2 having one flow path or a sanitary washing apparatus comprising only a posterior nozzle 1 having two flow paths, for example. Description is now made of a case where the switching valve 14*c* shown in FIG. 67 is employed for the sanitary washing apparatus comprising a posterior nozzle 1 having one flow path and a bidet nozzle 2 having one flow path.

The switching valve 14*c* shown in FIG. 67 comprises a motor 141, an inner cylinder 142, and an outer cylinder 143.

The inner cylinder 142 is inserted into the outer cylinder 143, and the axis of rotation of the motor 141 is attached to the inner cylinder 142. The motor 141 performs a rotating operation on the basis of a control signal fed by the controller 4. The motor 141 is rotated so that the inner cylinder 142 is rotated.

As shown in FIGS. 67(*a*) and 67(*b*), a washing water inlet 143*a* is provided at one end of the outer cylinder 143, and washing water outlets 143*b* and 143*c* are provided at opposite positions of the sides thereof. The inner cylinder 142 is provided with holes 142*e* and 142*f*. Chamfers (recesses) composed of a curved line and a straight line are respectively formed, as shown in FIG. 67(*b*), around the holes 142*e* and 142*f*.

By the rotation of the inner cylinder 142, the holes 142*e* and 142*f* are opposable to the washing water outlet 143*b* or 143*c* in the outer cylinder 143.

The pipe 203 shown in FIG. 3 is connected to the washing water inlet 143*a*, the bidet nozzle 2 is connected to the washing water outlet 143*b*, and the flow path in the posterior nozzle 1 is connected to the washing water outlet 143*c*.

Figure 68:
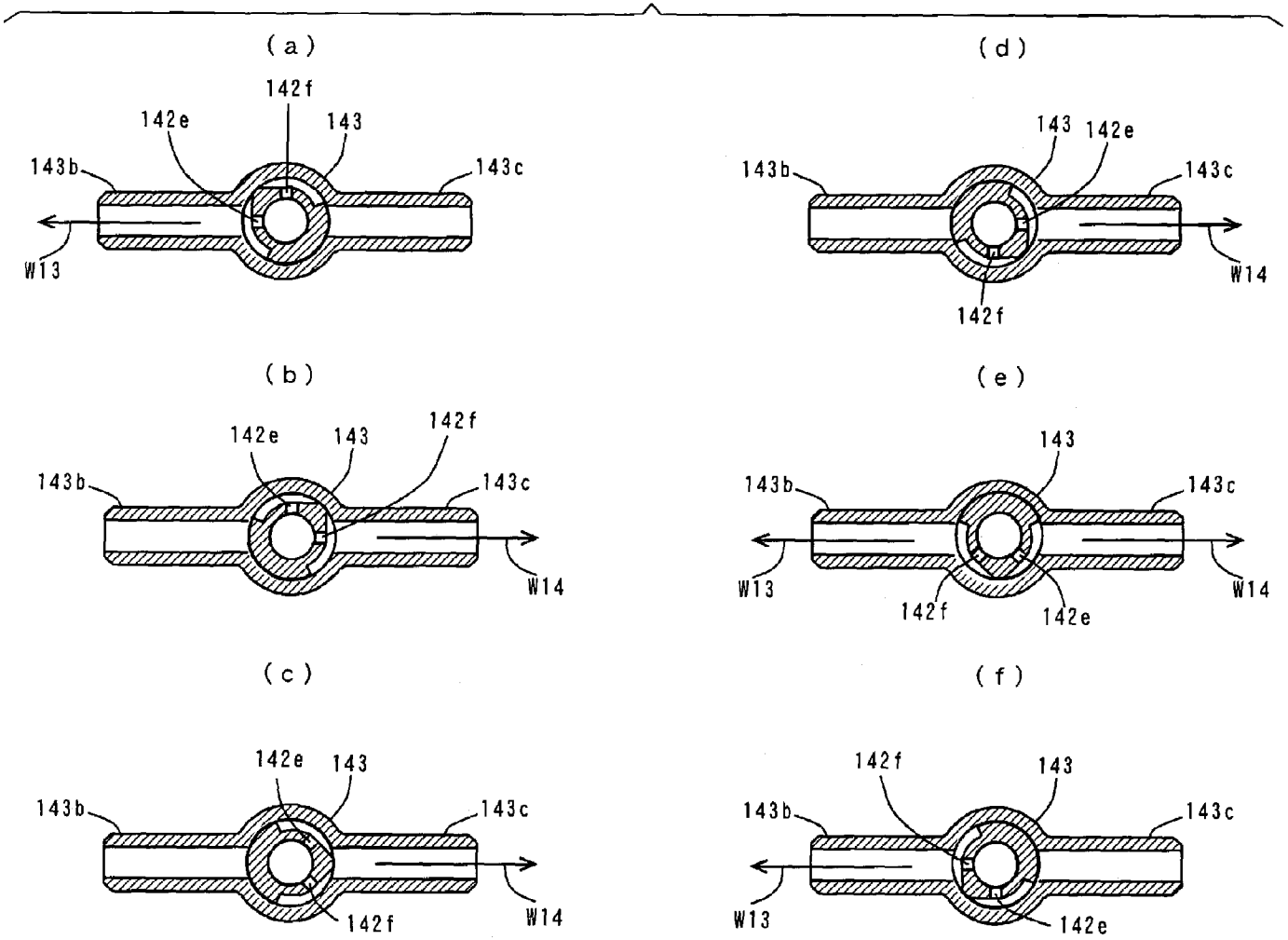
FIG. 68 is a cross-sectional view showing the operations of the switching valve shown in FIG. 67.

FIG. 68 is a cross-sectional view showing the operations of the switching valve 14*c* shown in FIG. 67.

FIGS. 68(*a*) to 68(*f*) respectively illustrate states where the motor 141 in the switching valve 14*c* is rotated through angles of zero, 90 degrees, 135 degrees, 180 degrees, 225 degrees and 270 degrees.

First, when the motor 141 is not rotated (rotated through an angle of zero), as shown in FIG. 68(*a*), the hole 142*e* in the inner cylinder 142 is opposed to the washing water outlet 143*b* in the outer cylinder 143. Consequently, the washing water passes in the inner cylinder 142 from the washing water inlet 143*a*, to flow out of the washing water outlet 143*b*, as indicated by an arrow W13.

When the motor 141 then rotates the inner cylinder 142 through 90 degrees, as shown in FIG. 68(*b*), the hole 142*f* in the inner cylinder 142 is opposed to the washing water outlet 143*c* in the outer cylinder 143. Consequently, the washing water passes in the inner cylinder 142 from the washing water inlet 143*a*, to flow out of the washing water outlet 143*c*, as indicated by an arrow W14.

When the motor 141 then rotates the inner cylinder 142 through 135 degrees, as shown in FIG. 68(*c*), a part of the chamfer (recess) around each of the holes 142*e* and 142*f* in the inner cylinder 142 is opposed to the washing water outlet 143*c* in the outer cylinder 143. Consequently, the washing water passes in the inner cylinder 142 from the washing water inlet 143*a*, to flow out of the washing water outlet 143*c*, as indicated by an arrow W14.

When the motor 141 then rotates the inner cylinder 142 through 180 degrees, as shown in FIG. 68(*d*), the hole 142*e* in the inner cylinder 142 is opposed to the washing water outlet 143*c* in the outer cylinder 143. Consequently, the washing water passes in the inner cylinder 142 from the washing water inlet 143*a*, to flow out of the washing water outlet 143*c*, as indicated by an arrow W14.

When the motor 141 then rotates the inner cylinder 142 through 225 degrees, as shown in FIG. 68(*e*), a part of the chamfer (recess) around the hole 142*e* in the inner cylinder 142 is opposed to the washing water outlet 143*c* in the outer cylinder 143, and a part of the chamfer (recess) around the hole 142*f* in the inner cylinder 142 is opposed to the washing water outlet 143*b* in the outer cylinder 143. Consequently, the washing water passes in the inner cylinder 142 from the washing water inlet 143*a*, to respectively flow out of the washing water outlets 143*b* and 143*c*, as indicated by an arrow W13 and an arrow W14.

When the motor 141 then rotates the inner cylinder 142 through 270 degrees, as shown in FIG. 68(*f*), the hole 142*f* in the inner cylinder 142 is opposed to the washing water outlet 143*b* in the outer cylinder 143. Consequently, the washing water passes in the inner cylinder 142 from the washing water inlet 143*a*, to flow out of the washing water outlet 143*b*, as indicated by an arrow W13.

As described in the foregoing, the motor 141 is rotated on the basis of the control signal from the controller 4 so that either one of the holes 142*e* and 142*f* in the inner cylinder 142 is opposed to the washing water outlets 143*b* and 143*c* in the outer cylinder 143, and the washing water flowing into the inner cylinder 142 from the washing water inlet 143*a* flows out of either one of the washing water outlets 143*b* and 143*c*.

Furthermore, the controller 4 controls the rotation angle of the motor 141 in the switching valve 14*c*, thereby making it possible to control the respective flow rates of the washing water flowing out of the washing water outlets 143*b* and 143*c*. Further, whatever angle is the rotation angle the motor 141 in the switching valve 14*c*, either one of the washing water outlets 142*e* and 142*f* or the chamfer (recess) around the washing water outlet is opposed to either one of the washing water outlets 143*b* and 143*c*. Accordingly, the flow path of the washing water is not closed, so that the washing water supplied from the washing water inlet 143*a* flows out of either one of the washing water outlets 143*b* and 143*c*.

Even when the pressurized washing water is supplied to the switching valve 14*c* from the pump 13 due to any failure when the nozzle unit 30 is not used, therefore, the washing water can be caused to flow out of either one of the washing water outlets 143*b* and 143*c* in the switching valve 14*c*. Consequently, the pressure in the pipe can be prevented from rising. As a result, it is possible to prevent damage to the pipe and leakage of water.

(Another Example of Posterior Nozzle)

Figure 69:
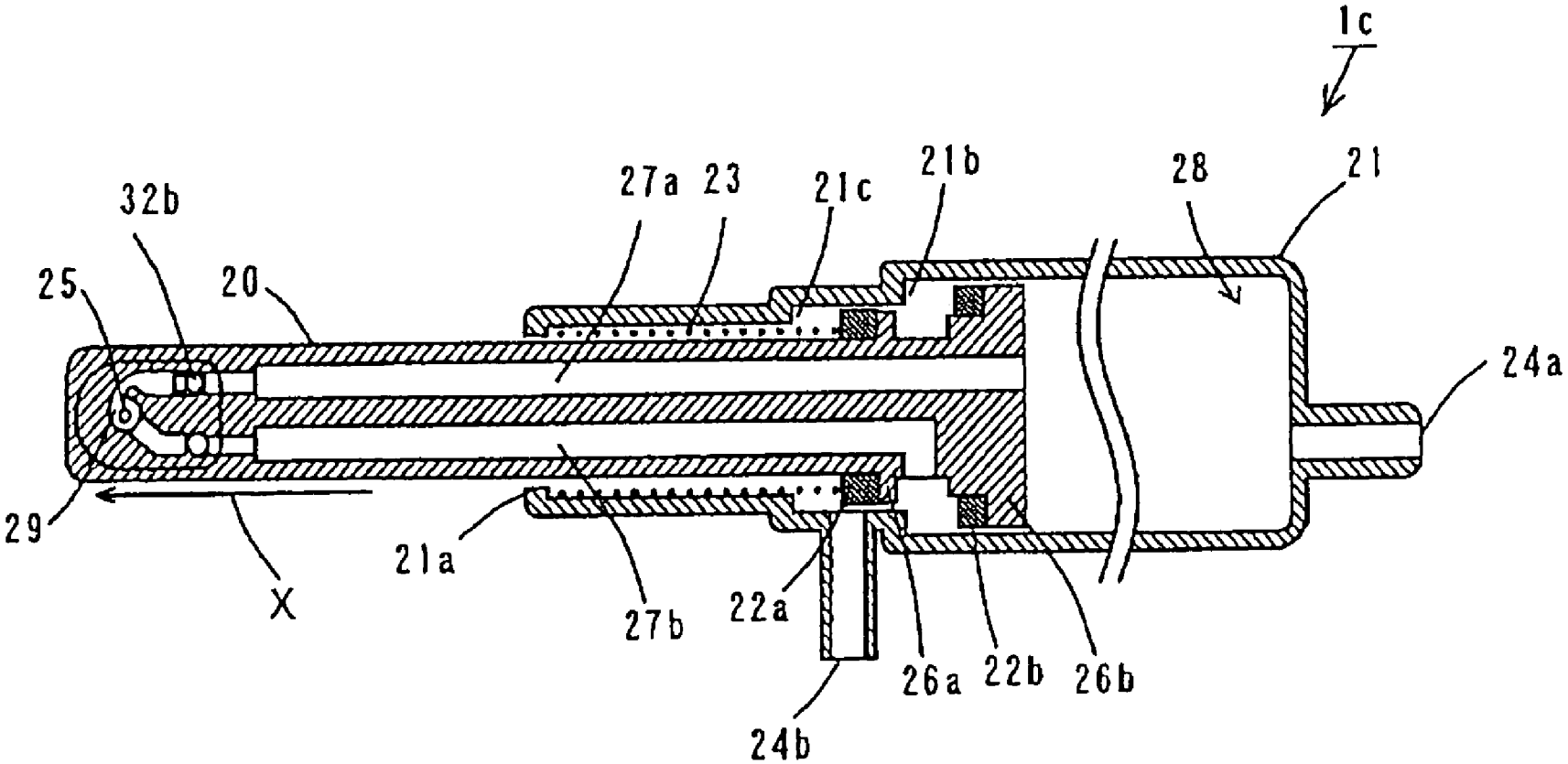
FIG. 69 is a schematic sectional view showing another example of a posterior nozzle in the nozzle shown in FIG. 3.

FIG. 69 is a schematic sectional view showing another example of the posterior nozzle 1 in the nozzle unit 30 shown in FIG. 3.

In a posterior nozzle 1*c* shown in FIG. 69, a ball check valve 32*b* is inserted between the first flow path 27*a* and the cylindrical swirl chamber 29 in the posterior nozzle 1 shown in FIG. 14.

As shown in FIG. 69, a spray hole 25 for spraying washing water is formed in the vicinity of a front end of a piston 20 in the posterior nozzle 1*c*. Flange-shaped stoppers 26*a* and 26*b* are provided at a rear end of the piston 20. Further, seal packings 22*a* and 22*b* are respectively mounted on the stoppers 26*a* and 26*b*. Inside the piston 20, a first flow path 27*a* communicating with the spray hole 25 from a rear end surface of the piston 20 is formed, and a second flow path 27*b* communicating with the spray hole 25 from a peripheral surface of the piston 20 between the stopper 26*a* and the stopper 26*b* is formed. Further, a cylindrical swirl chamber 29 is formed around the spray hole 25, and the ball check valve 32*b* is inserted between the first flow path 27*a* and the cylindrical swirl chamber 29. The details of the configuration at a front end of the piston 20 will be described later.

On the other hand, a cylinder 21 comprises a small diameter portion at its front end, an intermediate portion having an intermediate diameter, and a large diameter portion at its rear end. Consequently, a stopper surface 21*c* against which the stopper 26*a* in the piston 20 can abut through the seal packing 22*a* is formed between the small diameter portion and the intermediate portion, and a stopper surface 21*b* against which the stopper 26*b* in the piston 20 can abut through the seal packing 22*b* is formed between the intermediate portion and the large diameter portion. A washing water inlet 24*a* is provided on a rear end surface of the cylinder 21, a washing water inlet 24*b* is provided on a peripheral surface of the intermediate portion of the cylinder 21, and an opening 21*a* is provided on a front end surface of the cylinder 21. An inner space of the cylinder 21 is a temperature fluctuation buffering space 28. The washing water inlet 24*a* is provided eccentrically at a position different from the central axis of the cylinder 21. The washing water inlet 24*a* is connected to the washing water outlet 143*c* in the switching valve 14 shown in FIG. 9, and the washing water inlet 24*b* is connected to the washing water outlet 143*d* in the switching valve 14 shown in FIG. 9. When the piston 20 projects most greatly from the cylinder 21, the washing water inlet 24*b* communicates with the second flow path 27*b*. The details of the connection of the washing water inlet 24*b* with the second flow path 27*b* will be described later.

The piston 20 is inserted into the cylinder 21 so as to be movable such that the stopper 26*b* is positioned in the temperature fluctuation buffering space 28, and the front end projects from the opening 21*a*.

Furthermore, a spring 23 is disposed between the stopper 26*a* in the piston 20 and a peripheral edge of the opening 21*a* in the cylinder 21, to urge the piston 20 toward the rear end of the cylinder 21.

A micro-clearance is formed between an outer peripheral surface of the stopper 26*a* or 26*b* in the piston 20 and an inner peripheral surface of the cylinder 21, and a micro-clearance is formed between an outer peripheral surface of the piston 20 and an inner peripheral surface of the opening 21*a* in the cylinder 21.

Figure 70:
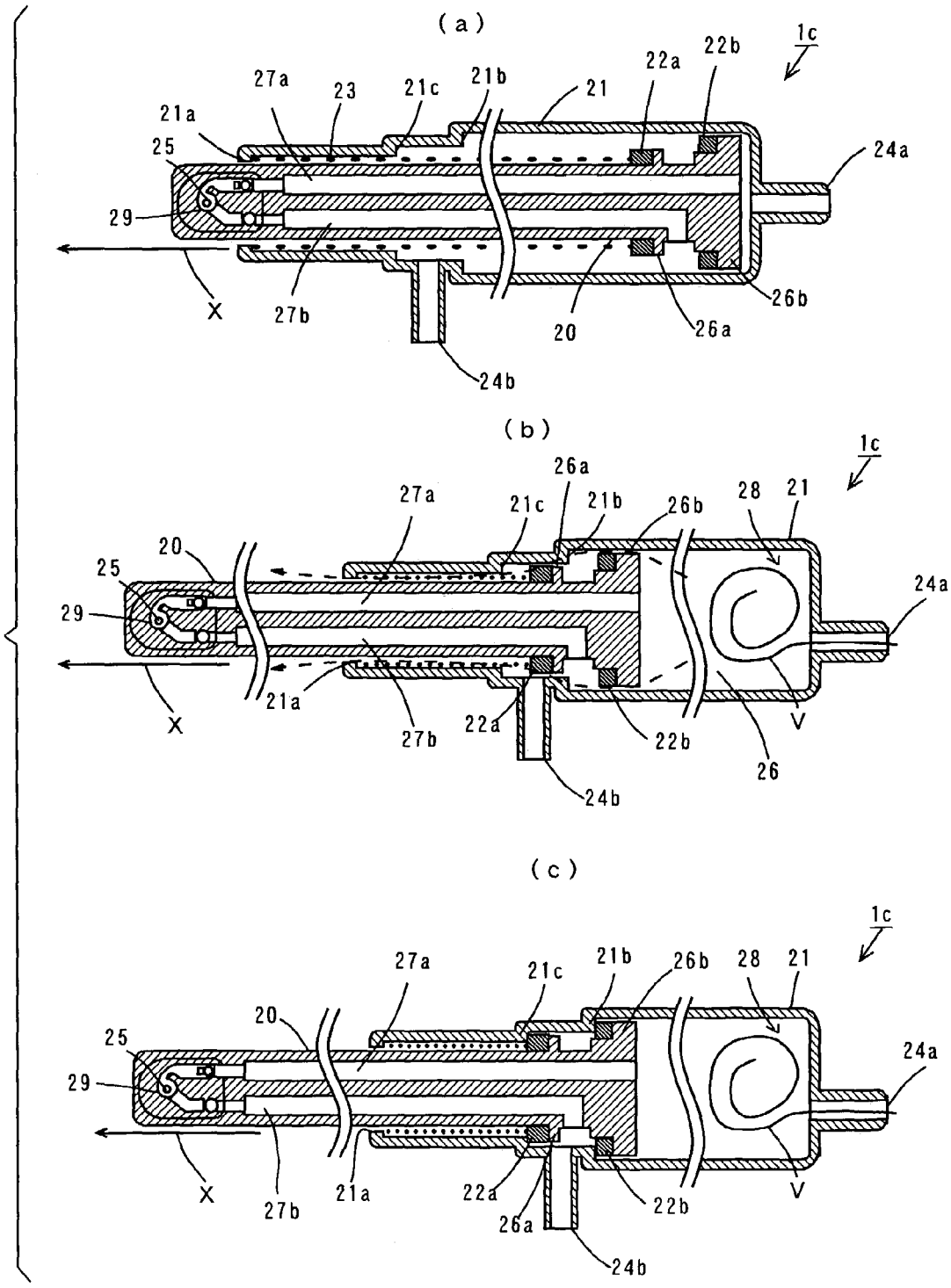
FIG. 70 is a cross-sectional view for explaining the operations of the posterior nozzle shown in FIG. 69.

Description is now made of the operations of the posterior nozzle 1*c* shown in FIG. 69. FIG. 70 is a cross-sectional view for explaining the operations of the posterior nozzle 1*c* shown in FIG. 69.

First, when no washing water is supplied from the washing water inlet 24*a* and 24*b* in the cylinder 21, as shown in FIG. 70(*a*), the piston 20*a* retreats in the opposite direction to a direction indicated by an arrow X by the elastic force of the spring 23, and is accommodated in the cylinder 21. As a result, the piston 20 enters a state where it does not project most greatly from the opening 21*a* in the cylinder 21. At this time, the temperature fluctuation buffering space 28 is not formed in the cylinder 21.

When the supply of washing water from the washing water inlet 24*a* in the cylinder 21 is then started, as shown in FIG. 70(*b*), the piston 20 gradually advances in the direction indicated by the arrow X against the elastic force of the spring 23 by the pressure of the washing water.

Consequently, the temperature fluctuation buffering space 28 is formed in the cylinder 21, and the washing water flows into the temperature fluctuation buffering space 28.

Since the washing water inlet 24*a* is provided at a position eccentric from the central axis of the cylinder 21, the washing water flowing into the temperature fluctuation buffering space 28 flows in a swirling state, as indicated by an arrow V. A part of the washing water in the temperature fluctuation buffering space 28 flows out of the micro-clearance between the outer peripheral surface of the piston 20 and the inner peripheral surface of the opening 21*a* in the cylinder 21 through the micro-clearance between the outer peripheral surface of the stopper 26*a* or 26*b* in the piston 20 and the inner peripheral surface of the cylinder 21, and is supplied to the cylindrical swirl chamber 29 through the first flow path 27*a* in the piston 20, to be slightly sprayed from the spray hole 25.

When the piston 20 further advances, the stoppers 26*a* and 26*b* are respectively brought into watertight contact with the stopper surfaces 21*c* and 21*b* in the cylinder 21 through the seal packings 22*a* and 22*b*, as shown in FIG. 70(*c*). Consequently, a flow path leading from the micro-clearance between the outer peripheral surface of the stopper 26*a* or 26*b* in the piston 20*a* and the inner peripheral surface of the cylinder 21 to the micro-clearance between the outer peripheral surface of the piston 20 and the inner peripheral surface of the opening 21*a* in the cylinder 21 is blocked off. Further, the washing water supplied from the washing water inlet 24*b* is supplied to the cylindrical swirl chamber 29 through the second flow path 27*b* in the piston 20. Consequently, the washing water supplied to the cylindrical swirl chamber 29 through the second flow path 27*b* in the piston 20 is mixed with the washing water supplied thereto through the first flow path 27*a* in the piston 20, and obtained mixed washing water is sprayed from the spray hole 25.

The washing water supplied from the washing water outlets 143*c* and 143*d* in the switching valve 14 is thus introduced into the cylindrical swirl chamber 29 after passing through the washing water inlets 24*a* and 24*b* in the cylinder 21 and the first flow path 27*a* and the second flow path 27*b* in the piston 20, and is sprayed from the spray hole 25 through the cylindrical swirl chamber 29.

Figure 71:
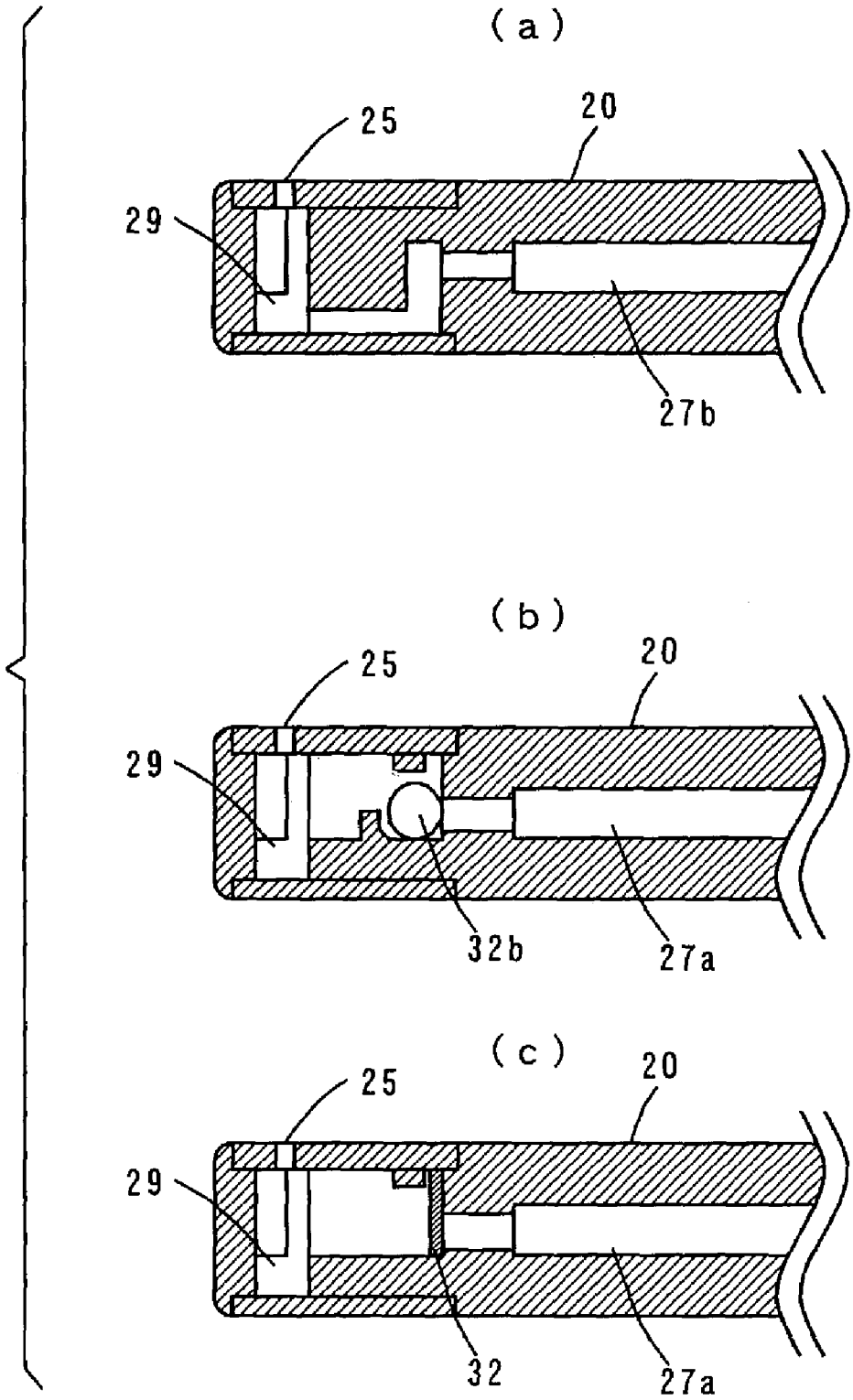
FIG. 71(*a*) is a cross-sectional view of a second flow path at a front end of a piston shown in FIG. 69, FIG. 71(*b*) is a cross-sectional view of a first flow path at the front end of the piston shown in FIG. 69, and FIG. 71(*c*) is a cross-sectional view showing another example of the front end of the piston.

FIG. 71(*a*) is a cross-sectional view of the second flow path 27*b* at the front end of the piston 20 shown in FIG. 69, FIG. 71(*b*) is a cross-sectional view of the first flow path 27*a* at the front end of the piston 20 shown in FIG. 69, and FIG. 71(*c*) is a cross-sectional view showing another example at the front end of the piston 20.

The washing water flowing through the second flow path 27*b* in the piston 20 is first supplied to a lower part of the cylindrical swirl chamber 29, as shown in FIG. 71(*a*).

On the other hand, the washing water flowing through the first flow path 27*a* in the piston 20 is supplied to a side surface of the cylindrical swirl chamber 29 while pushing up the ball check valve 32*b*, as shown in FIG. 71(*b*). The ball check valve 32*b* allows the washing water to flow from the first flow path 27*a* to the cylindrical swirl chamber 29, and prevents the washing water from flowing backward from the cylindrical swirl chamber 29 to the first flow path 27*a*. The operations of the ball check value 32*b* will be described later.

As shown in FIG. 71(*c*), the ball check valve 32*b* may be replaced with a plate-shaped check valve 32. The washing water flowing through the first flow path 27*a* is supplied to a side surface of the cylindrical swirl chamber 29 while pressing and bending the plate-shaped check valve 32. The plate-shaped check valve 32 allows the washing water to flow from the first flow path 27*a* to the cylindrical swirl chamber 29, and prevents the washing water from flowing backward from the cylindrical swirl chamber 29 to the first flow path 27*a*.

Figure 72:
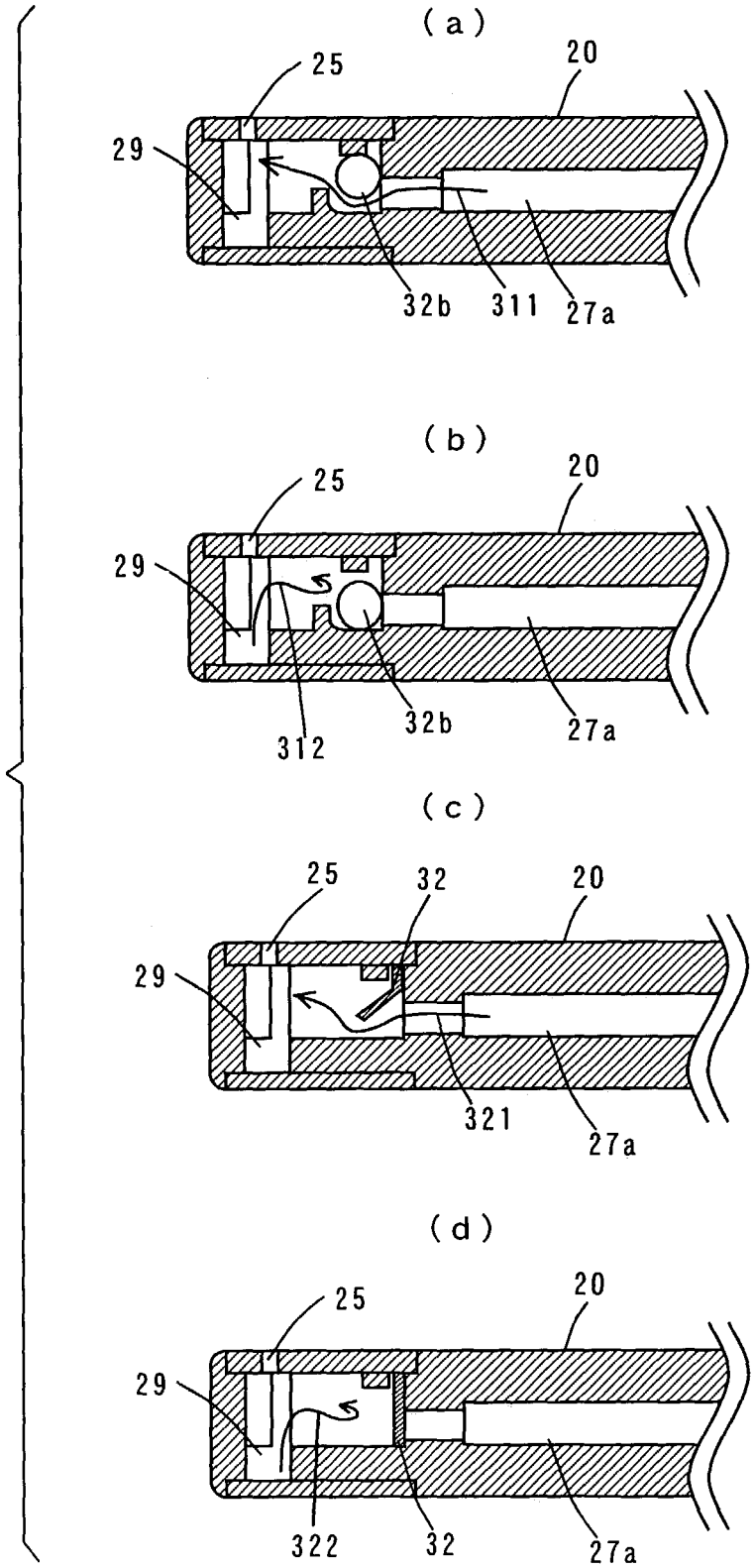
FIG. 72 is an explanatory view showing the operations of a ball check valve and a plate-shaped check valve shown in FIGS. 71(*b*) and 71(*c*)

FIG. 72 is an explanatory view showing the operations of the ball check valve 32*b* and the plate-shaped check valve 32, respectively, shown in FIGS. 71(*b*) and 71(*c*).

First, when the pressure in the first flow path 27*a* is higher than the pressure in the cylindrical swirl chamber 29, as shown in FIG. 72(*a*), so that the pressure of the washing water is applied in the direction from the first flow path 27*a* to the cylindrical swirl chamber 29, the ball check valve 32*b* moves upward, to open the first flow path 27*a*. Consequently, the washing water flows from the first flow path 27*a* to the cylindrical swirl chamber 29 in a direction indicated by an arrow 311.

On the other hand, when the pressure in the cylindrical swirl chamber 29 is higher than the pressure in the first flow path 27*a*, as shown in FIG. 72(*b*), so that the pressure of the washing water is applied in the direction from the cylindrical swirl chamber 29 to the first flow path 27*a*, the ball check valve 32*b* moves downward by its own weight, to close the first flow path 27*a*. Consequently, the washing water is prevented from circulating from the cylindrical swirl chamber 29 to the first flow path 27*a* in a direction indicated by an arrow 312.

When the pressure in the first flow path 27*a* is higher than the pressure in the cylindrical swirl chamber 29, as shown in FIG. 72(*c*), so that the pressure of the washing water is applied in the direction from the first flow path 27*a* to the cylindrical swirl chamber 29, the plate-shaped check valve 32 is curved toward the cylindrical swirl chamber 29, to open the first flow path 27*a*. Consequently, the washing water flows from the first flow path 27*a* to the cylindrical swirl chamber 29 in a direction indicated by an arrow 321.

On the other hand, when the pressure in the cylindrical swirl chamber 29 is higher than the pressure in the first flow path 27*a*, as shown in FIG. 72(*d*), so that the pressure of the washing water is applied in the direction from the cylindrical swirl chamber 29 to the first flow path 27*a*, the plate-shaped check valve 32 is not curved, to close the first flow path 27*a*. Consequently, the washing water is prevented from circulating from the cylindrical swirl chamber 29 to the first flow path 27*a* in a direction indicated by an arrow 322.

Here, when bubbles exist in the temperature fluctuation buffering space 28 in the cylinder 21, the width of pressure fluctuations of the washing water sprayed from the spray hole 25 is decreased. In the posterior nozzle 1 according to the present embodiment, the function of the ball check valve 32*b* prevents the width of pressure fluctuations of the washing water from being decreased. Description is now made of the decrease in the width of pressure fluctuations of the washing water due to the existence of the bubbles and the function of the ball check valve 32*b*.

Figure 73:
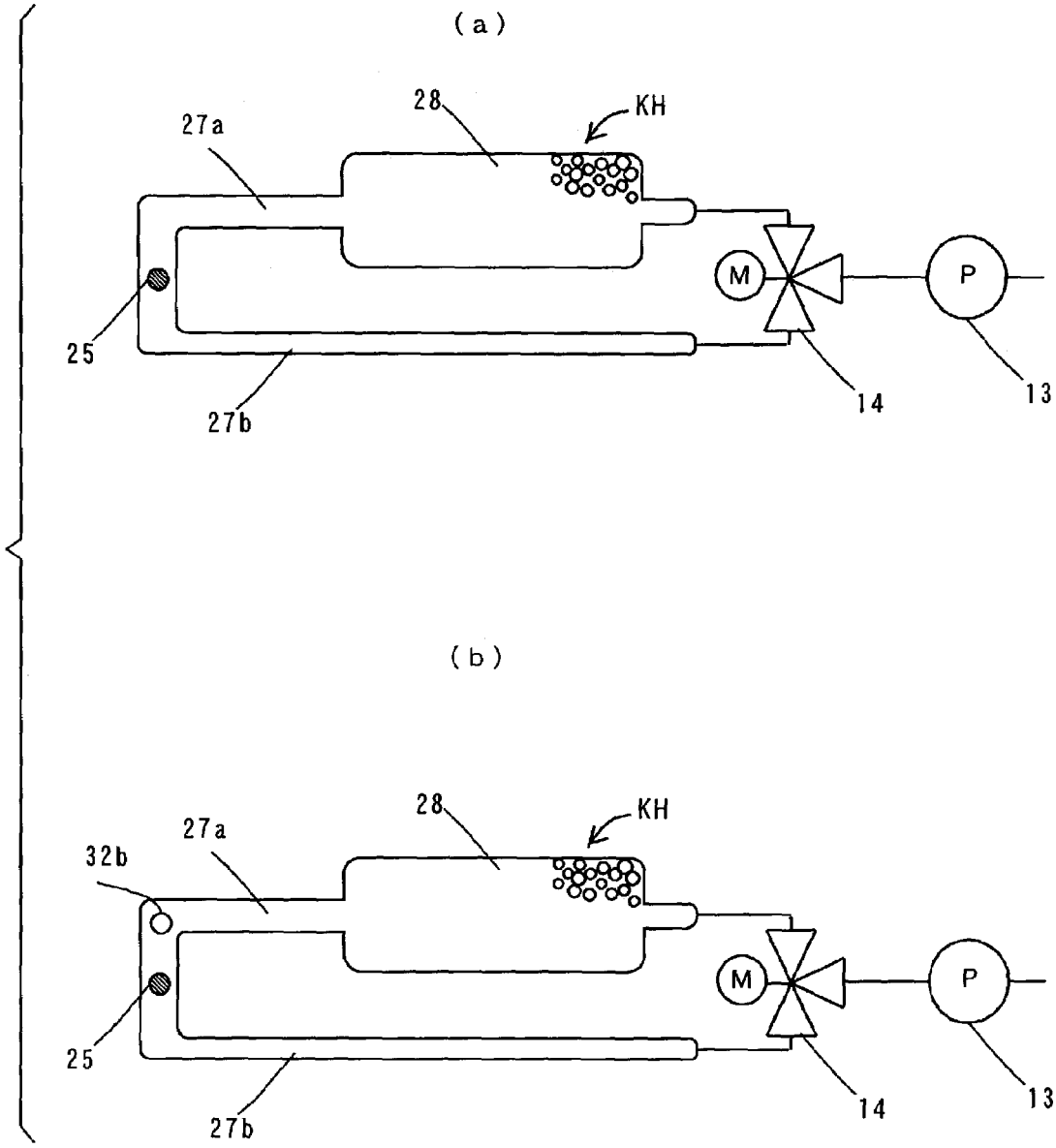
FIG. 73(*a*) is a schematic view showing a posterior nozzle having no ball check valve, and FIG. 73(*b*) is a schematic view showing a posterior nozzle having a ball check valve.
Figure 74:
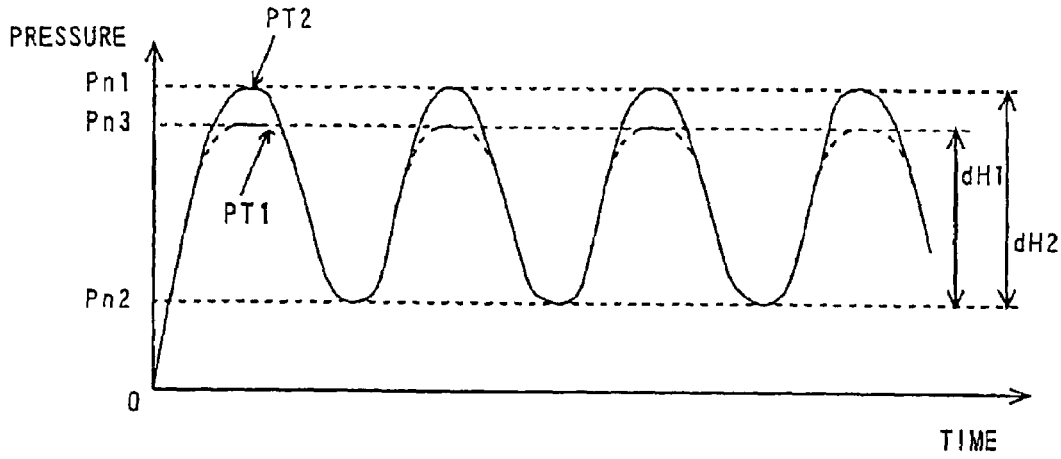
FIG. 74 is a diagram for explaining the decrease in the width of pressure fluctuations of washing water sprayed from a spray hole in the posterior nozzle.

FIG. 73(*a*) is a schematic view showing a posterior nozzle 1 having no ball check valve 32*b*, and FIG. 73(*b*) is a schematic view showing a posterior nozzle 1*c* having a ball check valve 32*b*. FIG. 74 is a diagram for explaining the decrease in the width of pressure fluctuations of the washing water sprayed from a spray hole 25 in the posterior nozzle 1*c*.

A dotted line PT1 shown in FIG. 74 indicates the change in pressure of washing water sprayed from a spray hole 25 in the posterior nozzle 1 having no ball check valve 32*b*, and a solid line PT2 indicates the change in pressure of washing water sprayed from the spray hole 25 in the posterior nozzle 1*c* having the ball check valve 32*b*.

As shown in FIGS. 73(*a*) and 73(*b*), washing water heated by the heat exchanger 11 is supplied to the first flow path 27*a* and the second flow path 27*b* through the pump 13 and the switching valve 14. In this case, the washing water is instantaneously heated by the heat exchanger 11, and dissolved air included in the washing water is stored as bubbles KH in the temperature fluctuation buffering space 28. Alternatively, air in a pipe is stored as bubbles KH in the temperature fluctuation buffering space 28. The bubbles KH are a compressed fluid, and contract if pressure is applied thereto.

In the case of the posterior nozzle 1 having no ball check valve 32*b* shown in FIG. 73(*a*), therefore, the pressure of the washing water supplied from the second flow path 27*b* is transmitted to the first flow path 27*a* through the cylindrical swirl chamber 29. As a result, the pressure transmitted to the first flow path 27*a* is transmitted to the temperature fluctuation buffering space 28, and the bubbles KH stored in the temperature fluctuation buffering space 28 contract so that the pressure is buffered.

When washing water having a width of fluctuations dH2 between a pressure Pn1 and a pressure Pn2 is supplied to the second flow path 27*b* by the function of the pump 13, as shown in FIG. 74, therefore, the bubbles KH stored in the temperature fluctuation buffering space 28 contract in the posterior nozzle 1 having no ball check valve 32*b* shown in FIG. 73(*a*). Therefore, washing water having a width of fluctuations dH1 between a pressure Pn3 and the pressure Pn2 which are lower than the pressure Pn1 is sprayed from the spray hole 25, as indicated by the dotted line PT1 in FIG. 74.

On the other hand, in the posterior nozzle 1*c* having the ball check valve 32*b* shown in FIG. 73(*b*), the pressure of the washing water supplied from the second flow path 27*b* is not transmitted to the first flow path 27*a* through the cylindrical swirl chamber 29 by the function of the ball check valve 32*b*. That is, even when the internal pressure of the second flow path 27*b* rises, the ball check valve 32*b* functions in the direction in which the washing water is prevented from flowing toward the first flow path 27*a*. Therefore, the washing water inside the second flow path 27*b* is unaffected by the bubbles KH stored in the temperature fluctuation buffering space 28.

When the washing water having the width of fluctuations dH2 between the pressure Pn1 and the pressure Pn2 is supplied to the second flow path 27*b* by the function of the pump 13, as shown in FIG. 74, therefore, the washing water inside the second flow path 27*b* is unaffected by the bubbles KH stored in the temperature fluctuation buffering space 28 in the posterior nozzle 1 having the ball check valve 32*b* shown in FIG. 73(*b*). Therefore, the washing water having the width of fluctuations dH2 between the pressure Pn1 and the pressure Pn2 is sprayed from the spray hole 25, as indicated by the solid line PT2 in FIG. 74.

In the posterior nozzle 1*c* in the present embodiment, when the bubbles KH thus exist in the temperature fluctuation buffering space 28 in the posterior nozzle 1*c*, the washing water supplied from the second flow path 27*b* is unaffected by the bubble KH stored in the temperature fluctuation buffering space 28 on the side of the first flow path 27*a*, so that the width of pressure fluctuations of the washing water supplied from the second flow path 27*b* is prevented from being decreased, thereby not decreasing the width of pressure fluctuations of linear flow sprayed from the spray hole 25. As a result, a washing feeling for the human body can be prevented from being decreased. The washing water supplied from the first flow path 27*a* is sprayed from the spray hole 25 as dispersed spiral flow by the function of the cylindrical swirl chamber 29. The purpose of the dispersed spiral flow is to give a soft washing feeling. Even if the width of pressure fluctuations of the washing water from the first flow path 27*a* is decreased by the bubbles KH stored in the temperature fluctuation buffering space 28, therefore, the purpose of the dispersed spiral flow is not lost.

(Still Another Example of Posterior Nozzle)

Figure 75:
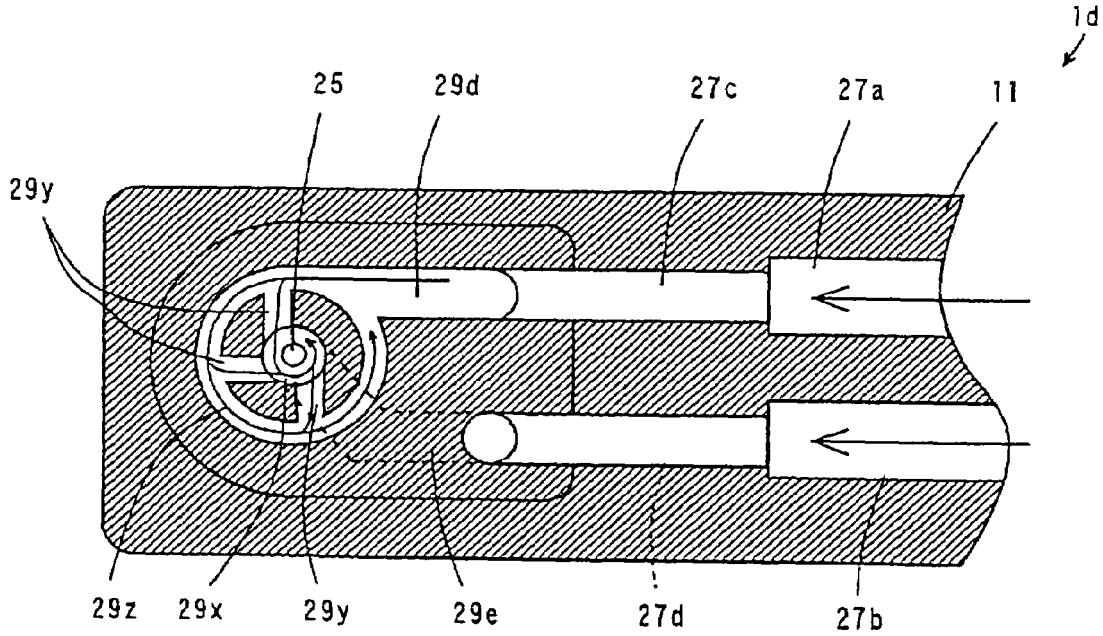
FIG. 75 is a schematic partially sectional view showing still another example of a posterior nozzle in a nozzle.
Figure 76:
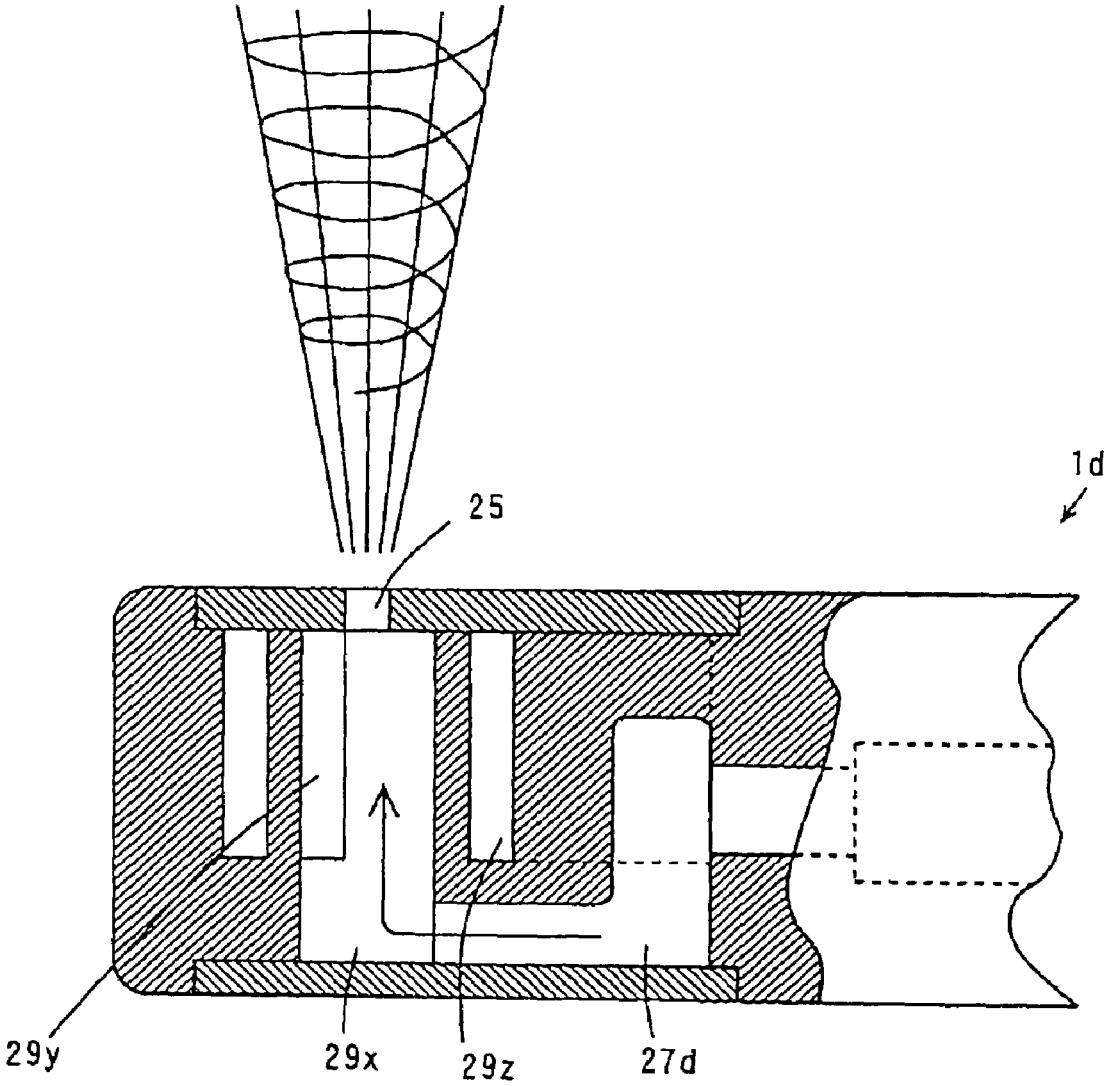
FIG. 76 is a schematic partially sectional view showing still another example of a posterior nozzle in a nozzle.

FIGS. 75 and 76 are schematic partial sectional views showing still another example of the posterior nozzle 1 in the nozzle unit 30.

In a posterior nozzle ld shown in FIG. 75, the cylindrical swirl chamber 29 in the posterior nozzle 1 shown in FIG. 14 is replaced with a center cylindrical swirl chamber 29*x*, a plurality of swirl chamber communicating flow paths 29*y*, and an annular swirl chamber 29*z*.

As shown in FIGS. 75 and 76, the annular swirl chamber 29*z* is formed concentrically on the outer periphery of the center cylindrical swirl chamber 29*x*. A first flow path 27*a* and a second flow path 27*b* are connected to the annular swirl chamber 29*z*. Further, the plurality of swirl chamber communicating flow paths 29*y* communicating with the center cylindrical swirl chamber 29*x* are formed in the annular swirl chamber 29*z*. Consequently, a rotating force produced by the annular swirl chamber 29*z* is added to a rotating force produced by the center cylindrical swirl chamber 29*x*. As a result, the rotating force of the washing water sprayed from the spray hole 25 can be increased.

(Another Example of Bidet Nozzle)

Figure 77:
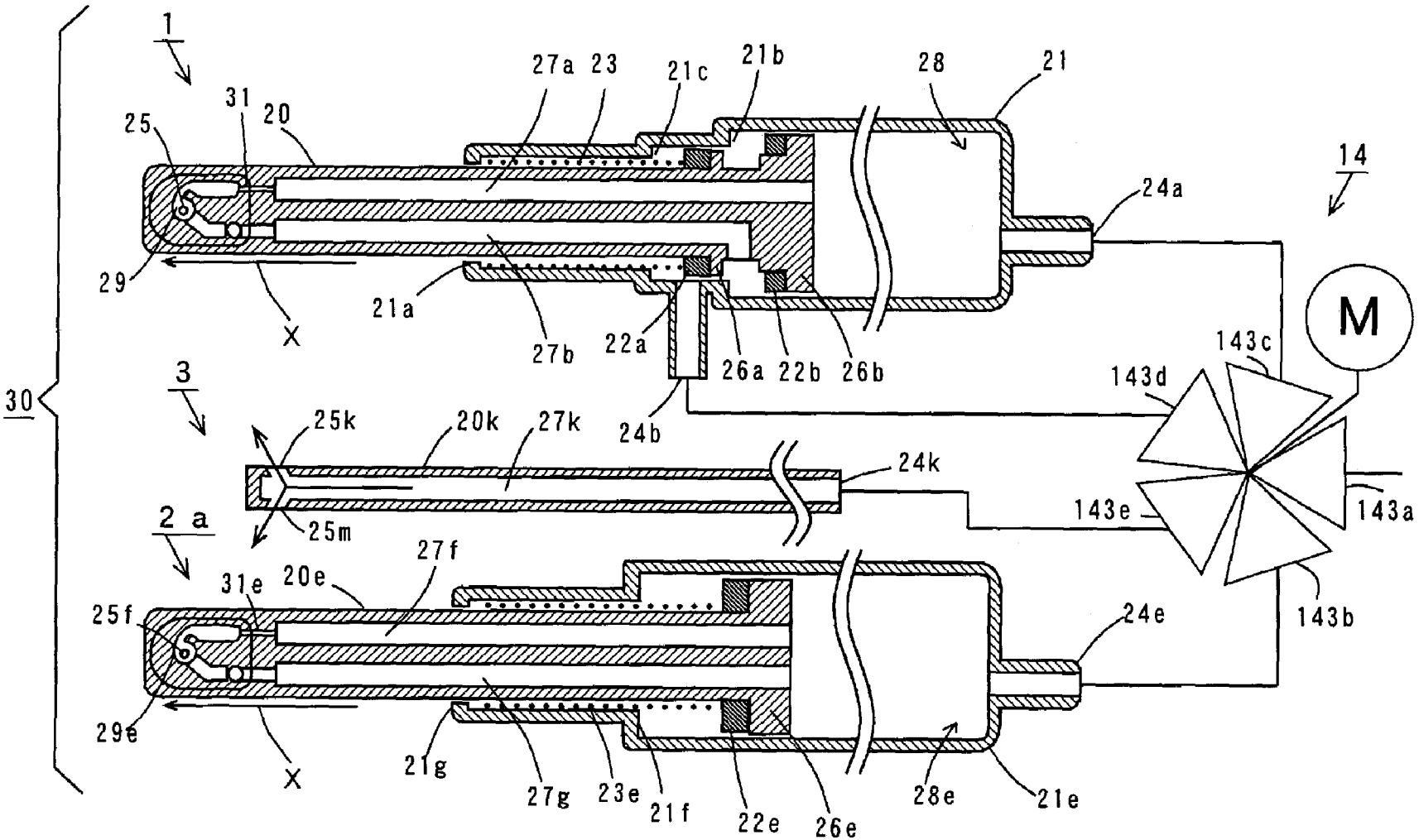
FIG. 77 is a schematic sectional view of a nozzle and a switching valve.

FIG. 77 is a schematic sectional view showing another example of the bidet nozzle.

As shown in FIG. 77, washing water outlets 143*c* and 143*d* in a switching valve 14 are connected to a posterior nozzle 1, a washing water outlet 143*b* in the switching valve 14 is connected to a bidet nozzle 2*a*, and a washing water outlet 143*e* in the switching valve 14 is connected to a nozzle cleaning nozzle 3.

A spray hole 25*f* for spraying washing water is formed in the vicinity of a front end of a piston 20*e* in the bidet nozzle 2*a*. A flange-shaped stopper 26*e* is provided at a rear end of the piston 20*e*. Further, a seal packing 22*e* is mounted on the stopper 26*e*. Inside the piston 20*e*, a first flow path 27*f* and a second flow path 27*g* which communicate with the spray hole 25*f* from a rear end surface of the piston 20*e* are formed. Further, a cylindrical swirl chamber 29*e* is formed around the spray hole 25*f*, and a flow-contracting portion 31*e* is inserted between the second flow path 27*g* and the cylindrical swirl chamber 29*e*. The flow-contracting portion 31*e* functions similarly to the ball check valve 32*b* shown in FIG. 73.

On the other hand, a cylinder 21*e* comprises a small diameter portion at its front end and a large diameter portion at its rear end. Consequently, a stopper surface 21*f* against which the stopper 26*e* in the piston 20*e* can abut through the seal packing 22*e* is formed between the small diameter portion and the large diameter portion. A washing water inlet 24*e* is provided on a rear end surface of the cylinder 21*e*, and an opening 21*g* is provided on a front end surface of the cylinder 21*e*. An inner space of the cylinder 21*e* is a temperature fluctuation buffering space 28*e*. The washing water inlet 24*e* is provided eccentrically at a position different from the central axis of the cylinder 21*e*. The washing water inlet 24*e* is connected to the washing water outlet 143*b* in the switching valve 14.

The piston 20*e* is inserted into the cylinder 21*e* so as to be movable such that the stopper 26*e* is positioned in the temperature fluctuation buffering space 28*e*, and the front end projects from the opening 21*g*.

Furthermore, a spring 23*e* is disposed between the stopper 26*e* in the piston 20*e* and a peripheral edge of the opening 21*g* in the cylinder 21*e*, to urge the piston 20*e* toward the rear end of the cylinder 21*e*.

A micro-clearance is formed between an outer peripheral surface of the stopper 26*e* in the piston 20*e* and an inner peripheral surface of the cylinder 21*e*, and a micro-clearance is formed between an outer peripheral surface of the piston 20*e* and an inner peripheral surface of the opening 21*g* in the cylinder 21*e*.

Figure 78:
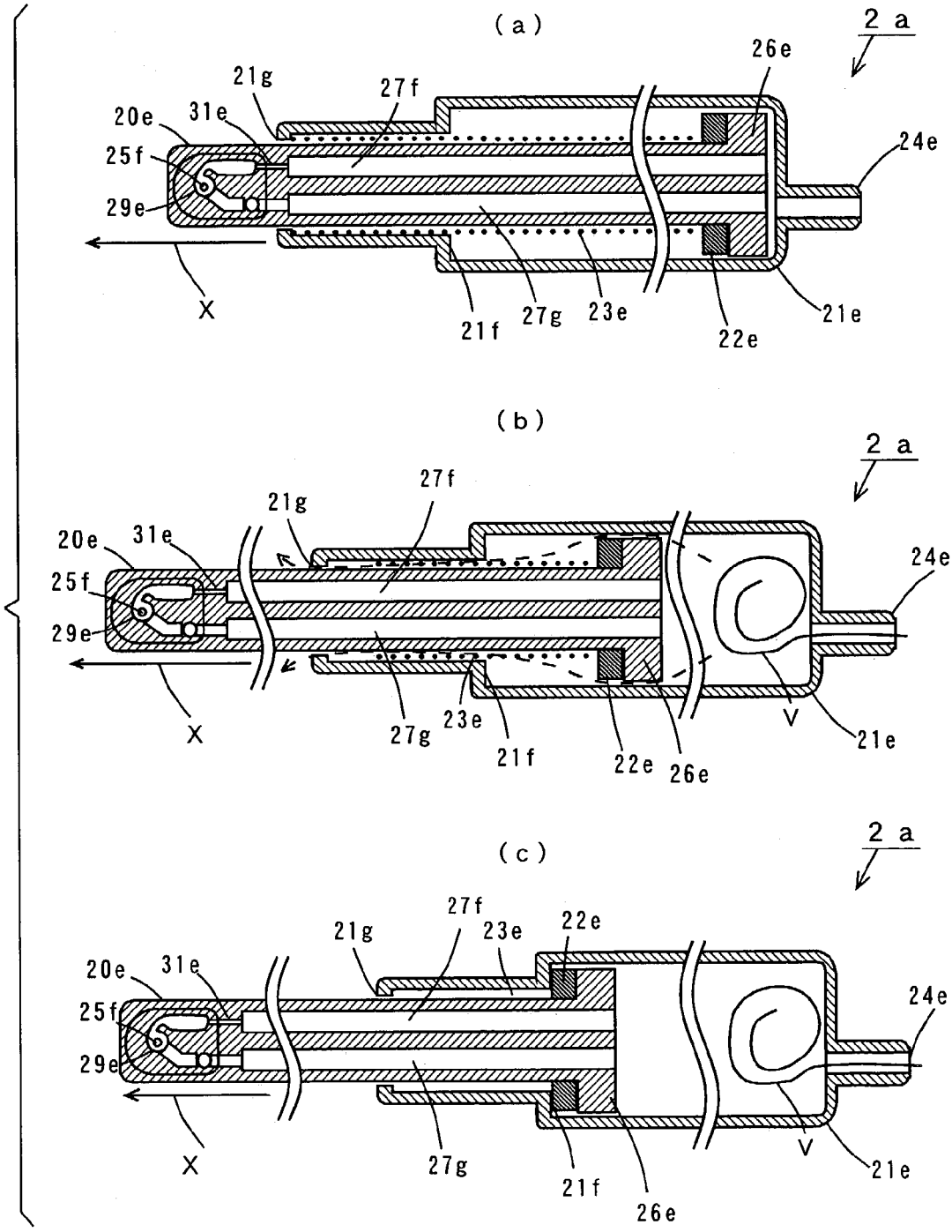
FIG. 78 is a cross-sectional view for explaining the operations of a bidet nozzle shown in FIG. 77.

Description is now made of the operations of the bidet nozzle 2*a* shown in FIG. 77. FIG. 78 is a cross-sectional view for explaining the operations of the bidet nozzle 2*a* shown in FIG. 77.

First, when no washing water is supplied from the washing water inlet 24*e* in the cylinder 21*e*, as shown in FIG. 78(*a*), the piston 20*a* retreats in the opposite direction to a direction indicated by an arrow X by the elastic force of the spring 23*e*, and is accommodated in the cylinder 21*e*. As a result, the piston 20*e* enters a state where it does not project most greatly from the opening 21*g* in the cylinder 21*e*. At this time, the temperature fluctuation buffering space 28*e* is not formed in the cylinder 21*e*.

When the supply of washing water from the washing water inlet 24*e* in the cylinder 21*e* is then started, as shown in FIG. 78(*b*), the piston 20*e* gradually advances in the direction indicated by the arrow X against the elastic force of the spring 23*e* by the pressure of the washing water. Consequently, the temperature fluctuation buffering space 28*e* is formed in the cylinder 21*e*, and the washing water flows into the temperature fluctuation buffering space 28*e*.

Since the washing water inlet 24*e* is provided at a position eccentric from the central axis of the cylinder 21*e*, the washing water flowing into the temperature fluctuation buffering space 28*e* flows in a swirling state, as indicated by an arrow V. A part of the washing water in the temperature fluctuation buffering space 28*e* flows out of the micro-clearance between the outer peripheral surface of the piston 20*e* and the inner peripheral surface of the opening 21*g* in the cylinder 21*e* through the micro-clearance between the outer peripheral surface of the stopper 26*e* in the piston 20*e* and the inner peripheral surface of the cylinder 21*e*, and is supplied to the cylindrical swirl chamber 29*e* through the first flow path 27*f* and the second flow path 27*g* in the piston 20*e*, to be slightly sprayed from the spray hole 25*f*. The details of the cylindrical swirl chamber 29*e* will be described later.

When the piston 20*e* further advances, the stopper 26*e* is brought into watertight contact with the stopper surface 21*f* in the cylinder 21*e* through the seal packing 22*e*, as shown in FIG. 78(*c*). Consequently, a flow path leading from the micro-clearance between the outer peripheral surface of the stopper 26*e* in the piston 20*e* and the inner peripheral surface of the cylinder 21*e* to the micro-clearance between the outer peripheral surface of the piston 20*e* and the inner peripheral surface of the opening 21*g* in the cylinder 21*e* is blocked off. Consequently, the washing water supplied to the cylindrical swirl chamber 29*e* through the first flow path 27*f* in the piston 20*e* is mixed with the washing water supplied thereto through the second flow path 27*g* in the piston 20*e*, and obtained mixed washing water is sprayed from the spray hole 25*f*.

The washing water supplied from the washing water outlet 143*b* in the switching valve 14 is thus introduced into the cylindrical swirl chamber 29*e* after passing through the washing water inlet 24*e* in the cylinder 21*e* and the first flow path 27*f* and the second flow path 27*g* in the piston 20*e*, and is sprayed from the spray hole 25*f* through the cylindrical swirl chamber 29*e*.

In the sanitary washing apparatus 100 according to the fifth embodiment, the tap water pipe 201 corresponds to a water supply source, the nozzle unit 30 corresponds to a spray device, the pumps 13*d*, 13*e*, and 13*a* correspond to a pressure device and a reciprocating pump, the pressure feeding piston 136*a* corresponds to a pressure member, the first flow path 27*a* corresponds to a first flow path, the second flow path 27*b* corresponds to a second flow path, the cylindrical swirl chamber 29, the center cylindrical swirl chamber 29*x*, the plurality of swirl chamber communicating flow paths 29*y*, and the annular swirl chamber 29*z* correspond to a rotating flow generator, the switching valves 14*b* and 14*c* correspond to a flow rate adjustment device, the posterior nozzle 1*c* and the bidet nozzle 2*a* correspond to a spray device, the plate-shaped check valve 32 and the ball check valve 32*b* correspond to a backflow preventor, the controller 4 corresponds to a control device and a command device, the water power adjustment switches 302*a*, 302*b*, and 302*aa* correspond to a pressure fluctuation setting device, the washing area adjustment switches 302*e*, 302*f*, and 302*dd* correspond to a divergent angle setting device, the inner cylinder 142 corresponds to an inner cylinder, the outer cylinder 143 corresponds to an outer cylinder, the holes 142*e*, 142*f*, and 142*g* correspond to a hole, the chamfer composed of a curved line and a straight line corresponds to a recess and a concave groove, the motor 141 corresponds to a driving device, the washing water outlets 143*b*, 143*c*, 143*d*, and 143*e* correspond to a plurality of fluid outlets, the washing water inlet 143*a* corresponds to a fluid inlet, the posterior nozzle 1, the bidet nozzle 2, and the nozzle cleaning nozzle 3 correspond to a spray device, the washing water inlet 24*a* corresponds to a first water supply port, the washing water inlet 24*b* corresponds to a second water supply port, a space in which the stoppers 26*a* and 26*b* are respectively brought into watertight contact with the stopper surfaces 21*c* and 21*b* in the cylinder 21 through the seal packings 22*a* and 22*b* corresponds to an annular space, the stoppers 26*a* and 26*b* correspond to first and second annular abutting portions, the temperature fluctuation buffering space 28 corresponds to an accommodating portion, the micro-clearance between the outer peripheral surface of the stopper 26*a* in the piston 20 and the inner peripheral surface of the cylinder 21 corresponds to a first clearance, the micro-clearance between the outer peripheral surface of the stopper 26*b* in the piston 20 and the inner peripheral surface of the cylinder 21 corresponds to a second clearance, and the ceramic heater 505 corresponds to a heating device.

(6) Sixth Embodiment

Figure 79:
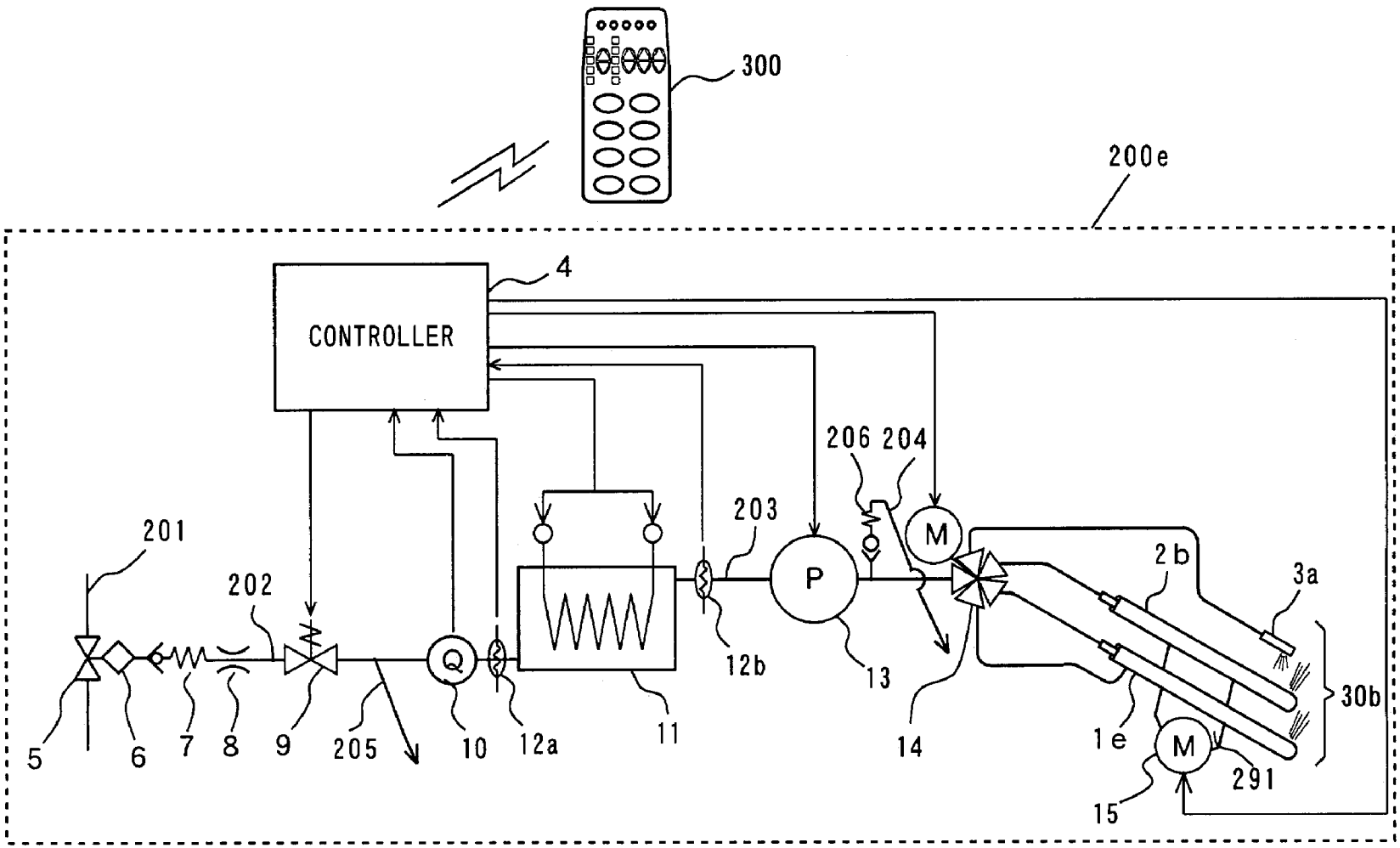
FIG. 79 is a schematic view showing the configuration of a main body in a sanitary washing apparatus according to a sixth embodiment.

FIG. 79 is a schematic view showing the configuration of a main body 200*e* in a sanitary washing apparatus 100 according to a sixth embodiment.

The main body 200*e* shown in FIG. 79 differs from the main body 200 shown in FIG. 3 in that a motor driving type nozzle unit 30*b* is provided in place of the hydraulic pressure driving type nozzle unit 30. In the main body 200*a* shown in FIG. 79, the nozzle unit 30*b* comprises a posterior nozzle 1*e*, a bidet nozzle 2*b*, a nozzle cleaning nozzle 3*a*, a motor 15 for advancing or retreating, and a holding stand 291.

A controller 4 feeds a control signal to a stop solenoid valve 9, a heat exchanger 11, a pump 13, a switching valve 14, and the motor 15 on the basis of a signal transmitted by ratio from the remote control device 300 shown in FIG. 1, a measured flow rate value given from a flow sensor 10, and a measured temperature value fed from temperature sensors 12*a* and 12*b*. Consequently, the motor 15 is rotated, so that the posterior nozzle 1*e* and the bidet nozzle 2*b* which are held in the holding stand 291 perform an advancing or retreating operation. The details of the posterior nozzle 1*e* and the bidet nozzle 2*b* performing the advancing or retreating operation by the function of the motor 15 will be described later.

Figure 80:
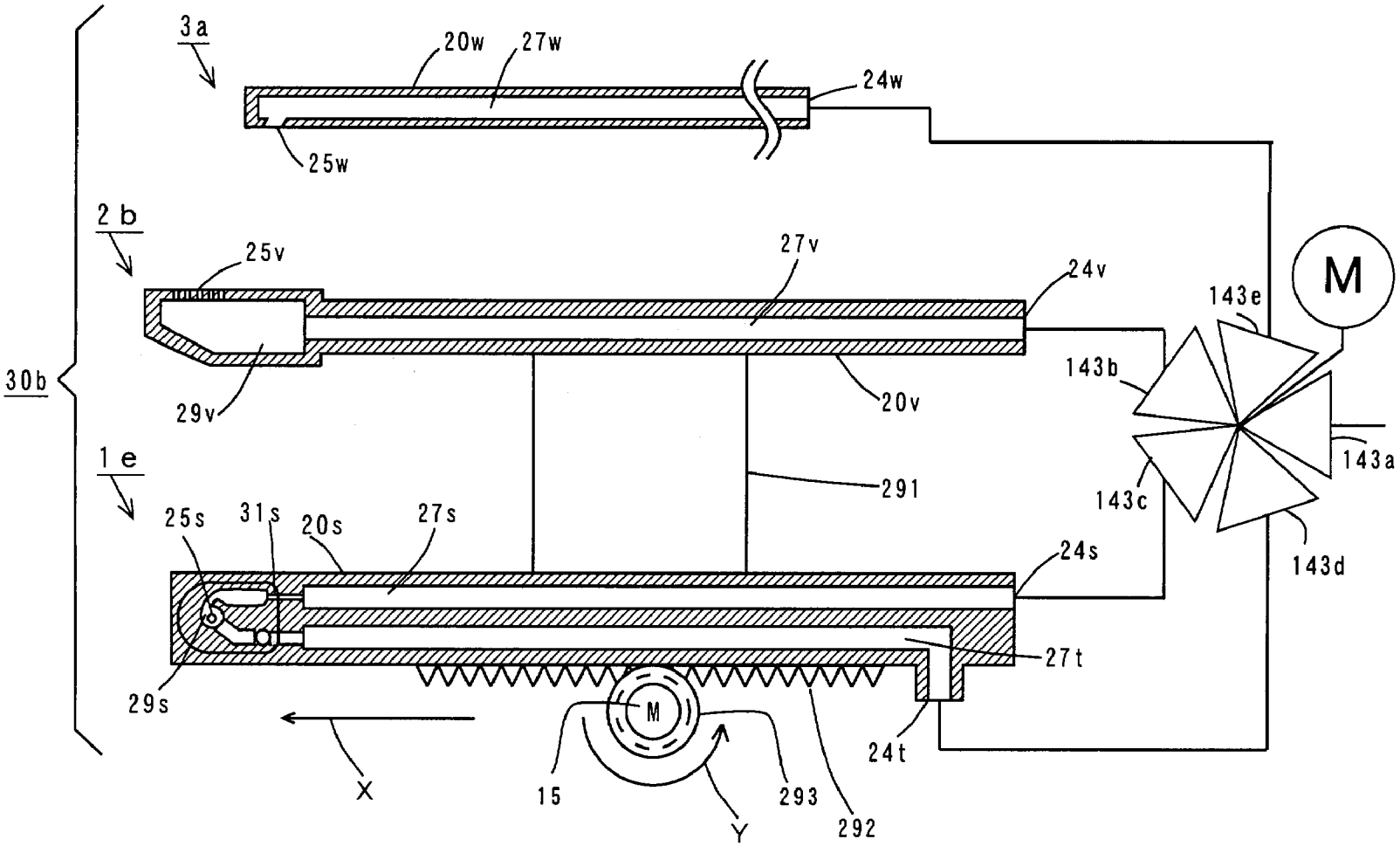
FIG. 80 is a schematic sectional view of a nozzle and a switching valve shown in FIG. 79.

Description is now made of the configuration of the nozzle unit 30*b* shown in FIG. 79. FIG. 80 is a schematic sectional view of the nozzle unit 30*b* and the switching valve 14 shown in FIG. 79. Description is first made of the configuration of the posterior nozzle 1*e*, description is then made of the configuration of the bidet nozzle 2*b*, and description is finally made of the configuration of the nozzle cleaning nozzle 3*a*.

As shown in FIG. 80, the posterior nozzle 1*e* is composed of a cylindrical sprayer 20*s*. A spray hole 25*s* for spraying washing water is formed in the vicinity of a front end of the sprayer 20*s*. A washing water inlet 24*s* is provided on a rear end surface of the sprayer 20*s*, and a washing water inlet 24*t* is provided on a side surface in the vicinity of a rear end of the sprayer 20*s*. Inside the sprayer 20*s*, a first flow path 27*s* communicating with the spray hole 25*s* from the washing water inlet 24*s* is formed, and a second flow path 27*t* communicating with the spray hole 25*s* from the washing water inlet 24*t* is formed. Further, a cylindrical swirl chamber 29*s* is formed around the spray hole 25*s*, and a flow-contracting portion 31*s* is inserted between the first flow path 27*s* and the cylindrical swirl chamber 29*s*. The washing water inlet 24*s* is connected to a washing water outlet 143*c* in the switching valve 14, and the washing water inlet 24*t* is connected to a washing water outlet 143*d* in the switching valve 14.

Consequently, the washing water supplied from the washing water outlets 143*c* and 143*d* in the switching valve 14 is introduced into the cylindrical swirl chamber 29*s* after passing through the washing water inlets 24*s* and 24*t* and the first flow path 27*s* and the second flow path 27*t* in the sprayer 20*s*, and is sprayed from the spray hole 25*s* after passing through the cylindrical swirl chamber 29*s*.

Then, the bidet nozzle 2*b* is composed of a cylindrical sprayer 20*v*. A spray hole 25*v* for spraying washing water is formed in the vicinity of a front end of the sprayer 20*v*. A washing water inlet 24*v* is provided on a rear end surface of the sprayer 20*v*. Inside the sprayer 20*v*, a flow path 27*v* communicating with the spray hole 25*v* from the washing water inlet 24*v* is formed. A buffering chamber 29*v* is formed around the spray hole 25*v*. The washing water inlet 24*v* is connected to the washing water outlet 143*b* in the switching valve 14.

Consequently, the washing water supplied from the washing water outlet 143*b* in the switching valve 14 is introduced into the buffering chamber 29*v* after passing through the washing water inlet 24*v* and the flow path 27*v* in the sprayer 20*v*, and is sprayed from the spray hole 25*v* after passing through the buffering chamber 29*v*.

Then, the nozzle cleaning nozzle 3*a* is composed of a cylindrical sprayer 20*w*. A spray hole 25*w* for spraying washing water is formed on the side of the posterior nozzle 1*e* and the bidet nozzle 2*b* in the vicinity of a front end of the sprayer 20*w*. A washing water inlet 24*w* is provided at a rear end of the sprayer 20*w*. A flow path 27*w* communicating with the spray hole 25*w* from the washing water inlet 24*w* provided at the rear end of the sprayer 20*w* is formed. The washing water inlet 24*w* is connected to a washing water outlet 143*e* in the switching valve 14.

Consequently, the washing water supplied from the washing water outlet 143*e* in the switching valve 14 is sprayed from the spray hole 25*w* after passing through the washing water inlet 24*w* and the flow path 27*w* in the sprayer 20*w* in the nozzle cleaning nozzle 3*a*. The posterior nozzle 1*e* and the bidet nozzle 2*b* are cleaned by the washing water sprayed from the spray hole 25*w*.

As shown in FIG. 80, the posterior nozzle 1*e* and the bidet nozzle 2*b* are fixed on the holding stand 291. A gear 292 is provided at one end of the holding stand 291. The gear 292 is engaged with a gear 293 fixed to the axis of rotation of the motor 15. The motor 15 is rotated in a direction indicated by an arrow Y in response to the control signal from the controller 4 so that the gear 293 fixed to the axis of rotation of the motor 15 is rotated, and is engaged with the gear 292 provided at one end of the nozzle holding stand 291. Accordingly, the nozzle holding stand 291 is moved in a direction indicated by an arrow X. Consequently, an advancing or retreating operation is performed by the posterior nozzle 1*e* and the bidet nozzle 2*b*.

In the present embodiment, when the user presses a posterior switch 303 or a bidet switch 306 in the remote control device 300 shown in FIG. 79, the controller 4 feeds the control signal to the motor 15. The motor 15 is rotated on the basis of the control signal fed from the controller 4, thereby causing the posterior nozzle 1*e* and the bidet nozzle 2*b* in the nozzle unit 30*b* to perform the advancing or retreating operation. As a result, the position of the nozzle unit 30*b* in the main body 200*e* in the sanitary washing apparatus 100 shown in FIG. 79 is changed Furthermore, the user presses a nozzle position adjustment switch in the remote control device 300, whereby the controller 4 feeds the control signal to the motor 15. In this case, the motor 15 is rotated by a very small amount on the basis of the control signal fed from the controller 4, to finely adjust the respective positions of the posterior nozzle 1*e* and the bidet nozzle 2*b* in the nozzle unit 30*b*.

In the motor driving type nozzle unit 30*b*, the fine adjustment of the spray position can be thus easily made, unlike that in the hydraulic pressure driving type nozzle unit 30.

In the sanitary washing apparatus 100 according to the sixth embodiment, the tap water pipe 201 corresponds to a water supply source, the nozzle unit 30*b*, the posterior nozzle 1*e*, and the bidet nozzle 2*b* correspond to a spray device, the pump 13 corresponds to a pressure device and a reciprocating pump, the first flow path 27*s* corresponds to a first flow path, the second flow path 27*t* corresponds to a second flow path, the cylindrical swirl chamber 29*s* corresponds to a rotating flow generator, the switching valve 14 corresponds to a flow rate adjustment device, and the controller 4 corresponds to a control device and a command device.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sanitary washing apparatus that sprays washing water supplied from a water supply source onto a human body, comprising:

a spray device that has a spray hole that sprays washing water supplied from said water supply source, a first flow path that introduces the washing water into the spray hole, and a second flow path that introduces the washing water into the spray hole, and is configured to change the divergent angle of the sprayed washing water;

a control device that controls said divergent angle of the washing water sprayed from said spray device;

a switch that sets the divergent angle of the washing water sprayed from said spray device;

a display device that displays the divergent angle of the washing water sprayed from said spray device; and a flow rate adjustment device that adjusts a flow rate of the washing water supplied to the first flow path and the second flow path, respectively, based on the control by the control device, to adjust the divergent angle of the washing water sprayed from the spray hole, wherein said control device controls the divergent angle of the washing water sprayed from said spray device based on the setting by said switch, and wherein said switch is configured to cause said spray device to change the divergent angle of the washing water.

2. The sanitary washing apparatus according to claim 1, wherein said switch is configured to cause said spray device to continuously change the divergent angle of the washing water.

3. The sanitary washing apparatus according to claim 1, wherein said display device displays the divergent angle of the washing water on the basis of the setting by said switch.

4. The sanitary washing apparatus according to claim 1, wherein said switch includes a remote control type switch.

5. The sanitary washing apparatus according to claim 1, whereinsaid spray device sprays the washing water in a circular cross-sectional shape.

6. A sanitary washing apparatus that sprays washing water supplied from a water supply source onto a human body, comprising a spray device that sprays washing water supplied from said water supply source onto a human body, said spray device comprising a spray hole, a first flow path that introduces the washing water supplied from said water supply source into the spray hole, a second flow path that introduces the washing water supplied from said water supply source into said spray hole, a rotating flow generator that generates rotating flow in the washing water in said first flow path, and a flow rate adjustment device that adjusts the flow rate of the washing water supplied to said first flow path and said second flow path;

said sanitary washing apparatus further comprising a control device that controls the divergent angle of the washing water sprayed from said spray device;

a switch that sets the divergent angle of the washing water sprayed from said spray device; and a display device that displays the divergent angle of the washing water sprayed from said spray device, wherein said control device controls the divergent angle of the washing water sprayed from said spray device on the basis of the setting by said switch, and wherein said switch is configured to cause the spray device change the divergent angle of the washing water.

7. The sanitary washing apparatus according to claim 6, wherein said rotating flow generator has a cylindrical chamber, and the washing water introduced from said first flow path is supplied along an inner peripheral surface of said cylindrical chamber.

8. The sanitary washing apparatus according to claim 6, wherein an annular space is provided between an inner peripheral surface of said cylinder and an outer peripheral surface of said piston, the washing water from said first flow path is supplied to said accommodating portion through said first water supply port, the washing water from said second flow path is supplied to said annular space through said second water supply port, said first flow path is provided so as to communicate with said accommodating portion, said second flow path is provided so as to communicate with said annular space, and said annular space is brought into a sealed state when said piston projects from said cylinder and is separated from said accommodating portion.

9. The sanitary washing apparatus according to claim 8, wherein said cylinder comprises, in the following order a front end having a first inner diameter, an intermediate portion having a second inner diameter larger than said first inner diameter, a rear end having an inner diameter larger than said second inner diameter, and a first stopper surface at a boundary between said front end and said intermediate portion, and a second stopper surface at a boundary between said intermediate portion and said rear end, said piston has first and second annular abutting portions which respectively watertightly abut against said first and second stopper surfaces when said piston projects from said cylinder, a first clearance being provided between an inner peripheral surface of said intermediate portion of said cylinder and an outer peripheral surface of said first annular abutting portion of said piston, a second clearance being provided between an inner peripheral surface at said rear end of said cylinder and an outer peripheral surface of said second annular abutting portion of said piston, the washing water from said first flow path being supplied to said rear end through said first water supply port, the washing water from said second flow path being supplied to said intermediate portion through said second water supply port, said first flow path being configured so as to communicate with said rear end of said cylinder, and said second flow path being configured so as to communicate with said intermediate portion of said cylinder.

10. The sanitary washing apparatus according to claim 6, wherein said flow rate adjustment device comprises an inner cylinder having a cylindrical outer peripheral surface and an outer cylinder having a cylindrical inner peripheral surface, said inner cylinder being positioned within said outer cylinder so as to be rotatable, and a fluid inlet is provided at one end of said inner cylinder, a peripheral wall of said inner cylinder is provided with holes and corresponding recesses around said holes in said inner cylinder, and a peripheral wall of said outer cylinder is provided with a plurality of fluid outlets which are opposable to said holes by the rotation of said inner cylinder.

11. The sanitary washing apparatus according to claim 10, wherein said flow rate adjustment device comprises a driving device that rotates said inner cylinder relative to said outer cylinder.

12. The sanitary washing apparatus according to claim 1, further comprising a pressure device that pressurizes the washing water supplied from said water supply source to spray the pressurized washing water from said spray device while subjecting the sprayed washing water to periodical pressure fluctuations.

13. The sanitary washing apparatus according to claim 6, further comprising a pressure device that pressurizes washing water supplied from said water supply source to a predetermined pressure, wherein said spray device sprays the washing water pressurized by said pressure device onto a human body.

14. The sanitary washing apparatus according to claim 1, wherein said switch is configured to cause the spray device to gradually change the divergent angle of the washing water.

15. The sanitary washing apparatus according to claim 12, further comprising a heating device that heats the washing water supplied from the water supply source and supplies the heated washing water to said pressure device.

16. The sanitary washing apparatus according to claim 15, wherein said heating device is an instantaneous heating device for heating the washing water supplied from said water supply source while causing the washing water to flow.

17. The sanitary washing apparatus according to claim 12, wherein the period of pressure fluctuations by said pressure device is the period of pressure fluctuations perceivable by the human body.

18. The sanitary washing apparatus according to claim 12, further comprising a pressure fluctuation setting device for setting the mode of the pressure fluctuations of the washing water, said control device controlling the mode of the pressure fluctuations by said pressure device on the basis of the setting by said pressure fluctuation setting device.

19. The sanitary washing apparatus according to claim 12, wherein said spray device comprises a cylinder, and a piston having a spray hole and positioned within said cylinder so as to be projectable from said cylinder, said piston being projected from said cylinder by the pressure of the washing water supplied from said pressure device and spraying the washing water from said spray hole.

20. The sanitary washing apparatus according to claim 13, further comprising a heating device that heats the washing water supplied from said water supply source and supplies the heated washing water to said pressure device.

21. The sanitary washing apparatus according to claim 20, wherein said heating device is an instantaneous heating device that heats the washing water supplied from the water supply source while causing the washing water to flow.

22. The sanitary washing apparatus according to claim 13, wherein said spray device comprises a cylinder, and a piston positioned within said cylinder so as to be projectable from said cylinder, said piston having said spray hole, said first flow path, and said second flow path, and being projected from said cylinder by the pressure of the washing water supplied from said pressure device and spraying, from said spray hole, the washing water supplied from said pressure device.

23. The sanitary washing apparatus according to claim 13, wherein said spray device comprises a cylinder and a piston, said cylinder comprising a first water supply port receiving the washing water supplied from said first flow path, and a second water supply port receiving the washing water supplied from said second flow path, said spray hole, said first flow path, and said second flow path being provided in the piston, and said piston accommodated in said cylinder by the pressure of the washing water supplied from said pressure device projecting from said cylinder so that an accommodating portion is formed in said cylinder, and the washing water supplied to said accommodating portion in said cylinder is sprayed from said spray hole.

24. The sanitary washing apparatus according to claim 13, wherein said flow rate adjustment device comprises an inner cylinder having a cylindrical outer peripheral surface and an outer cylinder having a cylindrical inner peripheral surface, said inner cylinder being positioned within said outer cylinder so as to be rotatable, a fluid inlet is provided at one end of said inner cylinder, a peripheral wall of said inner cylinder is provided with holes and corresponding recesses around said holes in said inner cylinder, and a peripheral wall of said outer cylinder is provided with a plurality of fluid outlets which are opposable to said holes by the rotation of said inner cylinder, and wherein said recesses are configured such that at least a part of one of the recesses is facing one of said plurality of fluid outlets in said outer cylinder when a corresponding hole in the inner cylinder is not facing said plurality of fluid outlets in said outer cylinder, the washing water from said pressure device flowing into said fluid inlet, and the washing water flowing out of said plurality of fluid outlets being supplied to said plurality of fluid paths in said spray device.

25. The sanitary washing apparatus according to claim 24, wherein said one of the recesses include a concave groove extending in the direction of rotation of said inner cylinder from said corresponding hole.

26. The sanitary washing apparatus according to claim 13, further comprising a pressure fluctuation setting device for setting the mode of the pressure fluctuations of the washing water, and a control device that controls the mode of the pressure fluctuations by said pressure device on the basis of the setting by said pressure fluctuation setting device.

27. The sanitary washing apparatus according to claim 12, said pressure device comprising a multiple action type reciprocating pump comprising:

a piston which reciprocates, and a plurality of pump chambers formed on both sides of said piston.

28. The sanitary washing apparatus according to claim 27, whereinsaid plurality of pump chambers respectively perform a suction operation and a discharge operation in different phases as said piston reciprocates.

29. The sanitary washing apparatus according to claim 27, wherein the water supply source has a relief water pipe.

30. The sanitary washing apparatus according to claim 27, further comprising a heating device that heats the washing water supplied from the water supply source and supplies the heated washing water to said pressure device.

31. The sanitary washing apparatus according to claim 30, wherein said heating device is an instantaneous heating device that heats the washing water supplied from the water supply source while causing the washing water to flow.

32. The sanitary washing apparatus according to claim 27, wherein said pressure device subjects the washing water to periodical pressure fluctuations, and a period of pressure fluctuations by said pressure device is a period of pressure fluctuations perceivable by the human body.

33. The sanitary washing apparatus according to claim 27, further comprising a temperature sensing device that senses the temperature of the washing water, said pressure device being operated after said temperature sensing device senses a predetermined temperature.

34. The sanitary washing apparatus according to claim 27, further comprising a pressure fluctuation setting device for setting the mode of the pressure fluctuations of the washing water, said control device controlling the mode of the pressure fluctuations by said pressure device on the basis of the setting by said pressure fluctuation setting device.

35. The sanitary washing apparatus according to claim 34, wherein said pressure fluctuation setting device comprises a switch for continuously changing the mode of said pressure fluctuations.

36. The sanitary washing apparatus according to claim 34, wherein said control device continuously increases or decreases at least one of the period of pressure fluctuations, the width of pressure fluctuations, and the central pressure of the washing water sprayed from said spray device on the basis of the setting by said pressure fluctuation setting device.

37. The sanitary washing apparatus according to claim 27, wherein said spray device comprises a cylinder, and a piston having a spray hole and positioned within said cylinder so as to be projectable from said cylinder, said piston projecting from said cylinder by the pressure of the washing water supplied from said pressure device and spraying the washing water from said spray hole.

* * * * *